US007402743B2

(12) United States Patent
Clark et al.

(10) Patent No.: US 7,402,743 B2
(45) Date of Patent: Jul. 22, 2008

(54) FREE-SPACE HUMAN INTERFACE FOR INTERACTIVE MUSIC, FULL-BODY MUSICAL INSTRUMENT, AND IMMERSIVE MEDIA CONTROLLER

(75) Inventors: David F. Clark, Van Nuys, CA (US); John G. Gibbon, La Crescenta, CA (US)

(73) Assignee: Body Harp Interactive Corporation, Van Nuys, CA (US)

( * ) Notice: Subject to any disclaimer, the term of this patent is extended or adjusted under 35 U.S.C. 154(b) by 349 days.

(21) Appl. No.: 11/171,722

(22) Filed: Jun. 30, 2005

(65) Prior Publication Data

US 2007/0000374 A1 Jan. 4, 2007

(51) Int. Cl.
*G10H 1/00* (2006.01)

(52) U.S. Cl. ..... 84/615; 84/678; 84/600; 250/578.1; 250/222.1; 250/215; 250/208.2; 250/206

(58) Field of Classification Search ..... 84/600, 84/615, 678; 250/201.1, 204, 205, 206, 206.1, 250/208.2, 215, 221, 222.1, 578.1
See application file for complete search history.

(56) References Cited

U.S. PATENT DOCUMENTS

| | | | | |
|---|---|---|---|---|
| 3,749,810 | A | 7/1973 | Dow | |
| 5,017,770 | A * | 5/1991 | Sigalov | 250/221 |
| 5,045,687 | A | 9/1991 | Gurner | |
| 5,369,270 | A * | 11/1994 | Gurner et al. | 250/221 |
| 5,414,256 | A | 5/1995 | Gurner et al. | |
| 6,072,113 | A | 6/2000 | Tohgi et al. | |
| 6,084,167 | A | 7/2000 | Akimoto et al. | |
| 6,142,849 | A | 11/2000 | Horton et al. | |
| 6,388,181 | B2 | 5/2002 | Moe | |
| 6,492,775 | B2 | 12/2002 | Klotz et al. | |
| 6,628,265 | B2 * | 9/2003 | Hwang | 345/156 |

* cited by examiner

*Primary Examiner*—Lincoln Donovan
*Assistant Examiner*—David S. Warren
(74) *Attorney, Agent, or Firm*—Advantia Law Group; Michael W. Starkweather; Jason P. Webb

(57) ABSTRACT

"Method and apparatus entraining interactive media players into a sustained experience of "Kinesthetic Spatial Sync," defined as a perceived simultaneity and spatial superposition between a non-tactile, full body ("free-space") input control process and immersive multisensory feedback. Asynchronous player input actions and (MIDI tempo) clock-synchronous media feedback events exhibit a seamless synesthesia[1] or multisensory events fused into an integral event perception, this being between musical sound (hearing), visual responses (sight), and body kinesthetic (radial extension, angular position, height, speed, timing, and precision). This non-tactile interface process and multisensory feedback "look and feel" is embodied as an optimal ergonomic human interface for interactive music and as a six-degrees-of-freedom full-body-interactive immersive media controller. The invention provides for a wide scope of fully reconfigurable transfer functions between kinesthetic input features and media responses ("Creative Zone Behaviors") managed by means of MIDI protocol and/or display interface commands. Alternative forms of optomechanical embodiments are disclosed, including floor Platform systems and floor-stand-mounted Console systems, all of which exhibit identical free-space input and integrated media response paradigms."

24 Claims, 80 Drawing Sheets

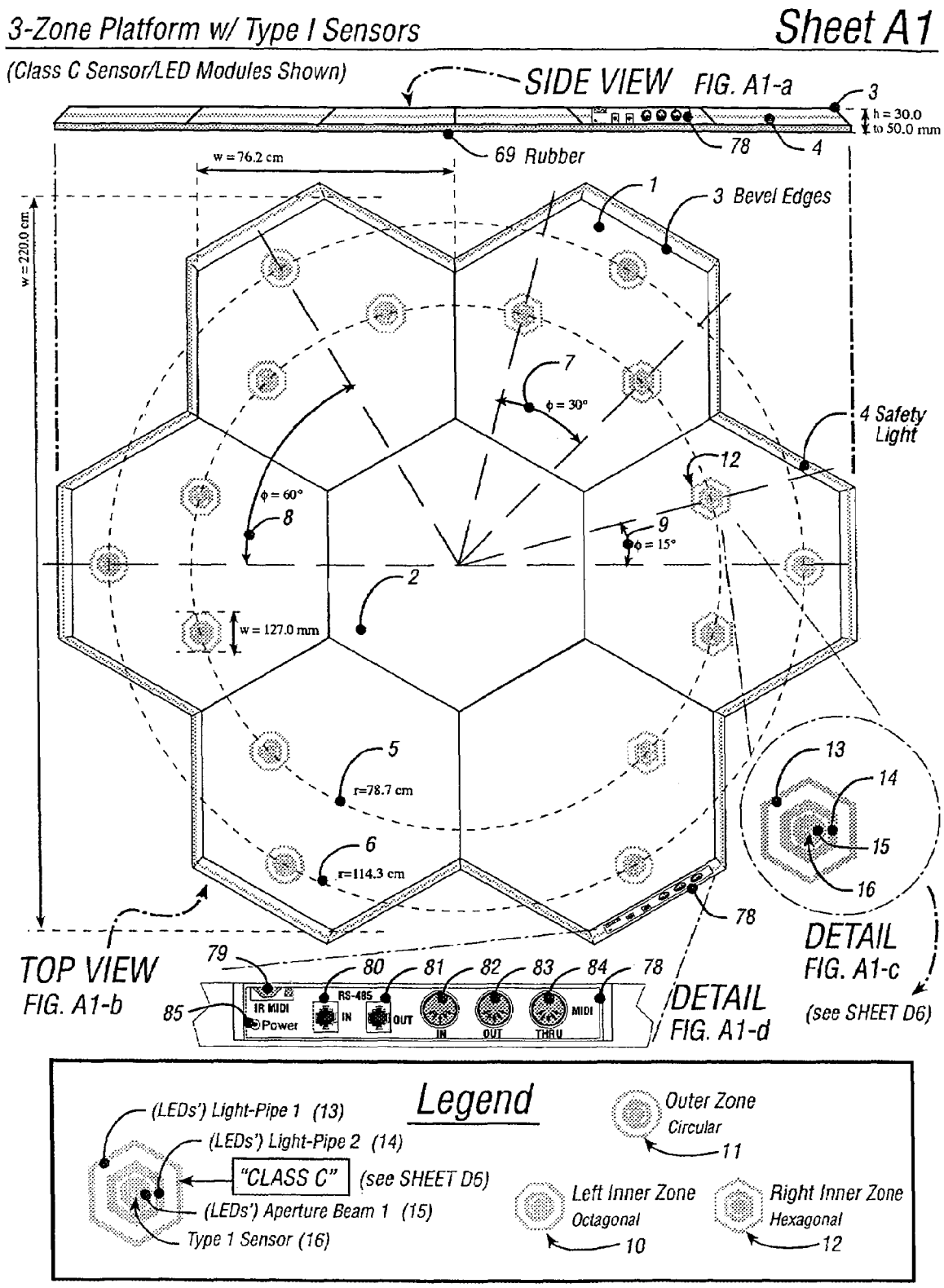
3-Zone Platform w/ Type I Sensors
Sheet A1
(Class C Sensor/LED Modules Shown)
SIDE VIEW FIG. A1-a
3
h = 30.0 to 50.0 mm
69 Rubber
78
4
w = 76.2 cm
w = 220.0 cm
1
3 Bevel Edges
7
ϕ = 30°
4 Safety Light
12
ϕ = 60°
8
9
ϕ = 15°
2
w = 127.0 mm
5
r=78.7 cm
6
r=114.3 cm
13
14
15
16
78
DETAIL FIG. A1-c
(see SHEET D6)
TOP VIEW FIG. A1-b
79
80
81
82
83
84
78
85
IR MIDI
Power
RS-485
IN
OUT
IN
OUT
THRU
MIDI
DETAIL FIG. A1-d
Legend
(LEDs') Light-Pipe 1 (13)
(LEDs') Light-Pipe 2 (14)
"CLASS C"
(see SHEET D6)
(LEDs') Aperture Beam 1 (15)
Type 1 Sensor (16)
Outer Zone Circular
11
Left Inner Zone Octagonal
10
Right Inner Zone Hexagonal
12

3-Zone Platform w/ Type I Sensors
Sheet A2
(Showing Trigger Zones, Player, IR Shadow, Attack Events, Feedback
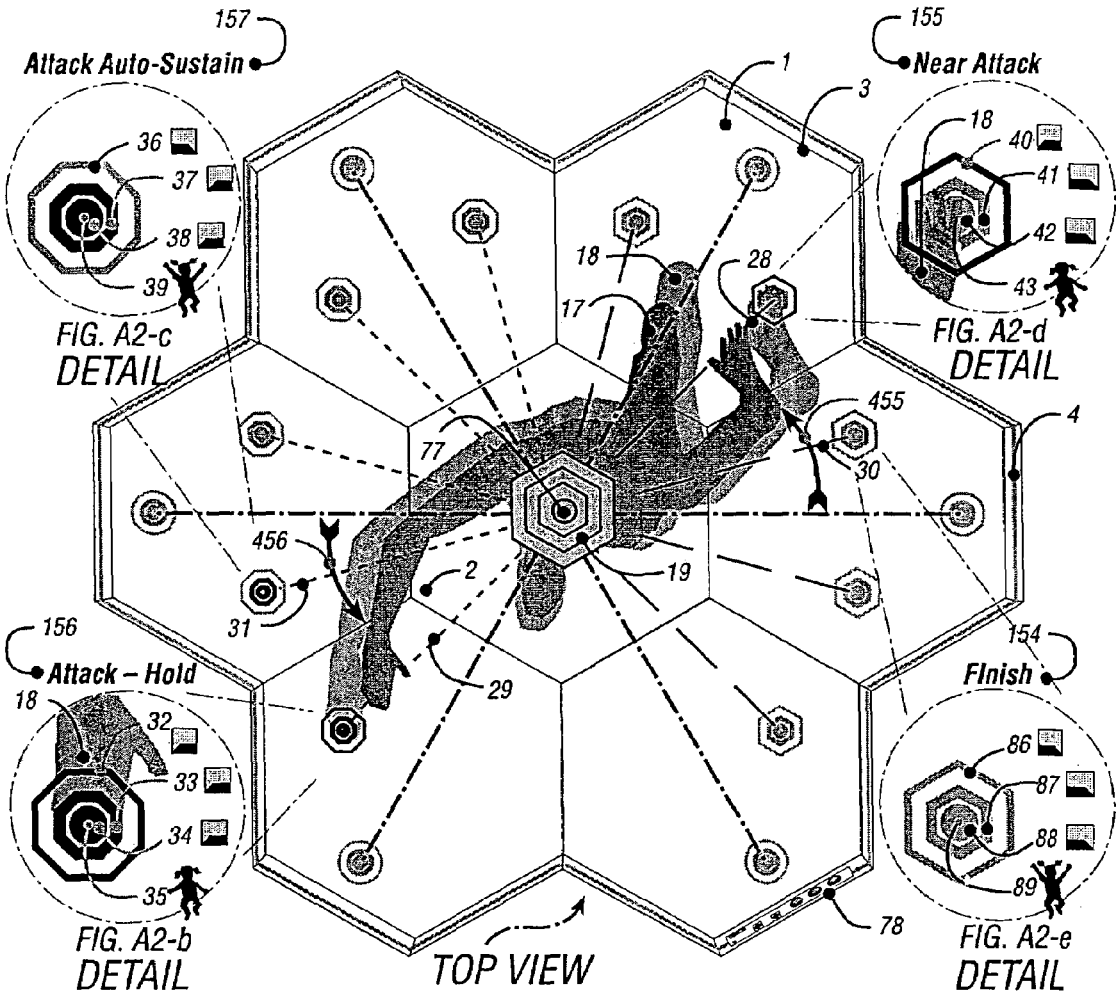
FIG. A2-a
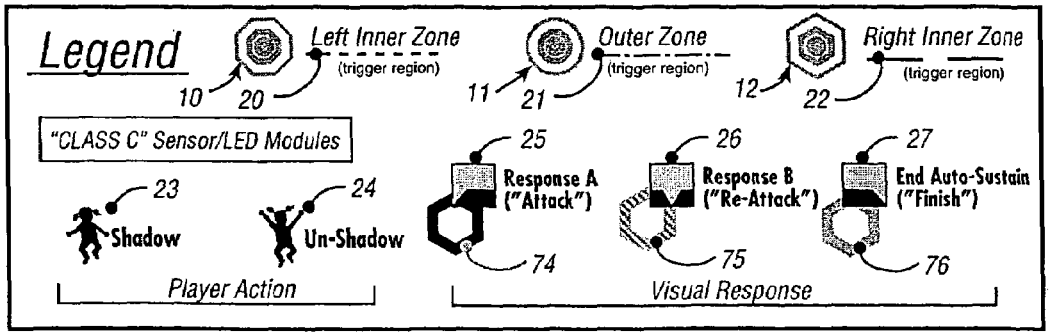

3-Zone Platform w/ Type I Sensors
Sheet A3
(Showing Trigger Zones, Player, IR Shadow, Re-Attack Events, Feedback States)
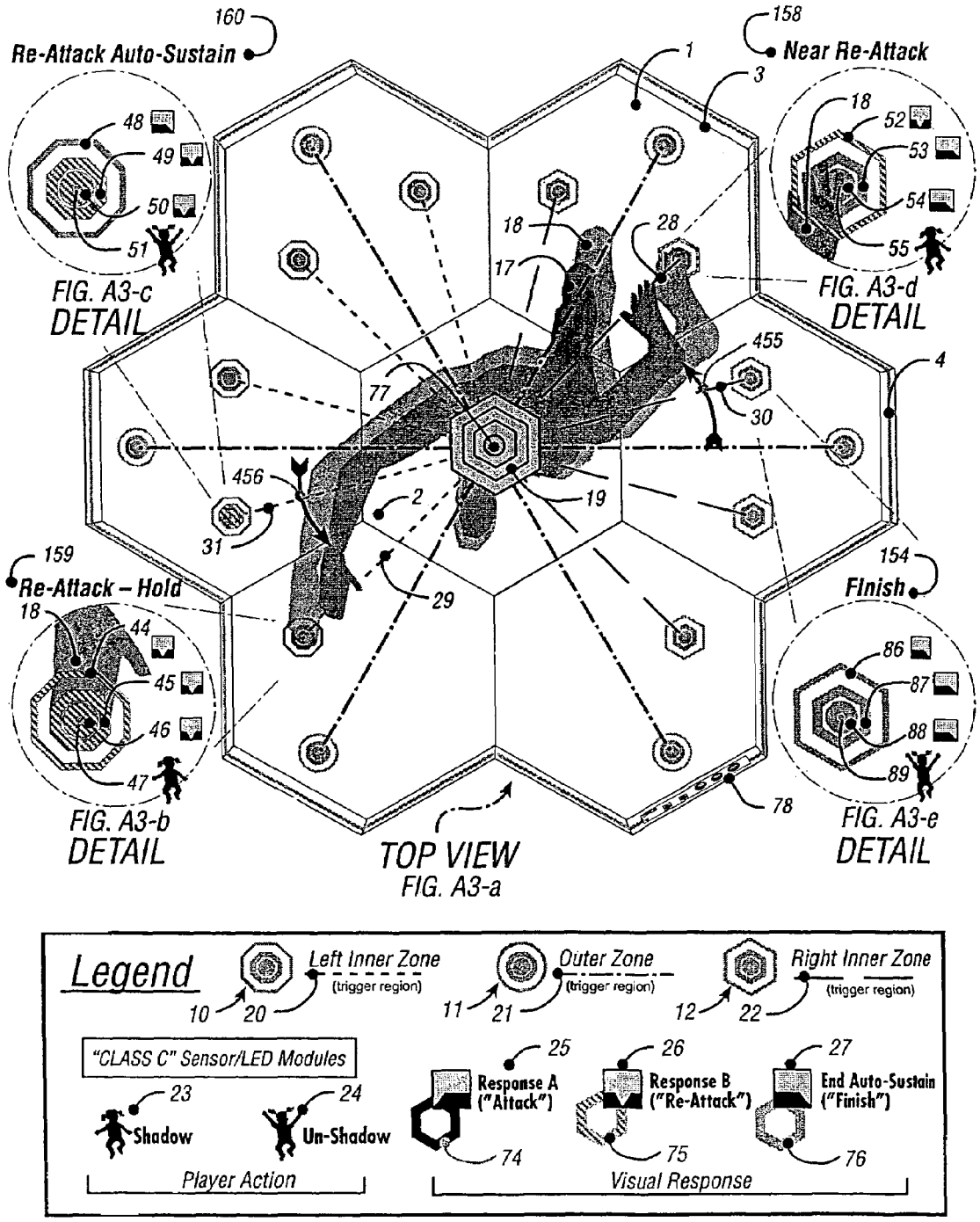

3-Zone Platform w/ Type I Sensors
Sheet A4
(Showing Player, Microbeams, Attack Events, Feedback States)
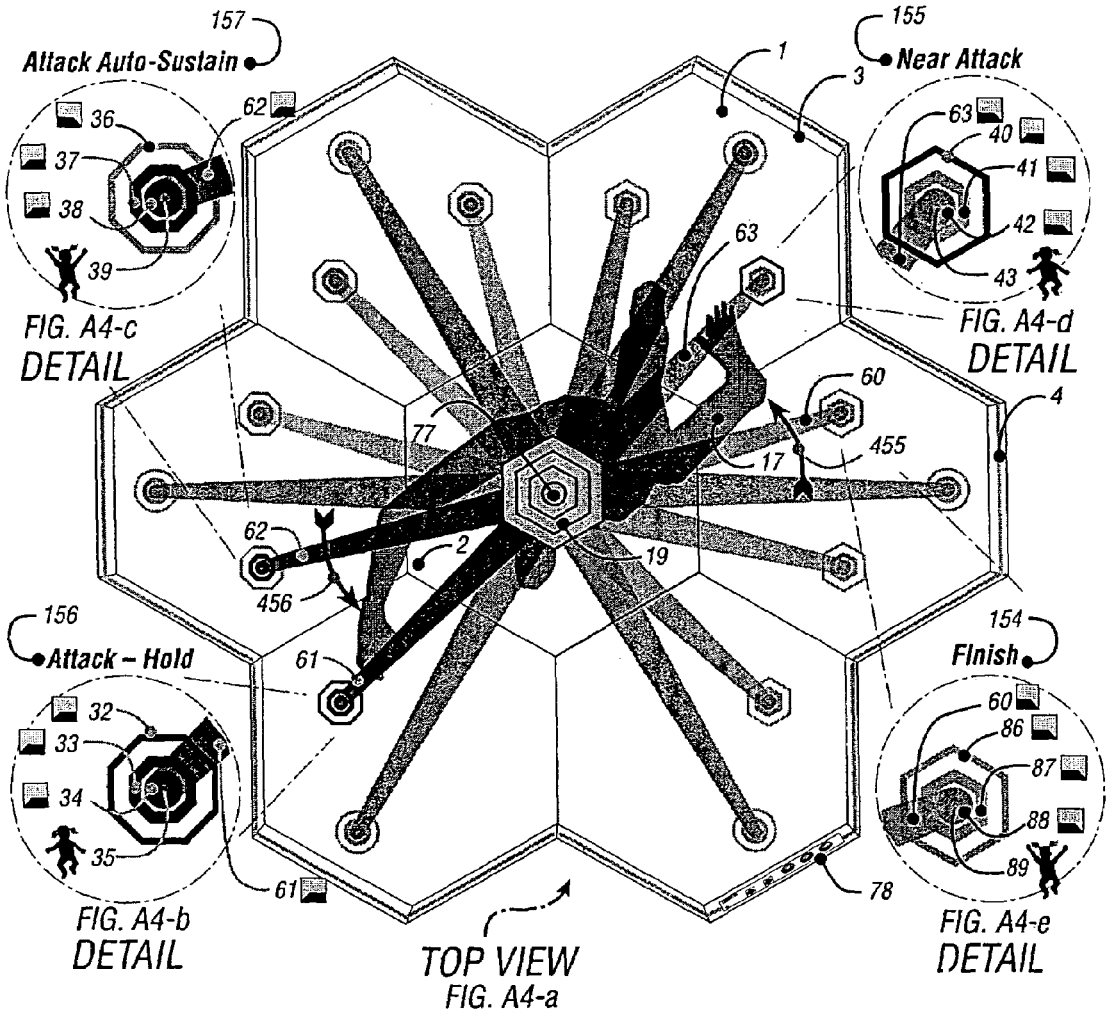
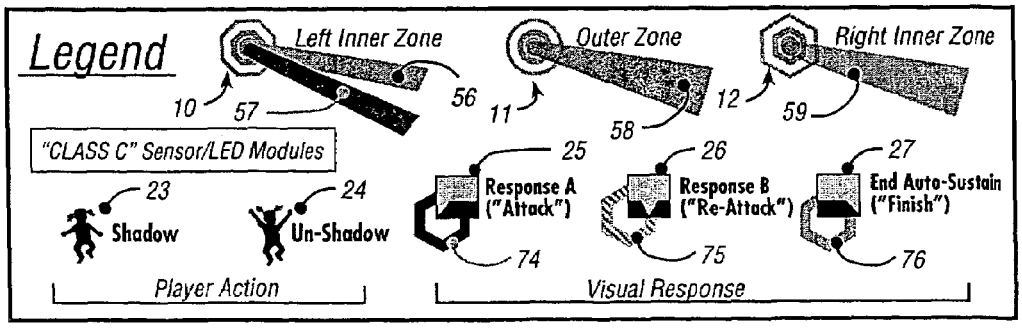

3-Zone Platform w/ Type I Sensors
Sheet A5
(Showing Player, Microbeam, Re-Attack Events, Feedback States)
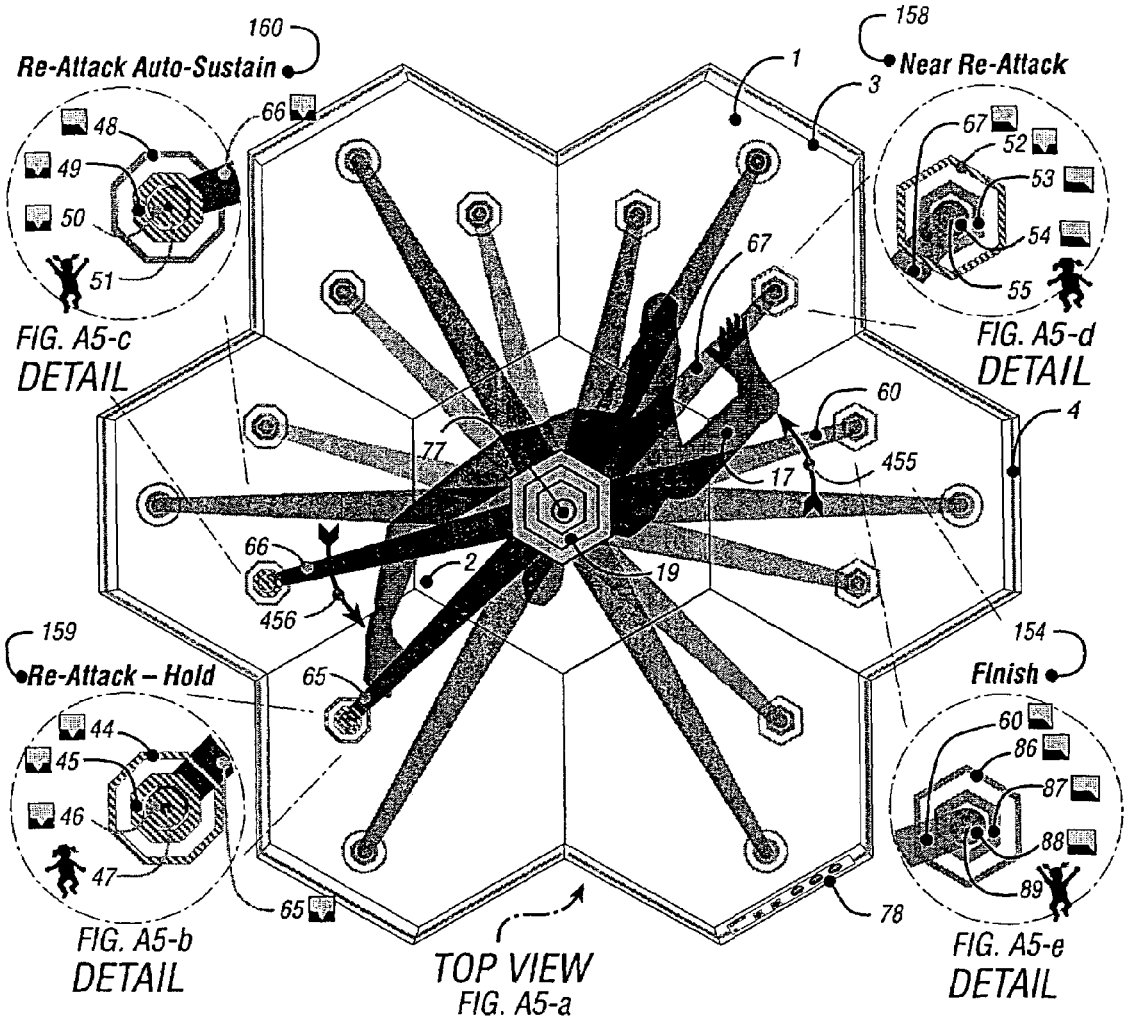
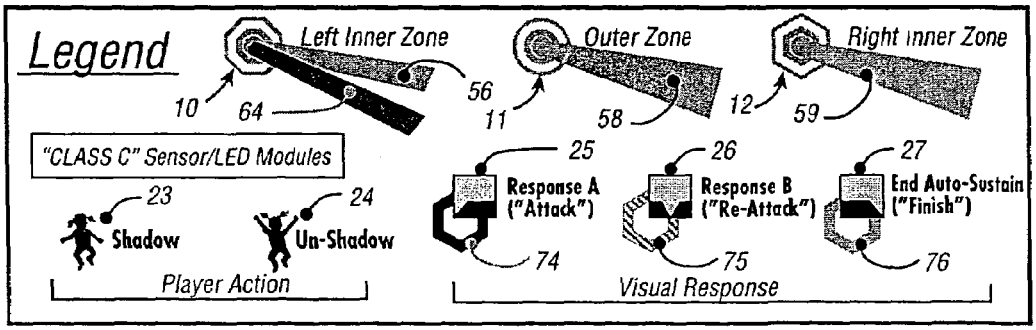

3-Zone Platform w/ Type I Sensors
Sheet A6
(Showing IR and Visible Floods, Adjustable Fixture Height, 2 Trigger Regions, Player, IR Shadow, Attack Events)
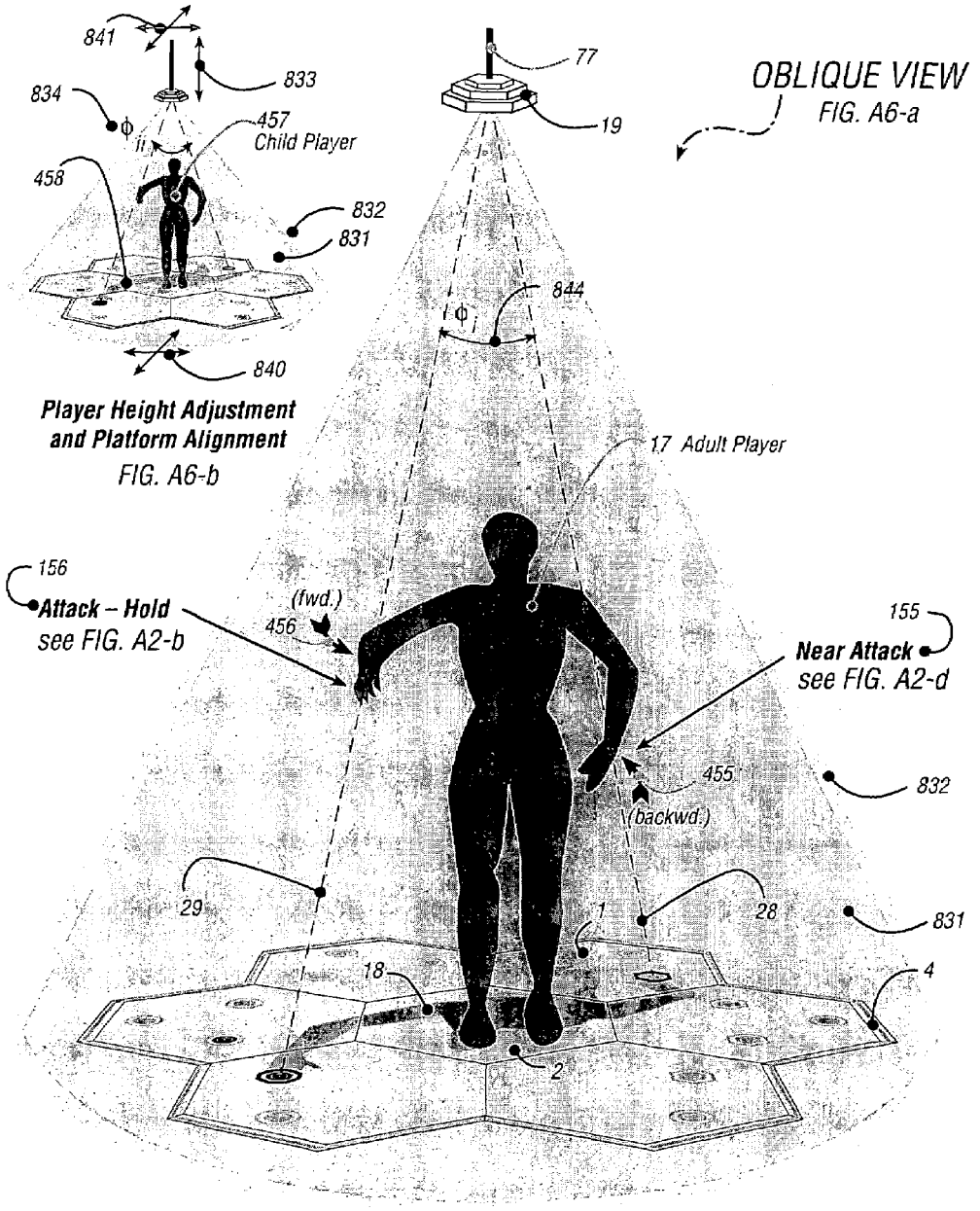

3-Zone Platform w/ Type I Sensors
Sheet A7
(Showing Trigger Zones, Player, IR Shadow, Attack Events)
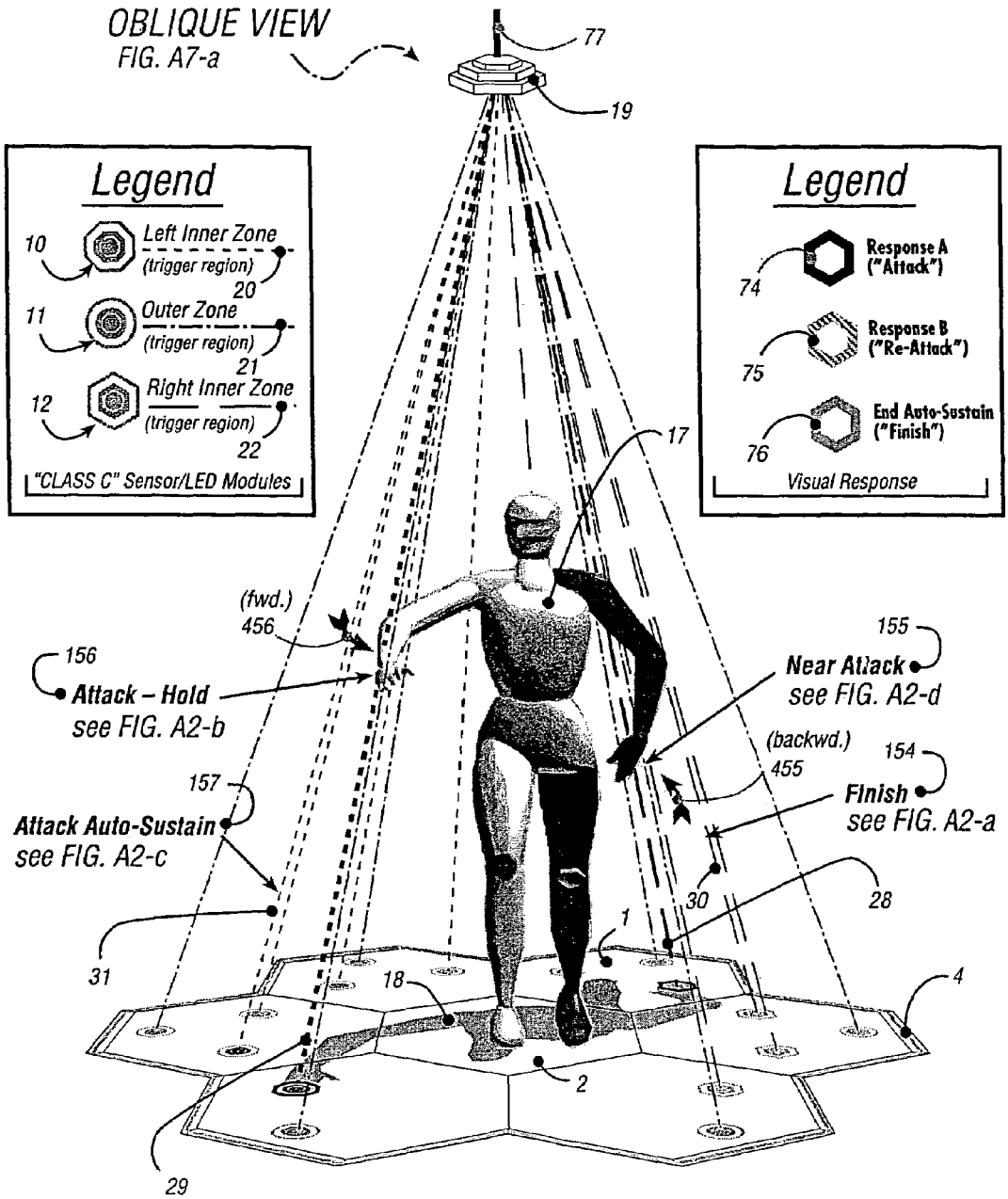

3-Zone Platform w/ Type I Sensors
Sheet A8
(Showing Microbeams, Player, Visible Shadow, Attack Events, Response States)
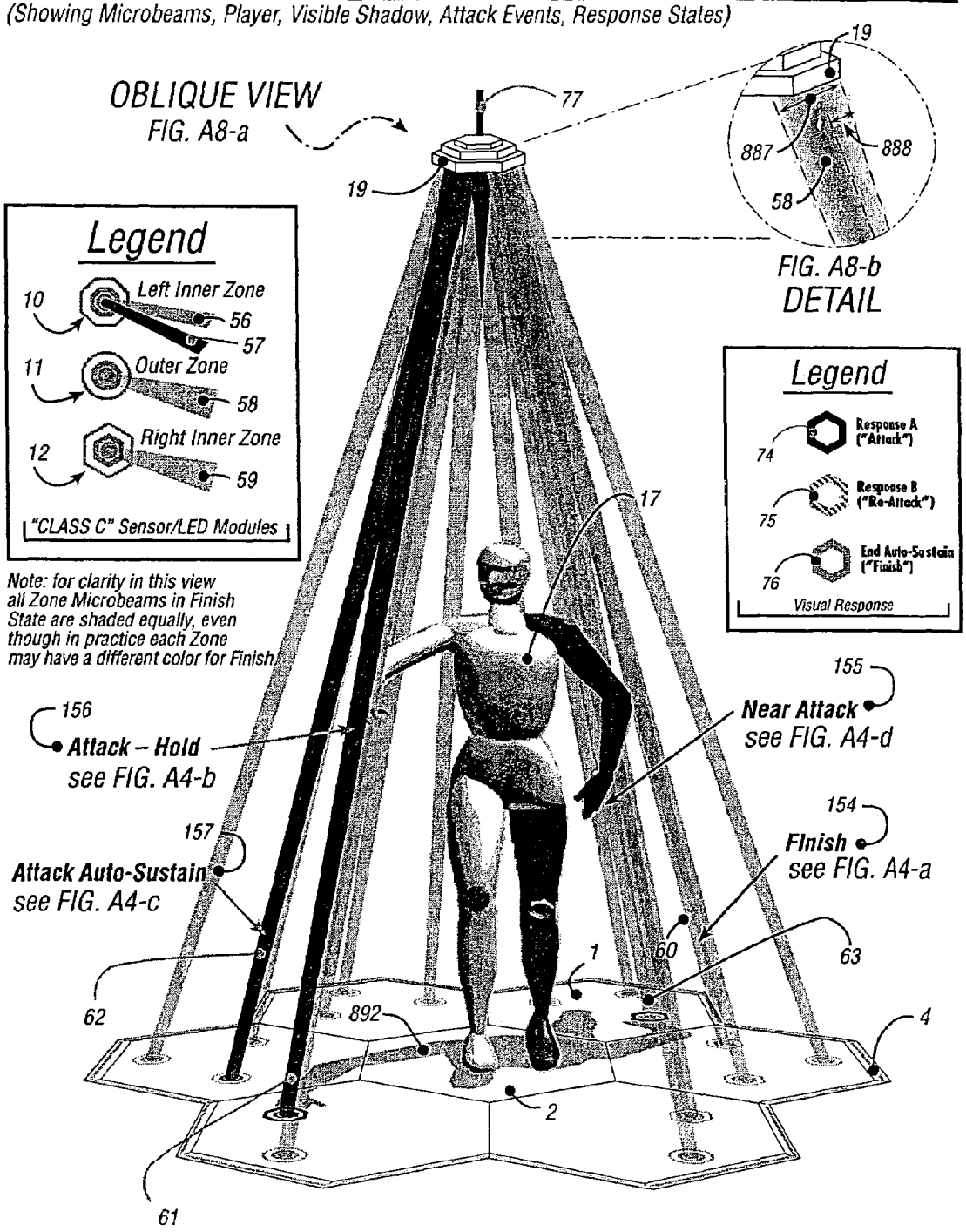

*n-Zone Platform w/ Type I Sensors* Sheet A9
*(Class D Sensor/LED Modules Shown)*
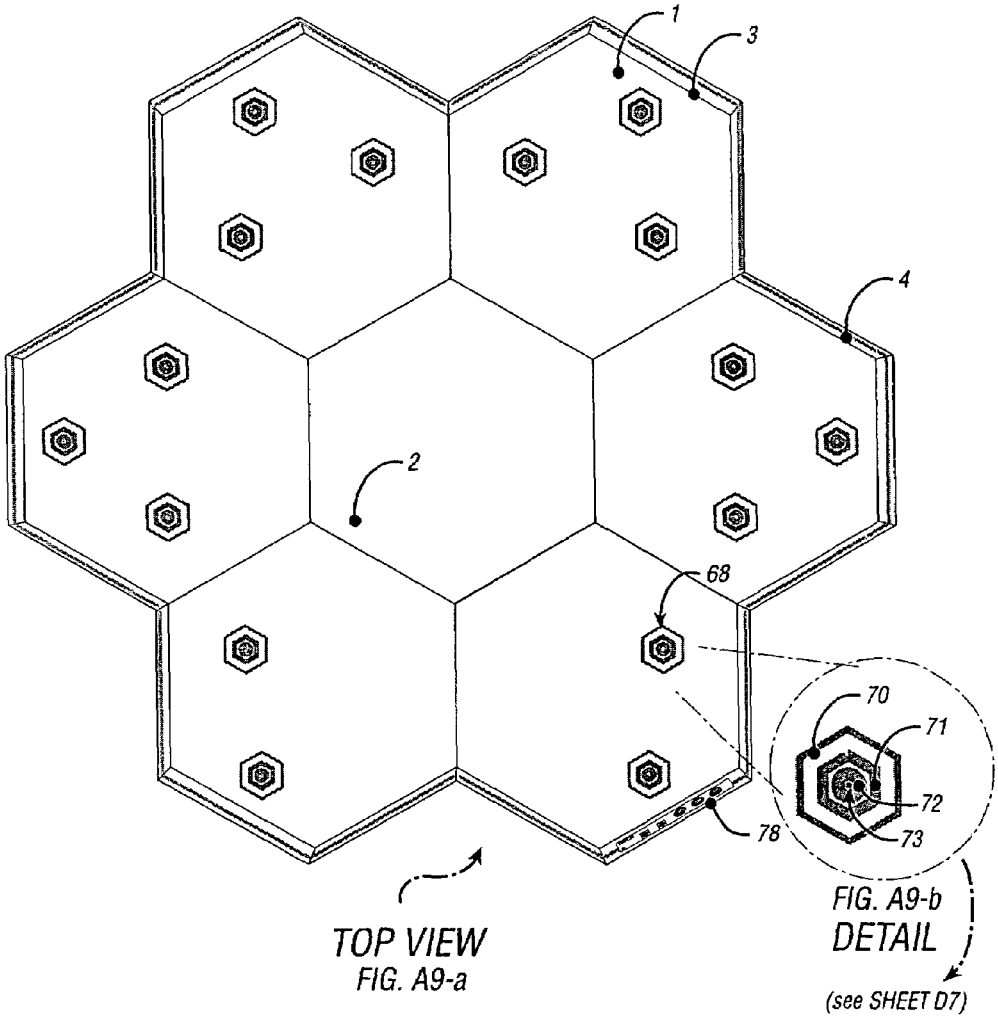
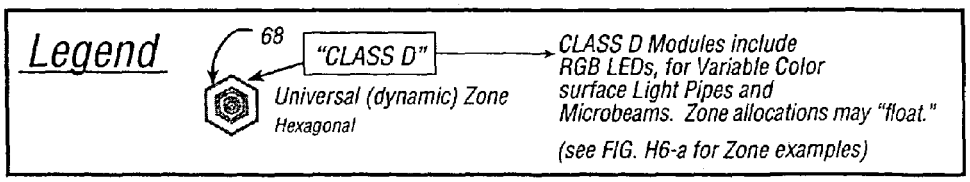

3-Zone Platform w/ Type I Sensors
Sheet A10
(Class A Sensor/LED Modules Shown)
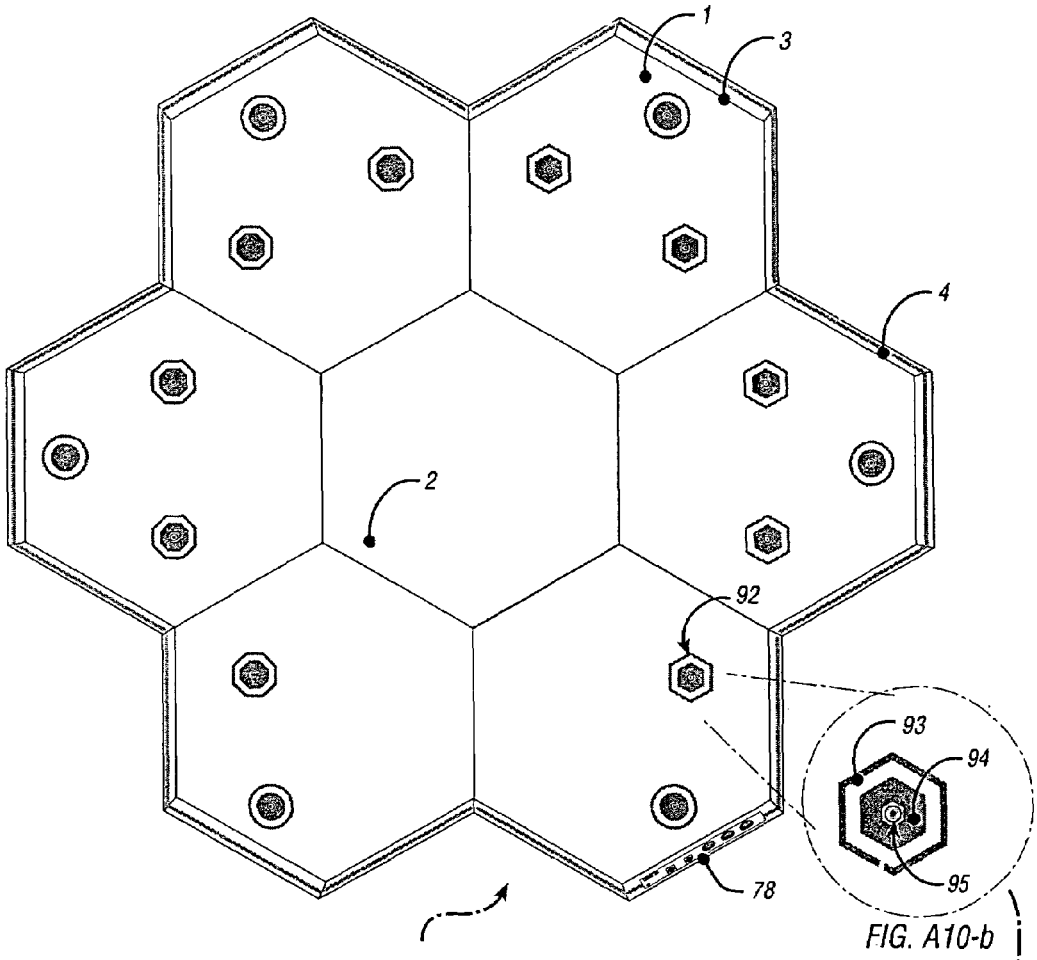
TOP VIEW
FIG. A10-a
FIG. A10-b
DETAIL
(see SHEET D4)
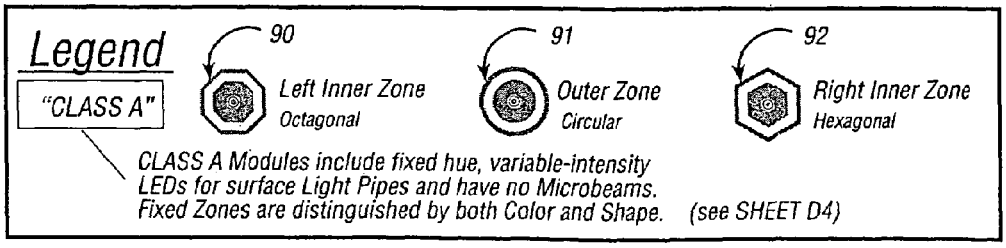

n-Zone Platform w/ Type I Sensors
Sheet A11
(Class B Sensor/LED Modules Shown)
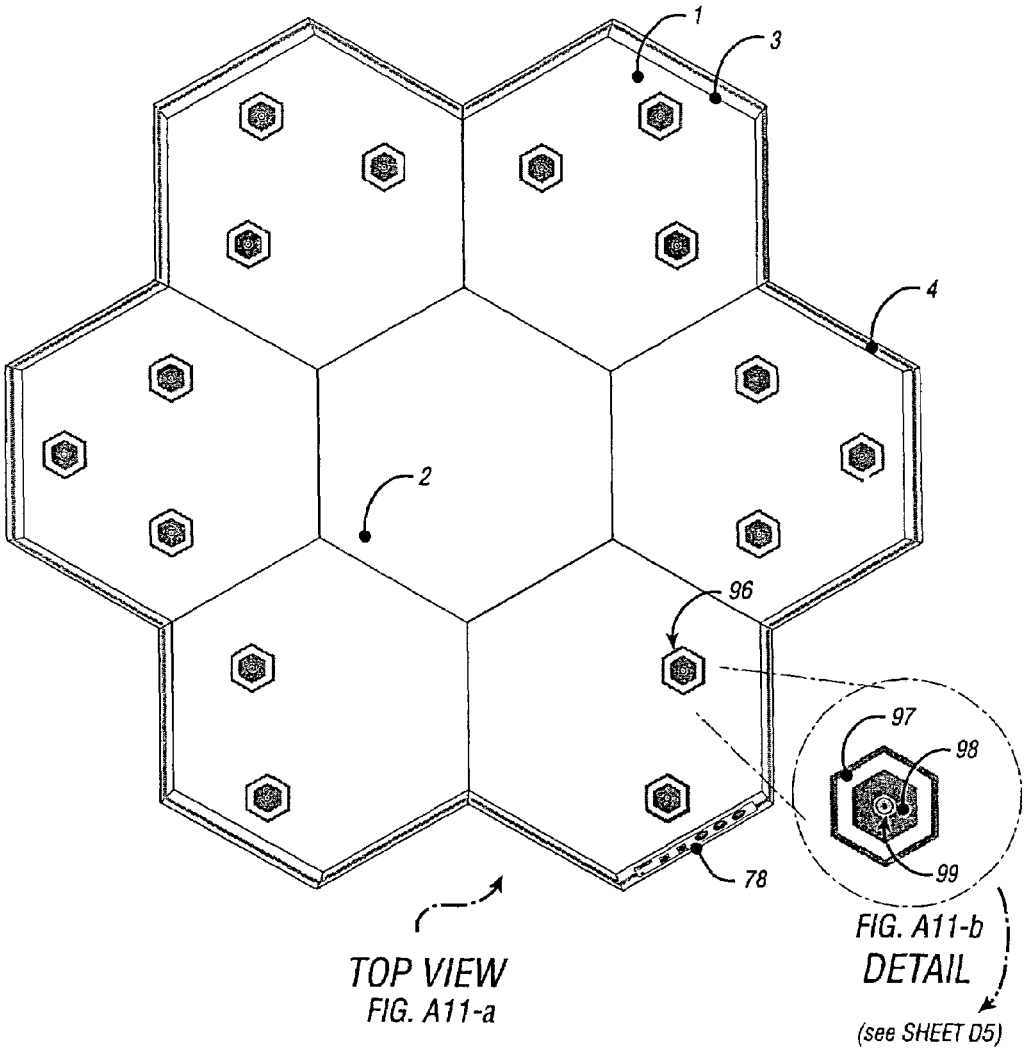
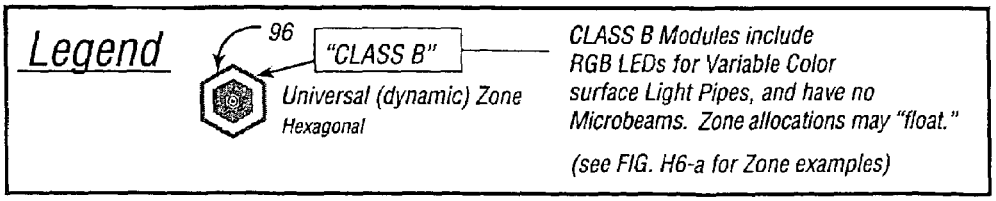

IR / Visible Overhead Flood Fixture

Sheet A12

(Platform Configuration Shown*)

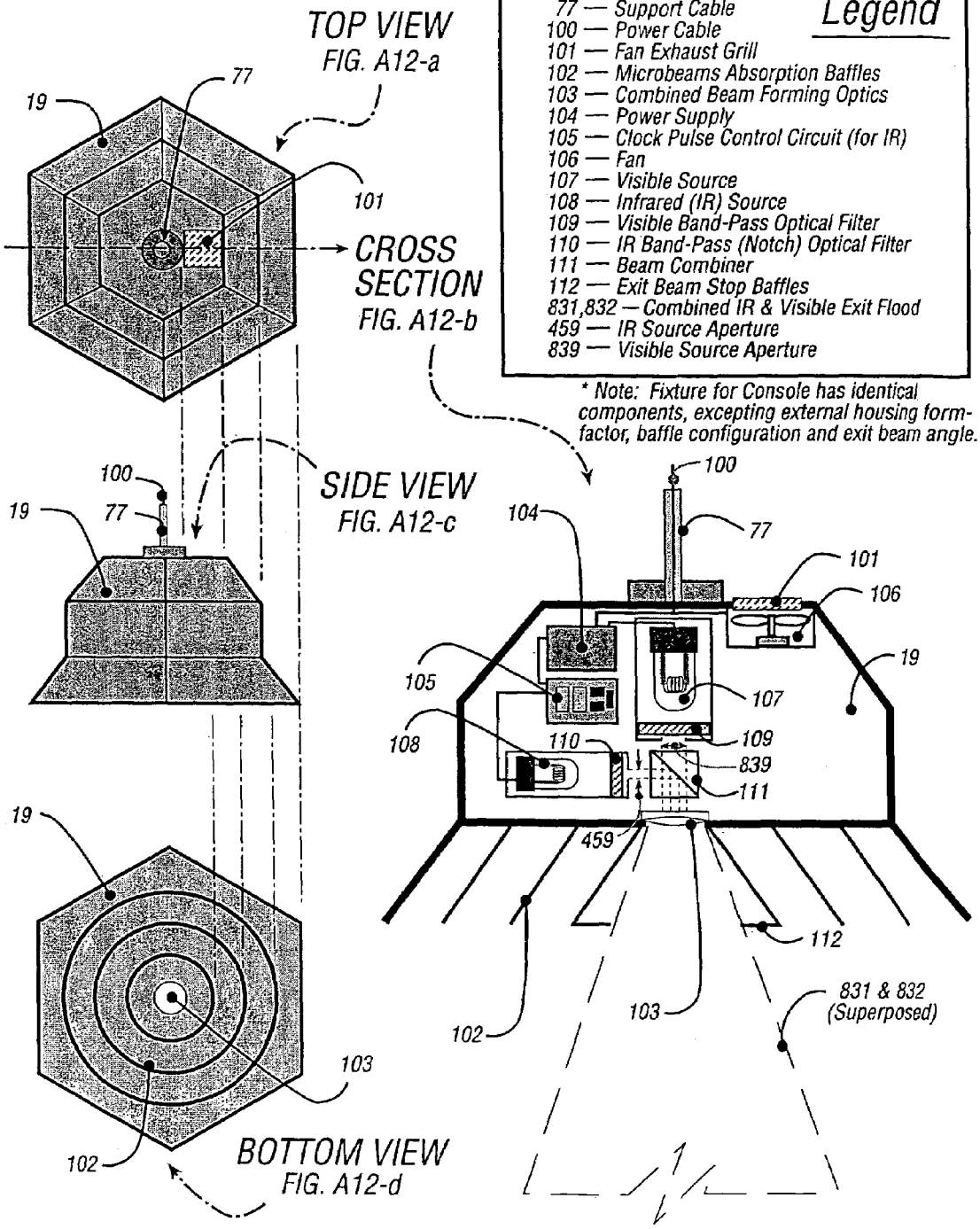

Legend

- 19 — Fixture Housing
- 77 — Support Cable
- 100 — Power Cable
- 101 — Fan Exhaust Grill
- 102 — Microbeams Absorption Baffles
- 103 — Combined Beam Forming Optics
- 104 — Power Supply
- 105 — Clock Pulse Control Circuit (for IR)
- 106 — Fan
- 107 — Visible Source
- 108 — Infrared (IR) Source
- 109 — Visible Band-Pass Optical Filter
- 110 — IR Band-Pass (Notch) Optical Filter
- 111 — Beam Combiner
- 112 — Exit Beam Stop Baffles
- 831,832 — Combined IR & Visible Exit Flood
- 459 — IR Source Aperture
- 839 — Visible Source Aperture

* Note: Fixture for Console has identical components, excepting external housing form-factor, baffle configuration and exit beam angle.

n-Zone Platform w/ Type I & II Sensors
Sheet B1
(Showing Type I Class D Sensor/LED Modules)
TOP VIEW
FIG. B1-a
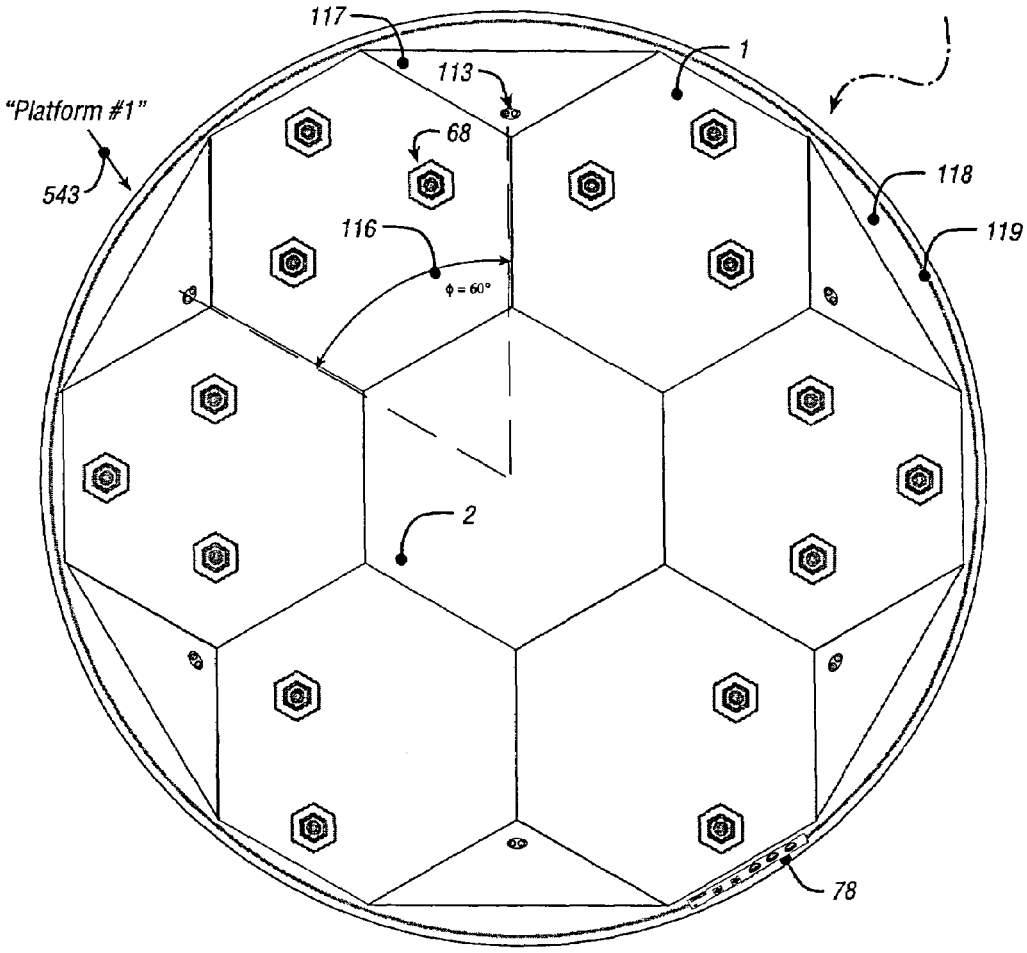
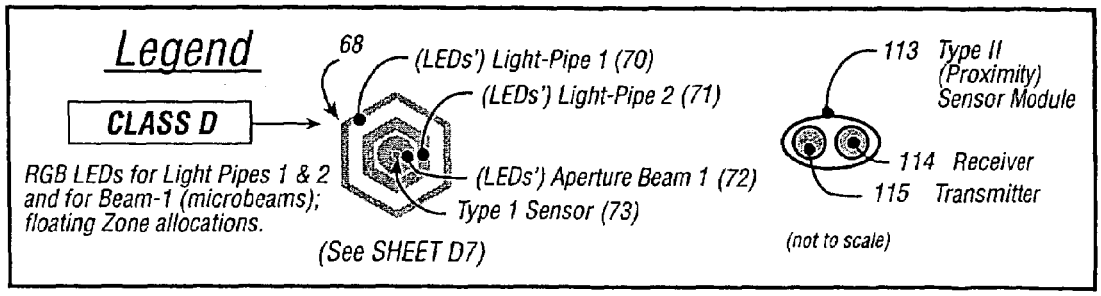

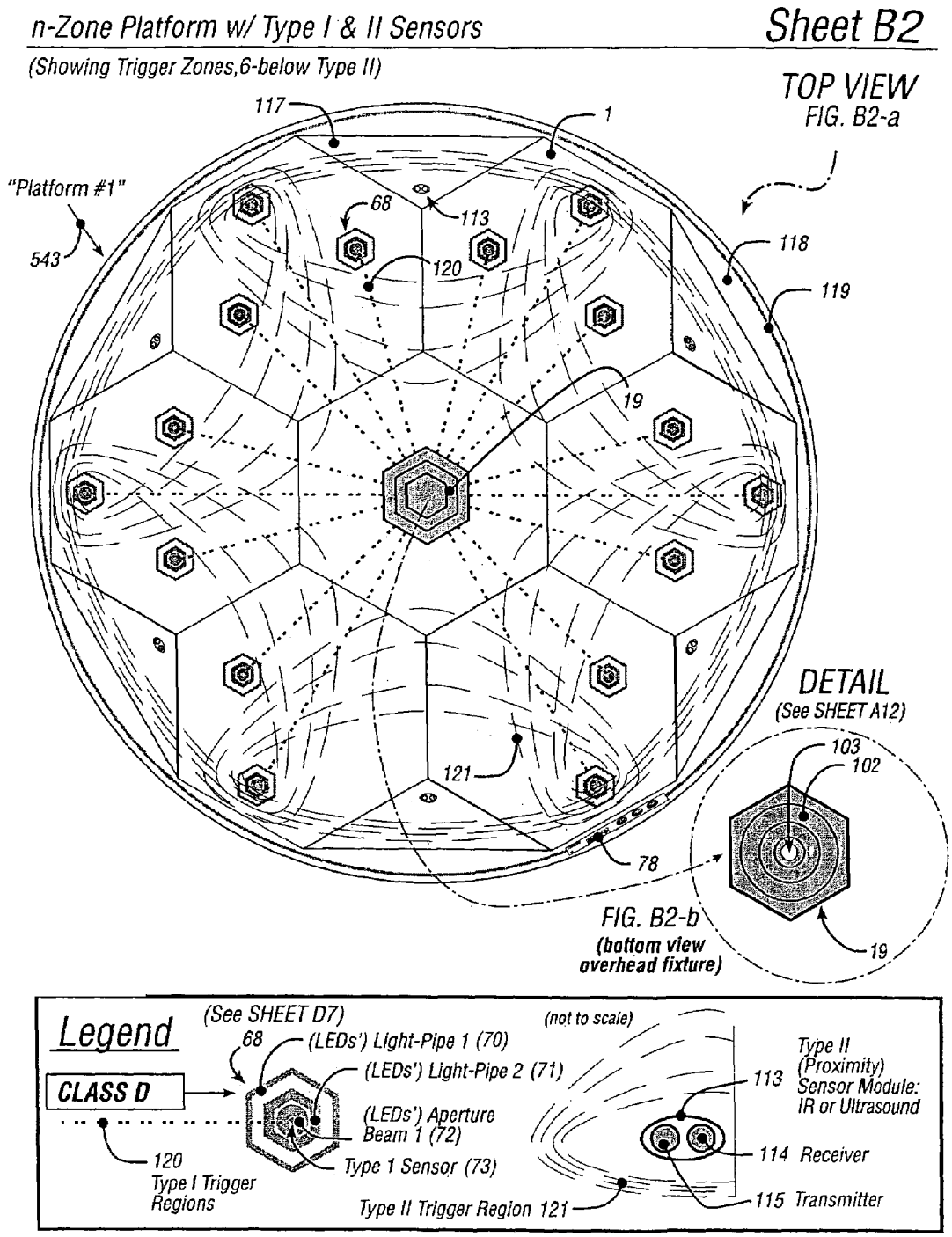
n-Zone Platform w/ Type I & II Sensors
Sheet B2
(Showing Trigger Zones,6-below Type II)
TOP VIEW
FIG. B2-a
"Platform #1"
543
117
1
68
113
120
118
119
19
121
78
DETAIL
(See SHEET A12)
103
102
19
FIG. B2-b
(bottom view overhead fixture)
Legend
(See SHEET D7)
(not to scale)
CLASS D
68
(LEDs') Light-Pipe 1 (70)
(LEDs') Light-Pipe 2 (71)
(LEDs') Aperture Beam 1 (72)
Type 1 Sensor (73)
120
Type I Trigger Regions
Type II Trigger Region 121
113
Type II (Proximity) Sensor Module: IR or Ultrasound
114 Receiver
115 Transmitter

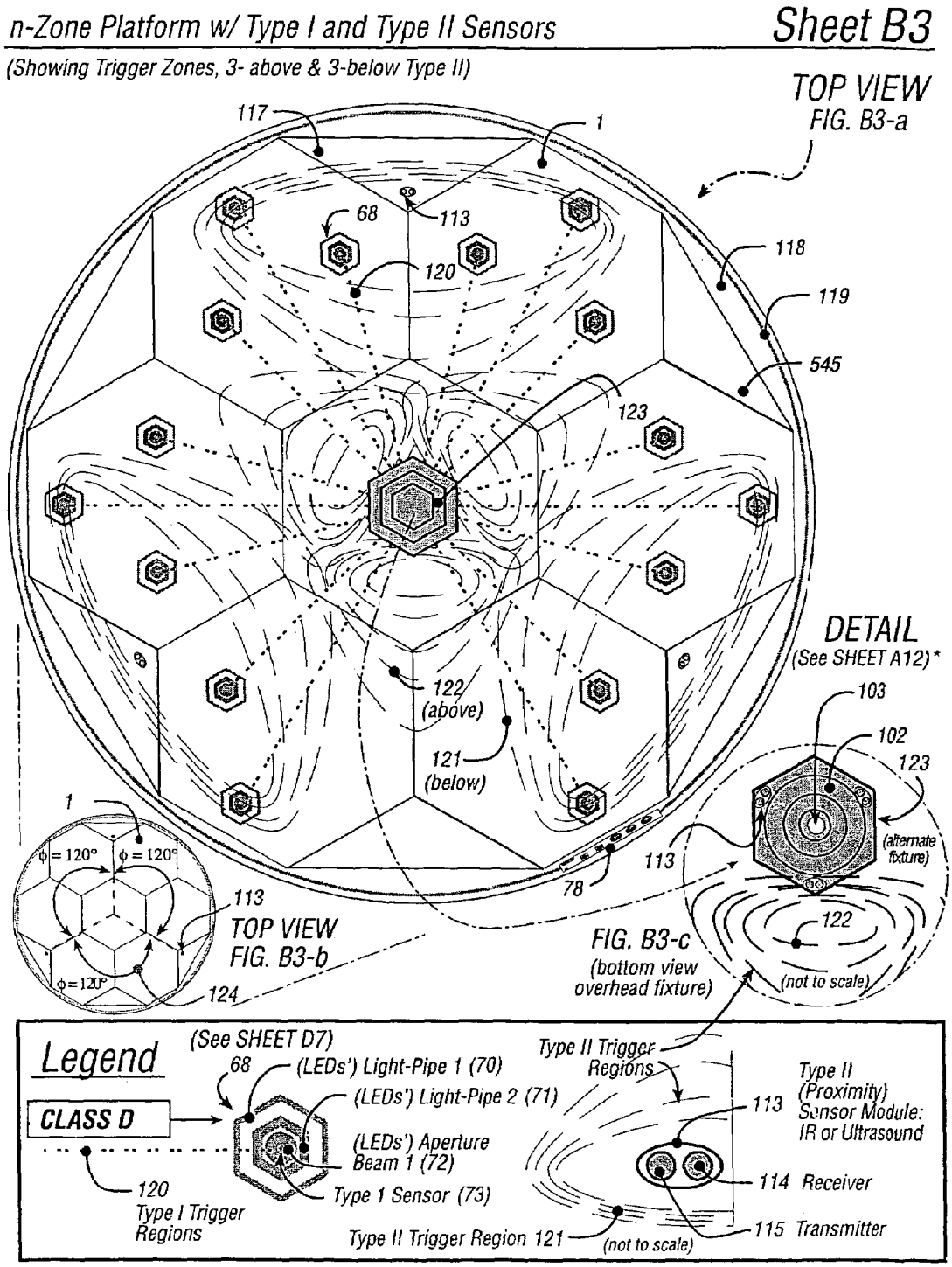
* Note: As shown on Sheet A12 except with addition of 3 Type II Modules and Data Cable)

n-Zone Integrated Console w/ Type I & II Sensors

Sheet C1

(Showing On-Axis Class D Sensor/LED Modules and Beams)

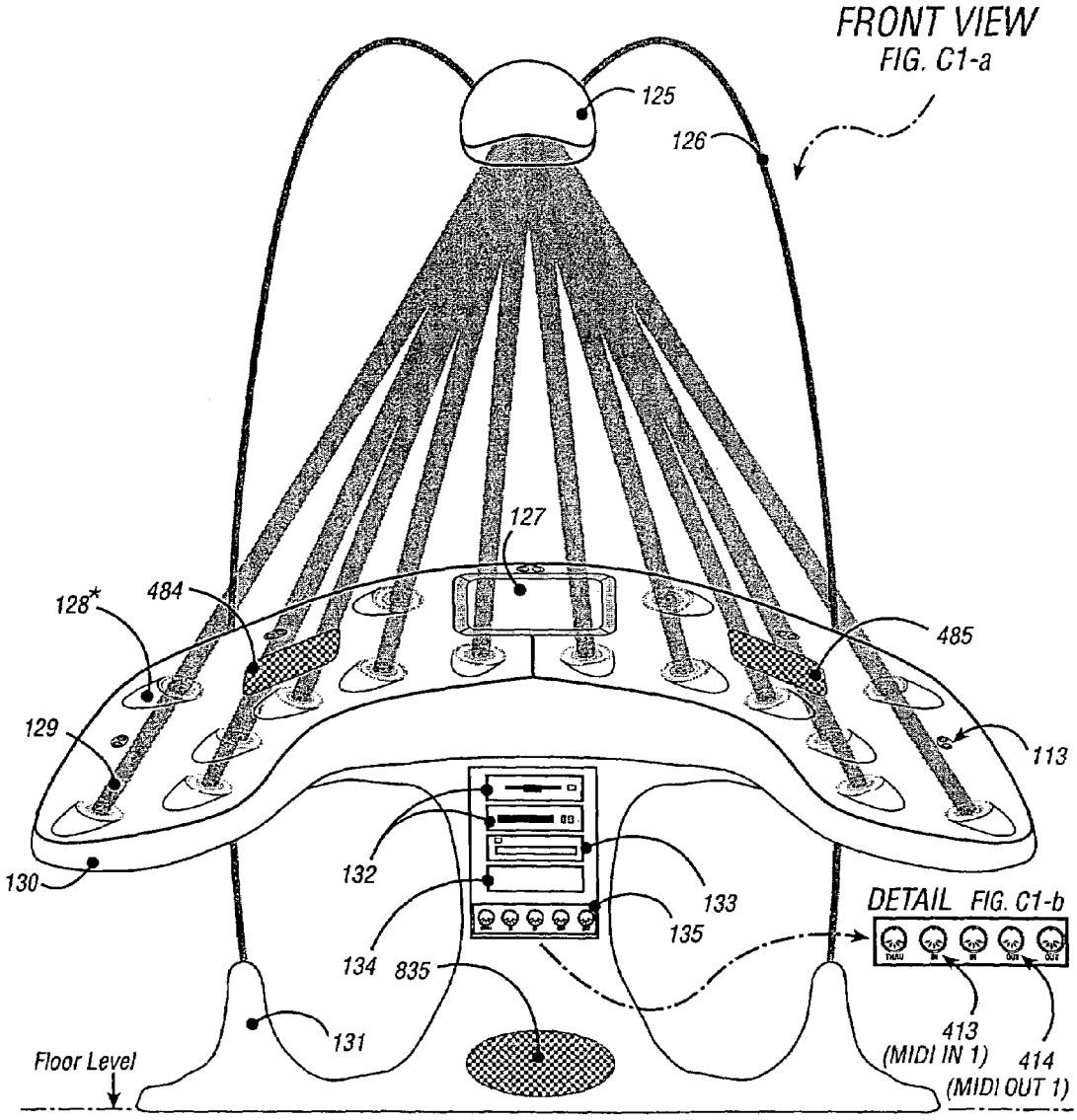

Legend

125 — IR/Visible Flood Fixture
126 — Fixture Supports
127 — Touch-Screen GUI Display
128 — Class D (Console) Sensor/LED Module*
113 — Type II Sensor Module
129 — BEAMS-1 (RGB Microbeams)
484, 485 — Left & Right Mid/High Speakers
130 — Console Upper Enclosure
131 — Lower Enclosure / Floor Stand
132 — Removable Magnetic Media Drives
133 — Removable Optical Media Drive
134 — Expansion Bay
135 — MIDI Interface
835 — Sub-woofer Speaker

*(Note: Type I Sensor– LED Modules are not depicted here in true 3D.)

n-Zone Integrated Console w/ Type I & II Sensors
Sheet C2
Showing On-Axis Class D Sensor/LED Modules)
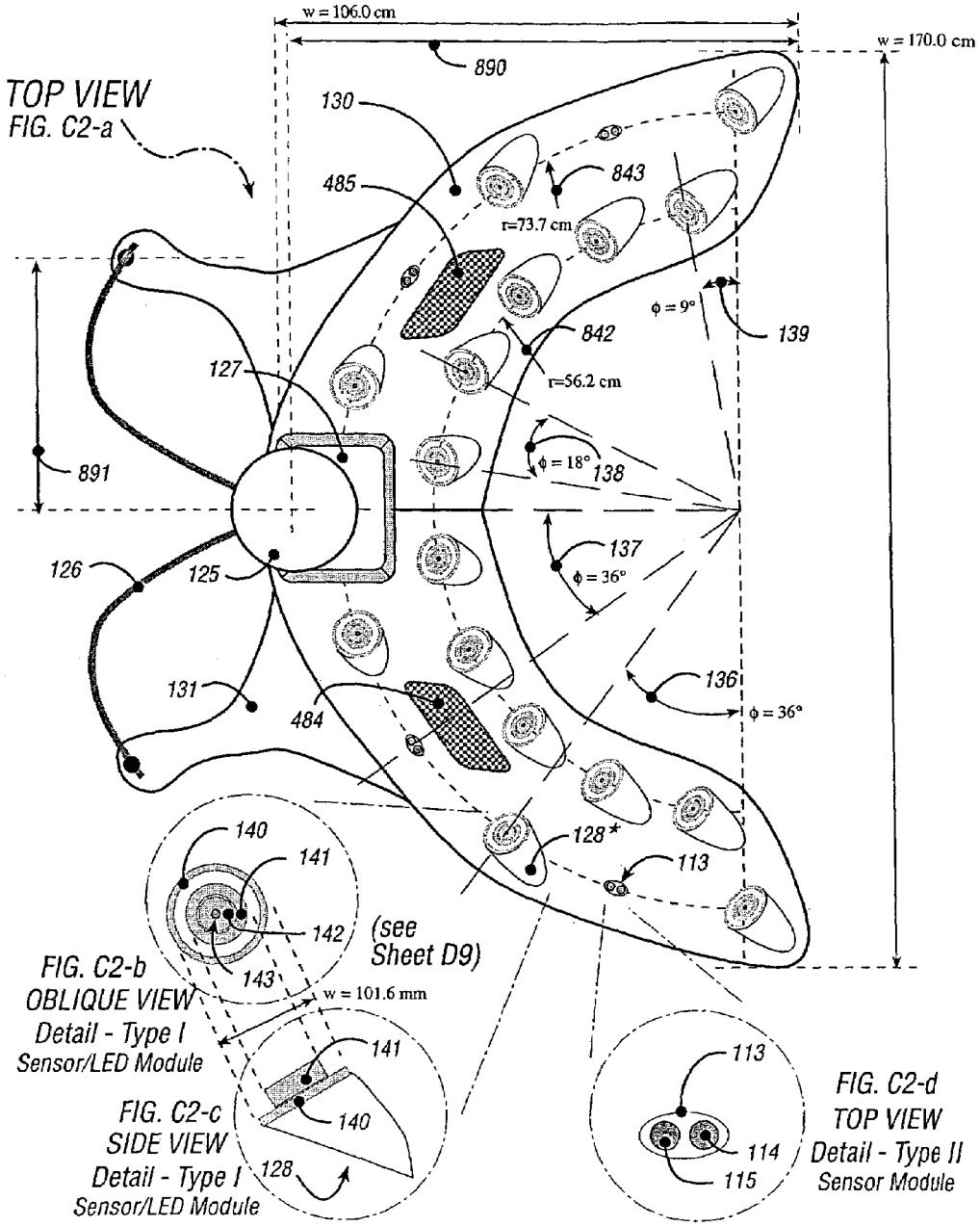
*(Note: Type I Sensor– LED Modules are not depicted here in true 3D.)

n-Zone Integrated Console w/ Type I & II Sensors
Sheet C3
Showing On-Axis Class D Sensor/LED Modules)
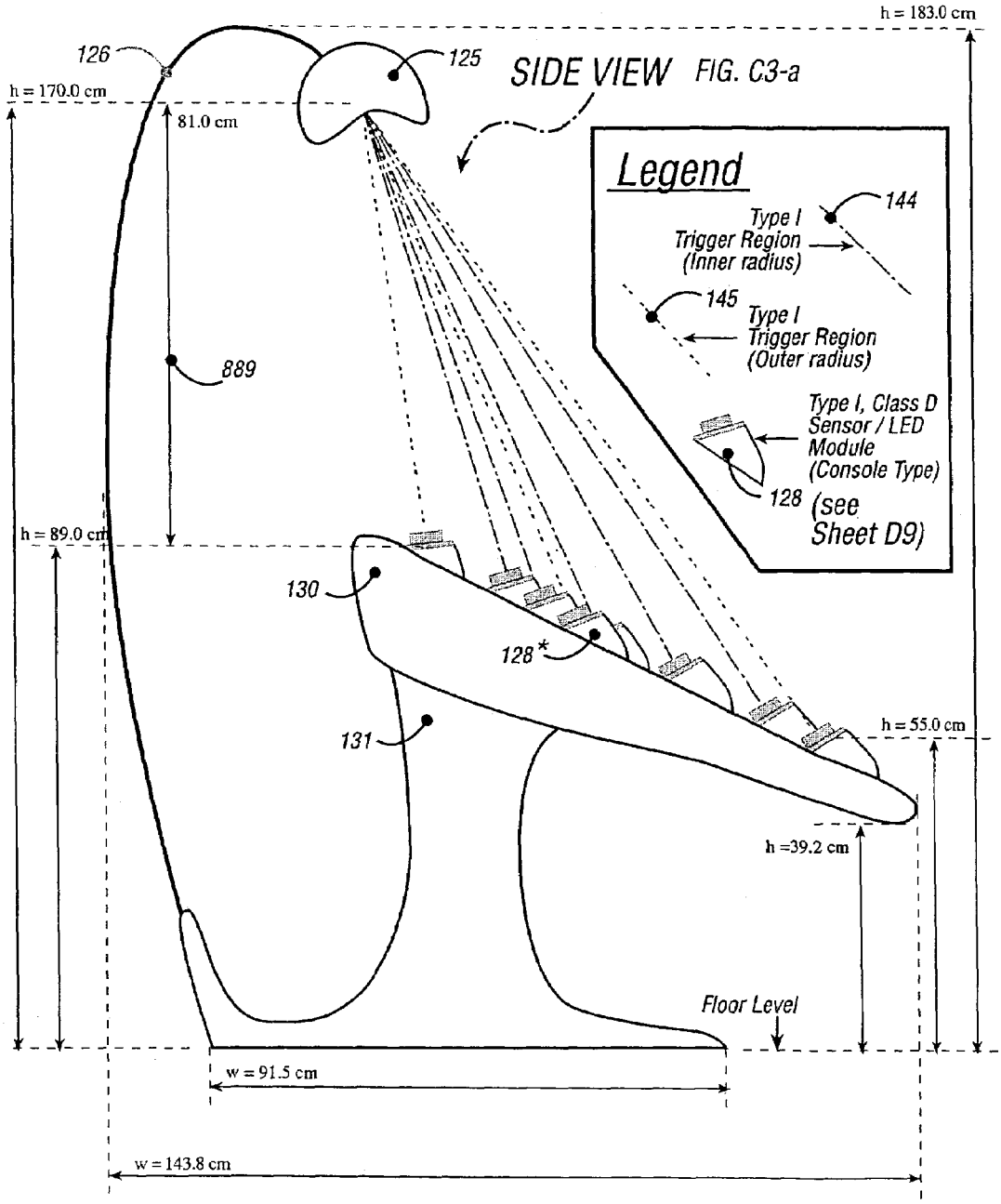
*(Note: Type I Sensor–LED Modules are not depicted here in true 3D.)

*n-Zone Integrated Console w/ Type I & II Sensors* Sheet C4
*(Showing Trigger Regions, Player, IR and Visible Shadows)*
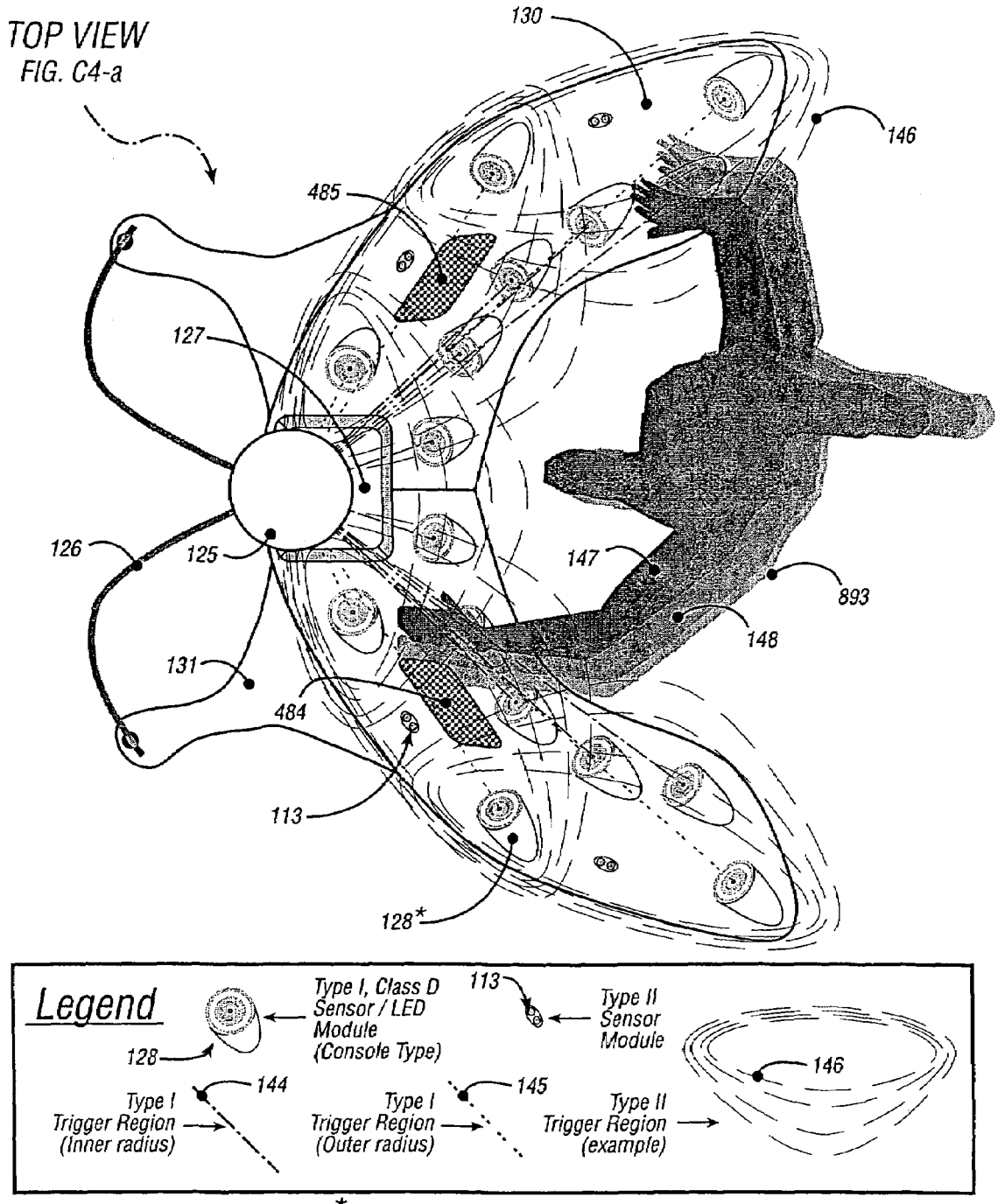
*(Note: Type I Sensor– LED Modules are not depicted here in true 3D.)

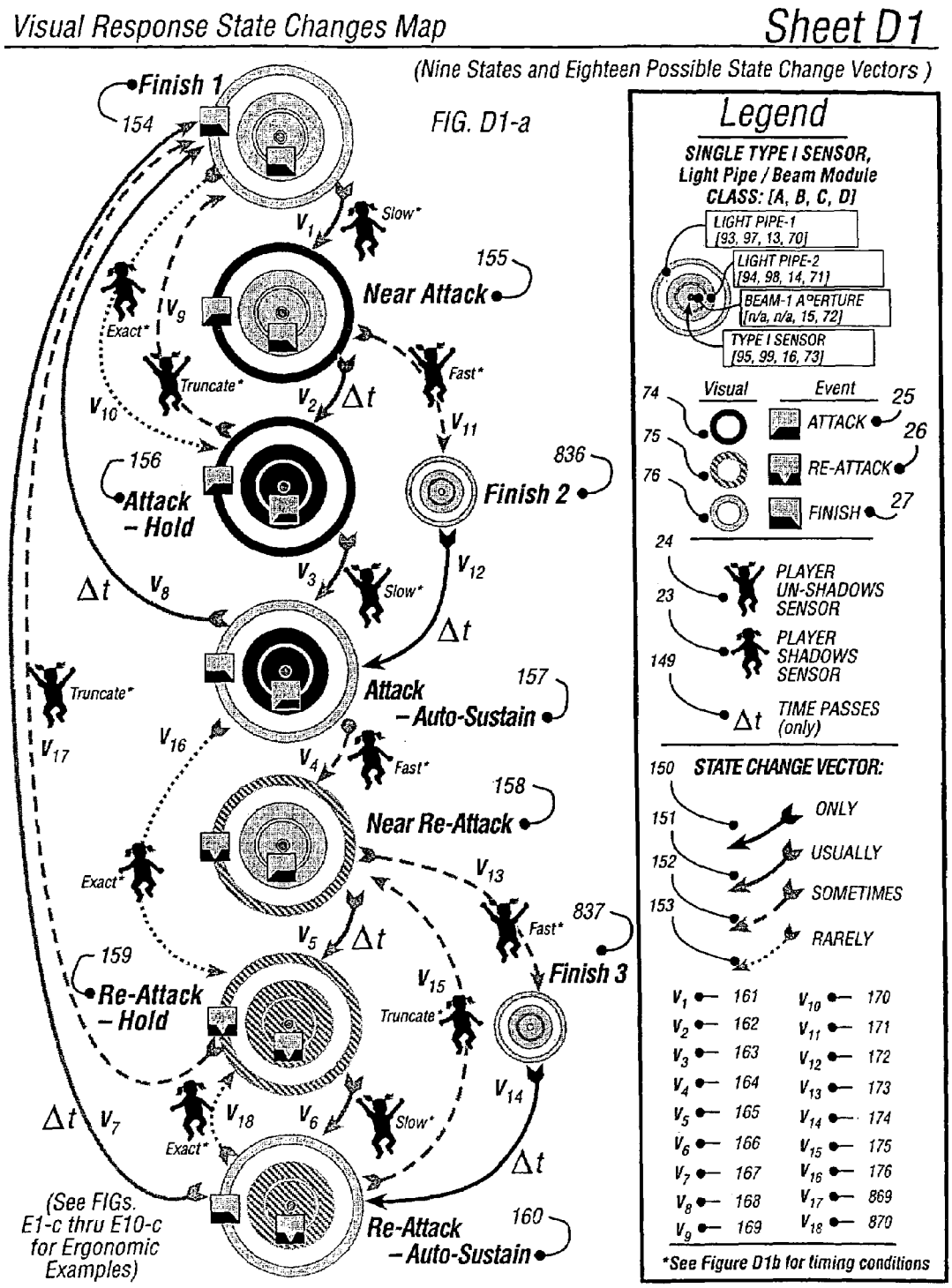
Visual Response State Changes Map
Sheet D1
(Nine States and Eighteen Possible State Change Vectors )
FIG. D1-a
Finish 1
154
Slow*
V1
155
Near Attack
V9
Exact*
Truncate*
V2
Δt
Fast*
V10
V11
156
Attack – Hold
836
Finish 2
V3
Slow*
V12
Δt
V8
Δt
Truncate*
Attack – Auto-Sustain
157
V17
V16
V4
Fast*
158
Near Re-Attack
Exact*
V13
837
Fast*
V5
Δt
159
Re-Attack – Hold
V15
Finish 3
Truncate*
V14
Δt
V7
V18
V6
Slow*
Exact*
Δt
(See FIGs. E1-c thru E10-c for Ergonomic Examples)
Re-Attack – Auto-Sustain
160
Legend
SINGLE TYPE I SENSOR, Light Pipe / Beam Module
CLASS: [A, B, C, D]
LIGHT PIPE-1 [93, 97, 13, 70]
LIGHT PIPE-2 [94, 98, 14, 71]
BEAM-1 APERTURE [n/a, n/a, 15, 72]
TYPE I SENSOR [95, 99, 16, 73]
Visual
Event
74
75
76
ATTACK
25
RE-ATTACK
26
FINISH
27
24
PLAYER UN-SHADOWS SENSOR
23
PLAYER SHADOWS SENSOR
149
Δt
TIME PASSES (only)
150
STATE CHANGE VECTOR:
151
ONLY
152
USUALLY
153
SOMETIMES
RARELY
V1 161
V2 162
V3 163
V4 164
V5 165
V6 166
V7 167
V8 168
V9 169
V10 170
V11 171
V12 172
V13 173
V14 174
V15 175
V16 176
V17 869
V18 870
*See Figure D1b for timing conditions

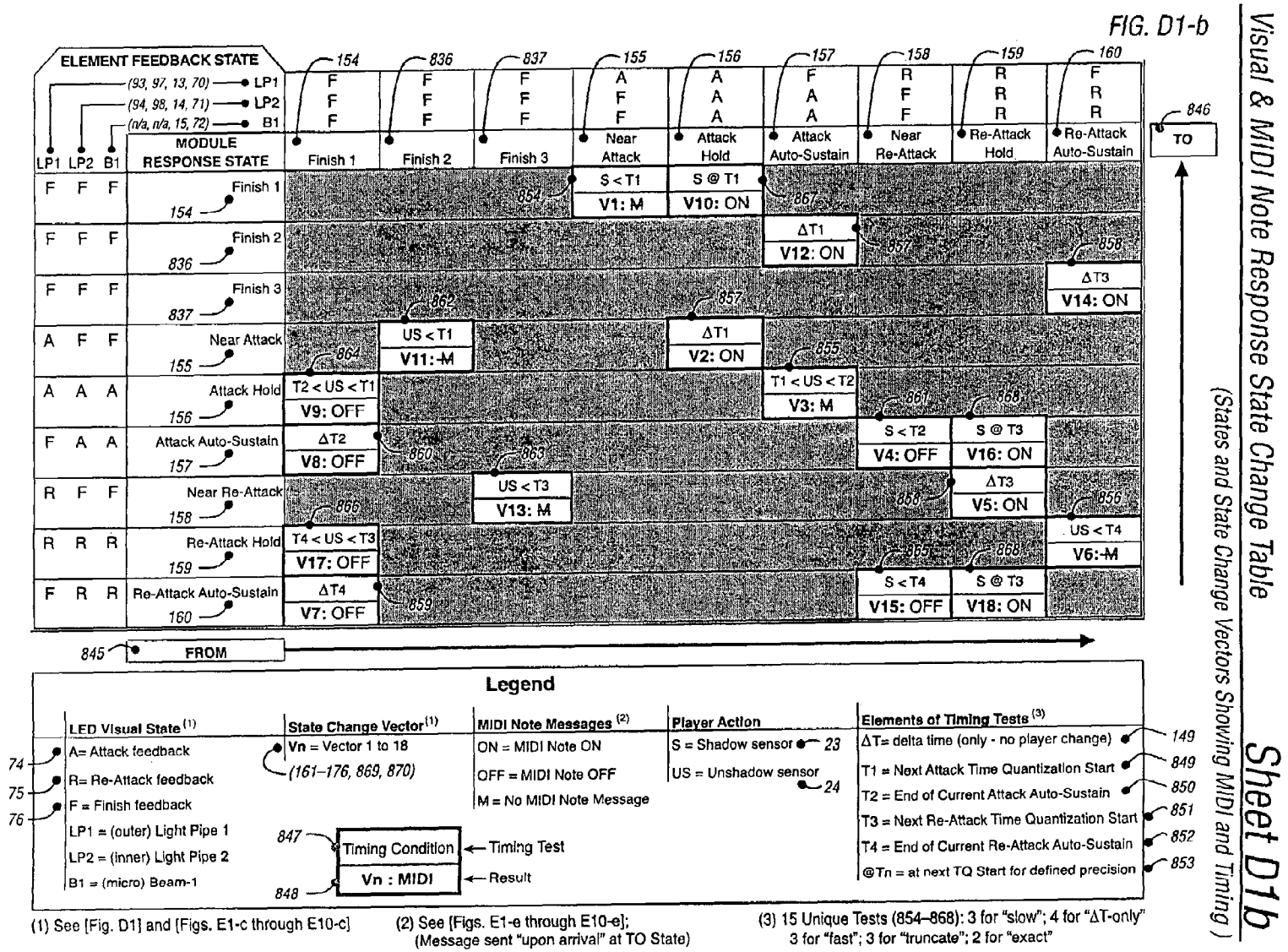
Visual & MIDI Note Response State Change Table
Sheet D1b
(States and State Change Vectors Showing MIDI and Timing )
FIG. D1-b
ELEMENT FEEDBACK STATE
LP1 (93, 97, 13, 70)
LP2 (94, 98, 14, 71)
B1 (n/a, n/a, 15, 72)
MODULE RESPONSE STATE
Finish 1
Finish 2
Finish 3
Near Attack
Attack Hold
Attack Auto-Sustain
Near Re-Attack
Re-Attack Hold
Re-Attack Auto-Sustain
S < T1
S @ T1
ΔT1
V1: M
V10: ON
V12: ON
ΔT3
V14: ON
US < T1
V11: M
V2: ON
T1 < US < T2
V3: M
S < T2
S @ T3
V4: OFF
V16: ON
T2 < US < T1
V9: OFF
ΔT2
V8: OFF
US < T3
V13: M
ΔT3
V5: ON
T4 < US < T3
V17: OFF
US < T4
V6: M
ΔT4
V7: OFF
S < T4
S @ T3
V15: OFF
V18: ON
FROM
TO
Legend
LED Visual State (1)
A= Attack feedback
R= Re-Attack feedback
F = Finish feedback
LP1 = (outer) Light Pipe 1
LP2 = (inner) Light Pipe 2
B1 = (micro) Beam-1
State Change Vector (1)
Vn = Vector 1 to 18
(161–176, 869, 870)
Timing Condition
Vn : MIDI
Timing Test
Result
MIDI Note Messages (2)
ON = MIDI Note ON
OFF = MIDI Note OFF
M = No MIDI Note Message
Player Action
S = Shadow sensor
US = Unshadow sensor
Elements of Timing Tests (3)
ΔT= delta time (only - no player change)
T1 = Next Attack Time Quantization Start
T2 = End of Current Attack Auto-Sustain
T3 = Next Re-Attack Time Quantization Start
T4 = End of Current Re-Attack Auto-Sustain
@Tn = at next TQ Start for defined precision
(1) See [Fig. D11] and [Figs. E1-c through E10-c]
(2) See [Figs. E1-e through E10-e]; (Message sent "upon arrival" at TO State)
(3) 15 Unique Tests (854–868): 3 for "slow"; 4 for "ΔT-only" 3 for "fast"; 3 for "truncate"; 2 for "exact"

*Spatial Displacement of Feedback: Light Pipes* Sheet D2

*Class A or Class B Sensor/LED Module*

*TOP VIEW*
*FIG. D2-a*

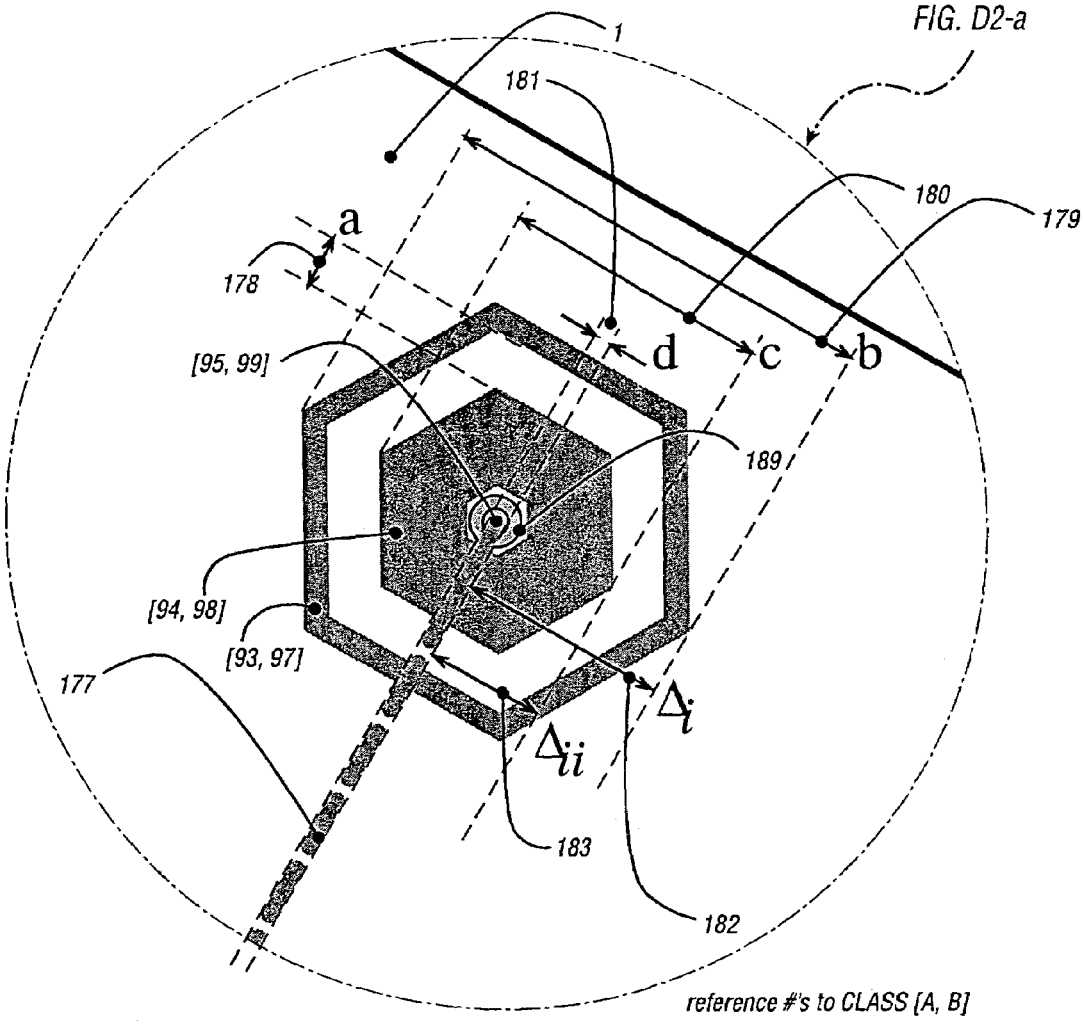

*reference #'s to CLASS [A, B]*

Legend*

182 – $\Delta_i$ – *Differential of Radius of Type I Trigger Region and Light Pipe 1 (Region 1 of spatial displacement of feedback)*

183 – $\Delta_{ii}$ – *Differential of Radius of Type I Trigger Region and Light Pipe 2 (Region 2 of spatial displacement of feedback)*

| | |
|---|---|
| 178 — a — Gap between Light Pipe 1 and Light Pipe 2 | 1 — Platform surface |
| 179 — b — Outside diameter of Light Pipe 1 | [93, 97] — Light Pipe 1 |
| 180 — c — Outside diameter of Light Pipe 2 | [94. 98] — Light Pipe 2 |
| 181 — d — Diameter of Type I Sensor Trigger Region | [95, 99] — Type I Sensor |
| | 177 — Type I Trigger Region |

*Note: Dimensional relationships hold for both fixed-color (Class A) and RGB (Class B) cases.

Spatial Displacement of Feedback: Light Pipes & Microbeam Sheet D3

Class C or Class D Sensor/LED Module

TOP VIEW
FIG. D3-a

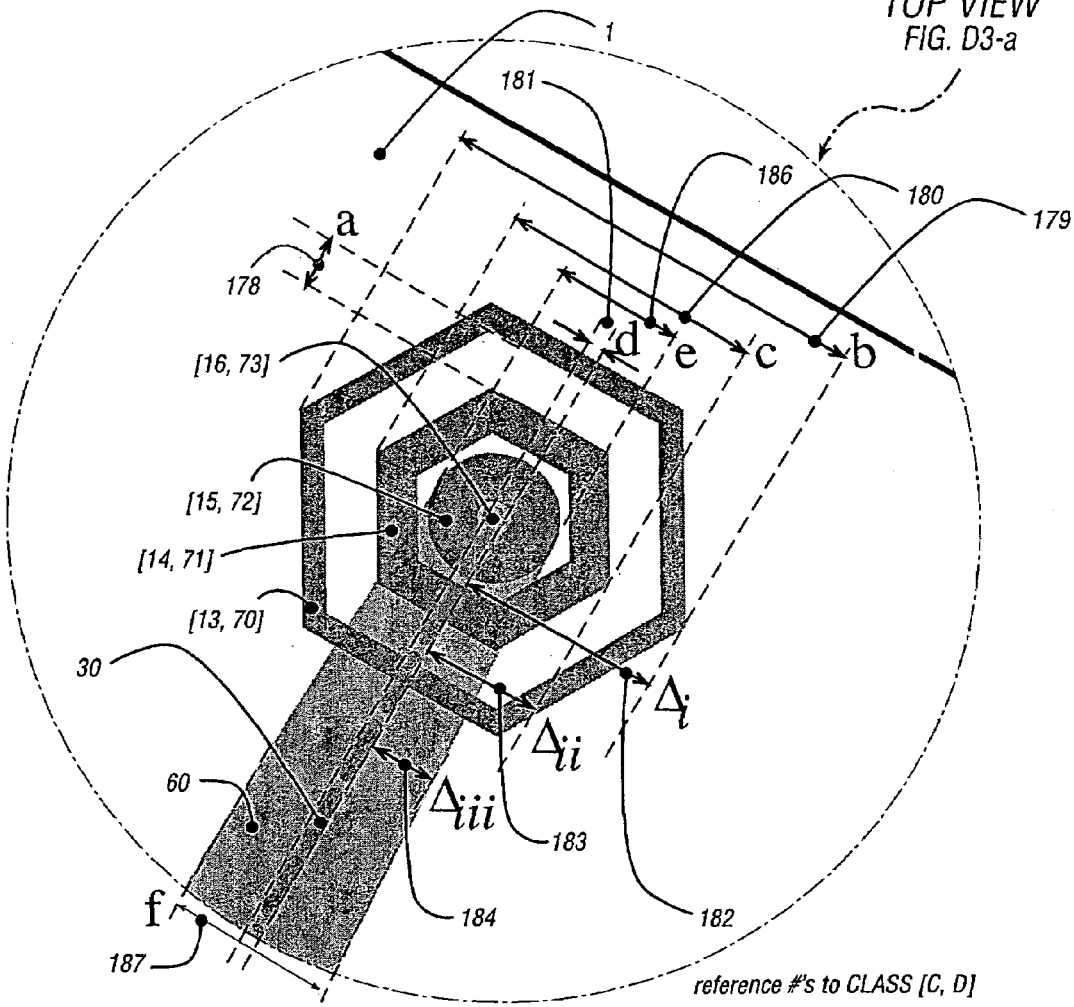

Legend*

| | | |
|---|---|---|
| 182 | $\Delta_i$ | Differential of Radius of Type I Trigger Region and Light Pipe 1 (Region 1 of spatial displacement of feedback) |
| 183 | $\Delta_{ii}$ | Differential of Radius of Type I Trigger Regionand Light Pipe 2 (Region 2 of spatial displacement of feedback) |
| 184 | $\Delta_{iii}$ | Differential of Radius of Type I Trigger Region and Beam 1 (Region 3 of spatial displacement of feedback) |

| | | | | | |
|---|---|---|---|---|---|
| 178 | a | Gap between Light Pipe 1 and Light Pipe 2 | 1 | | Platform surface |
| 179 | b | Outside diameter of Light Pipe 1 | [13, 70] | | Light Pipe 1 |
| 180 | c | Outside diameter of Light Pipe 2 | [14, 71] | | Light Pipe 2 |
| 181 | d | Diameter of Type I Sensor Trigger Region | [15, 72] | | Exit Aperture of Beam 1 |
| 186 | e | Exit Aperture Diameter of Beam 1 | [16, 73] | | Type I Sensor |
| 187 | f | Outside diameter of Beam 1 @ center of (888) | 30 | | Type I Trigger Region |
| | | | 60 | | Fogged Beam 1 |

*Note: Dimensional relationships hold for both fixed-color (Class C) and RGB (Class D) cases.

*Platform Type I Sensor / LED Module: "Class A"* Sheet D4

*(Light Pipes 1 and 2 only; Fixed-Color Variable-Intensity LEDs; Inner Right Zone Module Shown)*

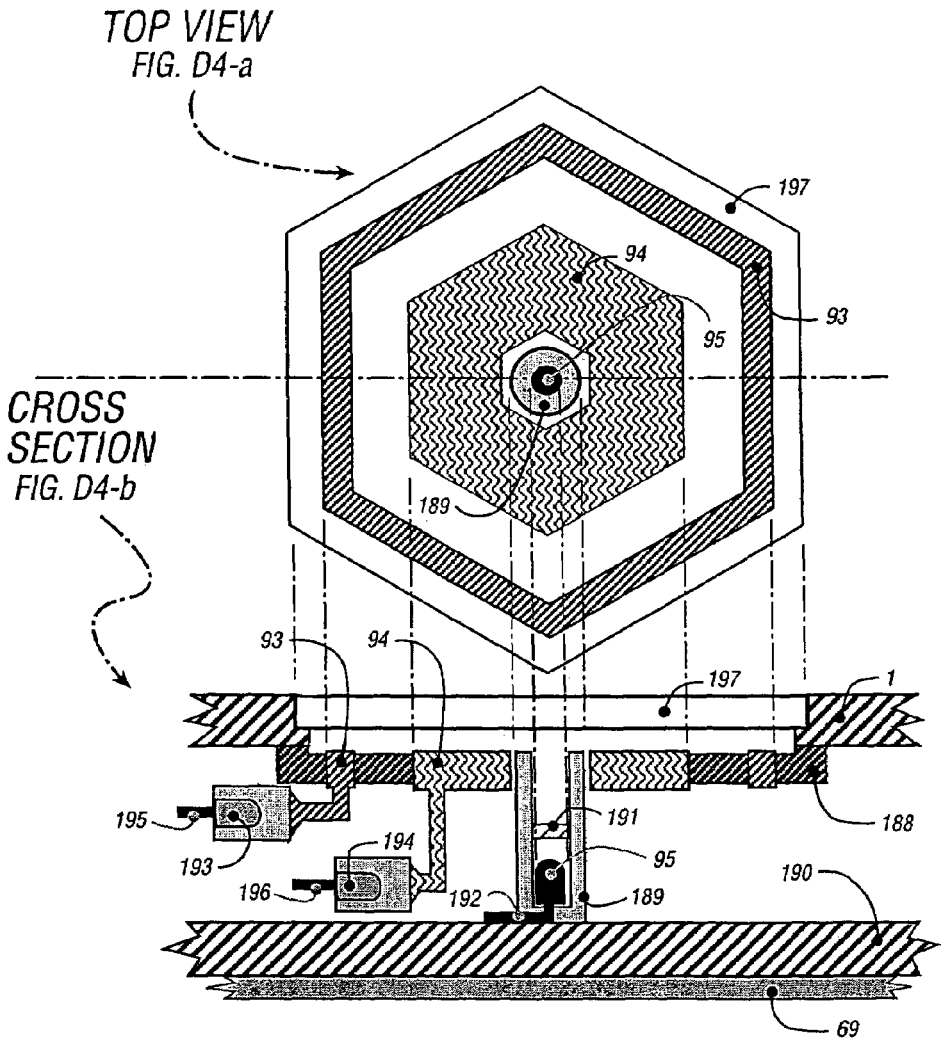

| Legend | | |
|---|---|---|
| | 197 — Clear, Scratch-Resistant Cover | 192 — Sensor connection to electronics |
| | 93 — Light Pipe 1 | 193 — Fixed Color, Variable-Intensity LED 1 |
| | 94 — Light Pipe 2 | 194 — Fixed Color, Variable-Intensity LED 2 |
| | 188 — Light Pipes Support | 195 — LED 1 connection to control electronics |
| | 95 — Type I Sensor | 196 — LED 2 connection to control electronics |
| | 189 — Mirrored Sensor Well | 69 — Rubber Impact / Non-Slip Cushion |
| | 1 — Platform Enclosure Top Surface | |
| | 190 — Platform Back (Inside) Surface | |
| | 191 — IR Band-Pass (Notch) Filter | |

*Note: Sensor well shown at 90° instead of employed lesser angles.

*Platform Type I Sensor / LED Module: "Class B"* Sheet D5

*(Light Pipes 1 and 2 only; RGB LEDs; for any n-Zone Module)*

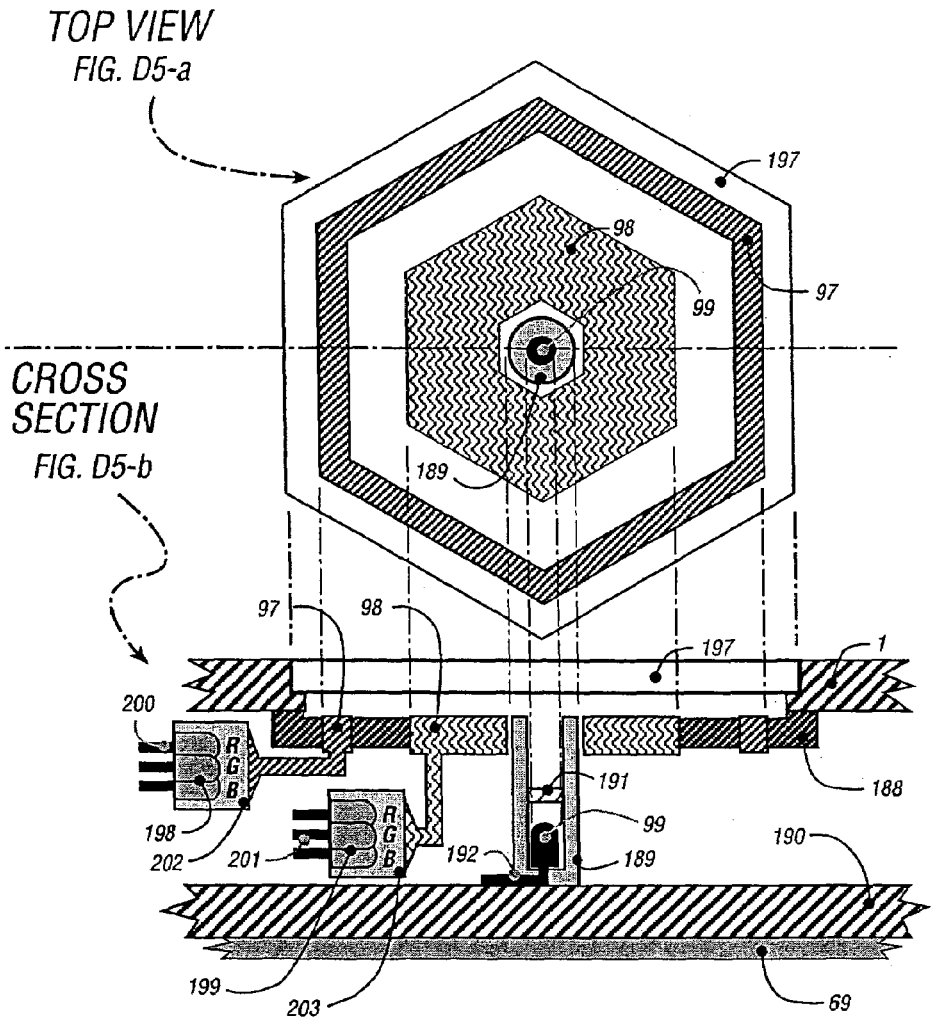

| Legend | | |
|---|---|---|
| | 197 — Clear, Scratch-Resistant Cover | 192 — Sensor connection to Electronics |
| | 97 — Light Pipe 1 | 198 — RGB LEDs 1 |
| | 98 — Light Pipe 2 | 199 — RGB LEDs 2 |
| | 188 — Light Pipes Support | 200 — LEDs 1 connection to control electronics |
| | 99 — Type I Sensor | 201 — LEDs 2 connection to control electronics |
| | 189 — Mirrored Sensor Well | 202 — LEDs 1 Mixing Chamber |
| | 1 — Platform Enclosure Top Surface | 203 — LEDs 2 Mixing Chamber |
| | 190 — Platform Back (Inside) Surface | 69 — Rubber Impact / Non-Slip Cushion |
| | 191 — IR Band-Pass (Notch) Filter | |

*Note: Sensor well shown at 90° instead of employed lesser angles.

Platform Type I Sensor / LED Module: "Class C" Sheet D6

(Light Pipes 1 and 2 and Beam 1; Fixed-Color Variable-Intensity LEDs; Inner Right Zone Module Shown)

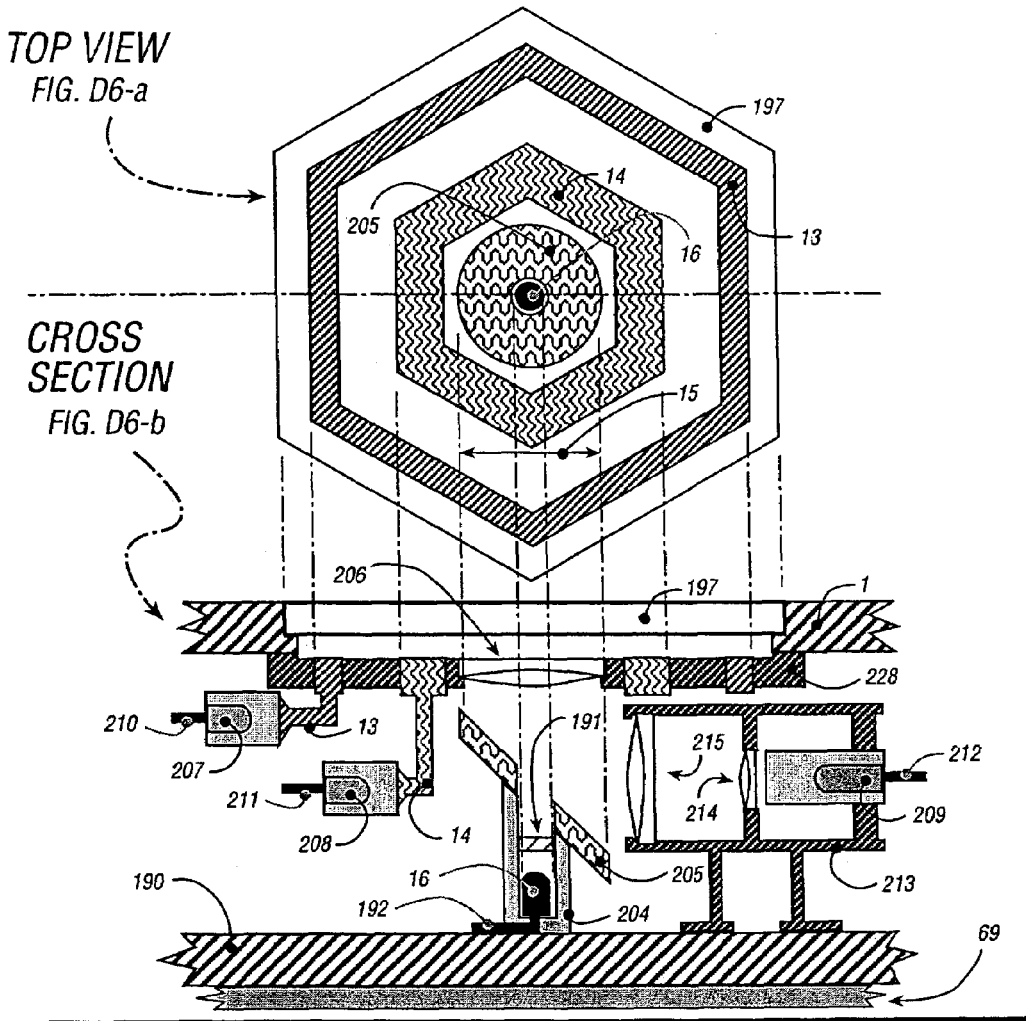

Legend

197 — Clear, Scratch-Resistant Cover
13 — Light Pipe 1 (to
14 — Light Pipe 2
228 — Light Pipes Support
16 — Type I Sensor
204 — Sensor Well & Mirror Support
205 — Perforated Elliptical Mirror
206 — Microbeam Correction Optics
1 — Platform Enclosure Top Surface
190 — Platform Back (Inside) Surface
191 — IR Band-Pass (Notch) Filter
69 — Rubber Impact / Non-Slip Cushion
192 — Sensor connection to electronics
207 — Fixed-color, Variable-Intensity LED 1
208 — Fixed-color, Variable-Intensity LED 2
209 — Fixed-color, Variable-Intensity and High Power LED 3
210 — LEDs 1 connection to control electronics
211 — LEDs 2 connection to control electronics
212 — LEDs 3 connection to control electronics
213 — Microbeam Assembly Housing & Support
214 — Microbeam Forming / Collimation Optics
215 Microbeam Collimation / Expansion Optics
15 — Microbeam Exit Aperture

*Note: Sensor well shown at 90° instead of employed lesser angles.

Platform Type I Sensor / LED Module: "Class D" — Sheet D7

(Light Pipes 1 and 2 and Beam 1; RGB LEDs; for any n-Zone Module) "Preferred (Thin) Embodiment"

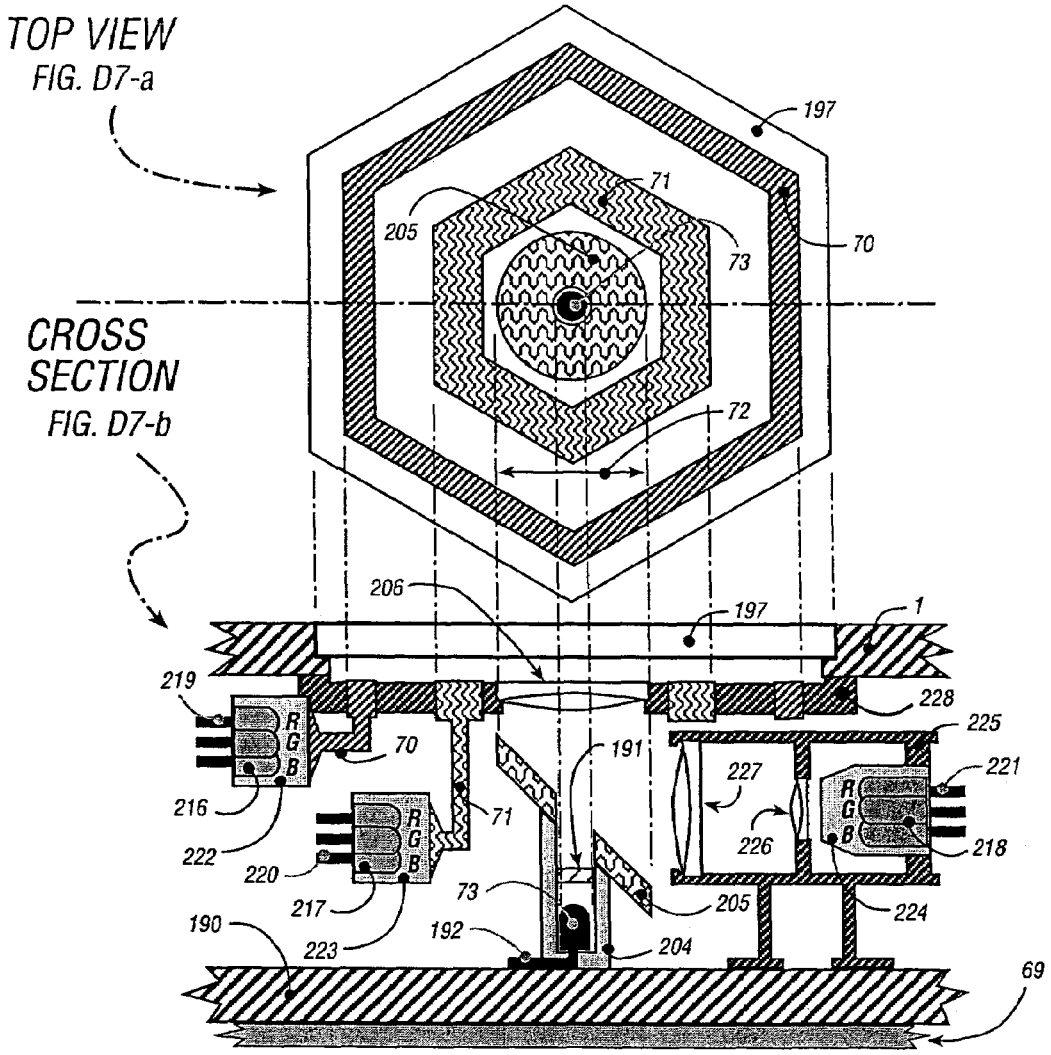

Legend

197 — Clear, Scratch-Resistant Cover
70 — Light Pipe 1
71 — Light Pipe 2
228 — Light Pipes Support
73 — Type I Sensor
204 — Sensor Well & Mirror Support
205 — Perforated Elliptical Mirror
206 — Microbeam Correction Optics
1 — Platform Enclosure Top Surface
190 — Platform Back (Inside) Surface
191 — IR Band-Pass (Notch) Filter
69 — Rubber Impact / Non-Slip Cushion
192 — Sensor connection to electronics
216 — RGB LEDs 1
217 — RGB LEDs 2
218 — High Power RGB LEDs 3
219 — LEDs 1 connection to control electronics
220 — LEDs 2 connection to control electronics
221 — LEDs 3 connection to control electronics
222 — LEDs 1 Mixing Chamber
223 — LEDs 2 Mixing Chamber
224 — LEDs 3 Mixing Chamber
225 — Microbeam Assembly Housing & Support
226 — Microbeam Forming / Collimation Optics
227 — Microbeam Collimation / Expansion Optics
72 — Microbeam Exit Aperture

*Note: Sensor well shown at 90° instead of employed, lesser angles

Console Type I Sensor / LED Module: "Class B"

Sheet D8

(Light Pipes 1 and 2 only; RGB LEDs; for any n-Zone Module)

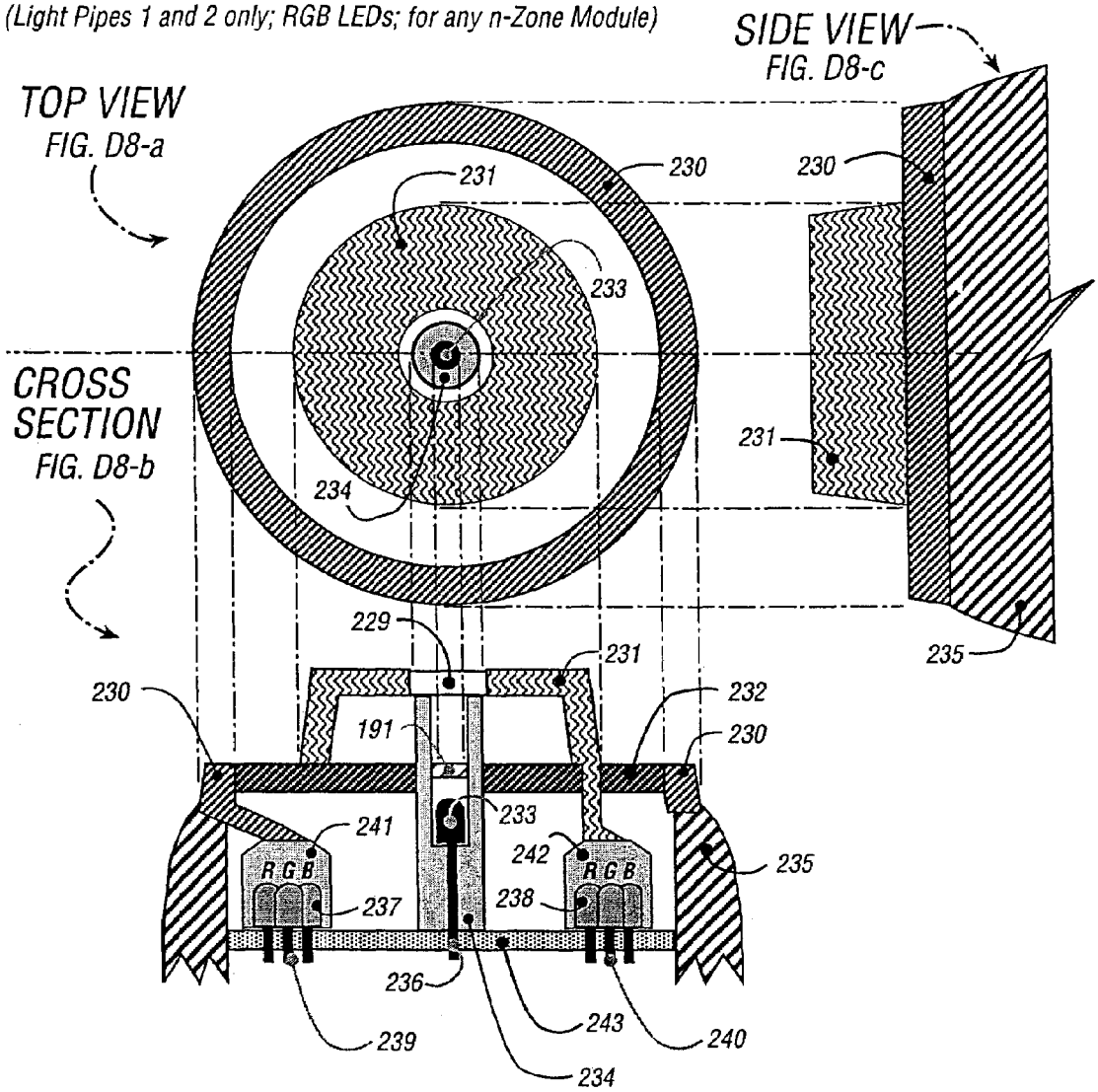

| Legend | | |
|---|---|---|
| | 229 — Clear Cover | 236 — Sensor connection to Electronics |
| | 230 — Light Pipe 1 - Console Type | 237 — RGB LEDs 1 |
| | 231 — Light Pipe 2 - Console Type | 238 — RGB LEDs 2 |
| | 232 — Light Pipes Support | 239 — LEDs 1 connection to control electronics |
| | 233 — Type I Sensor | 240 — LEDs 2 connection to control electronics |
| | 234 — Mirrored Sensor Well | 241 — LEDs 1 Mixing Chamber |
| | 235 — Module Enclosure | 242 — LEDs 2 Mixing Chamber |
| | 191 — IR Band-Pass (Notch) Filter | 243 — Printed Circuit Board (PCB) |

On-Axis Type I Sensor / LED Module: "Class D*"

Sheet D9

(Light Pipes 1 and 2 and Beam 1; RGB LEDs; for any n-Zone Module)

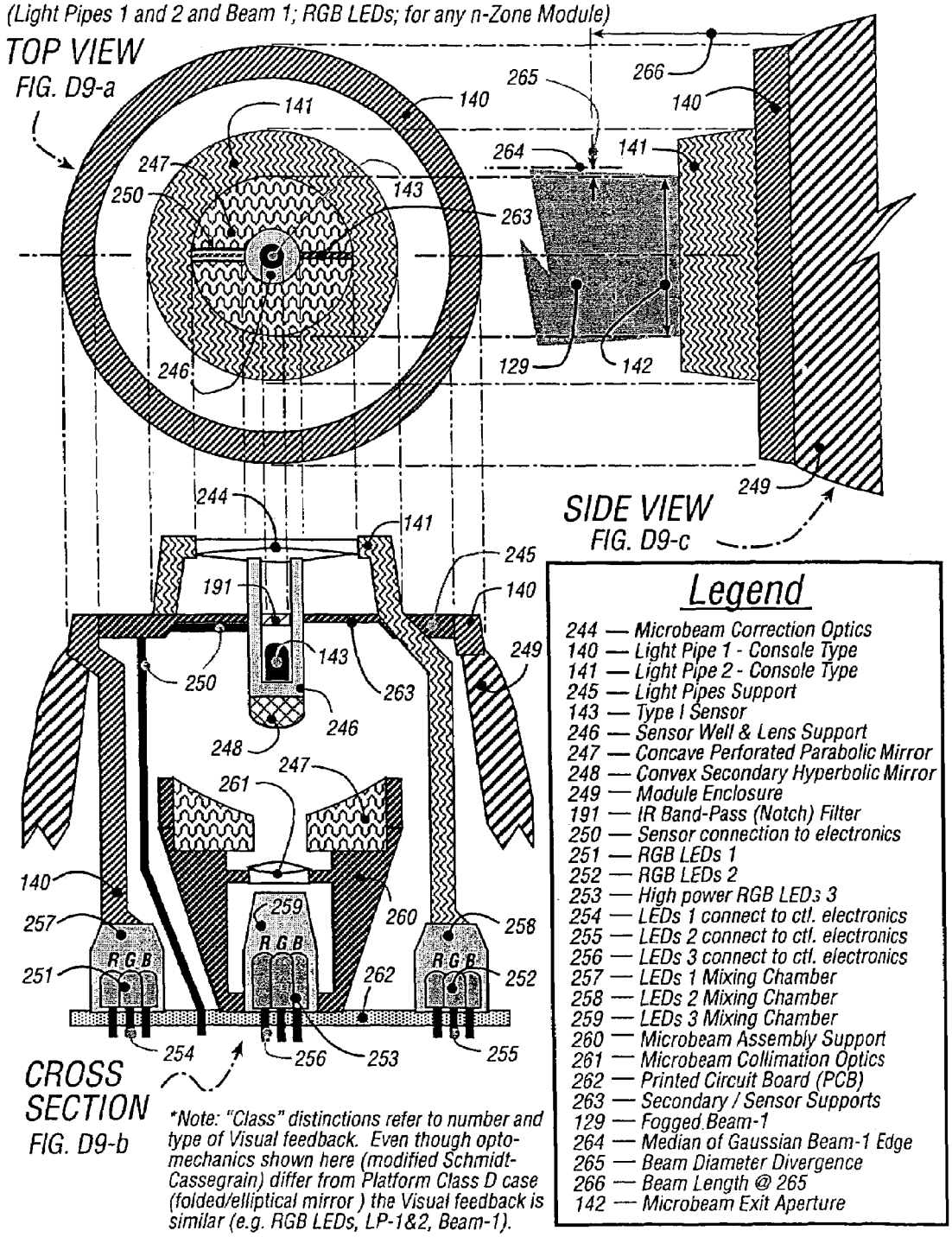

*Note: "Class" distinctions refer to number and type of Visual feedback. Even though opto-mechanics shown here (modified Schmidt-Cassegrain) differ from Platform Class D case (folded/elliptical mirror ) the Visual feedback is similar (e.g. RGB LEDs, LP-1&2, Beam-1).

Legend

244 — Microbeam Correction Optics
140 — Light Pipe 1 - Console Type
141 — Light Pipe 2 - Console Type
245 — Light Pipes Support
143 — Type I Sensor
246 — Sensor Well & Lens Support
247 — Concave Perforated Parabolic Mirror
248 — Convex Secondary Hyperbolic Mirror
249 — Module Enclosure
191 — IR Band-Pass (Notch) Filter
250 — Sensor connection to electronics
251 — RGB LEDs 1
252 — RGB LEDs 2
253 — High power RGB LEDs 3
254 — LEDs 1 connect to ctl. electronics
255 — LEDs 2 connect to ctl. electronics
256 — LEDs 3 connect to ctl. electronics
257 — LEDs 1 Mixing Chamber
258 — LEDs 2 Mixing Chamber
259 — LEDs 3 Mixing Chamber
260 — Microbeam Assembly Support
261 — Microbeam Collimation Optics
262 — Printed Circuit Board (PCB)
263 — Secondary / Sensor Supports
129 — Fogged Beam-1
264 — Median of Gaussian Beam-1 Edge
265 — Beam Diameter Divergence
266 — Beam Length @ 265
142 — Microbeam Exit Aperture

*Attacks* Sheet E1
*Ergonomic Timing, State Changes, MIDI Out, and Kinesthetic Sync Entrainment*
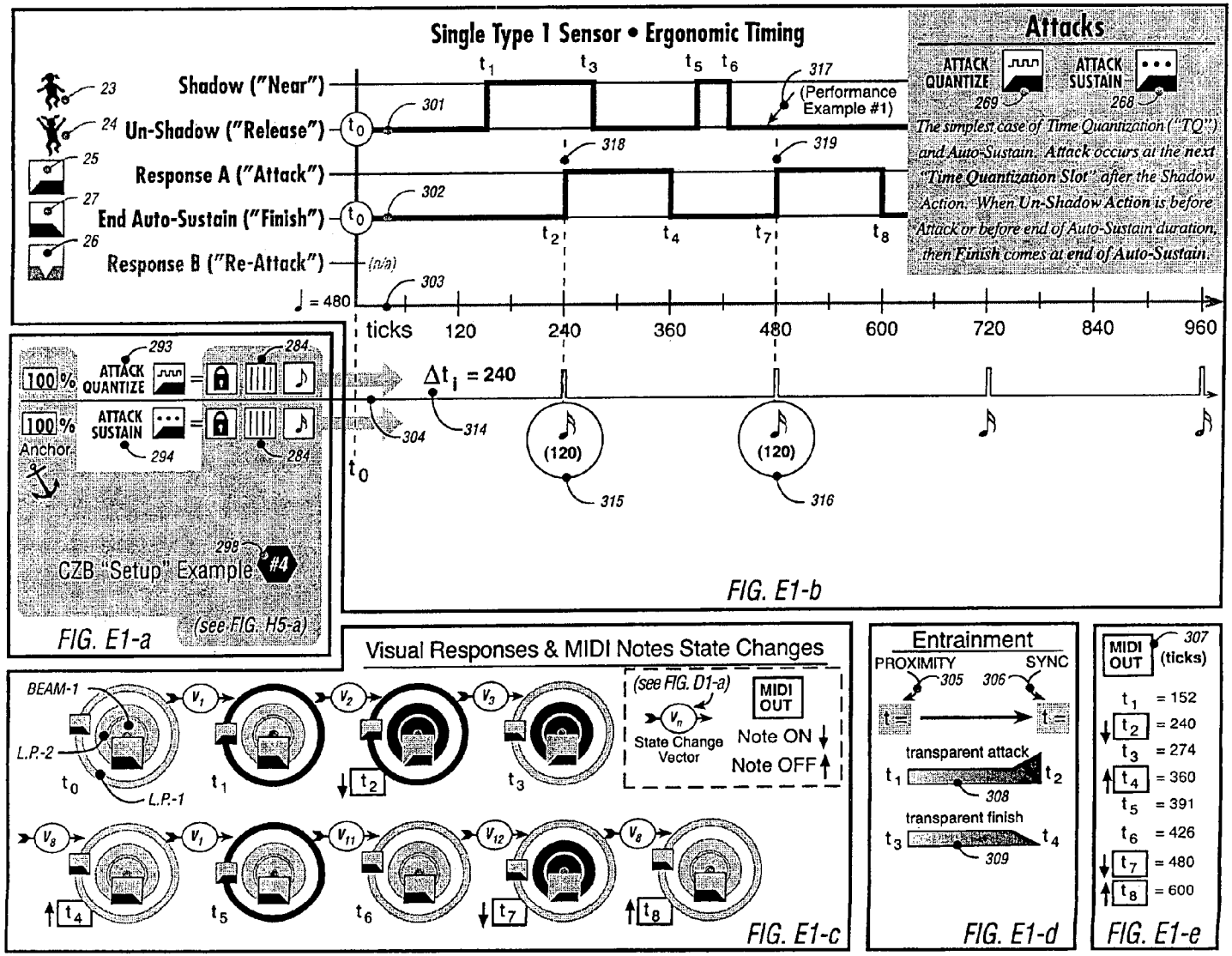

*Sustain Extend* Sheet E2
*Ergonomic Timing, State Changes, MIDI Out, and Kinesthetic Sync Entrainment*
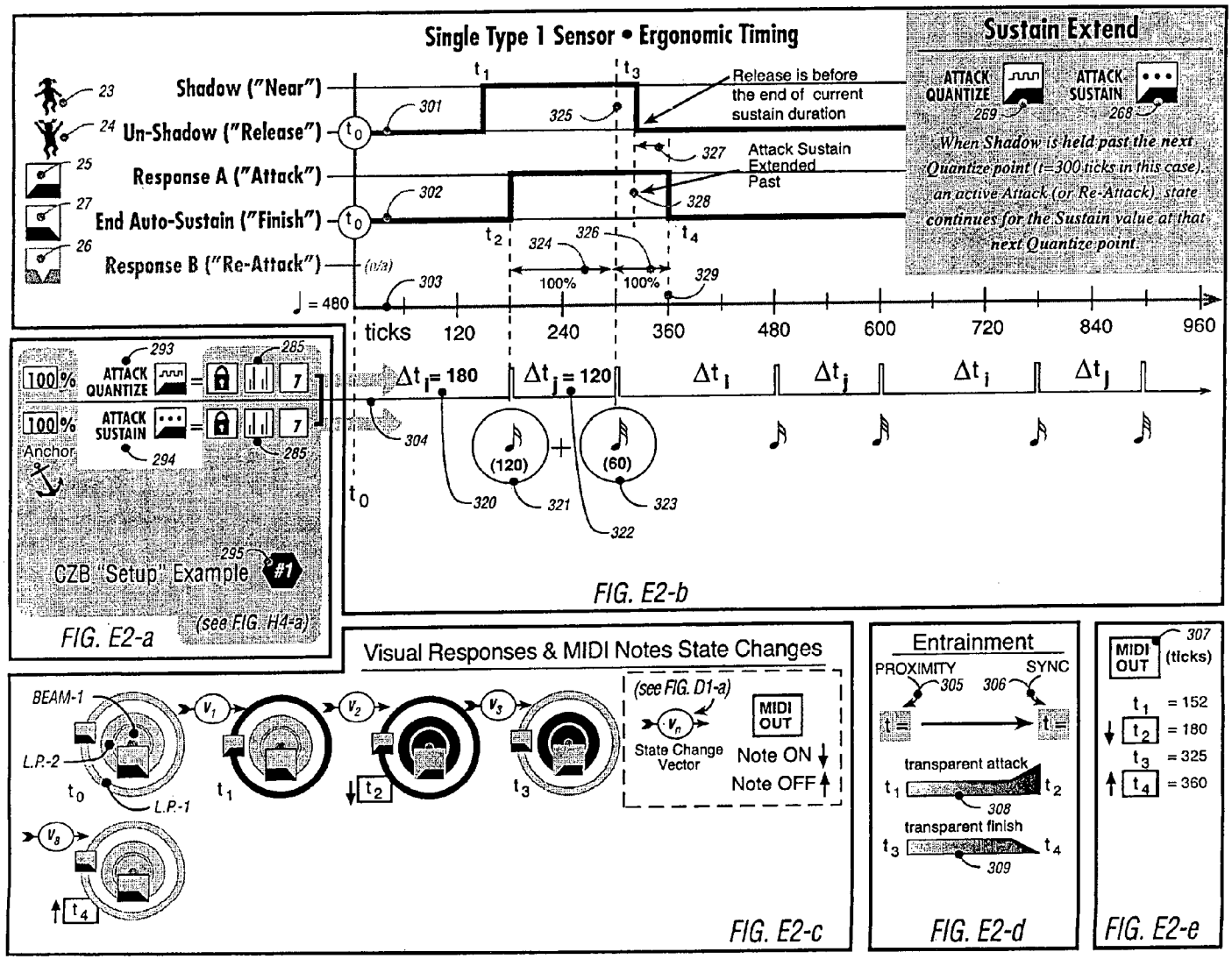

Sustain Truncate
Sheet E3
Ergonomic Timing, State Changes, MIDI Out, and Kinesthetic Sync Entrainment
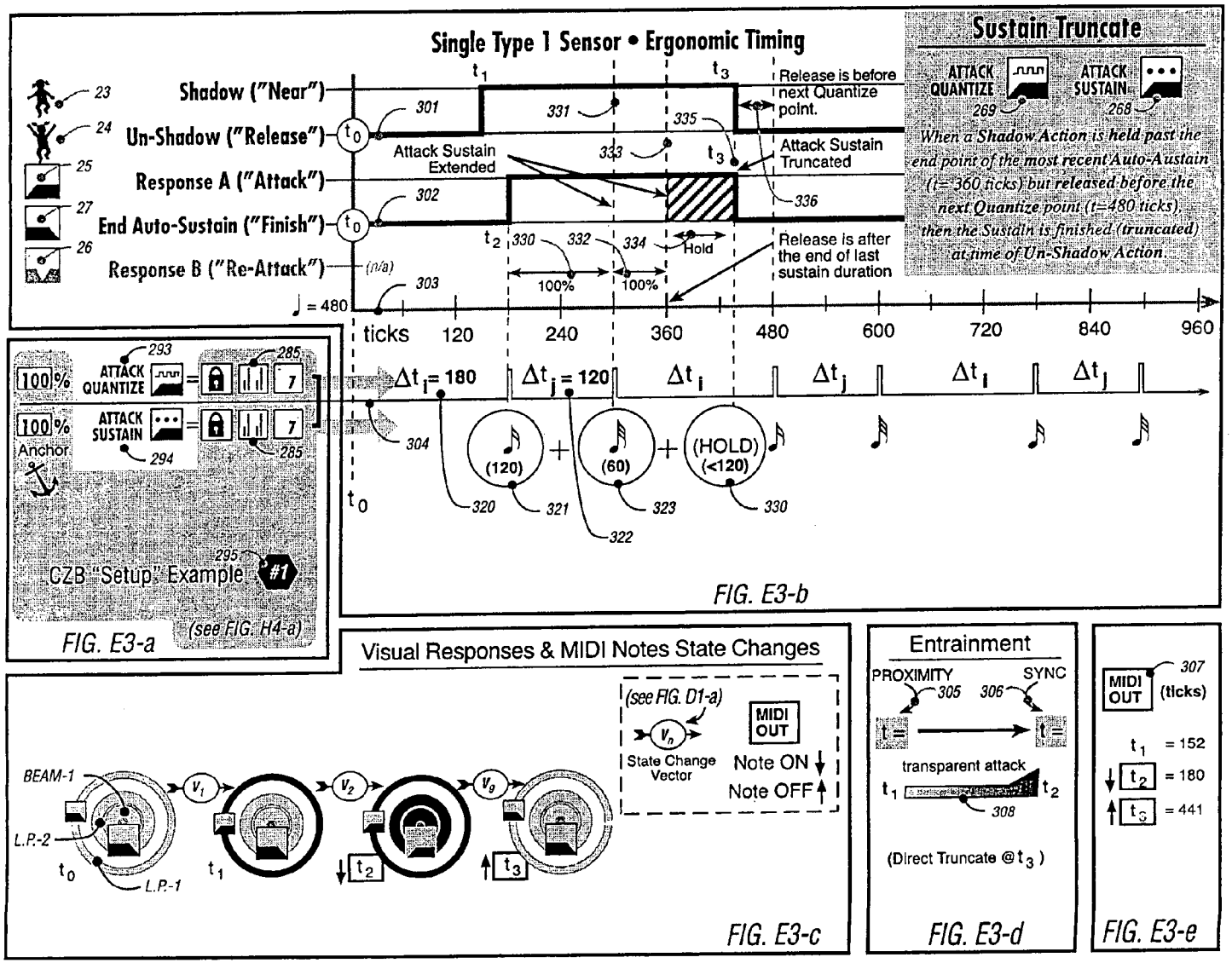

Sustain Anchor
Sheet E4
Ergonomic Timing, State Changes, MIDI Out, and Kinesthetic Sync Entrainment
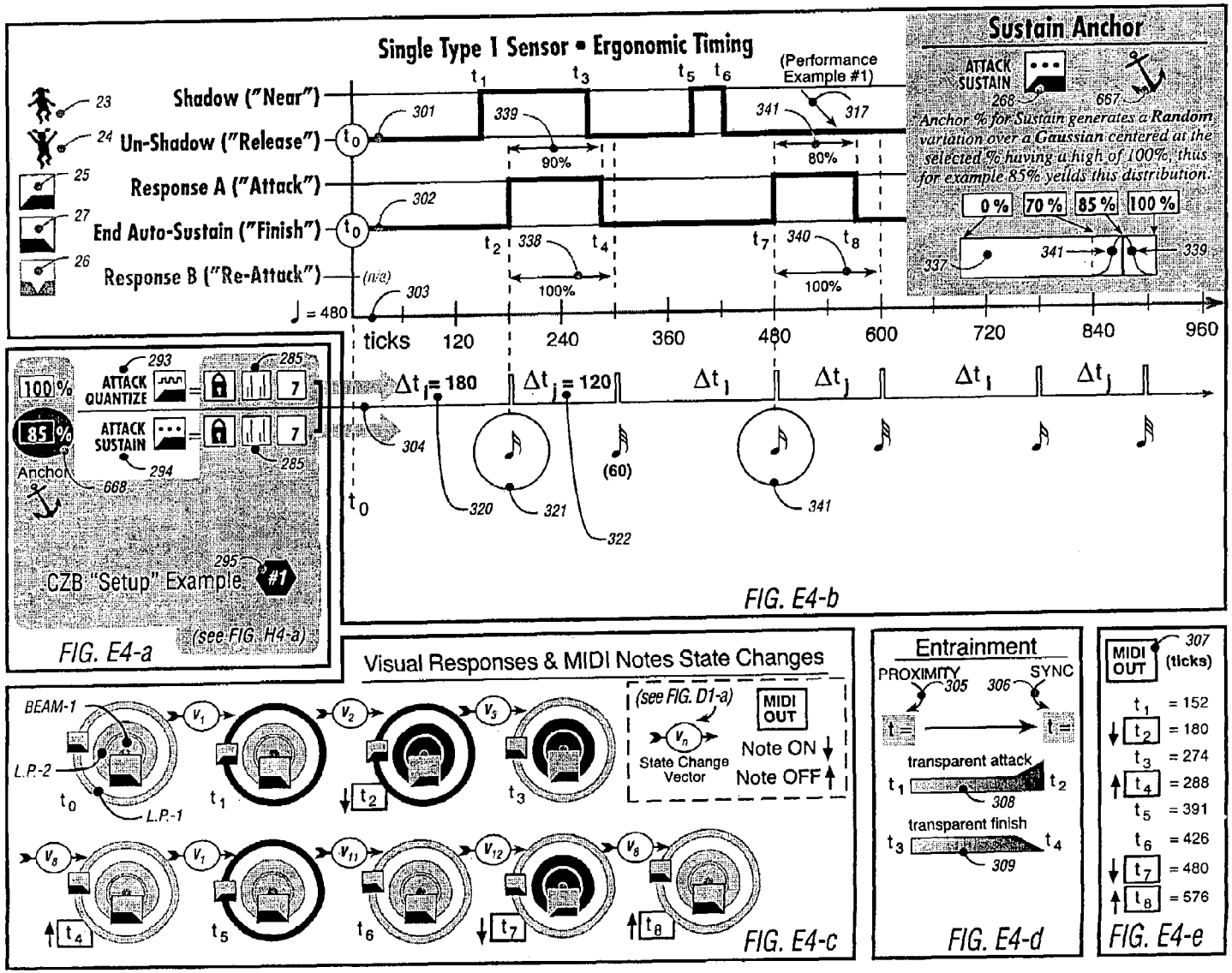

Quantize Anchor
Sheet E5
Ergonomic Timing, State Changes, MIDI Out, and Kinesthetic Sync Entrainment
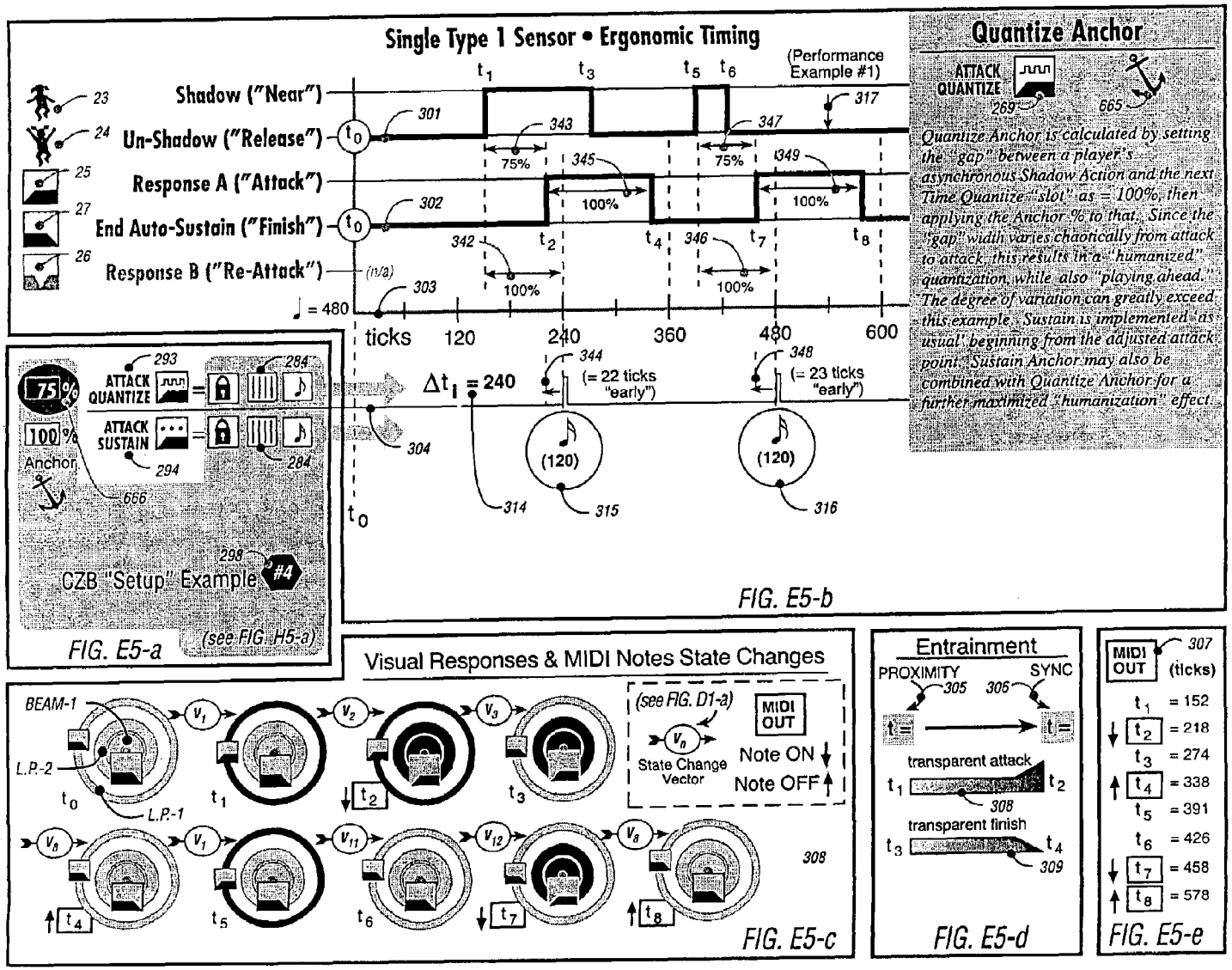

*Re-Attacks* Sheet E6
*Ergonomic Timing, State Changes, MIDI Out, and Kinesthetic Sync Entrainment*
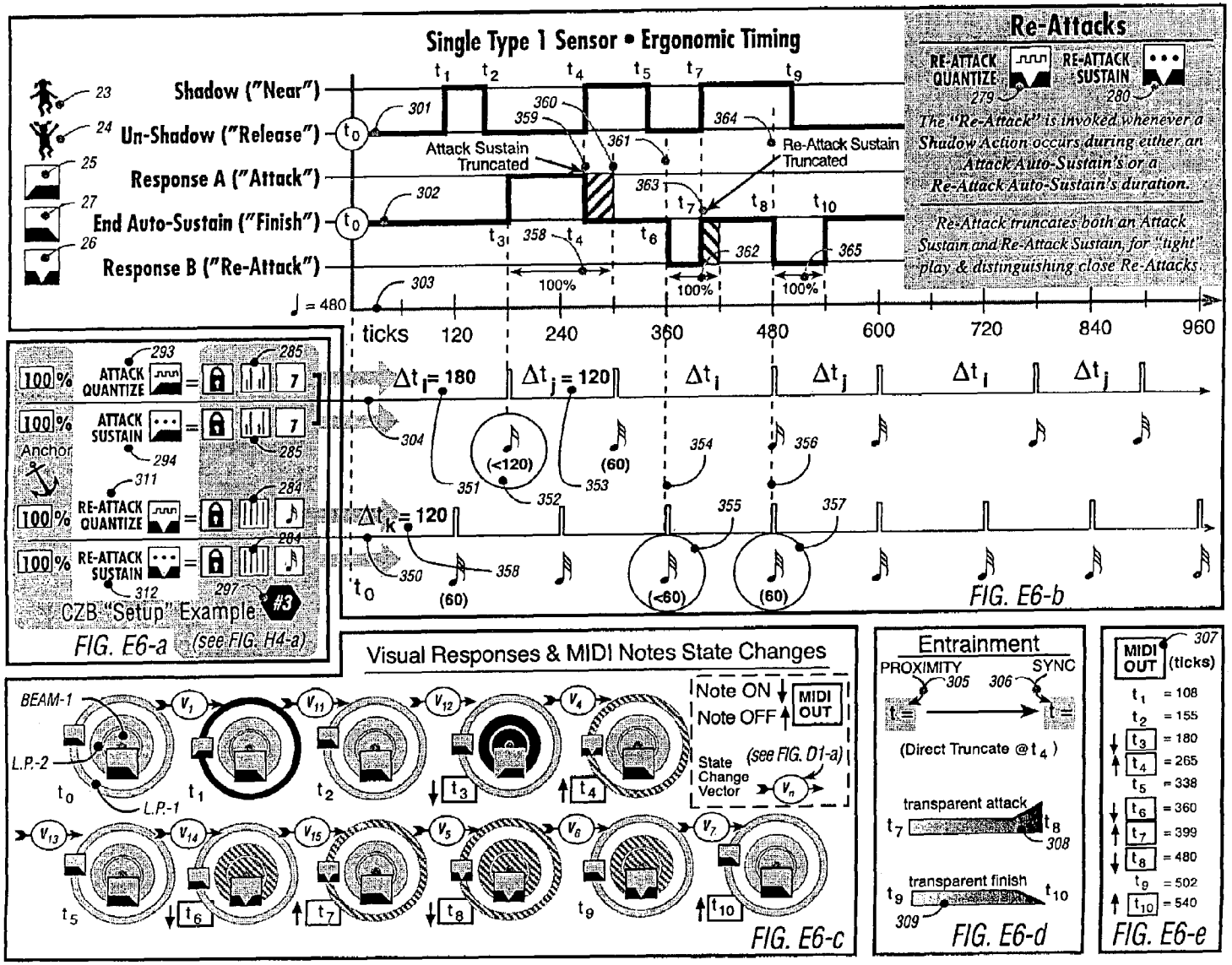

*Hybrid Quantizations* Sheet E7
*Ergonomic Timing, State Changes, MIDI Out, and Kinesthetic Sync Entrainment*
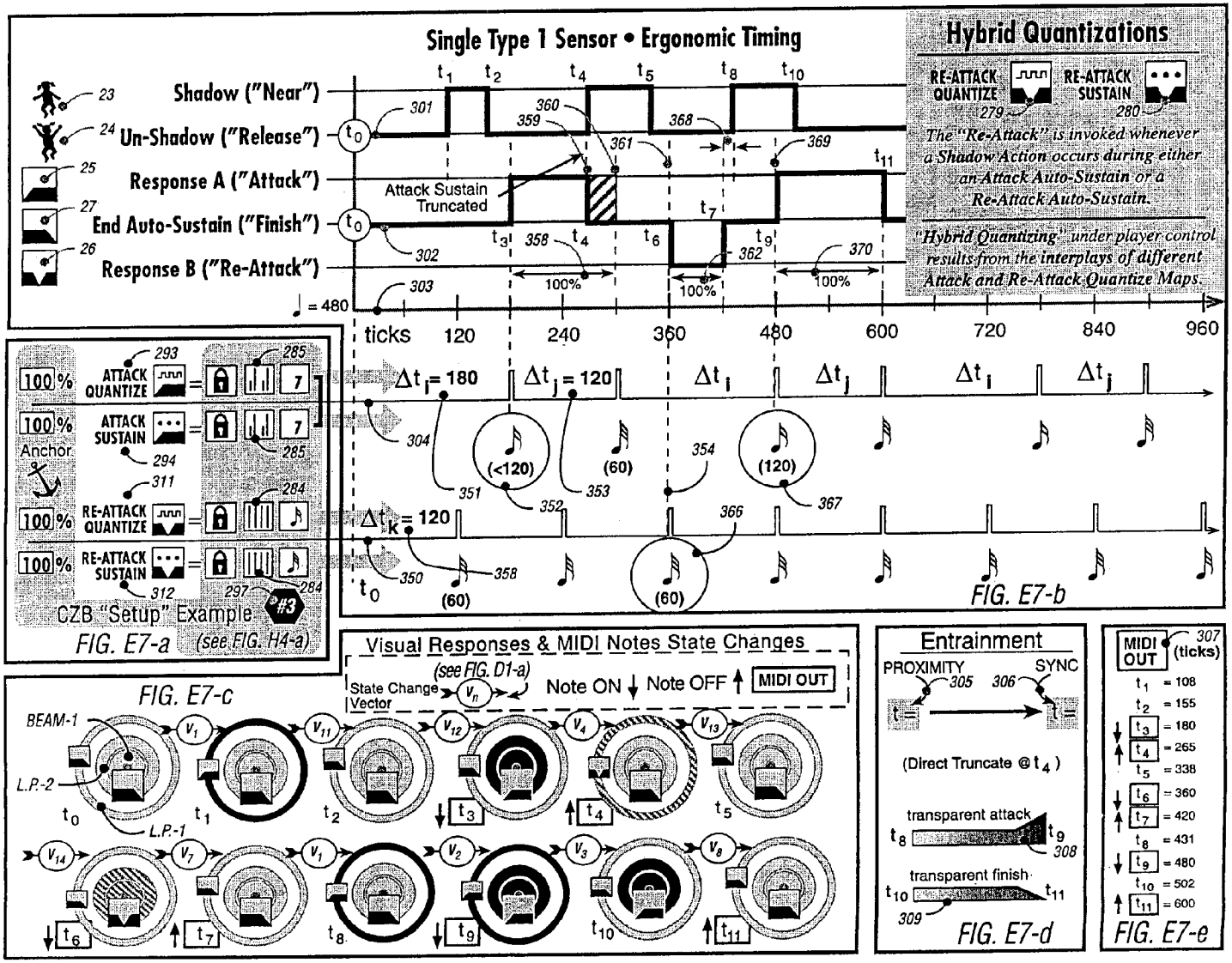

*Sustain by Attack Speed* Sheet E8
*Ergonomic Timing, State Changes, MIDI Out, and Kinesthetic Sync Entrainment*
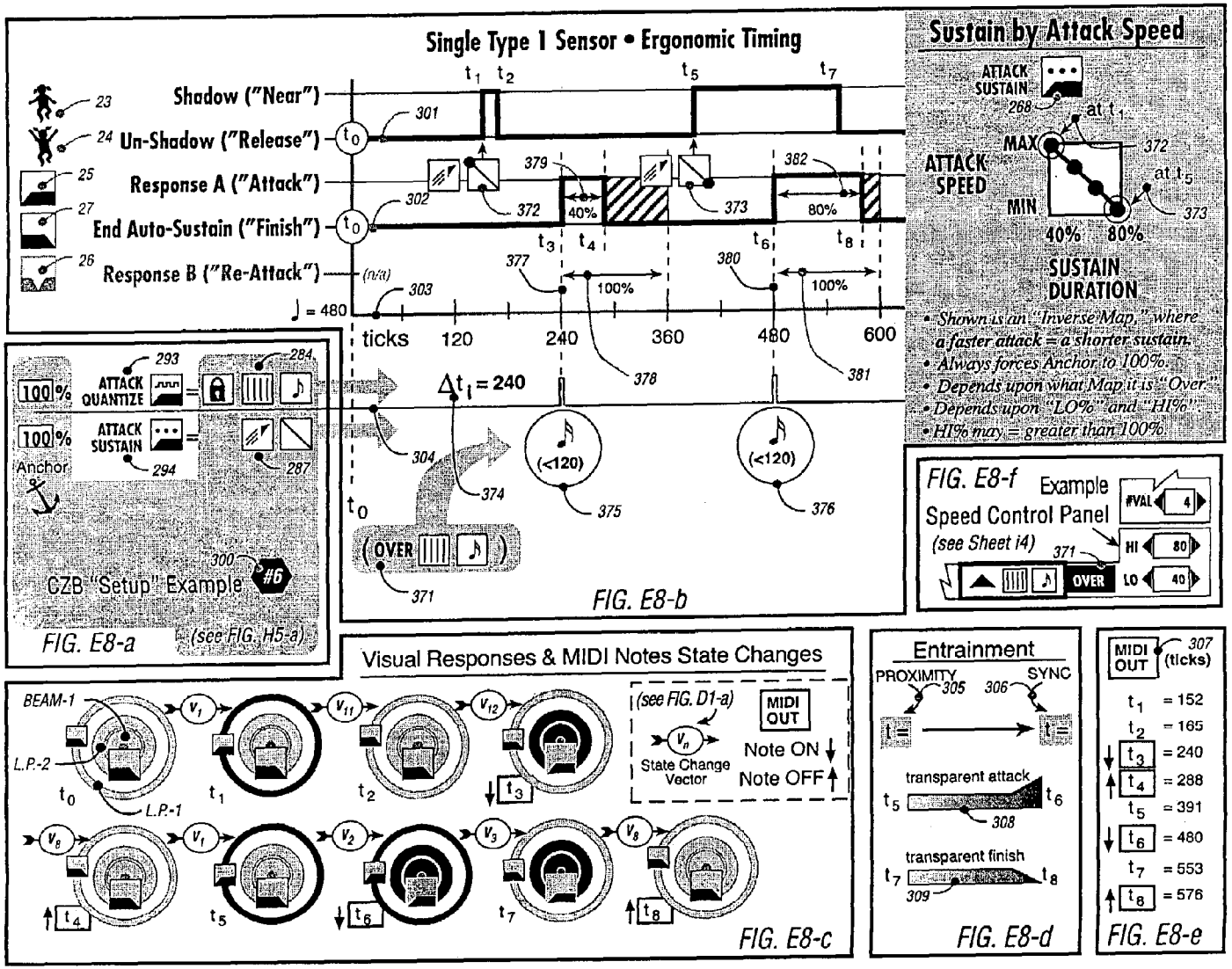

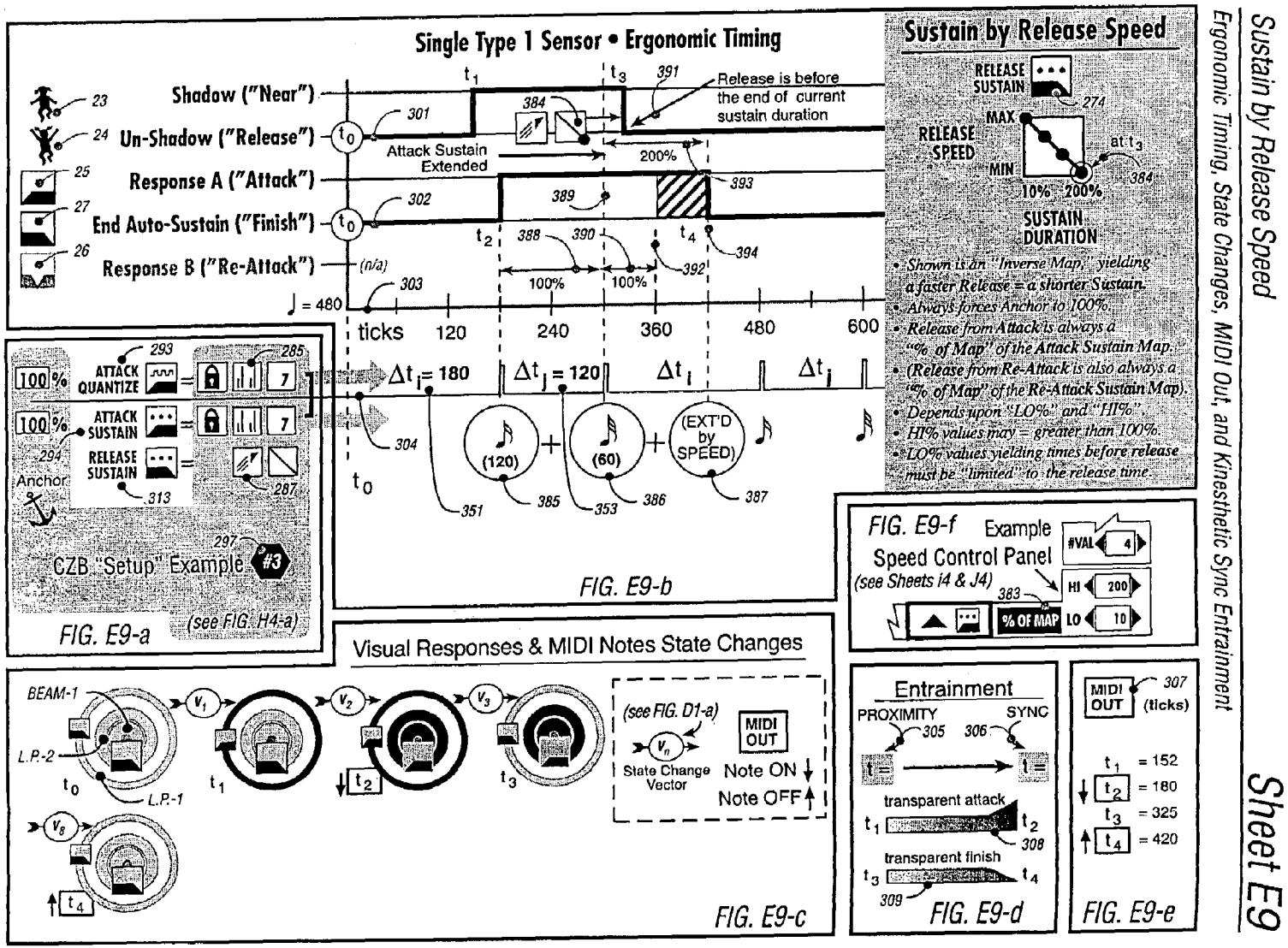
Sustain by Release Speed
Sheet E9
Ergonomic Timing, State Changes, MIDI Out, and Kinesthetic Sync Entrainment
Sustain by Release Speed
RELEASE SUSTAIN
RELEASE SPEED
MAX
MIN
10%
200%
SUSTAIN DURATION
Single Type 1 Sensor • Ergonomic Timing
Shadow ("Near")
Un-Shadow ("Release")
Response A ("Attack")
End Auto-Sustain ("Finish")
Response B ("Re-Attack")
Release is before the end of current sustain duration
Attack Sustain Extended
ticks
FIG. E9-b
FIG. E9-a
CZB "Setup" Example
(see FIG. H4-a)
Visual Responses & MIDI Notes State Changes
MIDI OUT
Note ON
Note OFF
State Change Vector
(see FIG. D1-a)
BEAM-1
L.P.-1
L.P.-2
FIG. E9-c
FIG. E9-f
Example Speed Control Panel
(see Sheets i4 & J4)
FIG. E9-e
MIDI OUT (ticks)
FIG. E9-d
Entrainment
PROXIMITY
SYNC
transparent attack
transparent finish

*Quantize by Attack Height* Sheet E10
*Ergonomic Timing, State Changes, MIDI Out, and Kinesthetic Sync Entrainment*
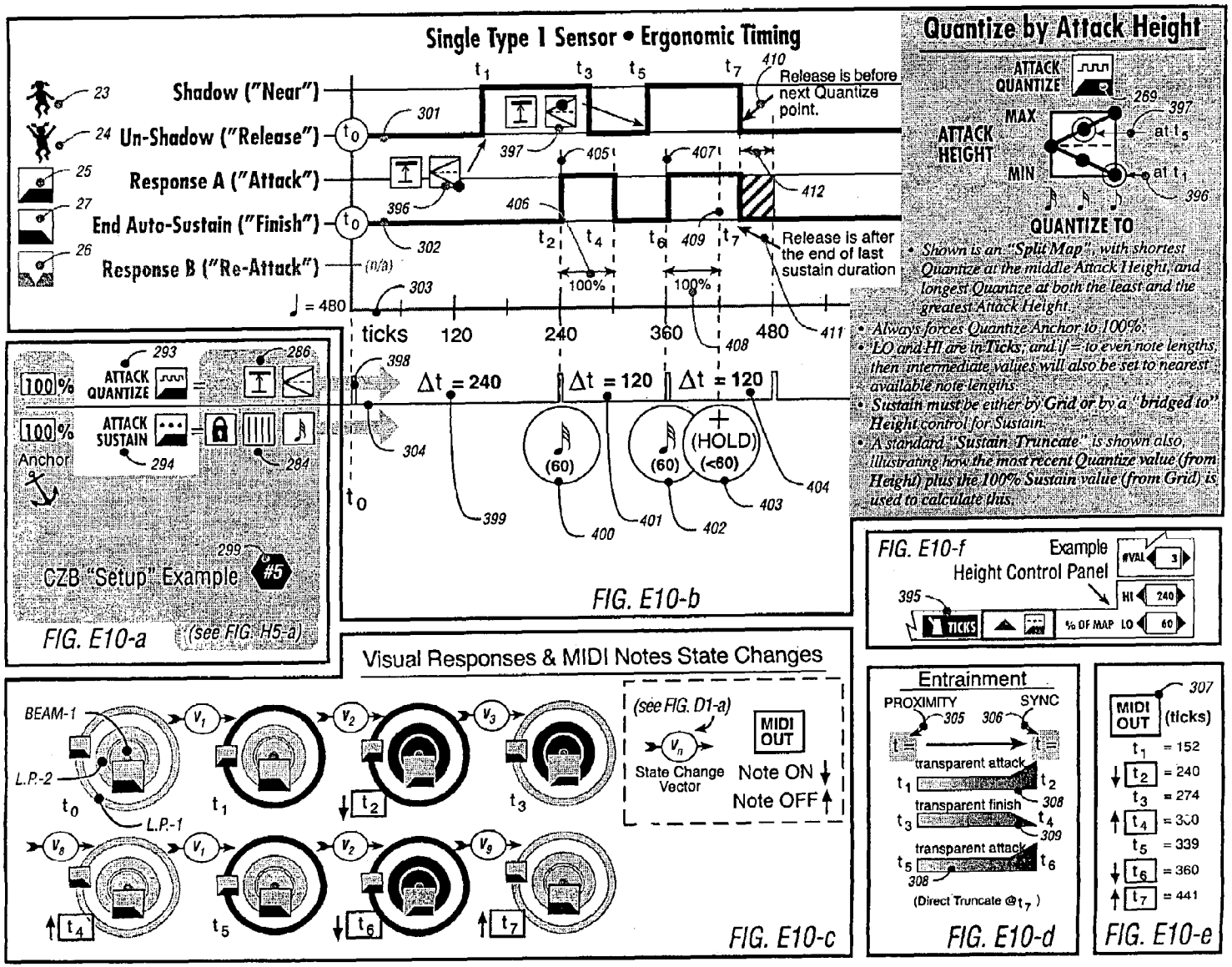

*Integrated Console Architecture* — *Sheet F1*
*Simplified Overview of Hardware & Software Partitions, and Figure Cross-Reference* — *FIG. F1-a*
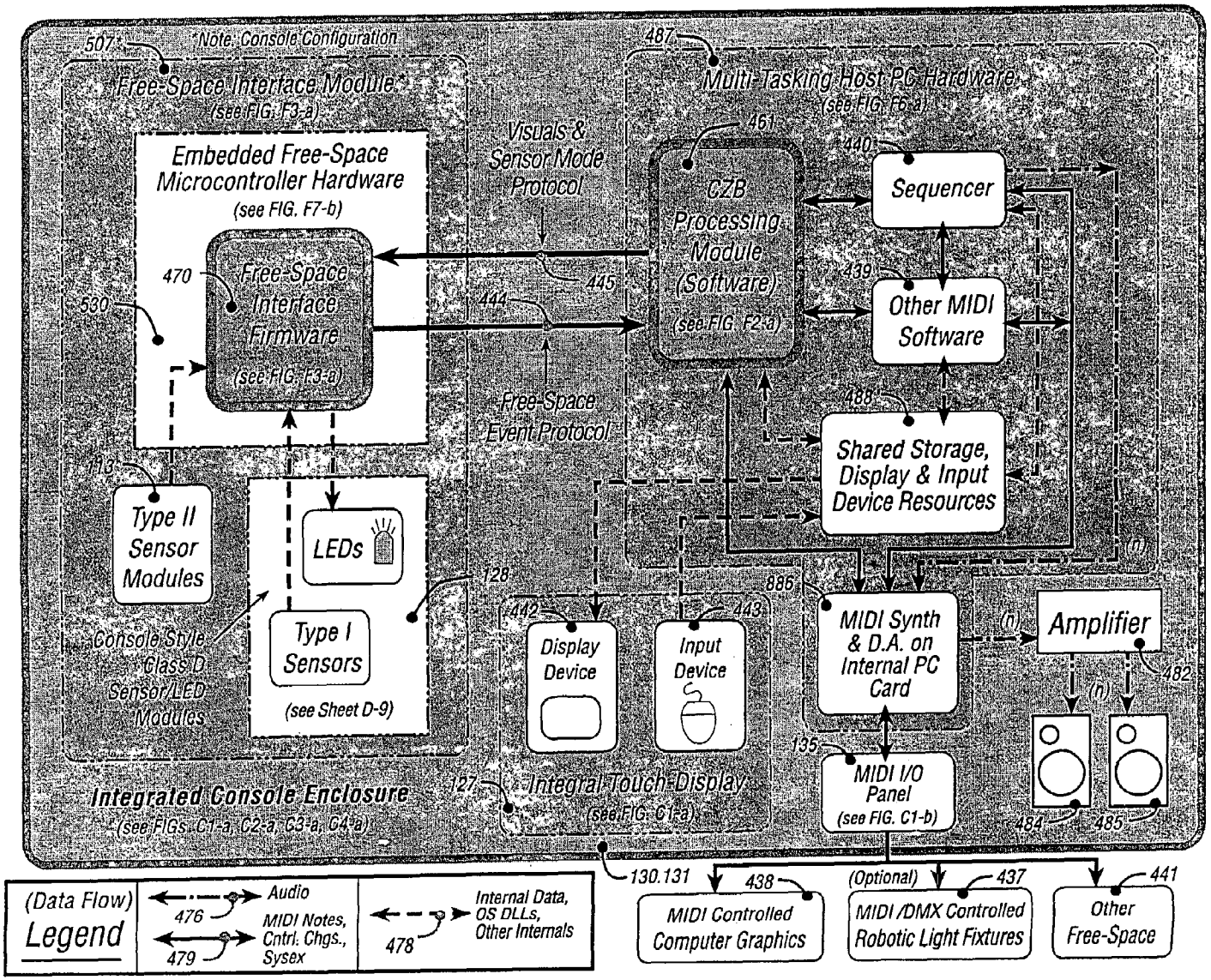

*Interface-and-Host Architecture* — *Sheet F1b*
*Simplified Overview of Hardware & Software Partitions, and Figure Cross-Reference* — *FIG. F1-b*
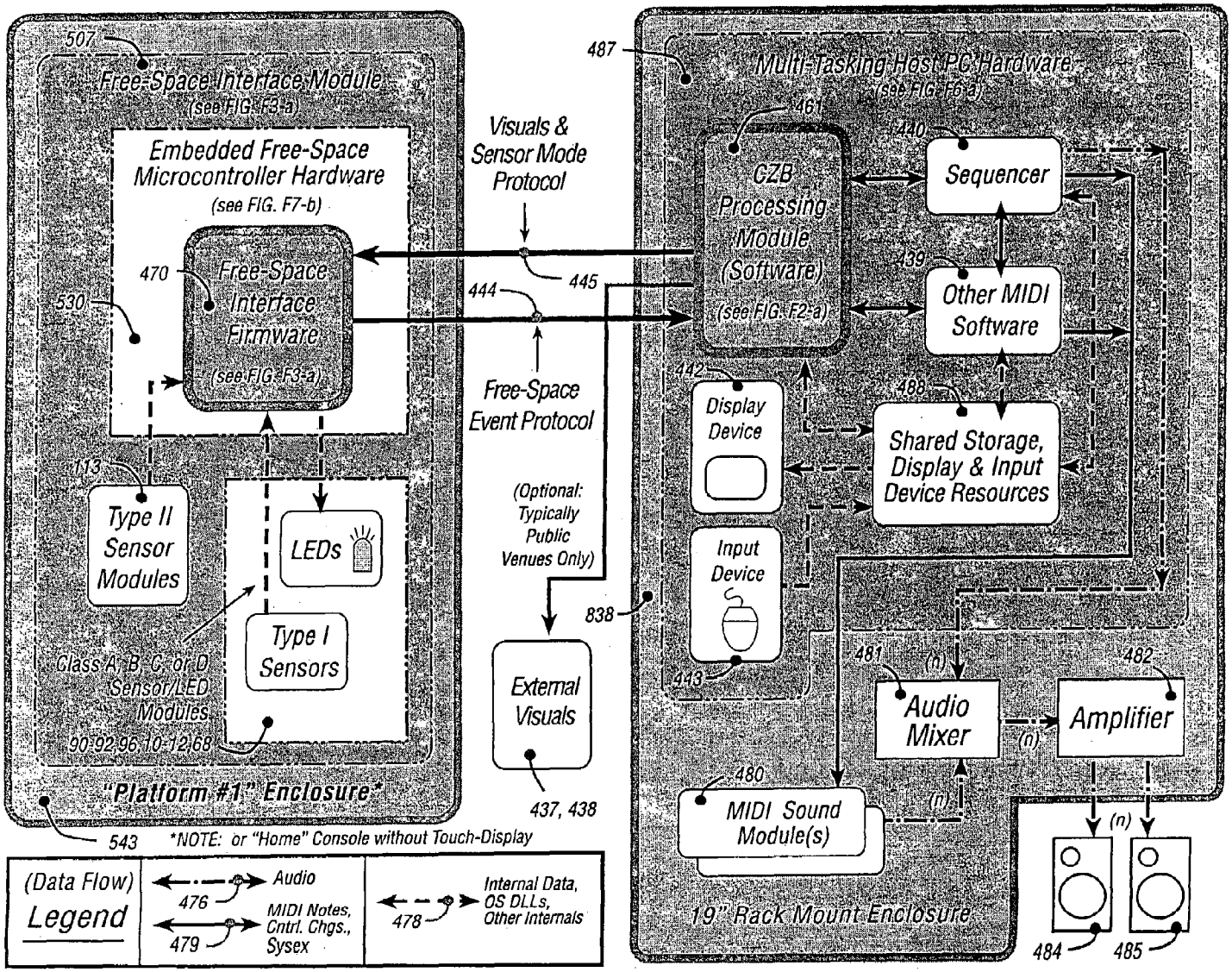

Matrix of Embodiment Variations

*Combinations of Sensor Types, LED/Light Pipe Types, PC Host/LCD, and MIDI Audio*

Sheet F1c

FIG. F1-c

| Embodiment | Type I Sensor / LED Module Type | | | | | | | | | | |
|---|---|---|---|---|---|---|---|---|---|---|---|
| | (1) A | (2) B | (3) C | (4) D | On-Axis B (5) | On-Axis D (6) | (7) Type II | (8) Integral LCD / PC | Ext. MIDI Audio | (9) Int. MIDI Audio | Form Factor |
| **PLATFORM** | | | | | | | | | | | |
| 871 Variation 1 | ✔ | | | | | | | | ✔ | | thin |
| 872 Variation 2 | | ✔ | | | | | | | ✔ | | thin |
| 873 Variation 3 | | | ✔ | | | | | | ✔ | | thin |
| 874 Variation 4 | | | | ✔ | | | | | ✔ | | thin |
| 875 Variation 5 | | ✔ | | | | | ✔ | | ✔ | | thin |
| 876 Variation 6 | | | | ✔ | | | ✔ | | ✔ | | thin |
| 877 Variation 7 | | | | | | ✔ | ✔ | | ✔ | | thick |
| **CONSOLE** | | | | | | | | | | | |
| 878 Variation 1 | | | | | ✔ | | | | ✔ | | |
| 879 Variation 2 | | | | | | ✔ | | | ✔ | | |
| 880 Variation 3 | | | | | ✔ | | ✔ | | ✔ | | |
| 881 Variation 4 | | | | | | ✔ | ✔ | | ✔ | | |
| 882 Variation 5 | | | | | ✔ | | ✔ | ✔ | | ✔ | |
| 883 Variation 6 | | | | | | ✔ | ✔ | ✔ | | ✔ | |
| 884 Variation 7 | | | | | ✔ | | ✔ | ✔ | ✔ | | |
| 885 Variation 8 | | | | | | ✔ | ✔ | ✔ | ✔ | | |

(1) See [Sheet D4]
(2) See [Sheet D5]
(3) See [Sheet D6]
(4) See [Sheet D7]
(5) See [Sheet D8]
(6) See [Sheet D9]
(7) See {Sheets B1, B2, B3, C4]
(8) See [Sheets C1, C2, C4, F1]
(9) See [Sheet F1] – item (886)

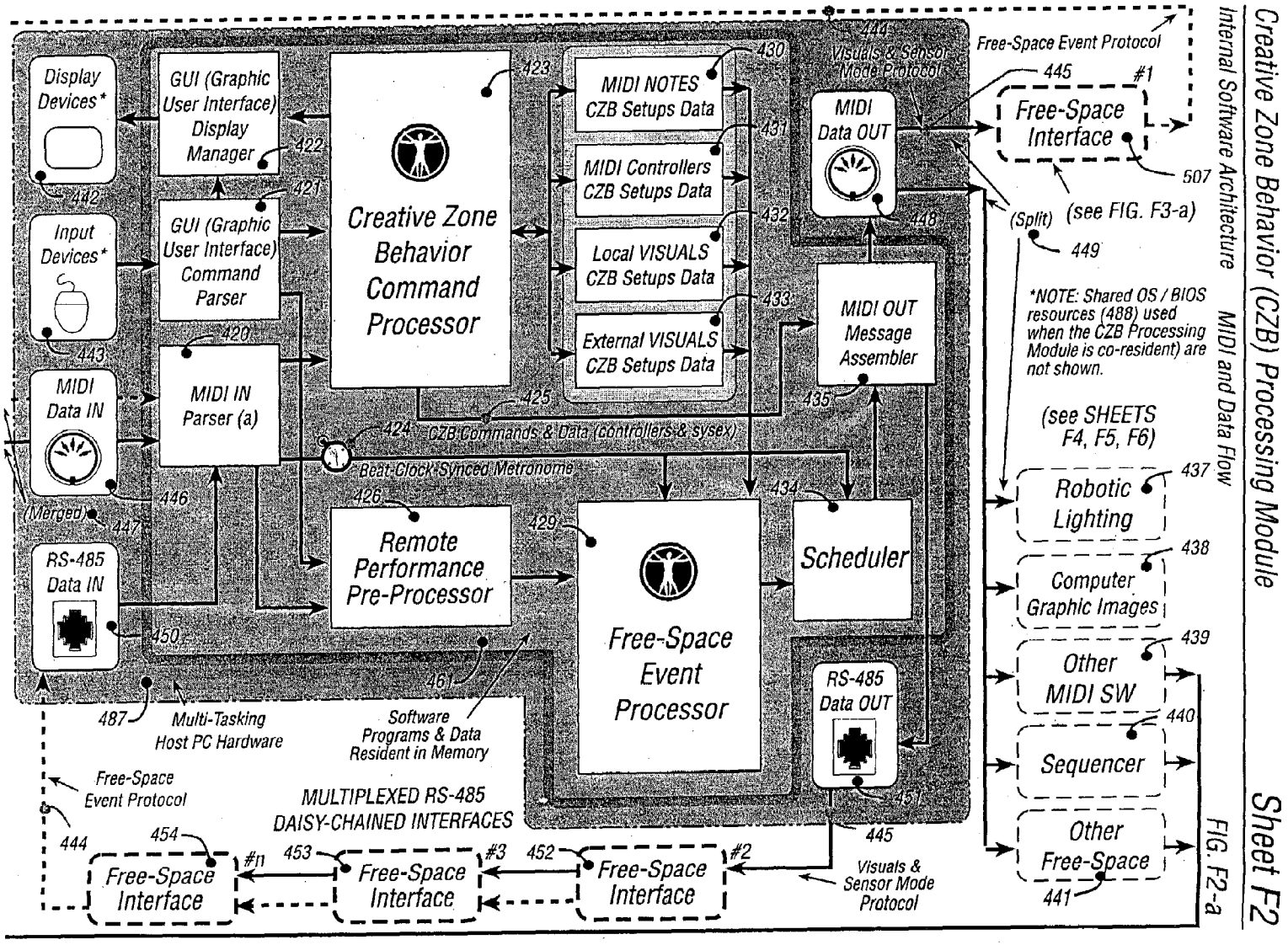
Creative Zone Behavior (CZB) Processing Module
Sheet F2
Internal Software Architecture
MIDI and Data Flow
FIG. F2-a
Free-Space Event Protocol
Free-Space Interface
#1
507
445
(see FIG. F3-a)
449
(Split)
*NOTE: Shared OS / BIOS resources (488) used when the CZB Processing Module is co-resident) are not shown.
(see SHEETS F4, F5, F6)
Robotic Lighting
437
Computer Graphic Images
438
Other MIDI SW
439
Sequencer
440
Other Free-Space
441
Visuals & Sensor Mode Protocol
444
MIDI Data OUT
448
MIDI OUT Message Assembler
435
Scheduler
434
RS-485 Data OUT
451
Visuals & Sensor Mode Protocol
MIDI NOTES CZB Setups Data
430
MIDI Controllers CZB Setups Data
431
Local VISUALS CZB Setups Data
432
External VISUALS CZB Setups Data
433
Free-Space Event Processor
429
Free-Space Interface
#2
452
Creative Zone Behavior Command Processor
423
CZB Commands & Data (Controllers & Sysex)
425
Beat-Clock-Synced Metronome
424
Remote Performance Pre-Processor
426
Software Programs & Data Resident in Memory
461
MULTIPLEXED RS-485 DAISY-CHAINED INTERFACES
Free-Space Interface
#3
453
GUI (Graphic User Interface) Display Manager
422
GUI (Graphic User Interface) Command Parser
421
MIDI IN Parser (a)
420
Free-Space Interface
#n
454
Multi-Tasking Host PC Hardware
487
Free-Space Event Protocol
444
Display Devices*
442
Input Devices*
443
MIDI Data IN
446
(Merged)
447
RS-485 Data IN
450

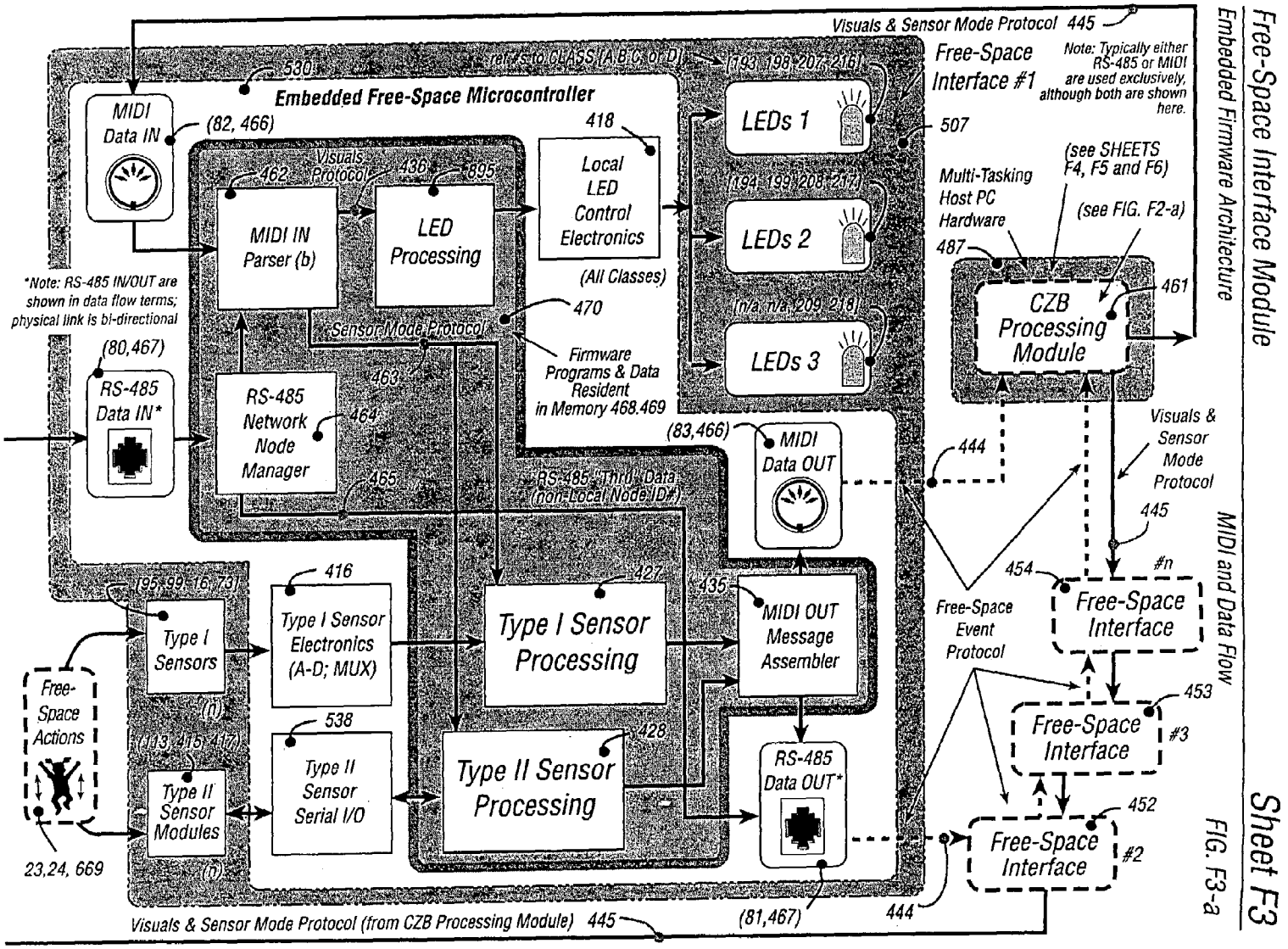
Free-Space Interface Module
Sheet F3
Embedded Firmware Architecture
MIDI and Data Flow
FIG. F3-a
Visuals & Sensor Mode Protocol 445
Note: Typically either RS-485 or MIDI are used exclusively, although both are shown here.
Free-Space Interface #1
(see SHEETS F4, F5 and F6)
(see FIG. F2-a)
Multi-Tasking Host PC Hardware
CZB Processing Module
Visuals & Sensor Mode Protocol
Free-Space Interface #n
Free-Space Interface #3
Free-Space Interface #2
Free-Space Event Protocol
LEDs 1
LEDs 2
LEDs 3
MIDI Data OUT
MIDI OUT Message Assembler
RS-485 Data OUT*
Embedded Free-Space Microcontroller
Local LED Control Electronics
(All Classes)
Firmware Programs & Data Resident in Memory 468,469
LED Processing
MIDI IN Parser (b)
RS-485 Network Node Manager
Type I Sensor Processing
Type II Sensor Processing
Type I Sensor Electronics (A-D; MUX)
Type II Sensor Serial I/O
MIDI Data IN
RS-485 Data IN*
Type I Sensors
Type II Sensor Modules
Free-Space Actions
Visuals & Sensor Mode Protocol (from CZB Processing Module) 445
*Note: RS-485 IN/OUT are shown in data flow terms; physical link is bi-directional Global Sync Architecture: "Internal" Clock Master — Sheet F4
Co-Resident Software Block Diagram – MIDI and Data Flow – Use of Sequences
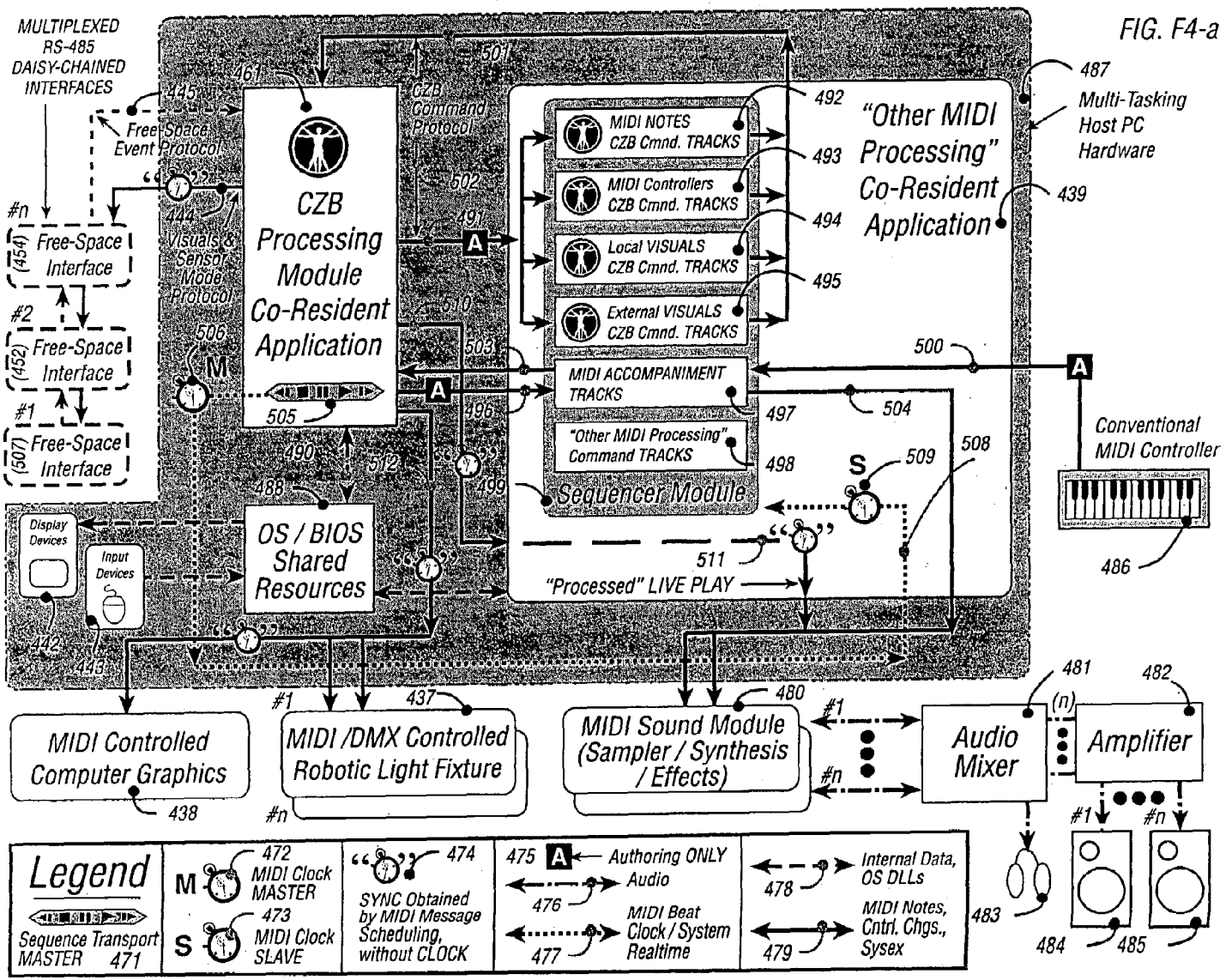

Global Sync Architecture: "CD-Audio/Other MIDI" Clock Master Sheet F5
Co-Resident Software Block Diagram – MIDI and Data Flow – Use of Sequences
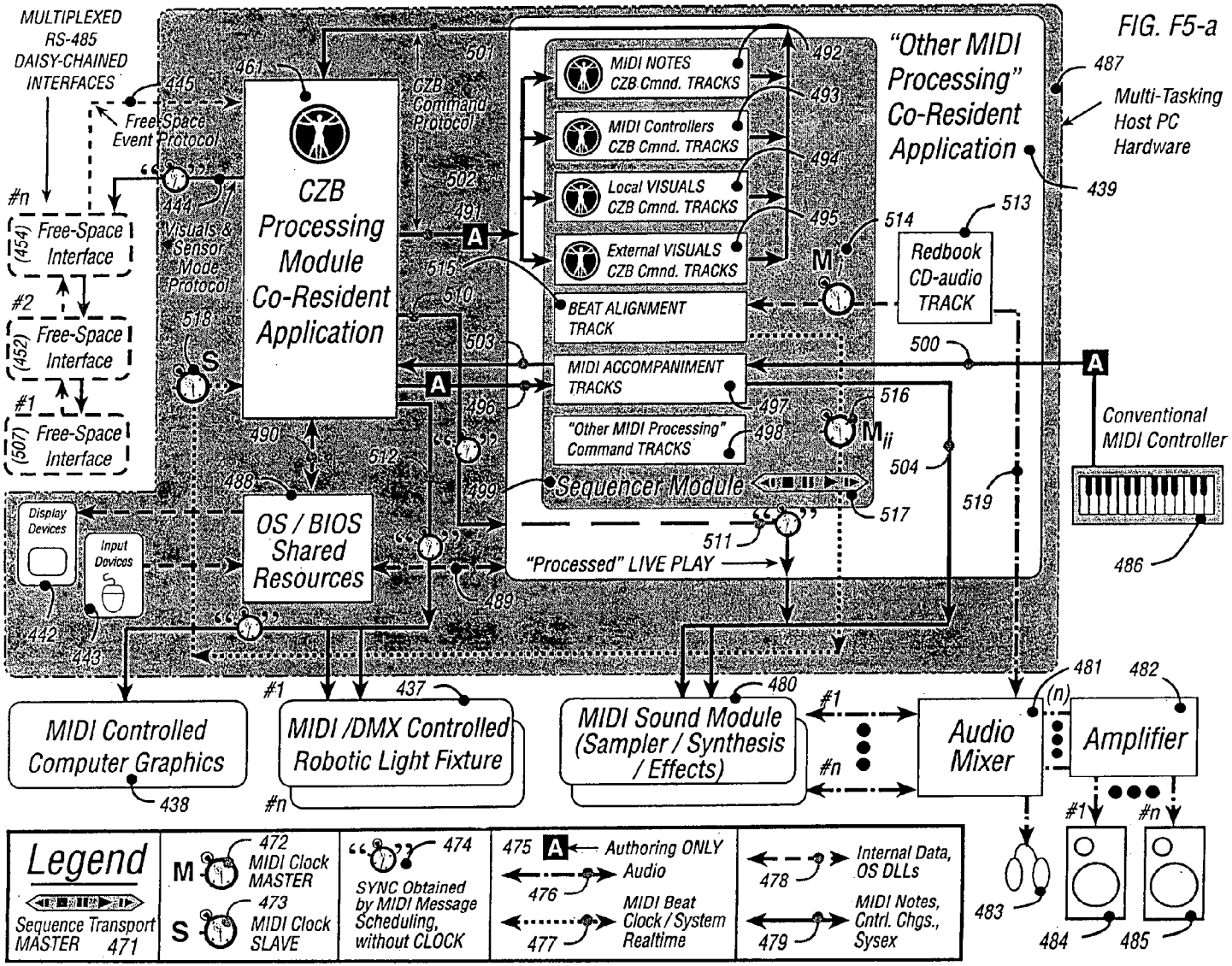

Global Sync Architecture: "Sequencer" Clock Master — Sheet F6
Co-Resident Software Block Diagram – MIDI and Data Flow – Use of Sequences
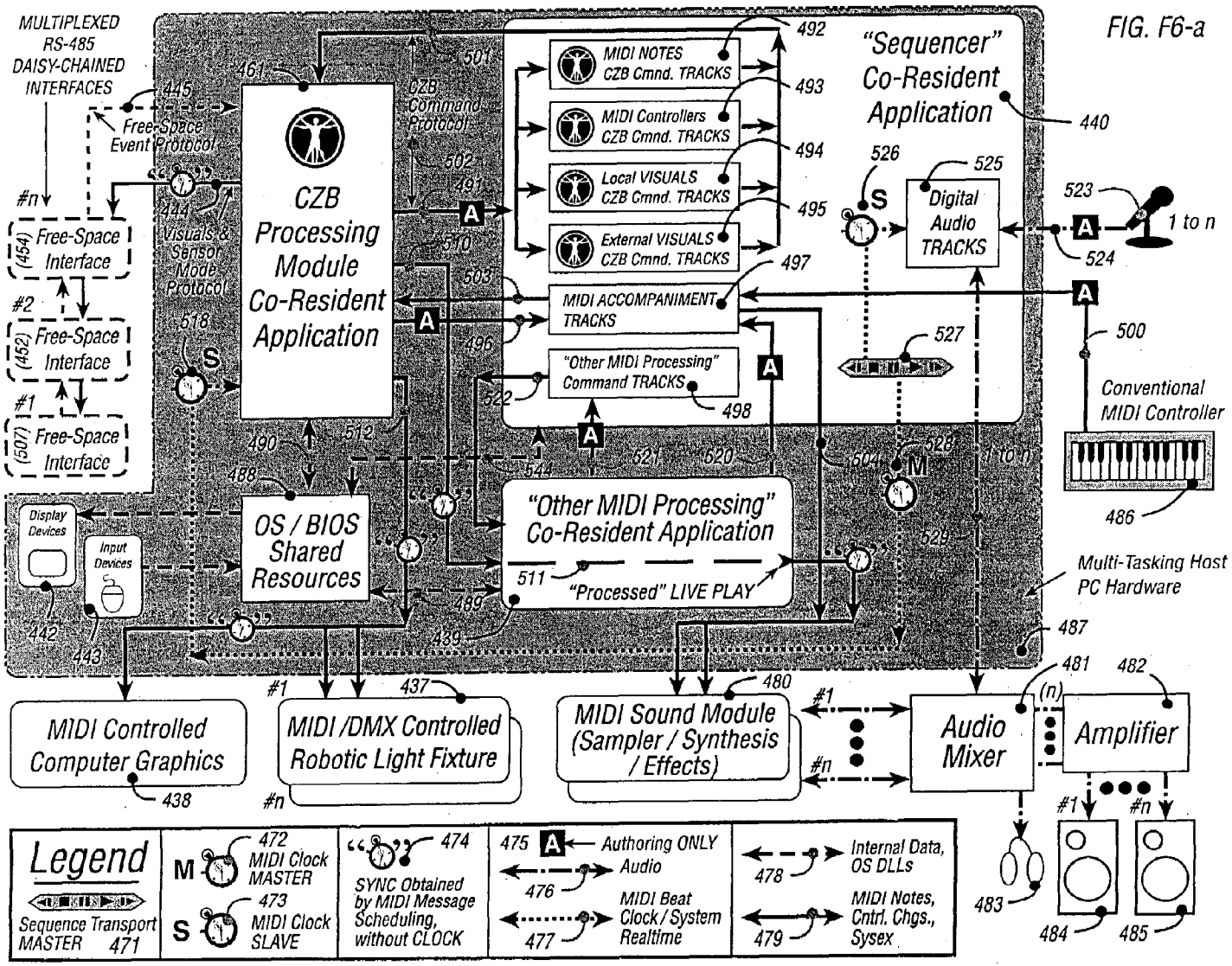

n-Zone Platform w/ Type I & II Sensors: Internal Electronics Sheet F7

Modular Hardware Overview

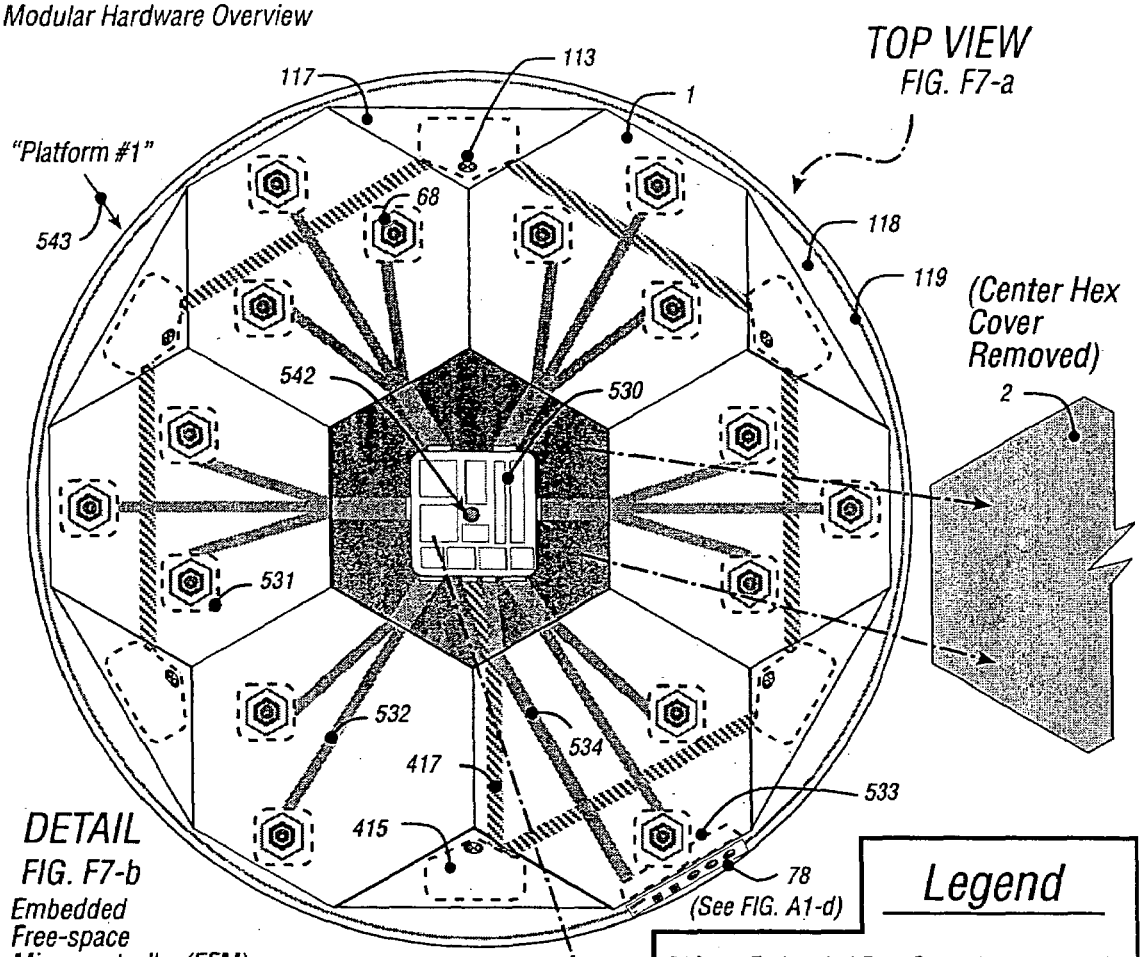

DETAIL
FIG. F7-b
Embedded Free-space Microcontroller (EFM)

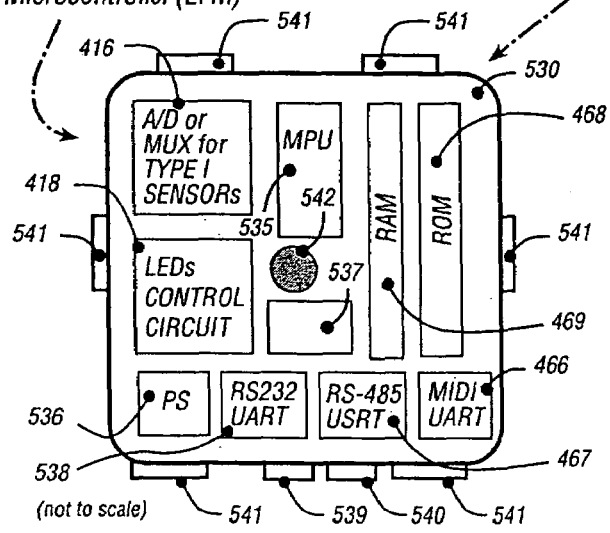

Legend

530 — Embedded Free-Space Microcontroller
531 — Type I Sensor / LED Module PCB (16)
415 — Type II Sensor Module PCB (6)
532 — Sensor/LED PCB's: Cable to EFM PCB
417 — Type II PCB's: Serial Cables
78 — Power, MIDI, RS-485 Front Panel
533 — PCB for Front Panel
534 — EFM PCB Cable to Front Panel PCB
535 — 68HCxx (or similar) Microprocessor
469 — RAM (Volatile Memory)
468 — ROM (Non-Volatile) Program/Data Store
536 — Power Supply
416 — Analog-to-Digital Converter & Mux
418 — LEDs Control Circuit
537 — Misc. "glue" and bus control logic
538 — RS-232 Serial Transciever
467 — RS-485 Network Transciever
466 — MIDI Transciever
539 — Serial Connector to Type II Cable
540 — Connector to Cable to Front Panel PCB
541 — Connector to Sensor/LED PCB Cable
542 — Hole for Center Cover Support Post

*Creative Zone Behaviors: 3-Way 'Synesthesia'* *Sheet G1*
*Relationship of Accompaniment and Creative Zone Commands to Perceived "Synesthesia"*
*CONCEPTUAL VIEW*
*FIG. G1-a*
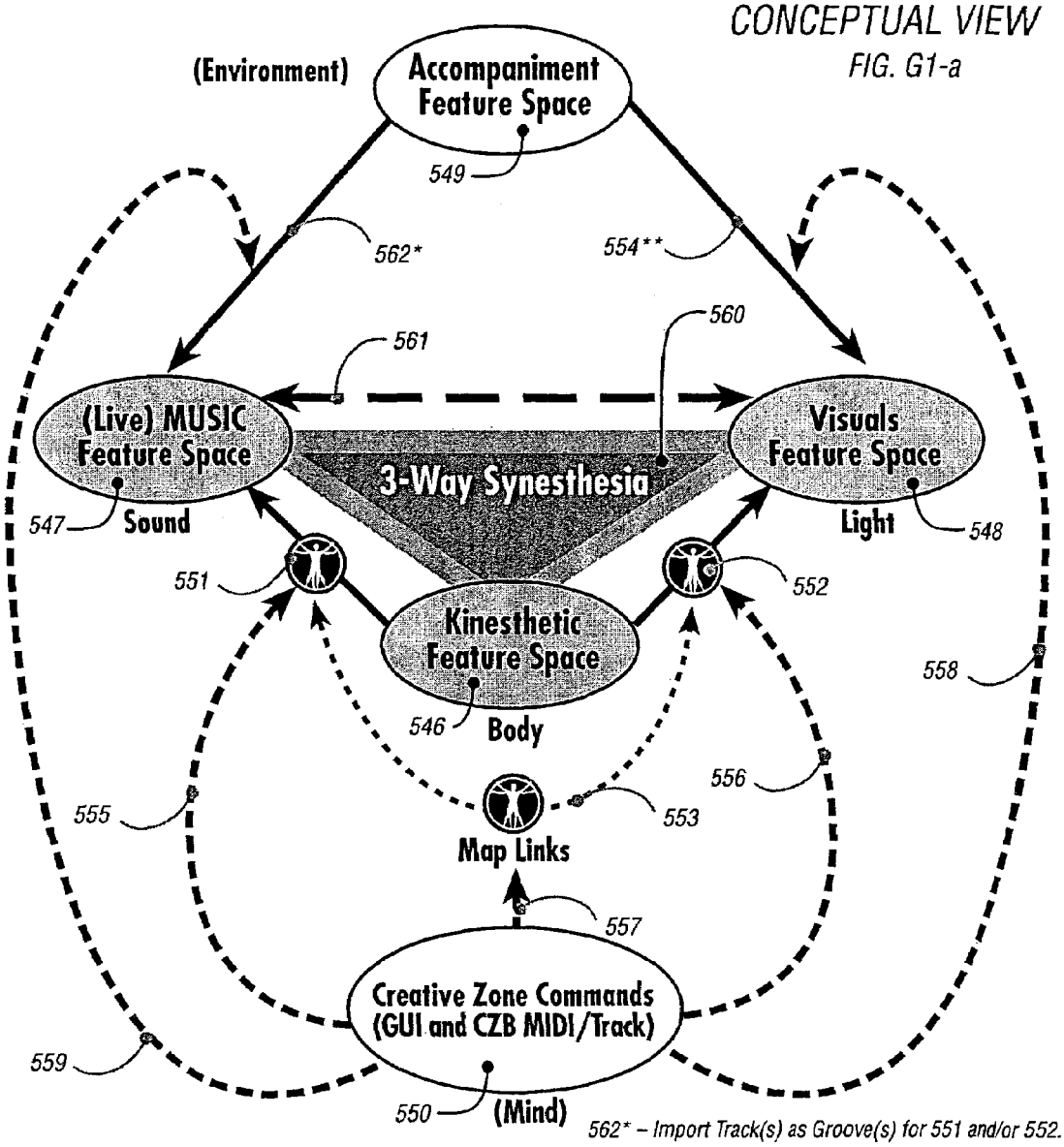
*562* – Import Track(s) as Groove(s) for 551 and/or 552.*
*554** – Lock Parameter to MIDI IN for 552.*
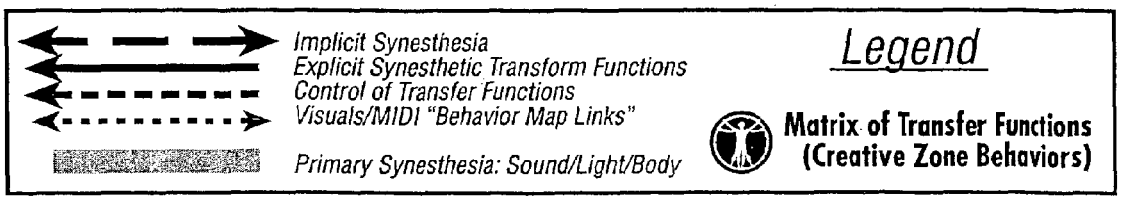

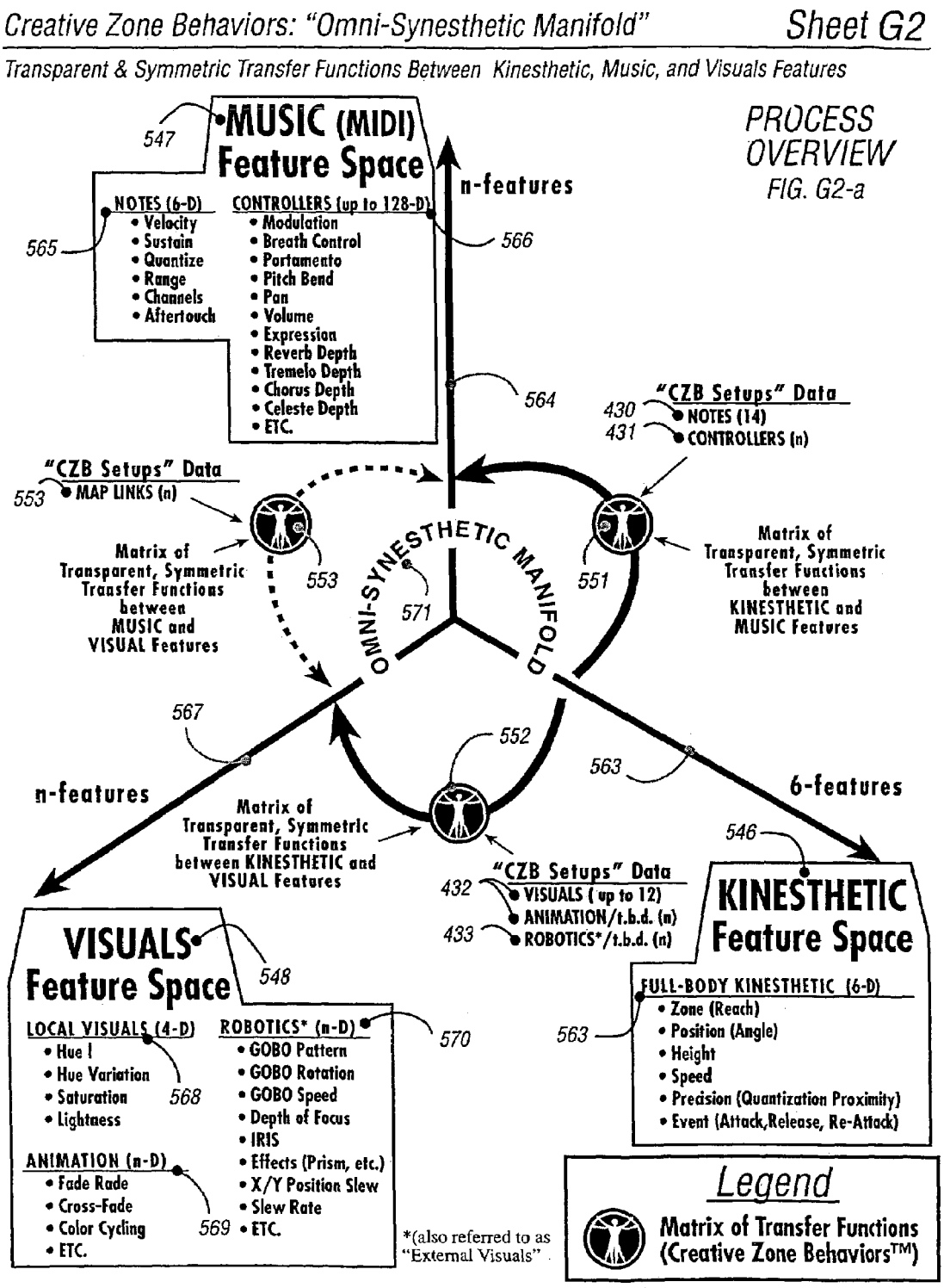
Creative Zone Behaviors: "Omni-Synesthetic Manifold"
Sheet G2
Transparent & Symmetric Transfer Functions Between Kinesthetic, Music, and Visuals Features
PROCESS OVERVIEW
FIG. G2-a
547
MUSIC (MIDI) Feature Space
n-features
NOTES (6-D)
• Velocity
• Sustain
• Quantize
• Range
• Channels
• Aftertouch
CONTROLLERS (up to 128-D)
• Modulation
• Breath Control
• Portamento
• Pitch Bend
• Pan
• Volume
• Expression
• Reverb Depth
• Tremelo Depth
• Chorus Depth
• Celeste Depth
• ETC.
565
566
564
"CZB Setups" Data
430 • NOTES (14)
431 • CONTROLLERS (n)
"CZB Setups" Data
553 • MAP LINKS (n)
Matrix of Transparent, Symmetric Transfer Functions between MUSIC and VISUAL Features
553
OMNI-SYNESTHETIC MANIFOLD
571
551
Matrix of Transparent, Symmetric Transfer Functions between KINESTHETIC and MUSIC Features
567
552
563
n-features
6-features
Matrix of Transparent, Symmetric Transfer Functions between KINESTHETIC and VISUAL Features
546
"CZB Setups" Data
432 • VISUALS (up to 12)
• ANIMATION/t.b.d. (n)
433 • ROBOTICS*/t.b.d. (n)
KINESTHETIC Feature Space
VISUALS Feature Space
548
FULL-BODY KINESTHETIC (6-D)
• Zone (Reach)
• Position (Angle)
• Height
• Speed
• Precision (Quantization Proximity)
• Event (Attack,Release, Re-Attack)
563
LOCAL VISUALS (4-D)
• Hue I
• Hue Variation
• Saturation
• Lightness
568
ROBOTICS* (n-D)
• GOBO Pattern
• GOBO Rotation
• GOBO Speed
• Depth of Focus
• IRIS
• Effects (Prism, etc.)
• X/Y Position Slew
• Slew Rate
• ETC.
570
ANIMATION (n-D)
• Fade Rade
• Cross-Fade
• Color Cycling
• ETC.
569
*(also referred to as "External Visuals")
Legend
Matrix of Transfer Functions (Creative Zone Behaviors™)

Creative Zone Behaviors: Matrix of Valid Transfer Functions
Sheet G3
Mapping From Kinesthetic to Notes & Visuals Responses
CONCEPTUAL VIEW
FIG. G3-a
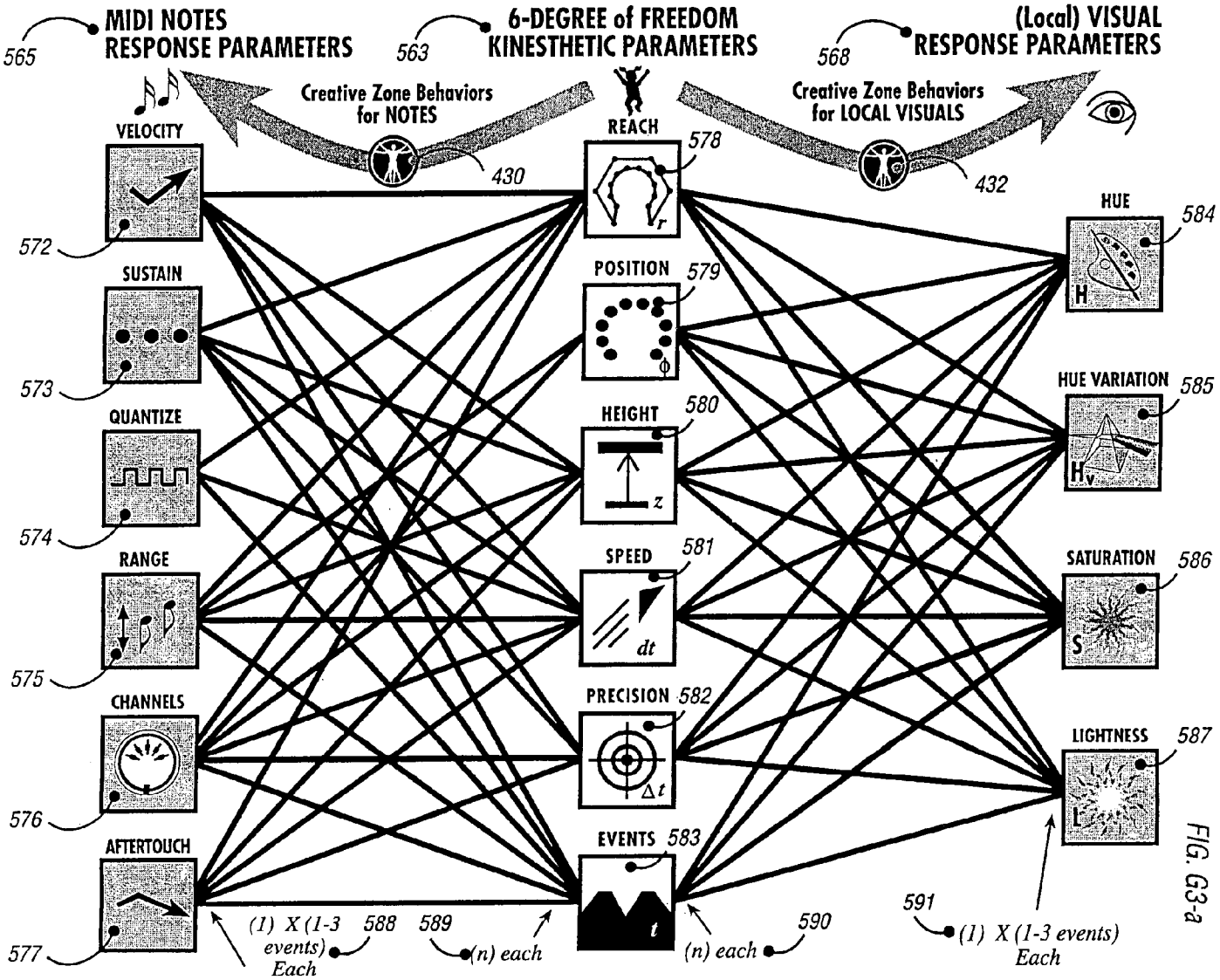

*Creative Zone Behaviors for Notes* Sheet H1
*Valid Control Types*
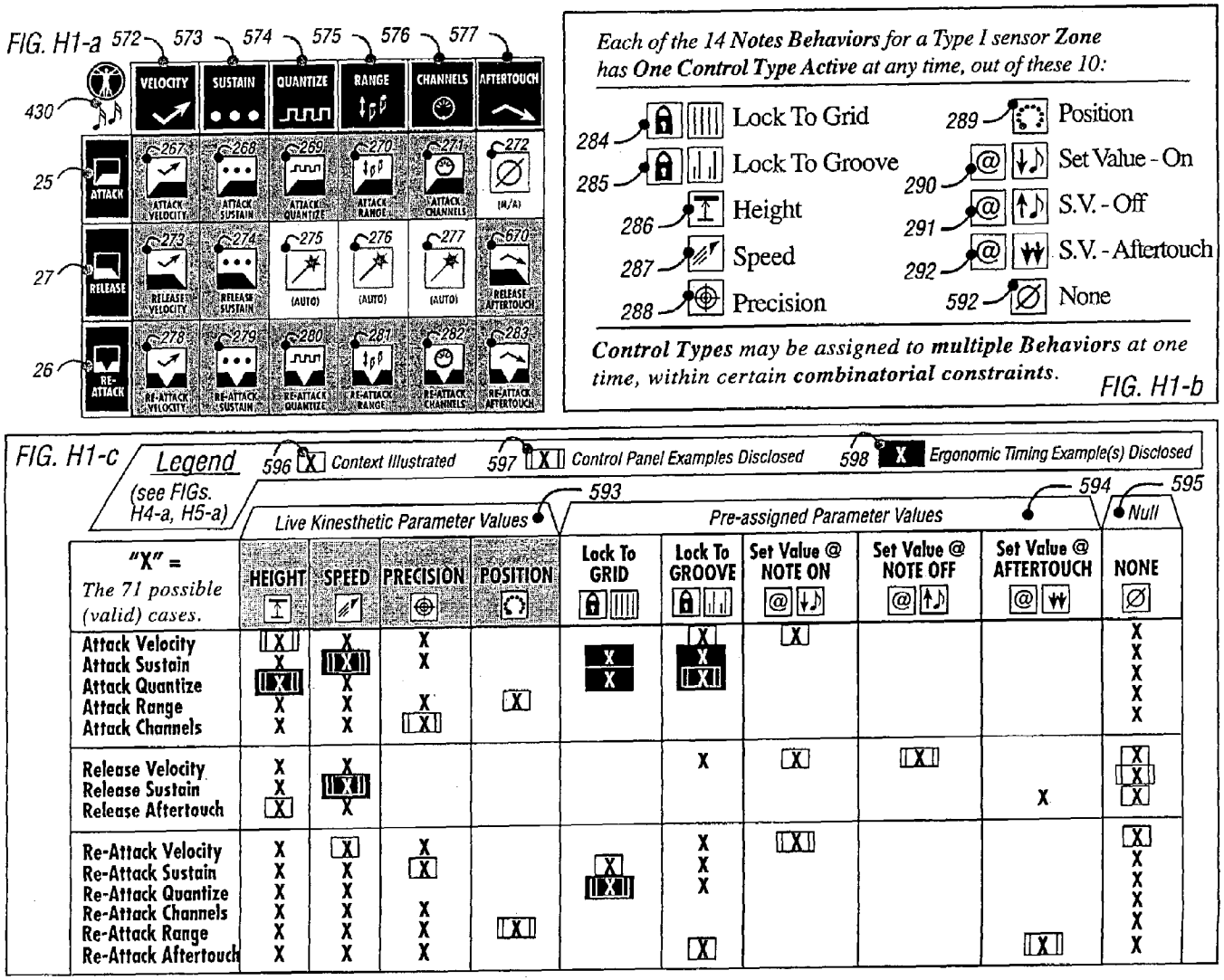

*Creative Zone Behaviors (CZB) Command Panel for Notes* Sheet H2
*Touch-Display Interface for One Zone*
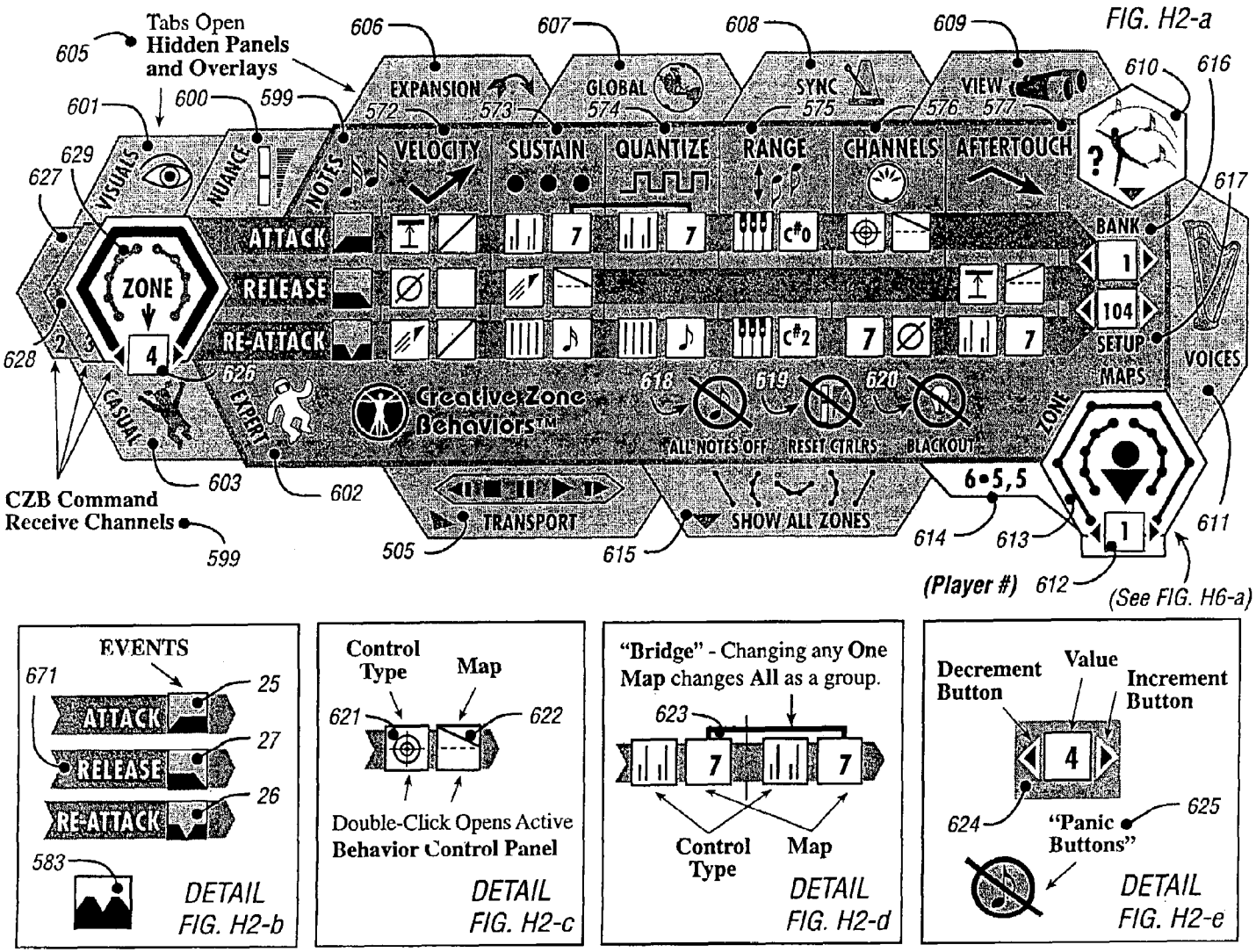

*Creative Zone Behaviors (CZB) Command Panel for Notes* Sheet H3
*Touch-Display Interface for Three Zones*
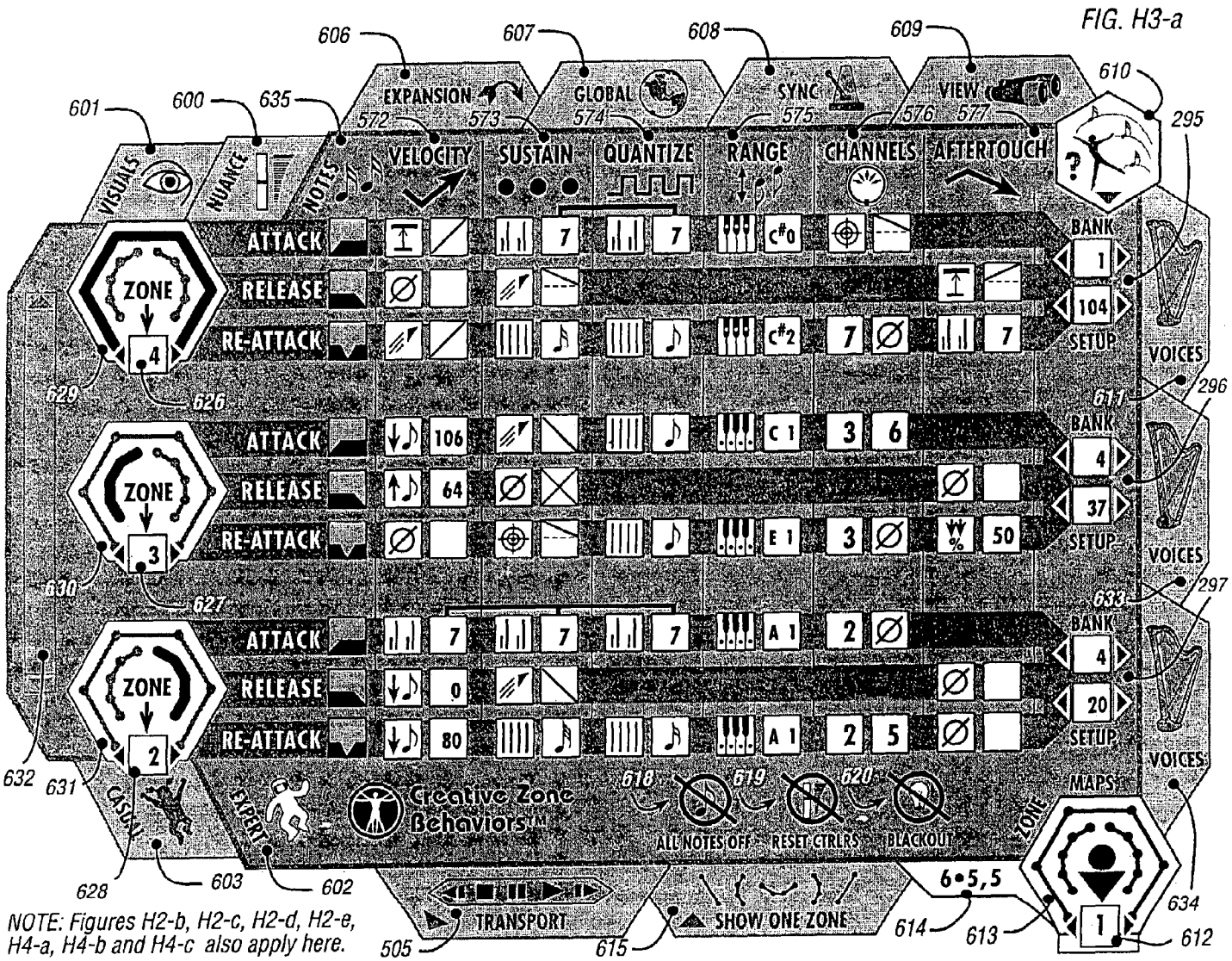
NOTE: Figures H2-b, H2-c, H2-d, H2-e, H4-a, H4-b and H4-c also apply here.

Creative Zone Behaviors (CZB) Command Panel for Notes — Sheet H4

Touch-Display Interface for Three Zones – FIGURE CROSS REFERENCE

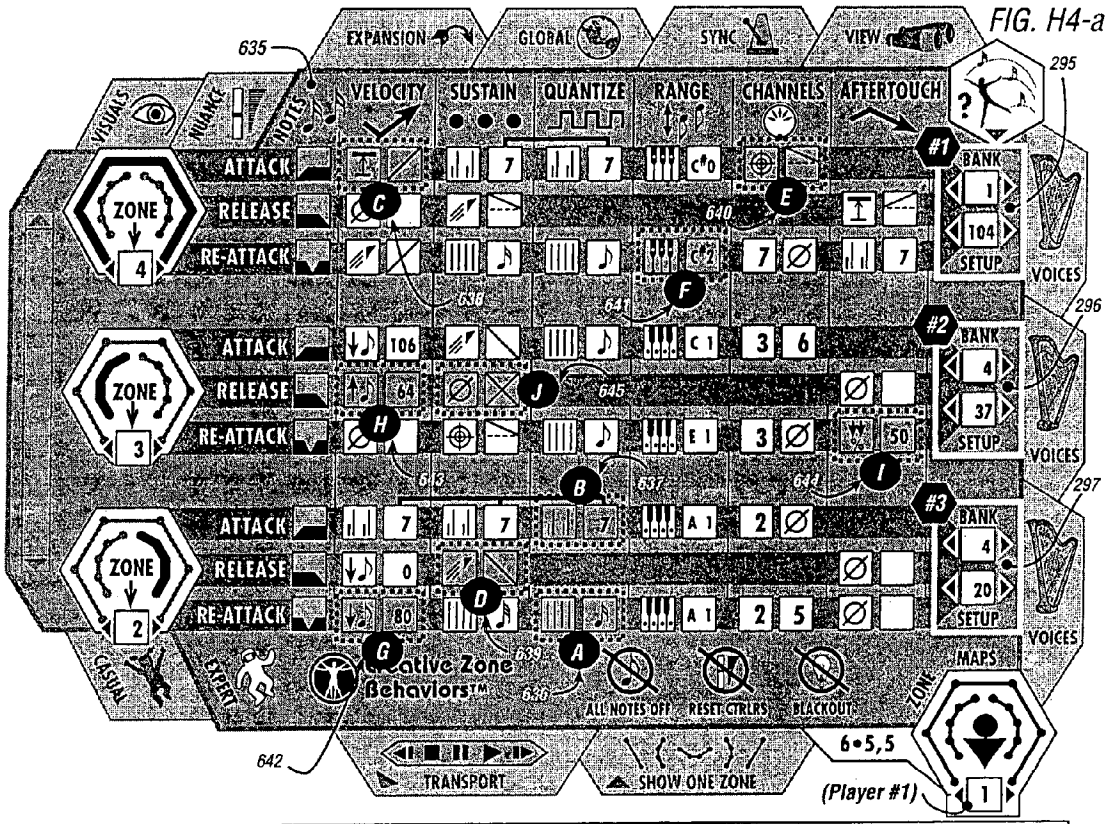

FIG. H4-b

Cross-Reference to Command Controls

| | DETAIL | APPLIED |
|---|---|---|
| A | Lock to Grid | i1, J1 |
| B | Lock to Groove | i2, J2 |
| C | Height | i3, J3 |
| D | Speed | i4, J4 |
| E | Precision | i5, J5 |
| F | Position | i6, J6 |
| G | Set Value - ON | i7, J7 |
| H | Set Value - OFF | i8, J8 |
| I | Set Value - A.T. | i9, J9 |
| J | None | i10, J10 |

(Legend to Figure H4-a) (FIG. #'s)

FIG. H4-c (Refer to Figure H4-a)

Cross-Reference to Ergonomic Timing (E Series Sheets)

(See Sheet H5 for additional references)

| | | |
|---|---|---|
| CZB "Setup" Example #1 | Attack Sustain & Attack Quantize: | E2, E3, E4 |
| CZB "Setup" Example #2 | (No E Series cross-reference to this Setup example) | |
| CZB "Setup" Example #3 | Release Sustain: | E9 |
| | Re-Attack Sustain & Re-Attack Quantize: | E6, E7 |

*Creative Zone Behaviors (CZB) Command Panel for Notes* Sheet H5

*Touch-Display Interface for Three Zones – FIGURE CROSS REFERENCE*

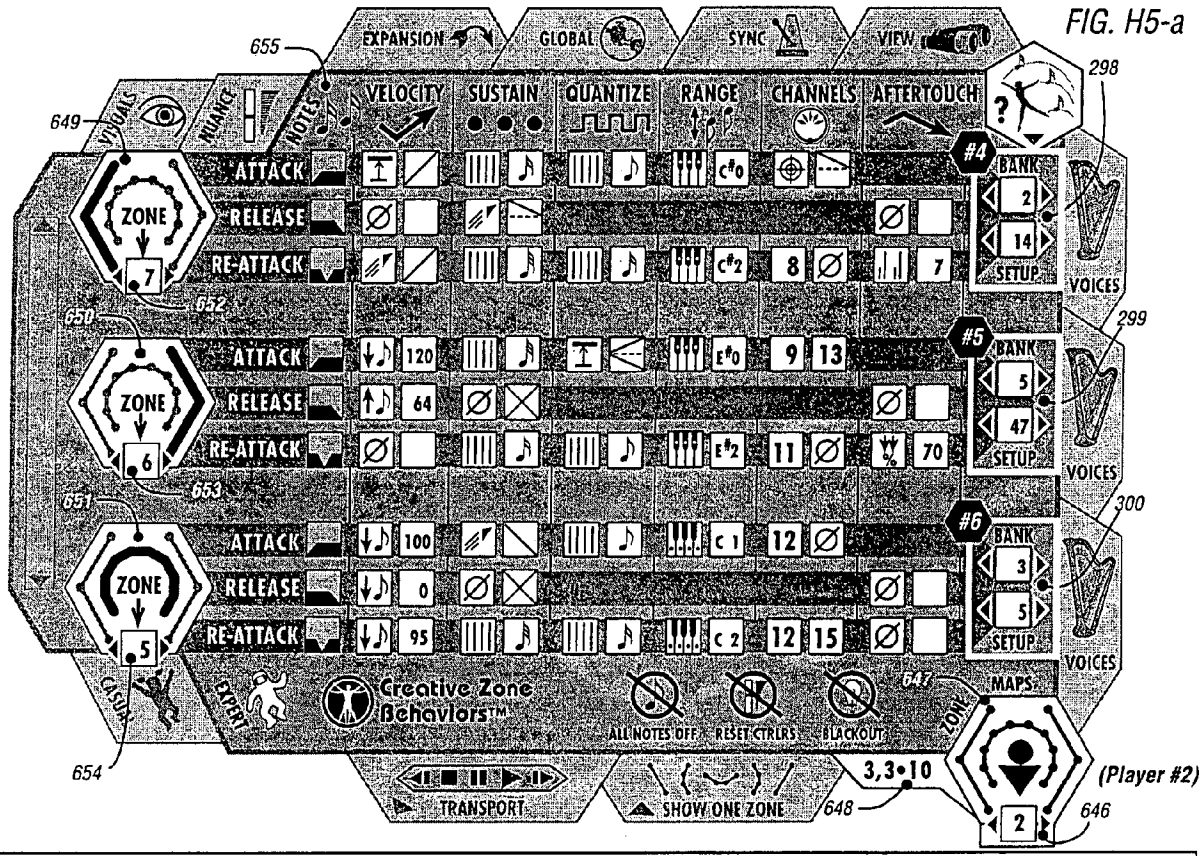

| | | |
|---|---|---|
| FIG. H5-b (Refer to Figure H5-a) | CZB "Setup" Example #4 | Attack Sustain & Attack Quantize: E1, E5 |
| Cross-Reference to Ergonomic Timing (E Series Sheets) | CZB "Setup" Example #5 | Attack Sustain & Attack Quantize: E10 |
| (See Sheet H4 for additional references) | CZB "Setup" Example #6 | Attack Sustain & Attack Quantize: E8 |

*Zone Maps Menu* Sheet H6
*Touch-Display Interface for Three Zones*
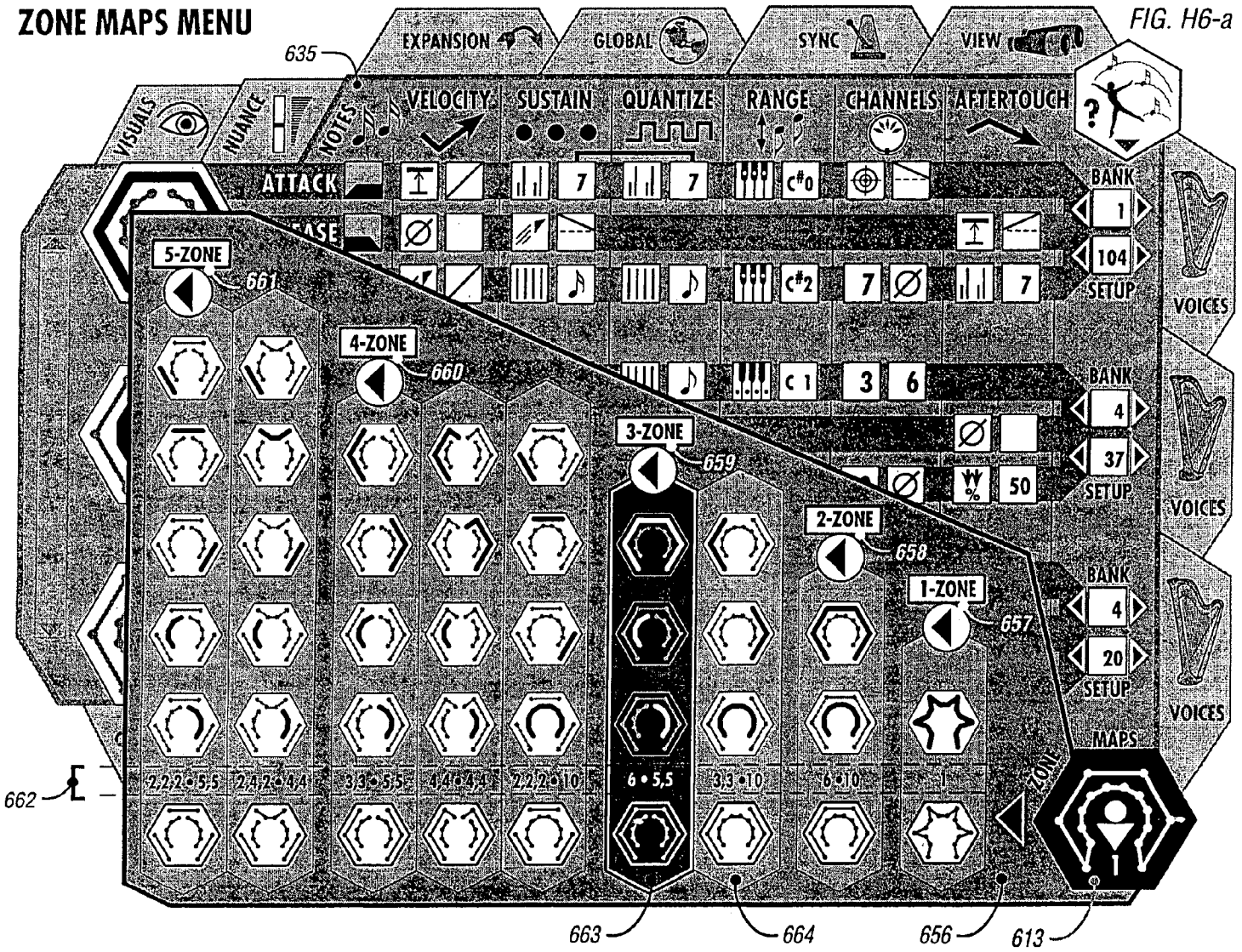
FIG. H6-a Lock To Grid Control Panel for Notes Behaviors
Sheet i1
Touch-Display Interface
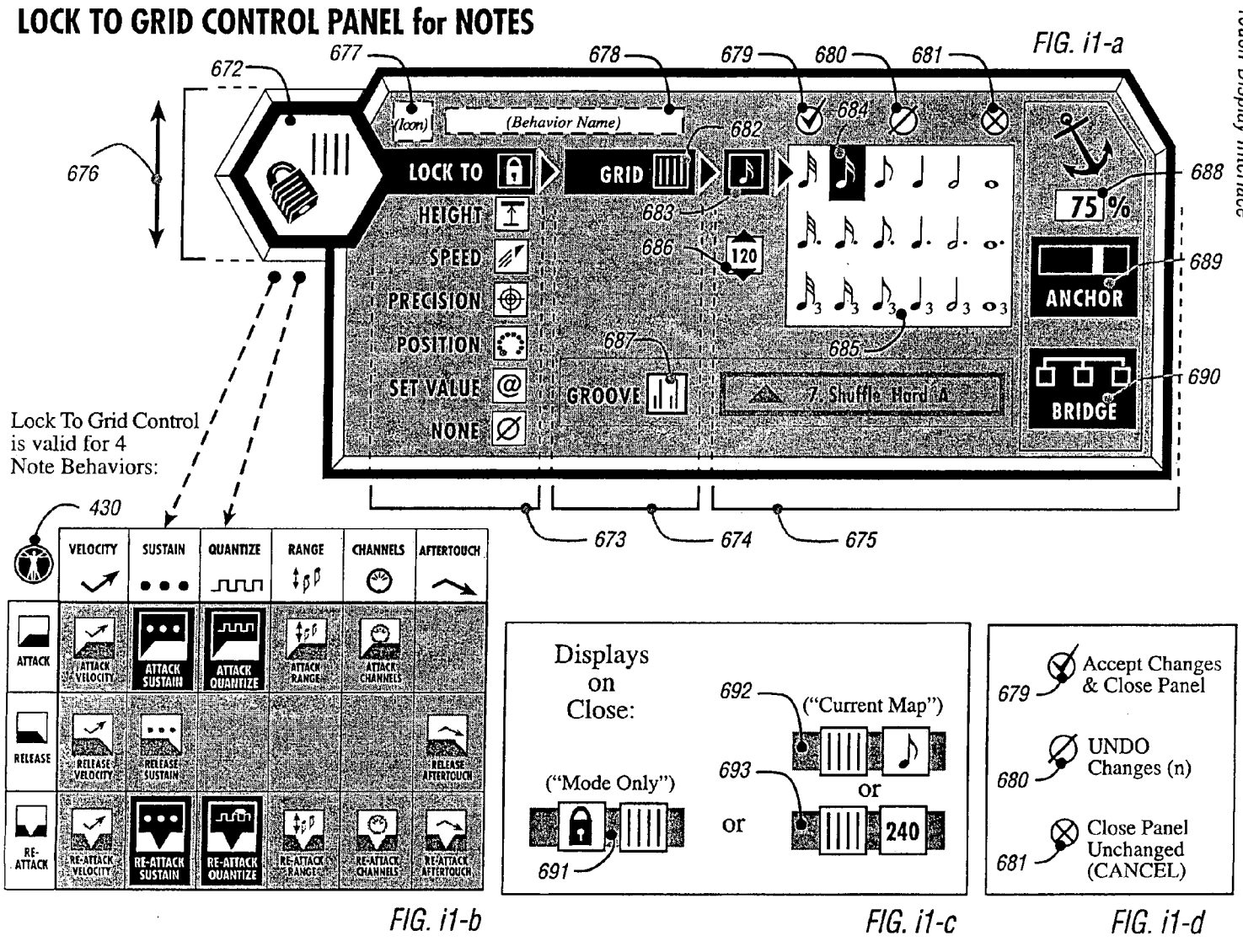

Lock To Groove Control Panel for Notes Behaviors
Sheet i2
Touch-Display Interface
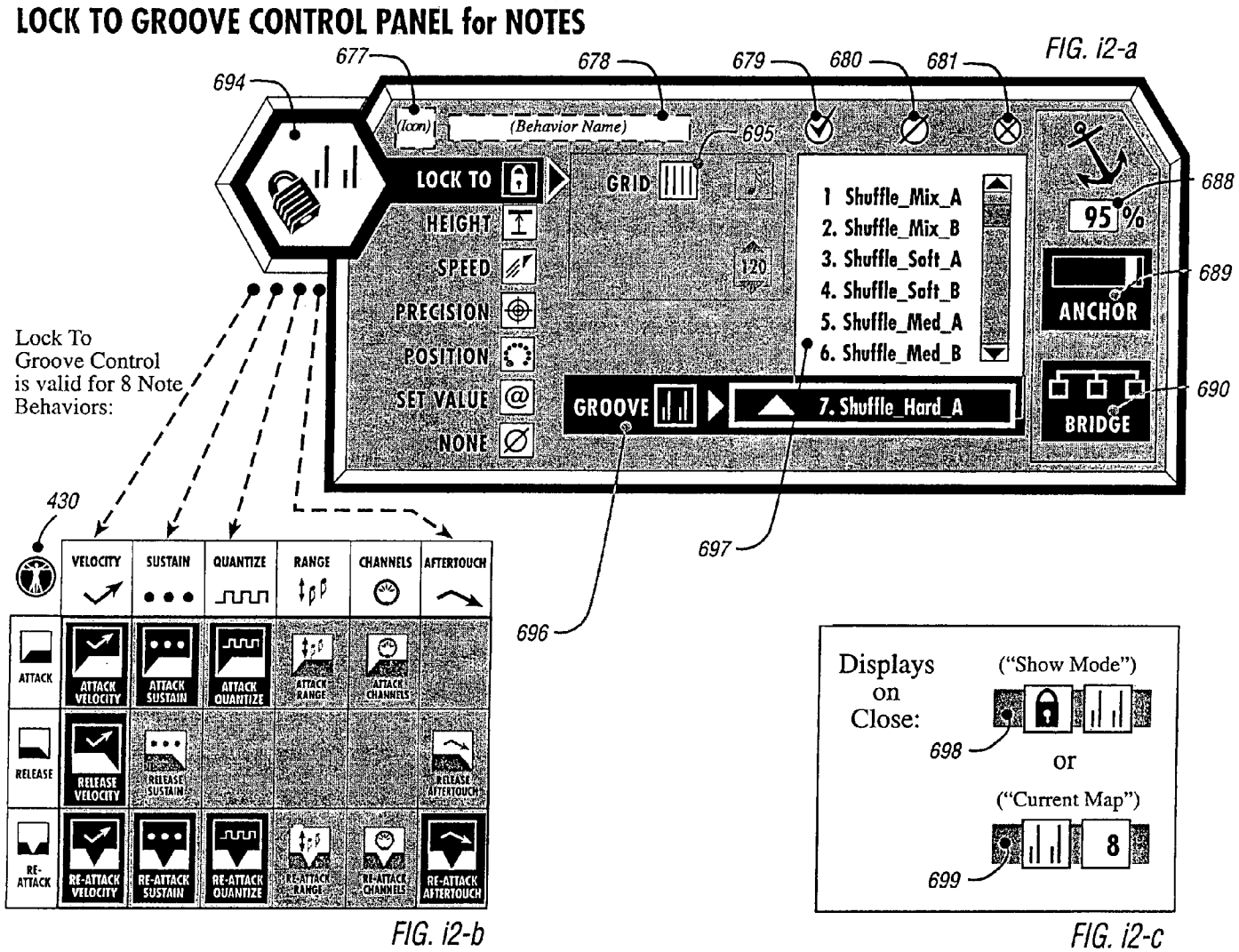

Height Control Panel for Notes Behaviors
Sheet i3
Touch-Display Interface
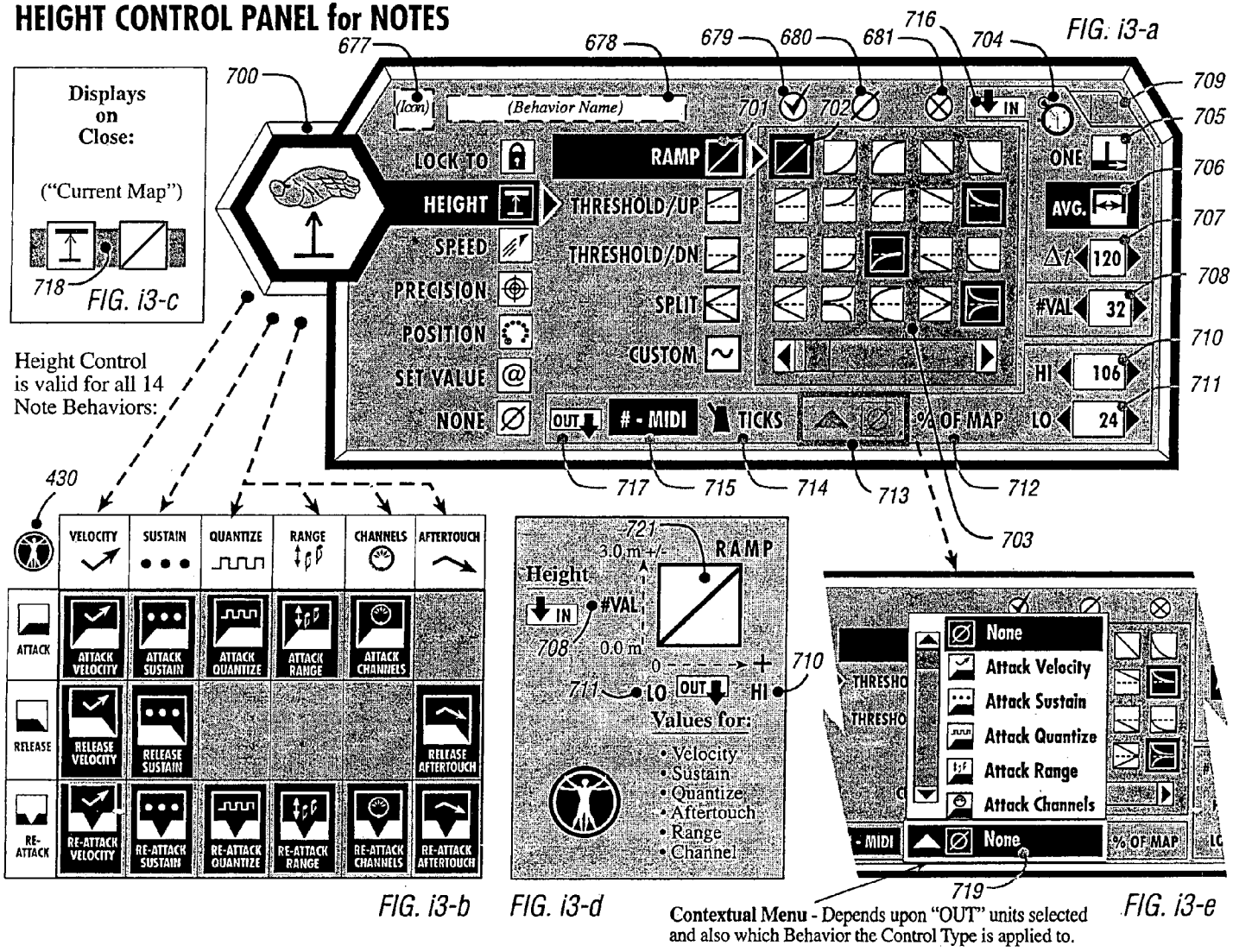

*Speed Control Panel for Notes Behaviors* Sheet i4
*Touch-Display Interface*
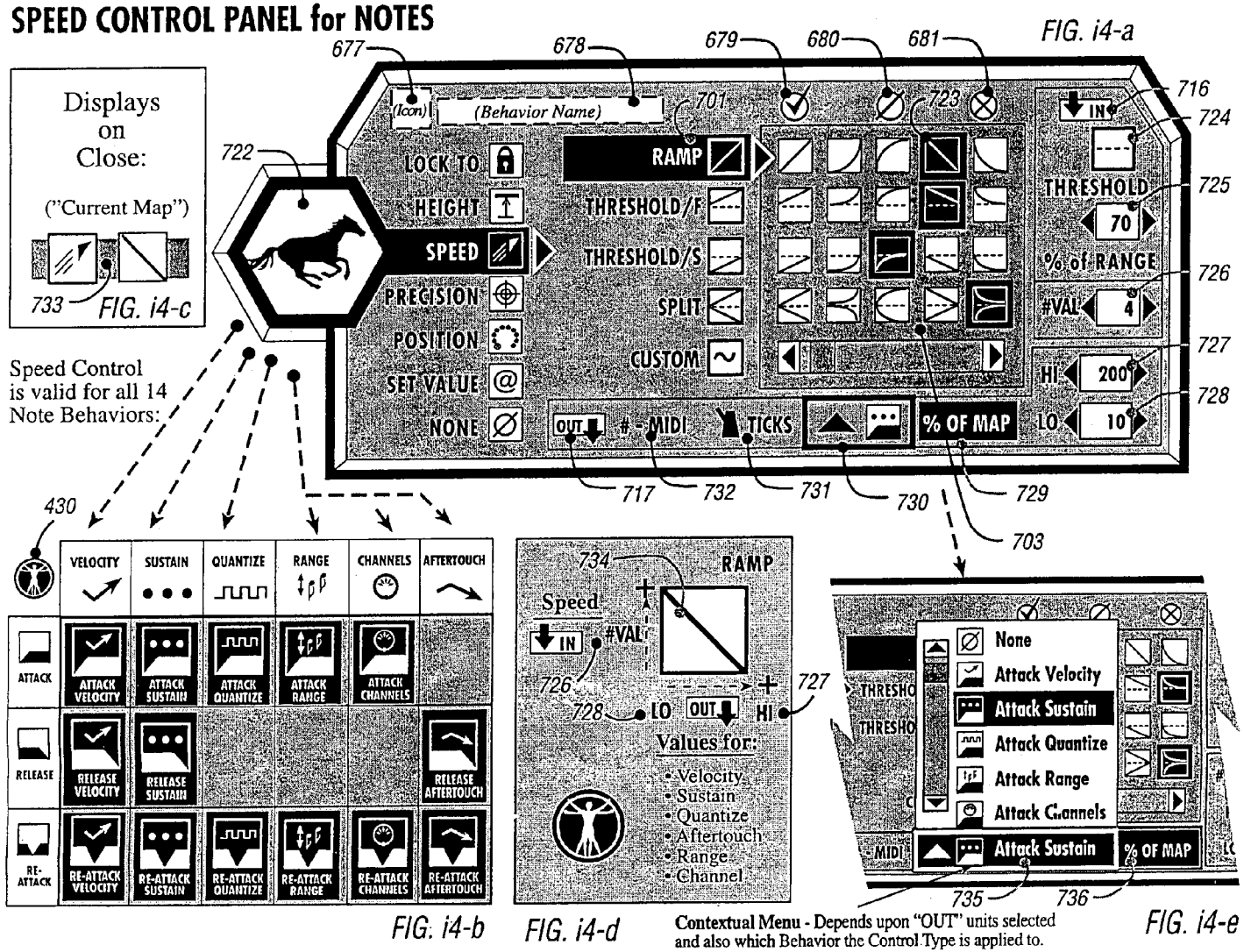

*Precision Control Panel for Notes Behaviors* Sheet i5
*Touch-Display Interface*
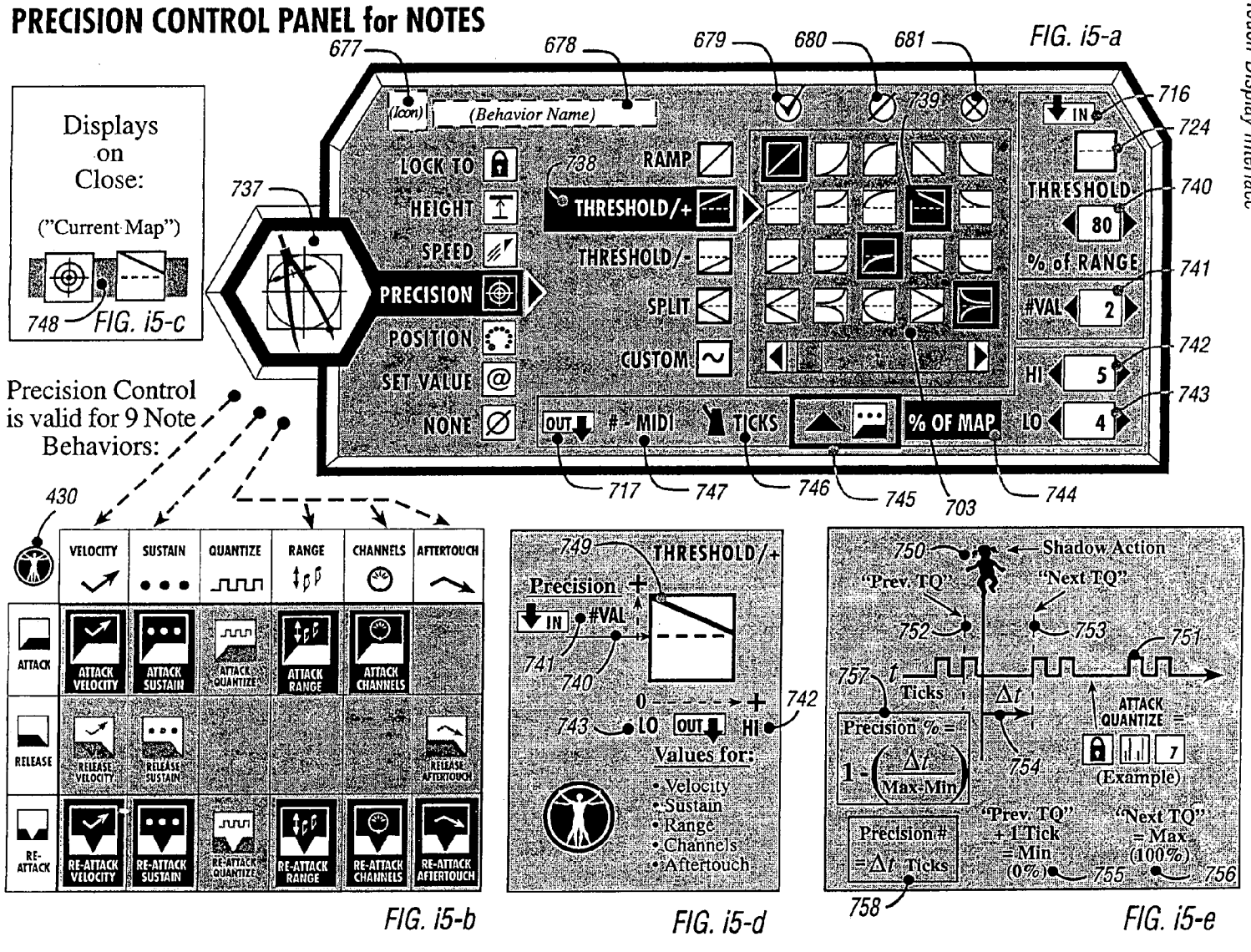

*Position Control Panel for Notes Behaviors* Sheet i6
*Touch-Display Interface*
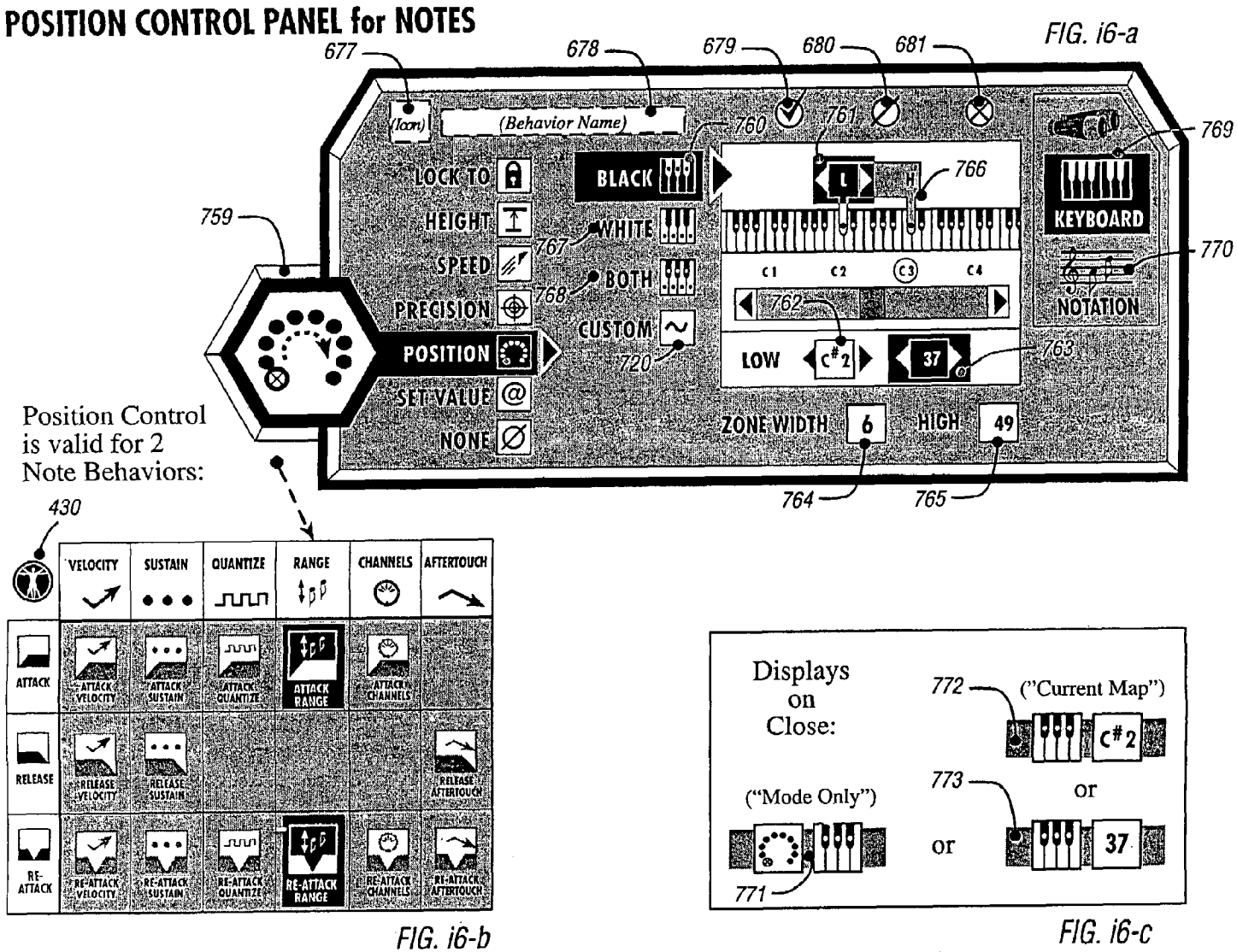

*Set Value ON Control Panel for Notes Behaviors* Sheet i7
*Touch-Display Interface*
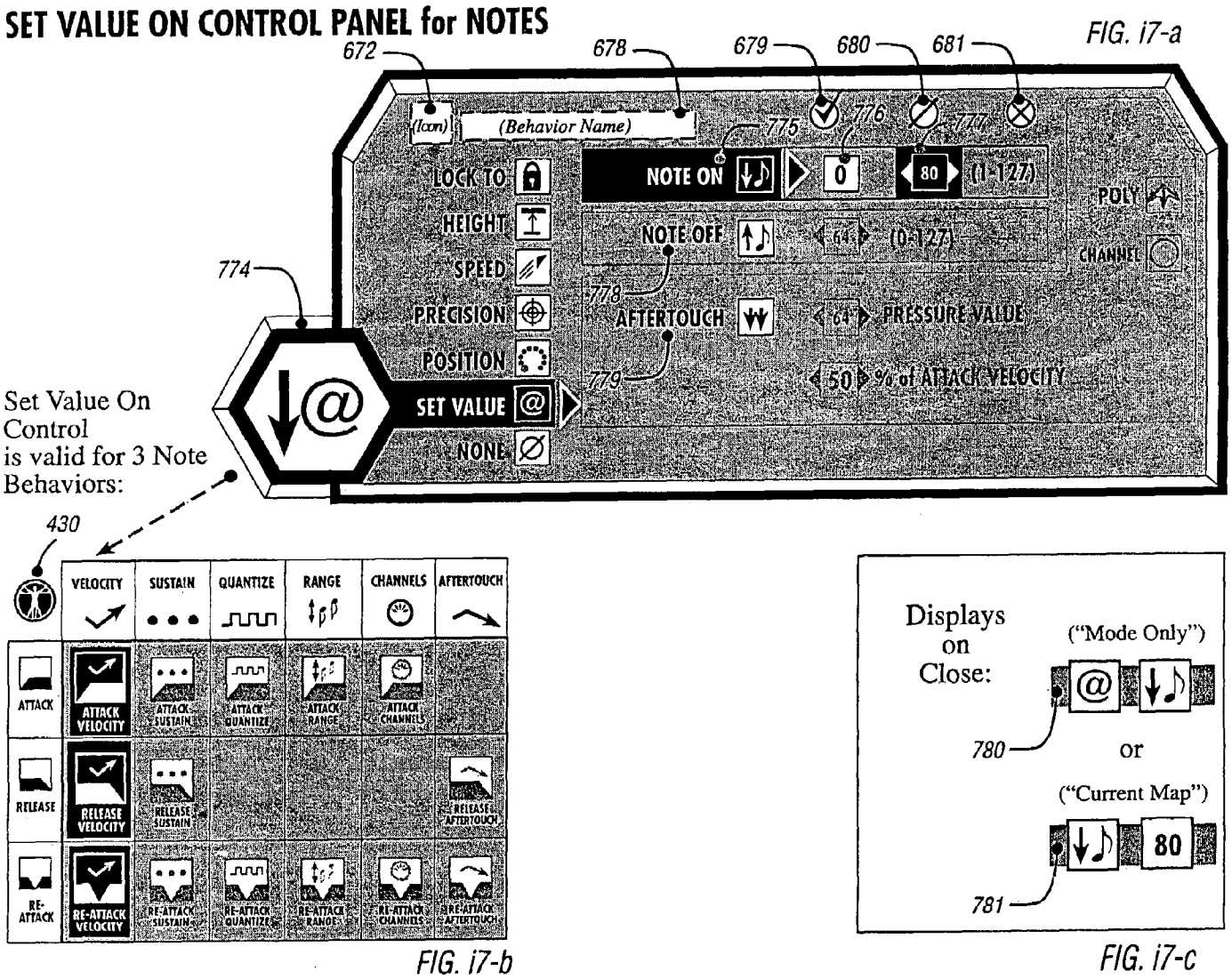
FIG. i7-a
FIG. i7-b
FIG. i7-c

*Set Value OFF Control Panel for Notes Behaviors* Sheet i8
*Touch-Display Interface*
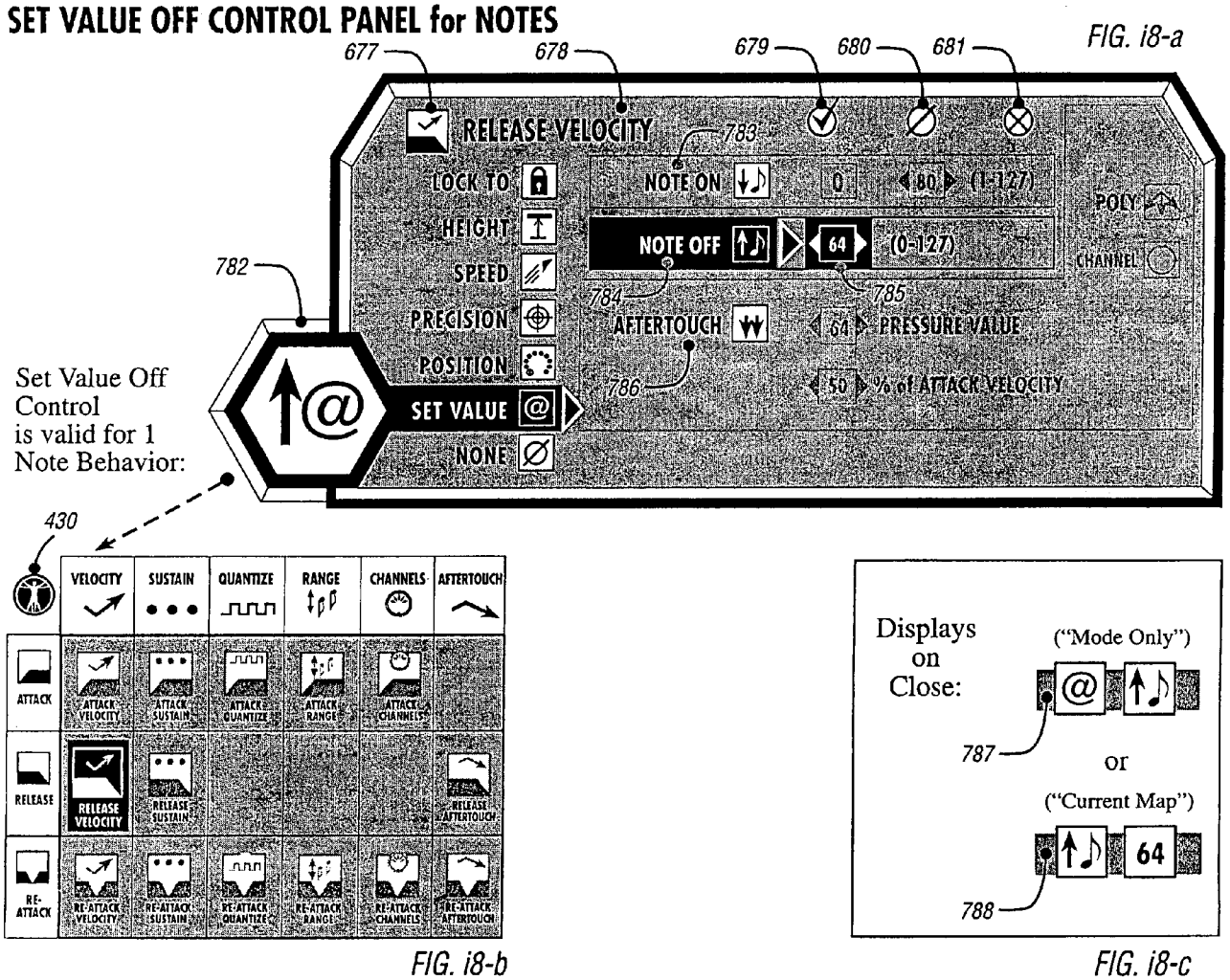

Set Value Aftertouch Control Panel for Notes Behaviors
Sheet i9
Touch-Display Interface
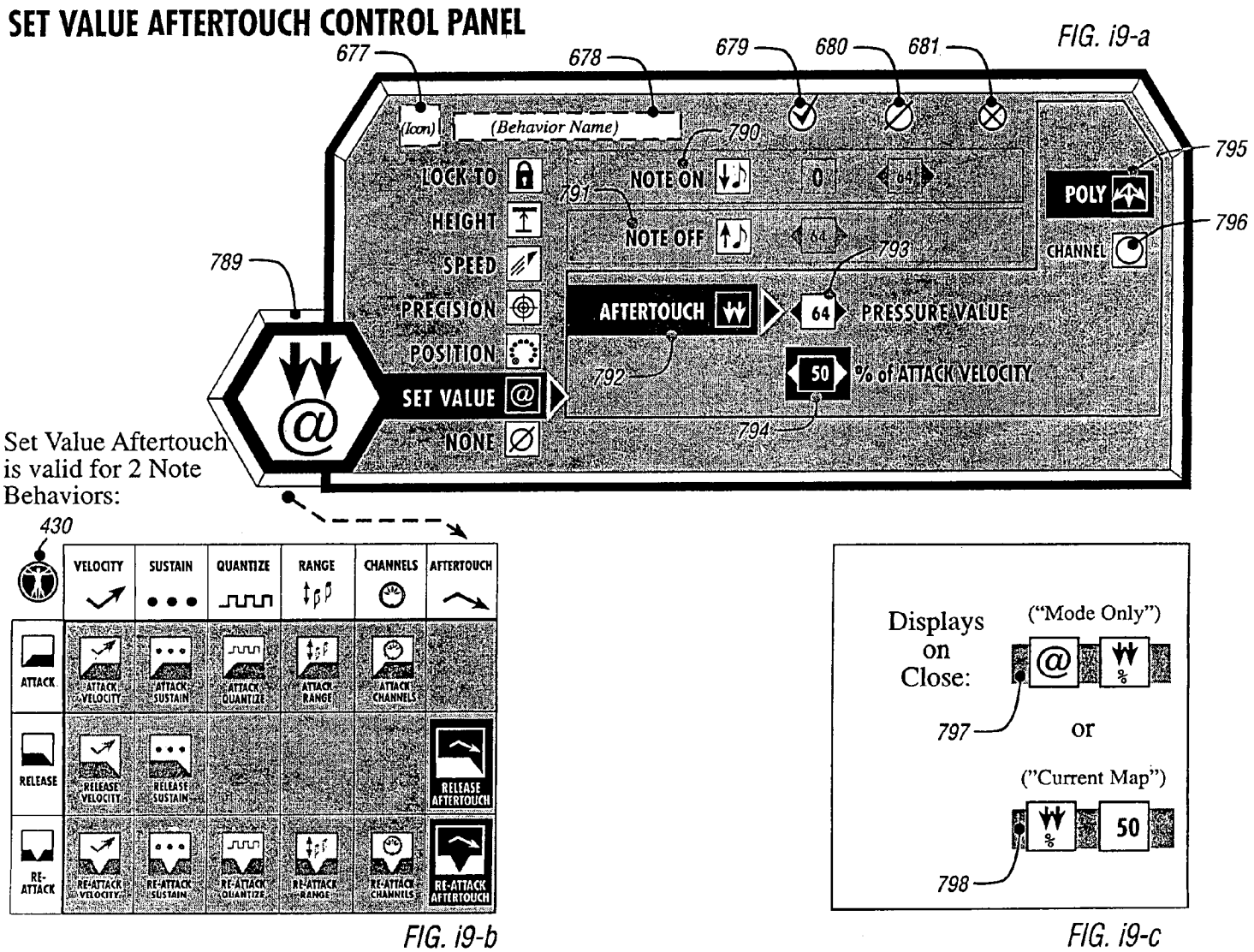

*None Control Panel for Notes Behaviors* Sheet i10
*Touch-Display Interface*
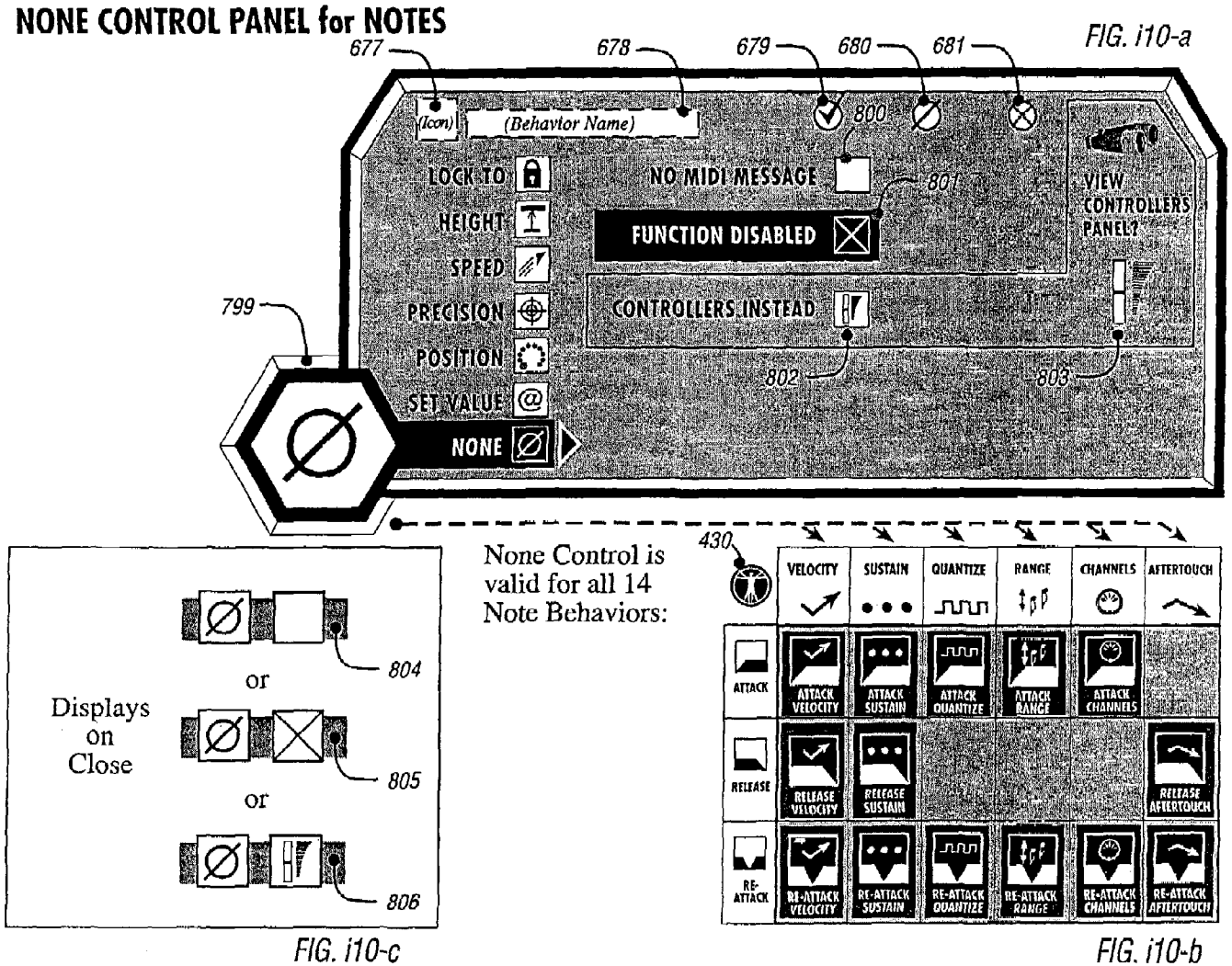

*Lock to Grid Applied to Notes Re-Attack Quantize Behavior* Sheet J1
*Touch-Display Interface for Three Zones*
FIG. J1-a
LOCK TO GRID APPLIED TO NOTES RE-ATTACK QUANTIZE BEHAVIOR
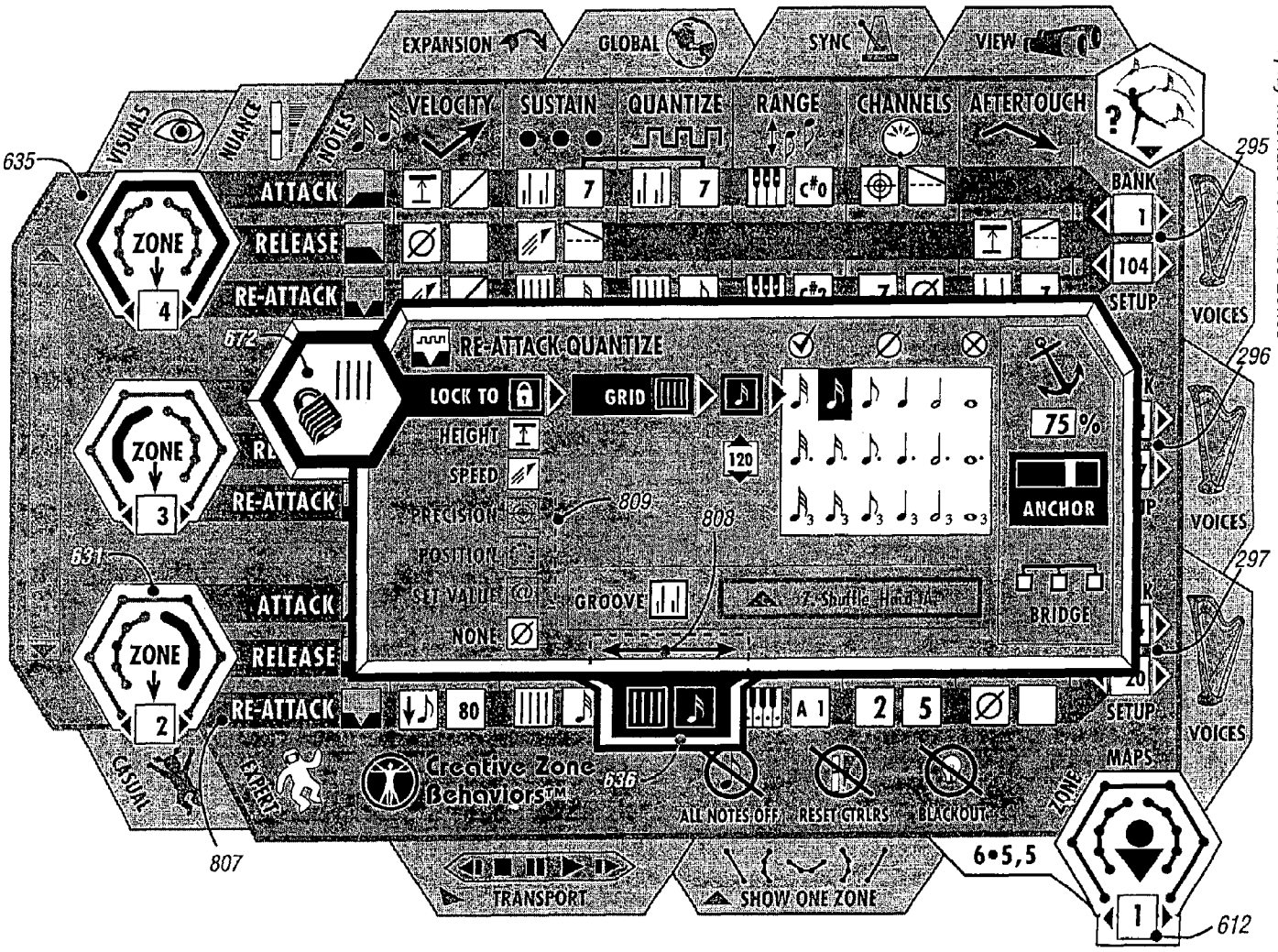

*Lock to Groove Applied to Notes Attack Quantize Behavior* Sheet J2
*Touch-Display Interface for Three Zones*
FIG. J2-a
LOCK TO GROOVE APPLIED TO NOTES ATTACK QUANTIZE BEHAVIOR
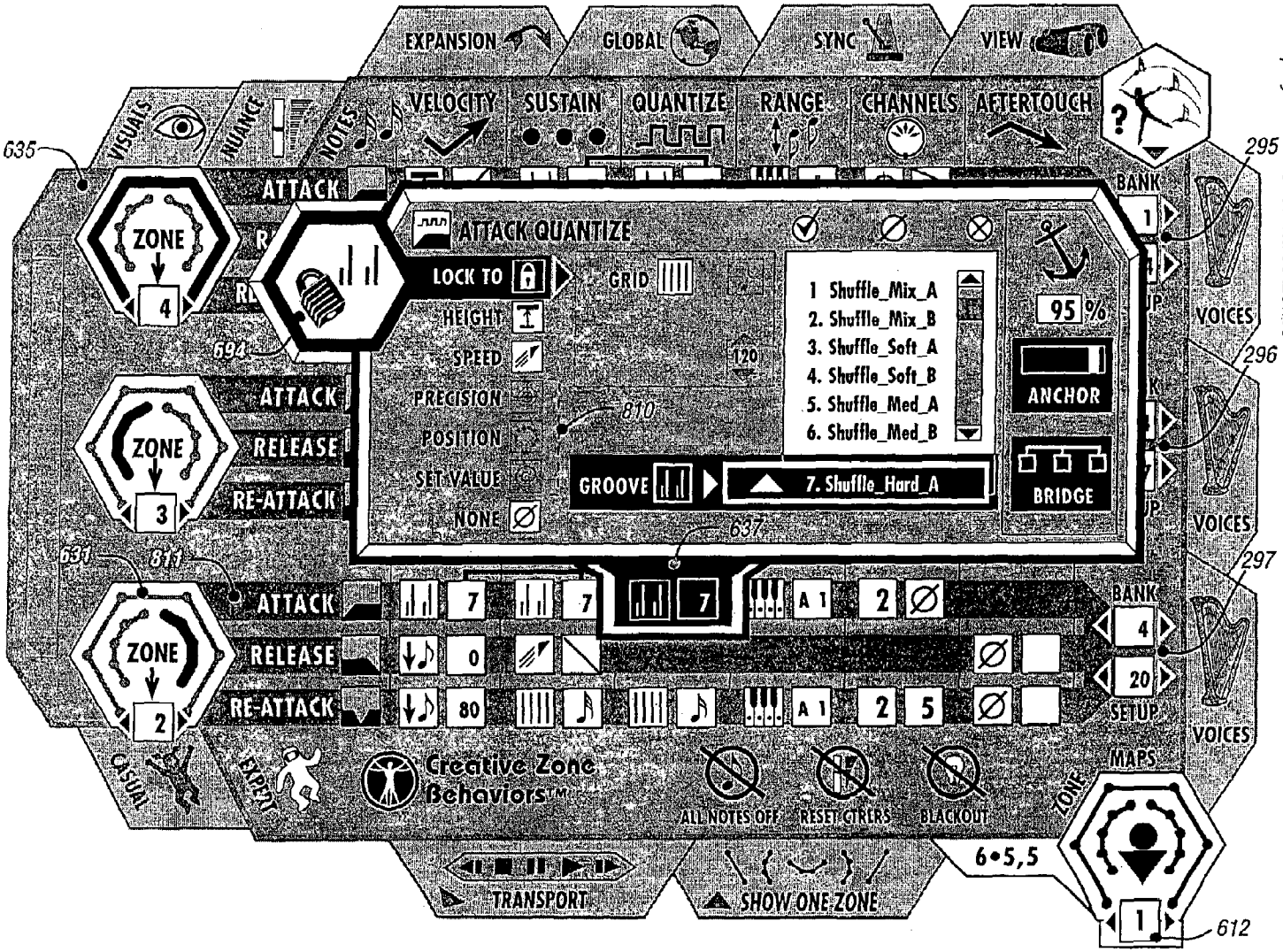

*Height Applied to Notes Attack Velocity Behavior* Sheet J3
*Touch-Display Interface for One Zone*
FIG. J3-a
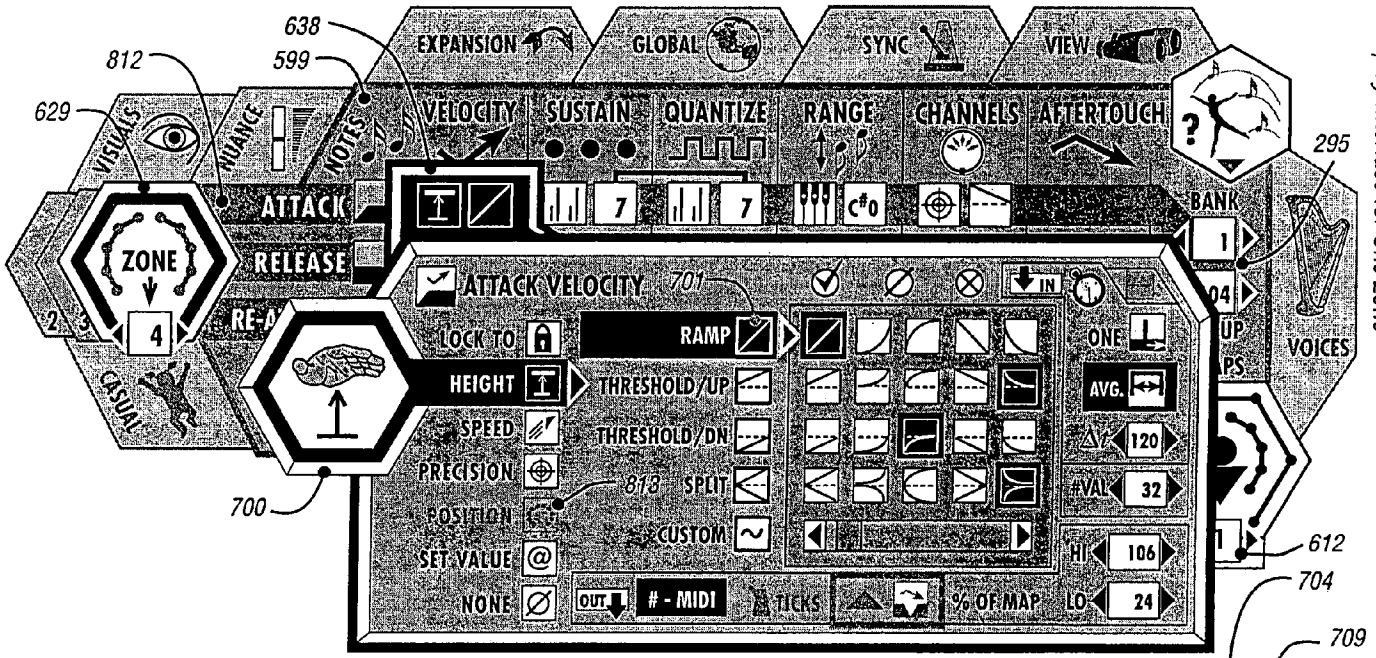
HEIGHT APPLIED TO NOTES ATTACK VELOCITY BEHAVIOR
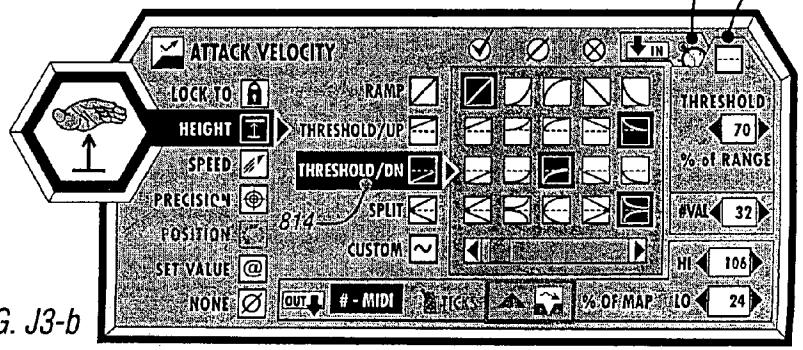
Where Threshold/Up, Threshold/Down, or a Split is applied, the "Tab" with Threshold % of Range parameter becomes available as well.
FIG. J3-b

*Speed Applied to Notes Release Sustain Behavior* Sheet J4
*Touch-Display Interface for Three Zones*
FIG. J4-a
SPEED APPLIED TO NOTES RELEASE SUSTAIN BEHAVIOR
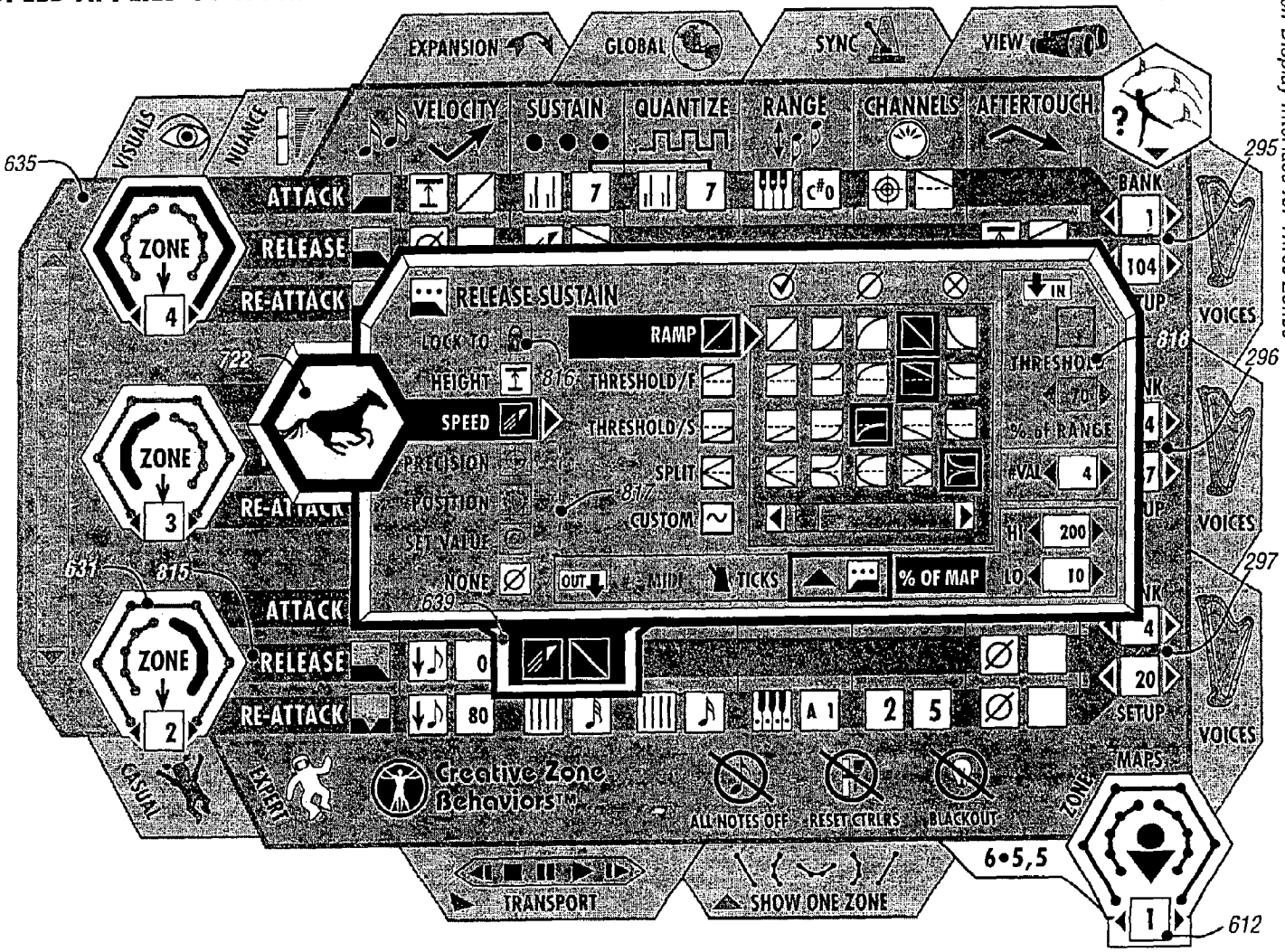

*Precision Applied to Notes Attack Channels Behavior* Sheet J5
*Touch-Display Interface for One Zone*
FIG. J5-a
PRECISION APPLIED TO NOTES ATTACK CHANNELS BEHAVIOR
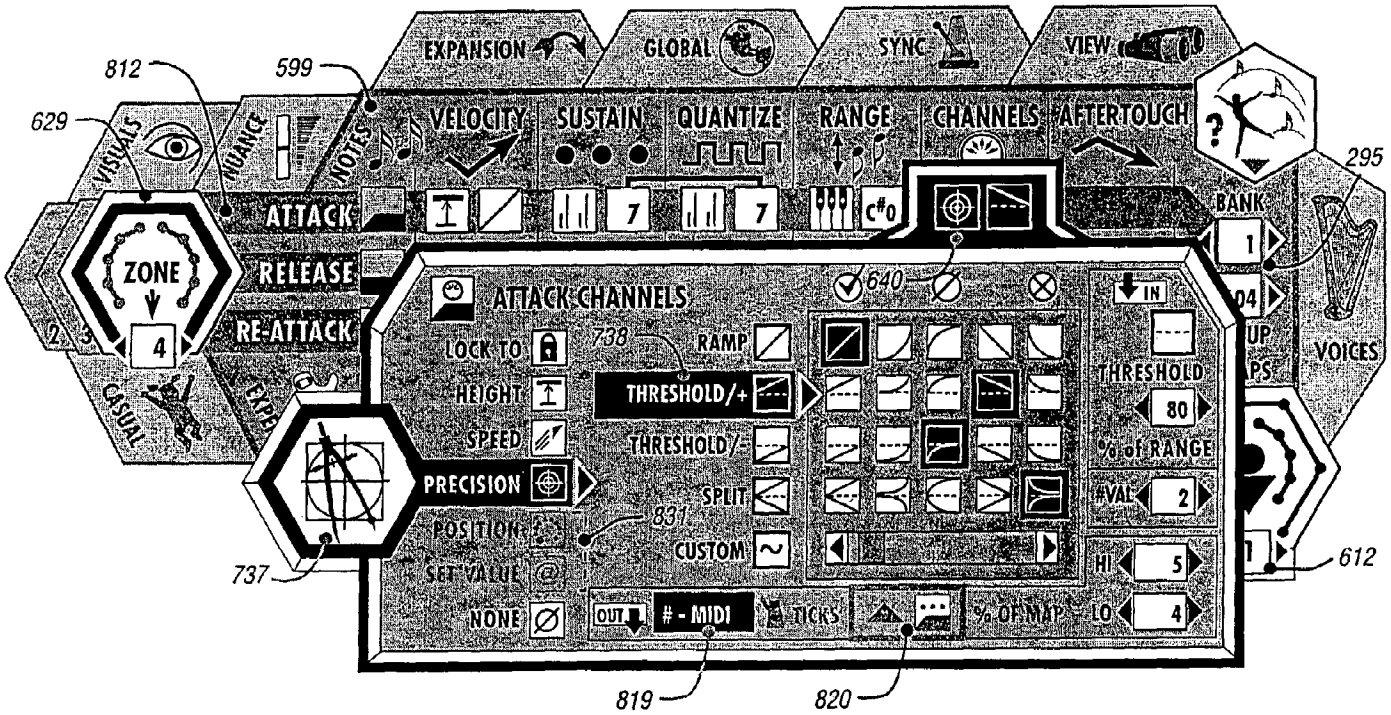

*Position Applied to Notes Re-Attack Range Behavior* Sheet J6
*Touch-Display Interface for One Zone*
FIG. J6-a
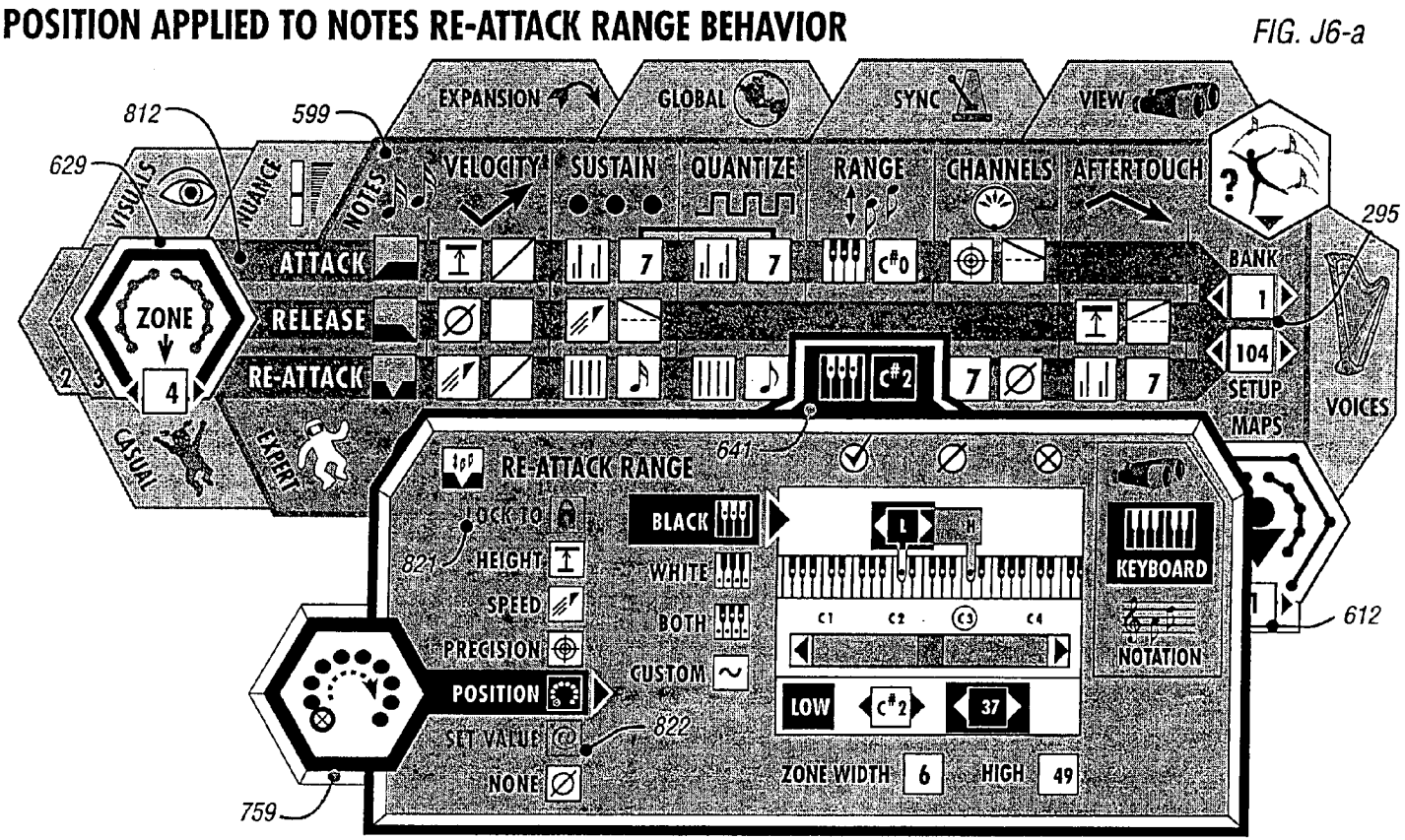

*Set Value ON Applied to Notes Re-Attack Velocity Behavior* Sheet J7
*Touch-Display Interface for Three Zones*
FIG. J7-a
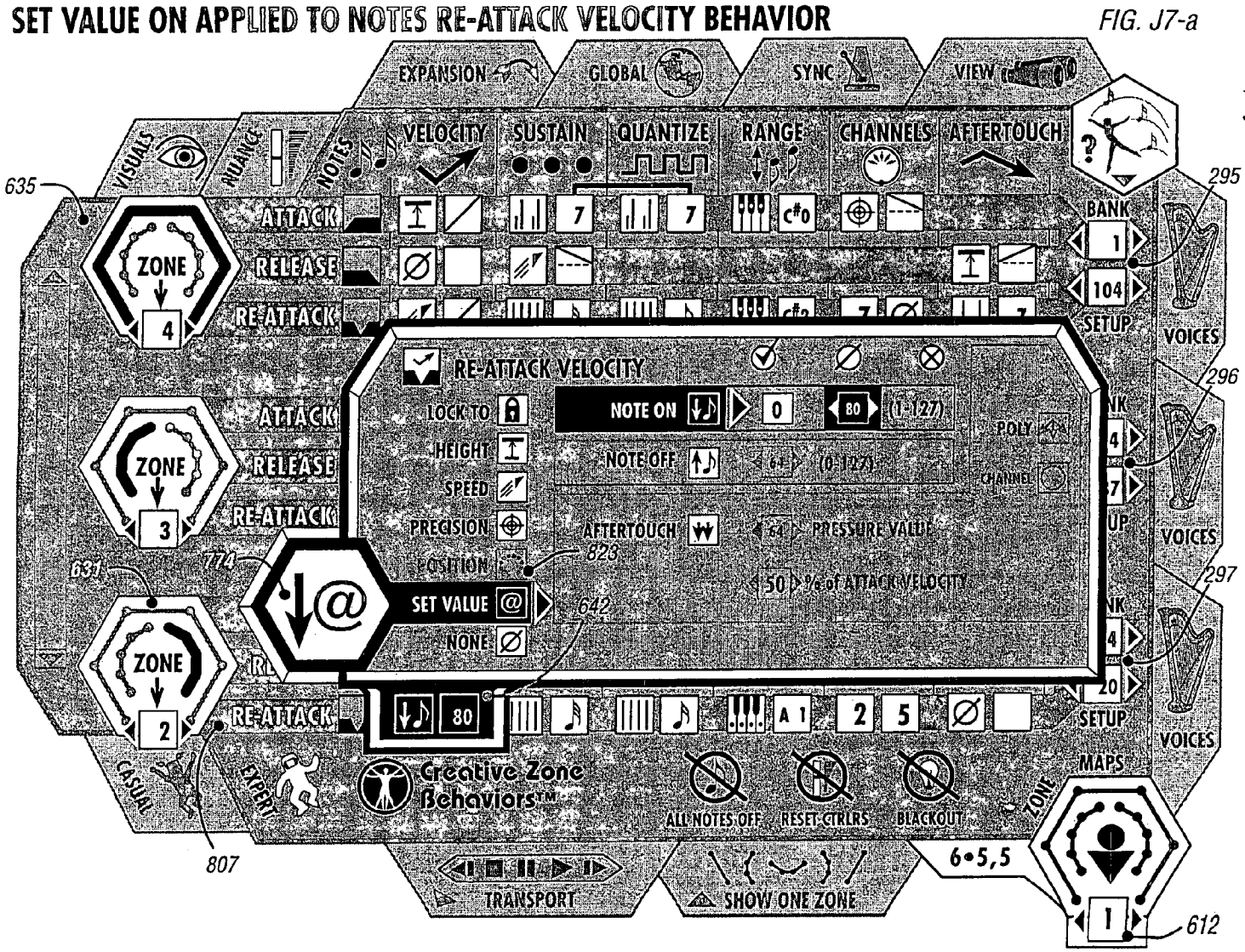

*Set Value OFF Applied to Notes Release Velocity Behavior* Sheet J8
*Touch-Display Interface for Three Zones*
FIG. J8-a
SET VALUE OFF APPLIED TO NOTES RELEASE VELOCITY BEHAVIOR
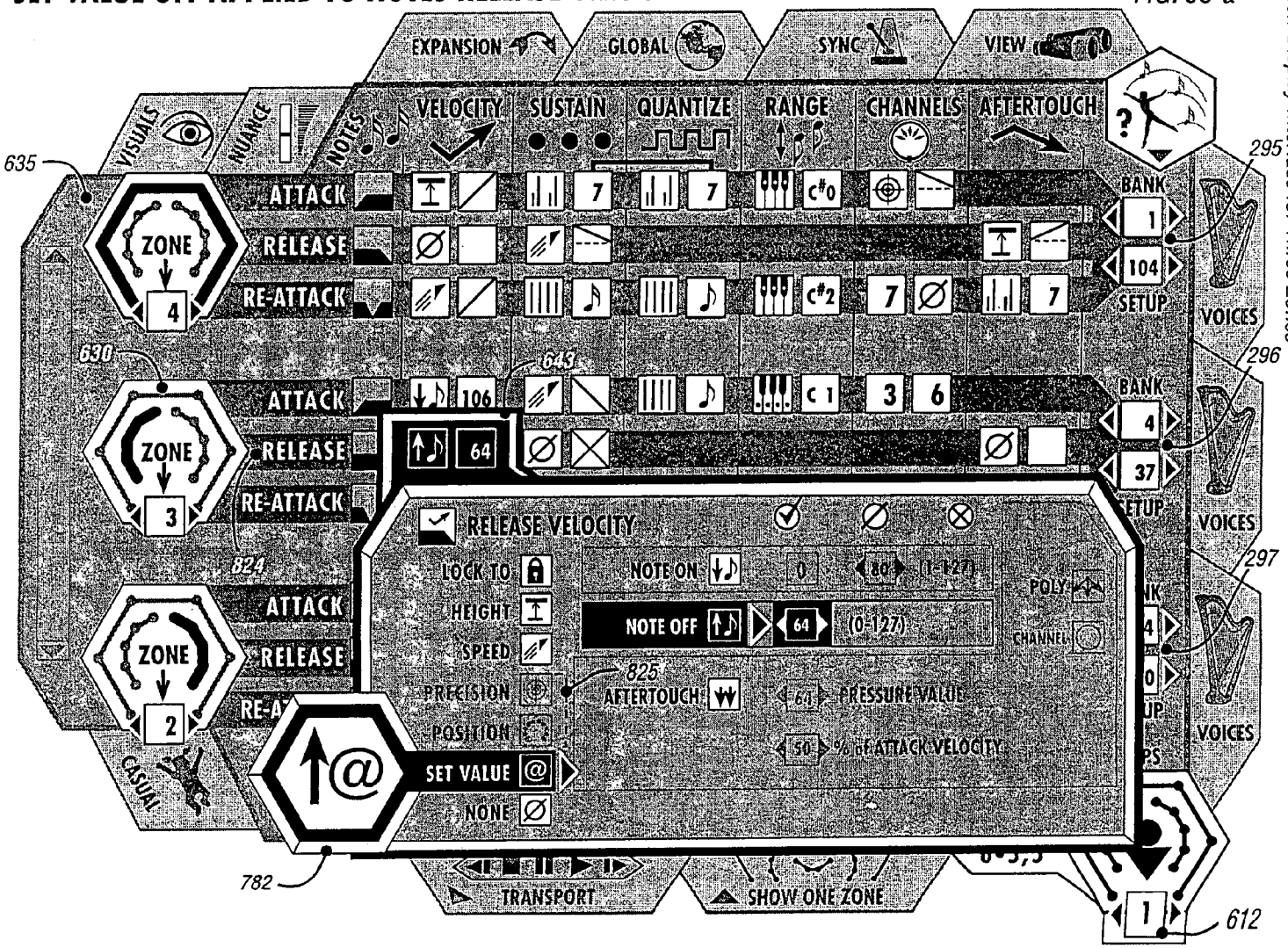

Set Value Aftertouch Applied to Notes Re-Attack Aftertouch Behavior Sheet J9
Touch-Display Interface for Three Zones
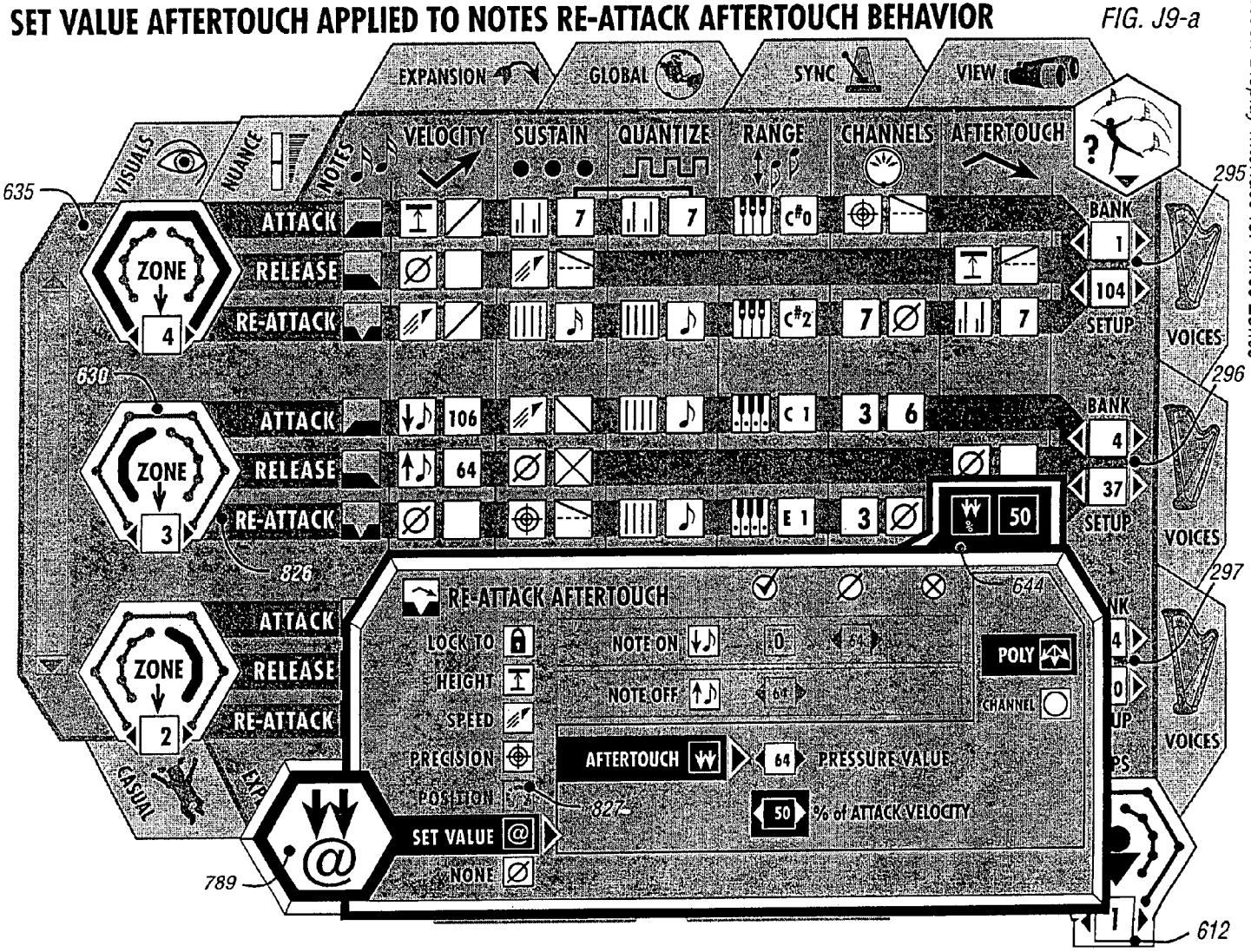

*None Applied to Notes Release Sustain Behavior* Sheet J10
*Touch-Display Interface for Three Zones*
FIG. J10-a
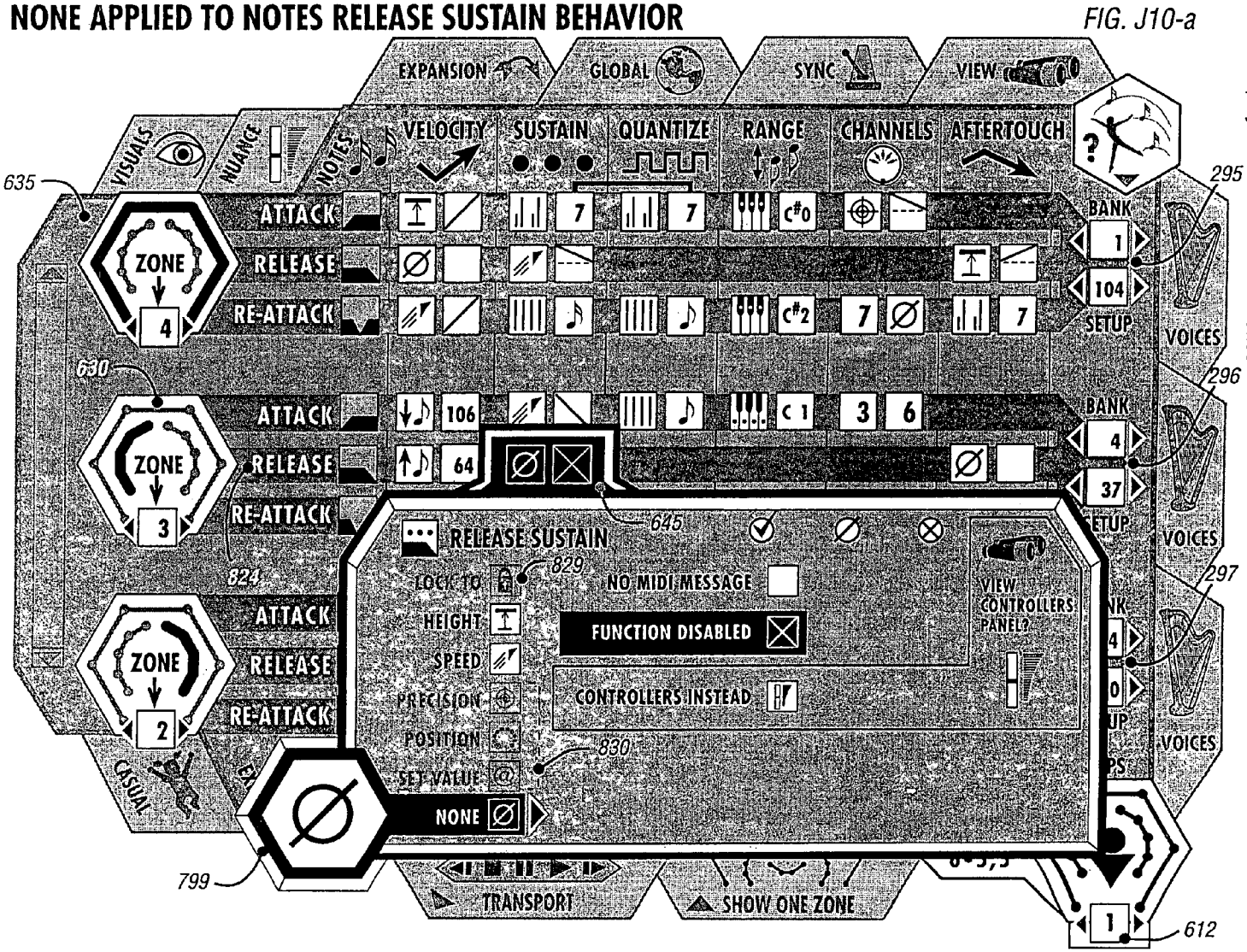

CZB Command Panel for Local Visuals: Preview & Assign Values Tab Sheet K2
Touch-Display Interface
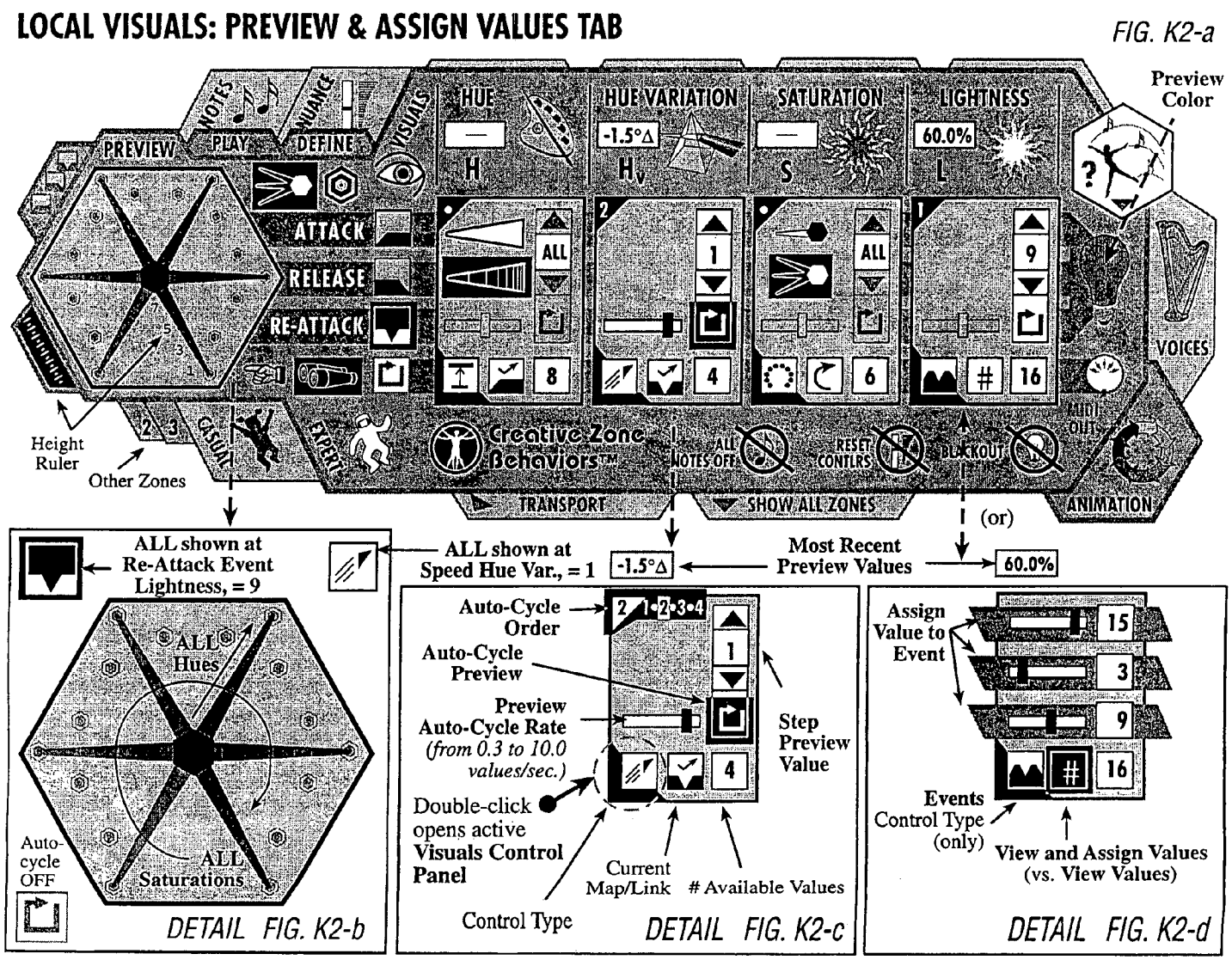

*CZB Command Panel for Local Visuals: Define Values Tab* Sheet K3
*Touch-Display Interface*
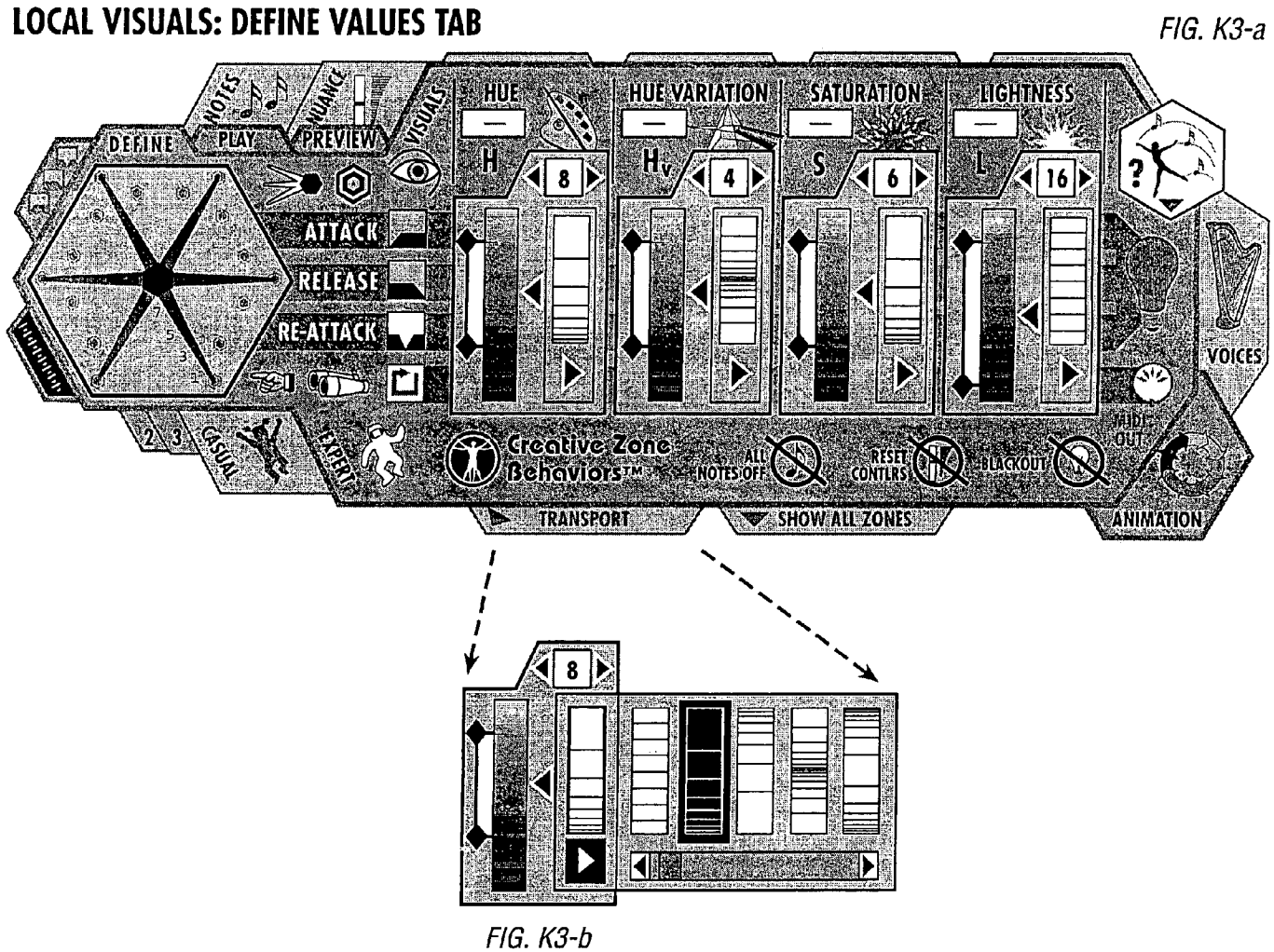

*CZB Command Panel for Local Visuals: Play Values Tab* Sheet K4
*Touch-Display Interface*
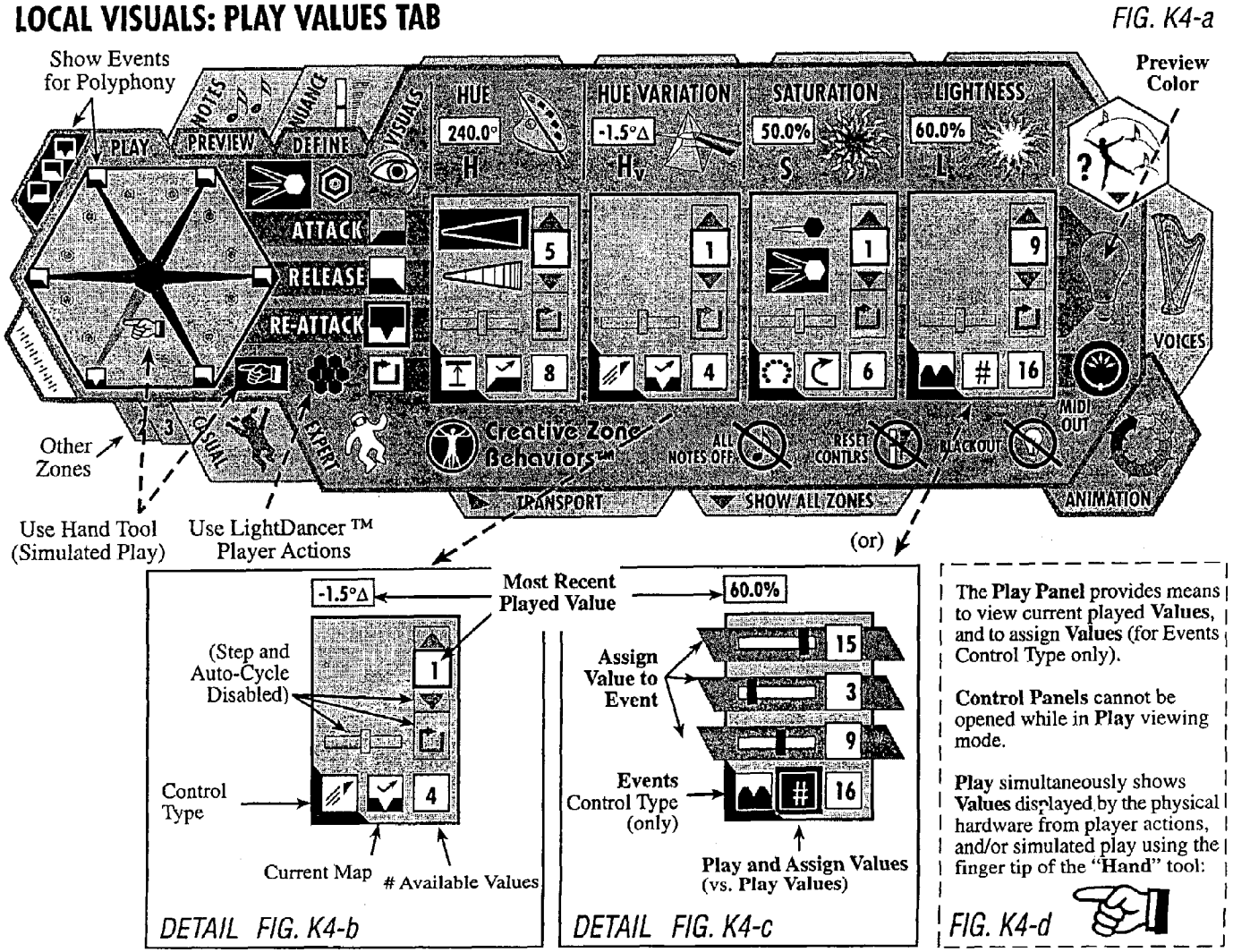

FREE-SPACE HUMAN INTERFACE FOR INTERACTIVE MUSIC, FULL-BODY MUSICAL INSTRUMENT, AND IMMERSIVE MEDIA CONTROLLER

1.0 SCOPE OF THE INVENTION

1.1 Introduction

We first contextualize the invention in terms of its embodiment as an optimal interactive music system:

(1) "A musical device which transparently and continuously performs in real-time (via the skilled application of electronic hardware, optics, mechanics and computer software), symmetry-enhancing global transfer functions between player actions and media results in the form of synchronized audio and visual responses for all musical degrees-of-freedom including 'notes,' 'nuances,' and rhythm (in MIDI terms, including such as Notes On and Off, Control Changes, and message scheduling, respectively)."

(2) In regards to live performance with accompaniment using this device, "A system generating music responses to player actions which are coherent in aesthetic integration and rhythmic sync for all musical event degrees-of-freedom, in real-time with accompaniment pre-recordings (CD-audio, Enhanced CD, DVD, Digital Audio) and/or MIDI sequences."

(3) In regards to live performance without accompaniment using this device, "A system generating music responses to player actions which are coherent in aesthetic integration and rhythmic sync for all musical event degrees-of-freedom, in real-time, between all such responses generated by a solo player and/or with other players performing via mutually networked interfaces in a shared media context."

Symmetry-Enhancing Media Feedback. Even when given arbitrary inputs, symmetry-enhancing transfer functions maintain or increase the quality of aesthetics for music outputs, including rhythmic tempo/meter/pattern alignment, timbre, and harmonics of chord-scale note alignment. Effortless play with a pleasing result is spontaneous for unpracticed players and for those without musical training. This facility of ease for beginners is however in no detriment to the large scope of subtle, complex and varied creative musical expressions achievable by practiced and virtuoso players.

Improved Context of Use for Chord/Scale Alignment Techniques. While the pre-existing methods for achieving chord-scale alignment (symmetry-enhancing pitch processing) are outside the scope of this invention, such means are employed in relationship to our invention. Various means of performing harmonization functions may be used and controlled, including other MIDI software, however these are improved in use by the transparent symmetry-enhancing features of our invention in all other regards.

Two Forms of Embodiment. The Free-Space Interface is embodied in two forms, a floor Platform (for full body play) and a floor-stand-mounted Console (for upper body play).

Scope of the Invention. The invention employs the following sets of opto-mechanical design features, human factors ergonomic processes, and operational features. This section serves to summarize the scope of the invention in broad conceptual terms, including with usages of certain special terminology employed where necessary, and without specific references to the Drawings.

1.2 Sensors

Sensors are arranged within the surface of the Interface radially (circularly), within certain preferred angular and radial spacing constraints.

Narrow-field optical, passive, through-beam (line-of-sight), shadow-transition detecting Type I sensors are employed.

An overhead optical source fixture assembly provides an invisible infrared (IR) flood to generate the player IR shadows which affect Type I sensor shadow transitions, or "triggers."

Two or more regions of sensors are situated at different radius from their mutual center of radius.

Type I sensors with associated electronics and software in preferred embodiments also exhibit Speed detection, in the form of detecting the lateral translation speed of any shadowing or unshadowing object across the line-of-sight of a Type I sensor.

Wide-field, active (reflective), proximity (height) detecting Type II Sensors are also employed.

Type I and Type II sensors are employed together, in practice with strategically cross-multiplied data spaces. Software logic synthesizes the two data types into an integral 6-degrees-of-freedom, real-time non-contact body sensing system.

1.3 Visual Feedback

Multiple active visual feedback are spatially co-registered on-axis (surrounding) the passive (through-beam) sensor trigger regions, including planar LED-illuminated light-pipes, and projecting microbeams preferably used with fogging materials. Active feedback forms a player-surrounding cone shape as a frame of reference.

Preferred ratios of spatial scale are employed between each Type I sensor's trigger region and its corresponding on-axis (surrounding) active visual response regions.

A visible player shadow is employed as an ergonomic feedback. The visible shadow is obtained by means of the overhead fixture assembly which combines the invisible infra-red (IR) flood source with a low-intensity but visible flood source for this purpose. The resulting visible player shadow are precisely spatially co-registered and aligned with the array of Type I sensors and with the surface light pipes and immersive active microbeams. When player affects a Type I sensor trigger, they simultaneously see their shadow cover the triggered sensor and also see the active visual feedbacks change at that same sensor location Intentional regions of spatial ambiguity and spatial displacements of visual feedback are employed within specific design constraints. These involve the spatial configuration of the Type I sensor in relationship to its surrounding concentric planar light pipes, features of the active immersive beams, and also the player's visible shadow.

The passive aspect of the visible microbeams (e.g., in the default or un-triggered "Finish" state) indicates player position before affecting trigger events (e.g. player position relative to the potential but not actualized trigger of Type I sensors).

Four distinctly different Local Visual feedback configurations are disclosed: Class A (fixed color, no microbeams), Class B (variable RGB color, no microbeams), Class C (fixed color, with microbeams) and Class D (variable RGB color, with microbeams).

1.4 Ergonomics

The performance paradigm is unconstrained (except for torso translation limits of ≦2.0 m, namely completely off of the Interface). So long as the player is located anywhere—and in any way—over the Interface and is in any form of motion, this constitutes the free-space, non-tactile, full-body means of "play," and it will be satisfactory and sufficient to produce aesthetic media results.

Our invention constitutes a transparent human interface that is self-evident, easy, clear, precise and creatively expressive.

Our invention promotes (entrains) continuous and natural body motions, both by optomechanical design and the operational feedback and response paradigm.

The biometric design factors facilitate natural and energy-efficient styles of play.

Our invention provides precision responses to both novice (first time or casual) and expert (practiced) players.

1.5 Media Response and Sync

Our invention is fully content-programmable. It provides simultaneous effortless and precision play, within the full range of popular, ethnic, classical, and any musical style and genre, including in seamless aesthetic integration across all musical parameters with pre-authored accompaniment including with prerecorded titles configured for free-space interactive music. "play-along".

Separate and complex groups of transfer functions are employed in parallel: (a) mappings from body kinesthetic to music, and (b) mappings from body kinesthetic to visuals. These two transfer function mappings together engender an a perceived Synesthesia between music and visuals, wherein the player body kinesthetic is perceived in terms of its unification of, or as being the link between, music and visuals. This effect brings a visceral clarity and consistency of feedback to kinesthetics, and maintains a simplicity and clarity of the whole paradigm even though the body-kinesthetic-to-music transfer functions are very widely varied.

Transparent trigger-event-by-event rhythmic time quantizing processes are in terms of individual notes. These temporal adjustment processes maintain a spatially- and temporally-co-registered kinesthetic-and-media perception. This we term the Kinesthetic Spatial Sync biofeedback effect.

Media responses to sensor triggers are transparently real-time quantized within the Kinesthetic Spatial Sync in a great variety of ways, and may function differently amongst multiple sensor trigger regions during free-space performance.

All audio and visual responses within the Kinesthetic Spatial Sync paradigm may be exactly—"to the (MIDI clock) tick"—synchronized to music pre-recordings (CD, DVD, digital audio) and MIDI sequences, by means such as slaving to MIDI's System Realtime Beat Clock, or SMPTE slaving via MTC (MIDI Time Code). This includes exact lock of the Kinesthetic Spatial Sync entrainment effect to any available (arbitrary) clock master source and includes chasing of variable tempo.

Our invention provides players with access to an unlimited variety of non-sequenced musical event structures (notes on/off polyphony, arpeggiation) by means of the disclosed biometrics of optomechanical design, multiple sensor zones, response programmability, and rhythmic processing algorithms.

1.6 Command Interface and MIDI

A novel Iconic Graphic User Interface (GUI) paradigm implements the authoring and control of this vast realm of flexibility in media response. The iconic GUI is largely language-independent (e.g. requires minimal text).

A novel GUI scheme for authoring (and underlying functional software) are employed for authoring Local Visuals response modes and parameters. No specific colors or color lookup tables (CLUT) need be exactly defined by the content author. This is accomplished by means of the disclosed GUI design having certain useful automated features for visual response configuration.

A vast scope of configurations are defined for the application of a novel six-degrees-of-freedom, full-body non-contact (input) interface: Reach, Position, Height, Speed, Precision, and Event Type (timing). These six kinesthetic degrees-of-freedom may be very flexibly mapped to multiple audio/visual response (output) feature spaces, and in parallel. This process we term Creative Zone Behaviors ("CZB"). In MIDI terms, the kinesthetic degrees-of-freedom may be applied to:

6 Note parameters: Velocity, Sustain, Quantize, Range, Channels, Aftertouch;

6 Note parameters: Velocity, Sustain, Quantize, Range, Channels, Aftertouch;

4 Local Visuals parameters: Hue, Hue Variation, Saturation, Lightness—a modified HSB space;

(n) up to 128 different MIDI Control Change types: Modulation, Breath Control, Portamento, Pan, Expression, Tremolo Depth, Vibrato Depth, Chorus Depth, etc.;

(n) Visuals Animation features: Fade Rate, Cross-Fade, Color Cycling, etc.;

(n) Visual Robotics features: GOBO pattern, GOBO rotation, GOBO speed, depth of focus, IRIS, prism effects, strobe, X/Y slew patterns, etc.; and (n) Computer Graphic Images (CGI) features including: digital video effects; compositing, layering, image libraries access, distortions, 3D translations, etc.

A MIDI protocol is employed which is designed specifically for free-space content: the CZB Command Protocol. This protocol enables flexible content title authoring and control of the vast realm of disclosed transfer functions conveniently, including for storage and recall utilizing conventional MIDI sequencer tracks.

Two additional free-space MIDI protocols are also disclosed, which are used for intercommunication between the major functional modules of the complete free-space interactive music media system. These are the Free-Space Event Protocol and the Visuals & Sensor Mode Protocol.

10 specific examples of Ergonomic Timing are disclosed in detail, for the application of player kinesthetics ("gestures") over single Type I sensors, to MIDI notes and local visuals responses. These detailed examples include:

Attacks
Sustain Hold
Sustain Extend
Sustain Anchor
Quantize Anchor
Re-Attacks
Hybrid Quantizations
Sustain by Attack Speed
Sustain by Release Speed
Quantization by Attack Height 10 different Creative Zone Behavior Control Types are disclosed, comprised of 4 Live Kinesthetic Controls (Height, Speed, Precision, and Position), plus 6 Pre-Assigned Parameter Controls (Lock to Grid, Lock to Groove, Set Value On, Set Value Off, Set Value After-touch, and None).

14 different Creative Zone Behaviors for Notes are disclosed: Attack Velocity, Attack Sustain, Attack Quantize, Attack Range, Attack Channels, Release Velocity, Release Sustain, Release Aftertouch, Re-Attack Velocity, Re-Attack Sustain, Re-Attack Quantize, Re-Attack Range, Re-Attack Channels, and Re-Attack Aftertouch.

For Creative Zone Behaviors for Notes, the particular Ergonomic Timing examples disclosed in detail illustrate only a few of the possible (valid) combinations out of a total of 71. These 71 behaviors for notes are formed by variously applying the 10 different Creative Zone Behavior Control Types to various of the 14 different Creative Zone Behaviors for Notes within certain contextual constraints.

In practice, each Creative Zone Behavior Control Type is applied in a Creative Zone Behavior together with specific employed transfer function Control Parameters. In the case of MIDI Notes and Local Visuals these include such as: LSB/MSB (least significant byte/most significant byte) values, % Anchor, Map Type, Map Group, Custom Map #, Groove #, Groove Bank, Mode flags, # Values (depth), Low Value, High Value, etc.

2.0 OVERVIEW OF THE INVENTION

Overview of Music Function. [Series G]. The invention employs multiple transparent transfer functions (551, 552, 553) mapping from a 6-dimensional (563) input feature space (546) of player's sensor-detected full-body "free-space" state: radial extension or "Reach" (578), angular rotation or "Position" (579), Height (580), Speed (581), Precision (582) and Event timing (583). These six are mapped into the (n)-dimensional output feature space (547) of musical parameters for Notes (565) including Velocity (572), Sustain (573), Quantize (574), Range (578), Channels (576) and Aftertouch (577); and for Controllers (566) such as modulation, breath control, portamento, pan, reverb, tremolo and so forth.

Introduction to Visual Feedback Function. [Series A, D, G]. Simultaneous with musical responses (547) players are provided with spatially co-registered conical full-body-immersive and projected-planar visual frames of reference (568). The conical reference is co-registered with the planar reference via point-source shadow projection. The conic and planar geometry is made readily apparent by means of multiple and synchronous active and passive visual feedback. These visual feedback (548) include a 3D conical array of fogged light beams [Sheets A8, C1], an array of illuminated 2D geometric shapes in the form of surface light pipes [Sheets A2 through A5; Series D], and a single player 2D visible shadow (892) projection. Methods of active visual feedback employ coordinated and programmable (color) changes in "intensity" or Lightness (587), Hue (584), Hue Variation (585) and Saturation (586). Such visual changes are "polyphonic" (e.g. occurring at multiple locations, overlapping, and in sync with corresponding polyphonic musical note responses).

Principle Method of Play. Player actions include intercepting an array of photonic sensor trigger regions which are nested within the conical visual frame of reference, and which are inputs to the scope of transfer functions (551, 552, 553) resulting in media outputs. Two Types (I & II) of sensors are employed: Type I detecting player's shadowing (23) and unshadowing (24) the array of optical sensors (e.g., intercepting an overhead visible and infrared (IR) dual-source Flood (831) within its lines-of-sight through to the sensors), and Type II detecting player's height by means of reflective ranging techniques.

Co-Registered Visual Feedback and Player Kinesthetic. Employed methods (552) of active and passive visual feedback (both 3D superposed and 2D projected) entrain (305, 306) players to perceive such feedback (568) as being temporally and spatially co-registered with player body kinesthetic actions.

Alternative Apparatus Embodiments. Two forms of overall optomechanical configurations and apparatus embodiments are disclosed. The "LightDancer™" or Platform [Series A, B] is mounted at floor level and requires a relatively large footprint of contact with the venue floor $(2.5\ m)^2$. The "SpaceHarp™" or Console [Series C] is stand-mounted above floor level and requires a relatively compact footprint of stand contact with the venue floor $(1.0\ m)^2$ although it extends above floor level over a relatively large area $(2.0\ m)\times(1.0\ m)$.

Variations in Embodiments. [Sheet F1*c*]. The two forms of the invention's embodiment are further differentiated into Variations, depending upon their respective inclusion of sensor types, LED and light pipe types, computer and display configuration, and MIDI/audio configuration. Seven principle Variations (871-877) of the Platform embodiment are disclosed, and eight principle Variations (878-885) of the Console embodiment are disclosed.

Alternative Ranges of Body Sensing. The Platform embodiment encourages unrestricted and arbitrary full-body motions (except for torso translation $\geqq 2.0$ m) and senses player (17) full torso, head, arms and legs. The Console embodiment encourages unrestricted upper-torso motion and primarily senses the upper torso including head and arms. The Platform venue also ideally includes an additional zone of surrounding unobstructed space ($\geqq 0.5$ m surrounding its periphery), while the Console venue only requires unobstructed space along its "inside" or the side of player (147) access (1.0 m)+/−(0.5 m).

Similar Method and Response Behaviors. Notwithstanding the various mechanical, optical, and cosmetic differences between the Platform (871-877) and Console (878-885) styles of embodiment, the two produce identical musical responses (547) and very nearly identical visual responses (548). As regards all salient aspects of the disclosed invention, including the perceptual-motor ergonomics and feedback, the two embodiments function in identical fashion with respect to each other.

Spatial Translation of Feedback vs. Perceived Spatio-Temporal Precision. Transparency of rhythmic transfer functions (573, 574) are obtained by employing the disclosed temporal logic functions together with certain ratios of radial displacement (182, 183, 184) between narrow optical sensor trigger regions and wider corresponding visual feedback regions. Each "line-of-sight" Type I sensor trigger region is spatially embedded within surrounding wider regions of passive and active visual feedback in both planar and immersive forms. In practice given a player's typical body appendage (455, 456) or torso in motion, the disclosed time-quantization logic (574) in software (461) together with the spatial-displaced ratios between each input sensor and it's multiple surrounding visual feedback yields a continuous and spontaneous entrainment (306) to perceived kinesthetic-media precision having input-output identity, this effect being transparently embedded within de-emphasized spatio-temporal regions of ambiguity.

Kinesthetic Spatial Sync. Multiple correlated passive and active visual (548) and musical (547) responses, in the context of the specified preferred opto-mechanic constraints, entrains player perceptual-motor perception into identification of input actions (23, 24) as unified with the synchronous active (output) responses (306), and contextualizes player's actually asynchronous (most of the time) sensor trigger (input) actions in terms of spatio-temporal Proximity (305) to the synchronous events. Kinesthetic Spatial Sync is in a strict classical sense, a biofeedback entrainment effect.

Clock-Slaved Transparent Ergonomic Effect. [Sheets F4, F5, F6]. The Kinesthetic Spatial Sync feedback paradigm furthermore entrains players to perceive their body's input actions (23, 24) to be exactly spatially synchronized and transparently tempo aligned with multi-sensory immersive media output responses, even while such responses (510, 511, 512) are clock-slaved (477) to an arbitrary internal or external source of variable (tempo) Clock Master (472), such as CD audio track (513), MIDI sequence (497), or digital audio track (525).

Multiple Applications. The invention may be employed as an optimal ergonomic human interface for interactive music, a virtuoso full-body musical performance instrument, an immersive visual media performance instrument, a 6-degree of freedom full-body spatial input controller, a full-body Augmented Reality (AR) interface, a limited motion capture system, and a choreography pattern recognition and classification system.

Single and Multiple Use. Typically embodied in the form of MIDI interface or MIDI input device, such free-space interfaces may be utilized in both solo (unaccompanied) venues as well as accompanied either with MIDI sequences and/or audio pre-recordings. The invention also includes provision for deployment of (n) multiple such interfaces in precision synchronization of all aesthetic parameters of media response.

Local and Remote Deployment. Multiple free-space interfaces may be used simultaneously and conjunct within a shared (common/adjacent) physical media space or within a shared logical media space spanning physically remote locations via data networks such as LAN, WAN and the Internet.

Mixed Ensembles. Such free-space interfaces may also be used with aesthetic result in various mixed ensembles such as together with traditional acoustic musical instruments, other electronic MIDI controllers and voice.

Other 3D Media Applications. In addition to the music media performance applications disclosed, the invention is also suitable as a six-degrees-of-freedom interactive human interface to control 3D robotic lighting, lasers, 3D computer graphics, 3D animation, and 3D virtual reality systems having outputs of either pseudo-3D (planar displays) and/or immersive-3D (stereoscopic or holographic displays.)

3.0 BACKGROUND OF THE INVENTION

History and Evolution of Transparency

Acoustic Evolution Considering the general history of music instrument technologies and methods, evolution may be considered in terms of the progressive availability of more and increasingly transparent and symmetric gesture-to-sound mappings or cybernetic input-output "transfer functions". For example, early clavichords and fretted lutes introduced the transfer function of restricting the map between finger (key) presses to pitches of fixed-length strings, vs. the more continuously variable pitches achievable with unfretted strings. In subsequent historical developments, the even- or equal-tempering of claviers, in contrast to the previously untempered schemes (such as Just Intonation, Pentatonic, other modes, etc.), were newly empowered to play equally pleasingly in any key signature—or the expression of symmetry with respect to musical key transposition. This was a significant new freedom to both modulate freely and easily between any keys or modes, and to enjoy the vast combinatorial number of polymodal or even a-tonal harmonic structures. Tradeoffs were made, notably the unavoidable sonic interferometric beat frequencies resulting from tempered non-even-integer intervals vs. "pure" even-integer-ratio harmonics. Such tradeoffs resulted however in desirable gains in other areas, including increased universality (tuning and aesthetic compatibility of various instruments) and expressivity (omni-modulation, complex harmonies). Similarly early woodwinds with only simple unaided open holes later developed more complex mechanisms exhibiting such "worthwhile" sets of tradeoffs. Thus the evolution of keyboard, string, brass, woodwind, percussion and other instruments may all be considered in this light. The evolution of acoustic instruments may also be considered to have continued to evolve in this fashion, directly and indirectly into the various forms of modern electronic- and software-enhanced musical equipment prevalent today. (Noting such more recent electronic developments is not meant to imply any negation of the continuing evolution of acoustic instruments as well.)

Electronic Evolution: Timbre. Today's electronic keyboards employing sound generators and synthesizers, with the nearly effortless touch of a key provide transparent access to aesthetic timbres from large libraries of audio output sounds (using techniques such as FM synthesis, wavetable, DLS data, samples, etc.) This results in significant reduction of performance skill requirements (as compared to such as brass, woodwind or unfretted stringed instruments) in order to generate pleasing timbres, and greatly reduces or eliminates the need to expend energy on neuromuscular expertise and bio-mechanical precision to affect sufficient timbale transfer functions. Considering individual key attacks, the reduced neuro-muscular repertoire of simple finger presses of varying speeds and pressures still enables production of virtuoso-quality timbres. Assembling an inter-subjectively aesthetic aggregate of simultaneous and/or overlapping individual key attacks into a sufficiently agreeable "musical performance" nonetheless typically requires substantial training and practiced skills in regards to rhythm, structure, pitch (chord and scale), and dynamics. So the evolution has continued further.

Electronic Evolution: Effects. 3D spatial audio processors, effects units, and synthesizer parametric controls implement transparent audio transfer functions in subtle aspects of timbre, audio signal transformations and inter-channel phase relationships. These are employed both globally (per ensemble) and as responsive to such as individual instrument key aftertouch pressure, velocity, stick (drum pad) pressure, and adjunct continuous controllers using devices such as wheels, knobs, faders, joysticks, trackballs and even the mouse. While such as a "great hall reverb" effect may not sound exactly like a expertly-microphoned physical location such as a Cathedral or Metropolitan Opera House, musicians in unsuitable or poor acoustical spaces can now present their performances with sonic ambience of numerous type, both as emulated acoustic environments and in synthetic spaces which have no natural or physical equivalent.

Electronic Evolution: Pitch (Chord/Scale) Auto-chord accompaniment schemes, algorithmic scoring, arpeggiation generators, vocal harmonizers, and various further schemes have implemented various degrees of transparency and symmetry in chord and scale transfer functions. Such methods may be utilized to constrain the available transfer mappings between instrument inputs and sound generating device outputs to time-varying definitions of chord, scale and melody structures. This is empowering in case of casual or non-musically-trained players, as well as engendering new possibilities of performance at times exceeding what is physically possible by skilled virtuoso players using instruments not incorporating such mappings, for example rapid parallel harmonies and arpeggiation in difficult keys, and chords widely voiced over many octaves simultaneously. These techniques have furthered both transparency, in terms of player ease of actions, and symmetry, in terms of aligning a more pitch-chaotic input feature space (MIDI note streams as input) into a more symmetric (chord/scale structure aligned) output stream.

Electronic Evolution: Breath and Lip Pressure. MIDI wind controllers and associated equipment translate breath, lip, tongue and finger behaviors into preset synthesizer patch responses and related synthesizer parametric modulations. Tradeoffs for players with varied acoustic backgrounds remain, such as the need for more difficult octave-shifting using nonstandard fingerings or precise lip pressures vs. diaphragm pressures (with varied degrees of difficulty for conventional reed, brass and other wind players). This development nonetheless has provided wind players new freedoms to play with considerably subtle and varied range of expression in completely different timbres of stringed, brass, woodwind and percussive sounds, as well as entirely synthetic sounds with no natural or acoustic equivalent.

Constraint and Expressive Freedom. Transfer functions of software-enhanced or modern electronic instruments viewed from one perspective constrain creative expression to a limited set of preset choices. In each historical case illustrated above however, these "constraints" simultaneously introduce new freedoms (degrees-of-freedom) of musical expression not previously practical or available in the unrestricted or less-restricted transfer function case.

Electronic Evolution: Desirability of Rhythmic Transfer Function. Rhythm is integral to inter-subjective perception of ongoing aesthetic character in musical expression, such that if rhythm is absent or irregular (with the exception of some solo contexts) more often than not such temporally chaotic character of events "outweighs" the degree of musicality in other elements of the performance. Thus, without an enhanced interactive musical system or instrument's employing a rhythmic transfer function, the non-musician or non-rhythmic "casual" player faces at times a steep mental and physical obstacle, requiring a focus of concentration, co-ordination and effort to overcome this barrier and express an intersubjectively aesthetic performance. Players must in this case exert sufficient perceptual-motor control to adjust their body behaviors precisely in relation to tempo and meter, this being critical even if timbre, effects and/or pitch are transparently being adjusted by other available methods or equipment.

Physical Contact Suppresses Rhythmic Transfer Function Transparency In real-time performance, the only available transfer functions (on an event-by-event basis) are to introduce strategic delays (e.g. no "tachyonic" operations, or moving events forward in time, are available). Transparency succeeds when any and all intermediating mechanisms executing the transfer function are not perceived, rather only the human input behavior (as stimulus) and the perceptual output of that in the form of media (as response) are evident. Transparency in event-by-event rhythmic transfer function is thus virtually an oxymoron in any form of physical-contact device, since the delay required to achieve an event's synchronization is readily (tactile) perceived and is thus ergonomically non-maskable.

Blocked Ownership of Creative Act. In case of modern electronic MIDI controllers with physical contact interfaces such as keyboards, drum pads, and wind controllers, employing any methods of "time quantization" or "even time delay" only yields a transfer function readily perceivable to both novice and virtuoso players alike. Any such introduced delays are inescapably perceived in relation to input attack events, since they create an artificial "time gap" between the moment of sensory perception of physical contact or pressure ("playing the note") and subsequent strategically delayed response ("hearing and feeling the note"). Such trigger-response pairs are perceived in acoustic or more ordinary circumstances as "simultaneous" or very nearly so (e.g. separated by $\leqq 10.0$ msec+/−5.0 milliseconds). Any perceived greater delay inescapably breaks the potential for the player to fully psychologically and kinesthetically "own authorship" of the creative expression. Perceived delay between action and response indicates that "something else is happening after I play a note and before I perceive the result . . . that something else is not me, so the result is not entirely mine."

This Free-space Instrument Implements Transparent Rhythmic Processing. With the methods disclosed the invention advances the evolution both of rhythmic transfer function transparency and symmetry. It introduces new constraints of body-motion (gesture) mappings into musical responses, however skillfully exploiting those to yield new freedoms of creative expression. Specifically for example, it employs certain techniques of real-time Quantization (574) and auto-Sustain (573) adjustments to player input actions, thus applying symmetry in the time domain. Critical to achieving transparency in these temporal transfer functions however, are the specifically disclosed combined methods of entrainment (306) whereby strategic delays are made in practice "invisible" or re-contextualized [Sheets D2, D3]. These methods include: (a) specific concentric spatial displacements of visual feedback (surface light pipe and active fogged beam diameters) in relation to on-axis (invisible) narrow sensor trigger regions (182, 183, 184); (b) contextualization in the temporal domain of asynchronous trigger actions in terms of proximity (305) to time-symmetric media responses perceived (306) as primary input and output both, and (c) provision of certain regions of spatial ambiguity within which the ergonomic and perceptual entrainment to time symmetric response may occur, namely blurred player shadow edges (884) and non-distinct (fogged) active beam edges (264, 888).

New Forms of Musical Expression. While these various techniques introduce some apparent constraints (difficulty in producing non-rhythmic attacks for example), in our free-space invention they also introduce new forms of expression and degrees-of-freedom. A number of various methods for player's real-time control of auto-Sustain are exploited such as by Attack Speed [Sheet D8], Release Speed [Sheet E9], Height of Attack and so forth [FIG. H1-*c*]. The invention's scope of auto-Sustain (573) processing in all cases engenders in particular the very significant new musical result: the Re-attack (26). These new freedoms thus include not only transparency of Sustain and Quantize, but also such as the "Precision" (582) feature (a measure of trigger proximity to quantization), and "Event Type" (583) (by adding the Re-Attack). A manifold of parameters and applications of these are exploited [Sheet H1]. These ergonomics are not transparently available with any physical contact type of control interfaces, nor have they been implemented with any other free-space approaches to media control.

4.0 METHOD AND APPARATUS

4.1 Visible and Infrared Floods

Overhead Flood Source Fixture. [Sheets A2 through A8, A12, B2, B3, C1 through C4]. A single compact illumination fixture (19, 125) is employed above the free-space interface floor Platform (1) or Console (130), containing optically superposed (111) IR (infrared) and visible optical flood sources (831, 832). The IR flood component (831) is utilized with the primary or Type I sensor [16, 143] array to sense IR shadows [18, 148] produced by objects such as players [17, 147] or their clothing or optional props intercepting Type I sensor "trigger regions" [20, 21, 22, 144, 145].

Superposition of Overhead Pulsed Invisible near-IR and Non-pulsed Visible Sources. [Sheet A12]. The overhead source assembly [19, 125] produces dual and co-aligned output frequency components: (a) a near-IR (invisible) component between 800 nm to 1000 nm wavelength [831], amplitude pulsed or intensity square wave cycled by a self-clocked circuit [105] at a frequency of 2.0 to 10.0 khz as source for Type I sensors; together with (b) a continuous visible component [832] at a frequency between 400 nm and 700 nm. Both sources are optically and mechanically configured [103, 111, 112] to illuminate or flood the entire interface surface [1, 130] situated beneath including in particular all the Type I sensors [16, 73, 95, 99, 143, 233] comprising the interface's Type I array.

Source Fixture Positioning. In the Platform embodiment [FIG. A6-*b*], the source fixture's [19] height is adjustable [833] to (3.0 m)+/−(1.0 m) above the center "hex" segment [2] of the floor Platform. In the Console embodiment [Sheets C1 through C4], the source fixture's [125] position [889, 890, 891] is fixed at (1.0 m)+/−(0.3 m) in height above the top of the interface [130], and is positioned by means of supports [126] off-center to the "outside" or convex side of the Console enclosure [130] as compared to the typical players [147] "inside" position on the concave side.

Dual Combined Source Elements. [FIG. A12] The IR [108] and visible [107] sources are physically separate sources optically combined so that the IR may employ it's clock pulse circuit [105] while the visible remains continuous, thus avoiding a flickering visible shadow [892, 893]. A beam combiner [111] is employed such that the dual frequencies exit the fixture's baffle aperture ([112]) superposed.

IR and Visible Shadows. [Sheets A2 through A8, C4]. In use, player [17, 147] and/or player's props intervene between the Type I sensor [16, 143] array beneath and IR flood [831] from the fixture [19, 125] above, resulting in the generation of IR shadows [18, 148] over one or more of the Type I sensors. The IR source component [108] in the optical apparatus has an relatively point source aperture [459] into the beam combiner [111] of less than 5.0 mm and thus is configured to result in the generation of IR shadows exhibiting relatively sharp edges defined as ≦4.0 mm+/−2.0 mm for an intensity transition of 100% to 0%. The visible source [107] exit aperture [839] is wider at 30.0 mm+/−10.0 mm, being thereby a slightly spatially extended source by means of an appropriately extended filament or equivalent in lamp [107], and thus resulting in visible shadow [892, 893] blurred edges [894] (for the ergonomic reasons disclosed). Optical filter [109] may also include a diffuser function in the relevant visible wavelengths to achieve this result.

Large Acceptable Margin-of-Error in Fixture Alignment over Platform. [FIG. A6-*b*]. The combination of: (a) single IR flood source [79] for all Type I sensors; (b) the Type I sensor processing AGC (automatic gain control) logic of software [427] residing in memory [468, 469]; the further measures employed to suppress optical crosstalk including (c) IR source clock [105]; (d) band-pass filters [191]; and (e) mirrored sensor well [189, 204], altogether allow a significant margin of error in relative alignment [840] of the platform with respect to position of overhead source fixture [19] without significant adverse impact on Type I sensor system performance. "Without adverse impact" is here defined as maintaining an sustained accuracy rate of (false triggers+missed triggers)≦(0.05%) of all "valid" trigger region [20, 21, 22, 120] interceptions [23, 24]. Misalignment of the source fixture [19] can range up to 40.0 cm or more in arbitrary radial translation [841] from its exact centered "ideal" position without degrading this accuracy level. In the Console embodiment, since the source flood assembly [125] by means of supports [126] is in fixed relationship to the interface enclosure [130] and thus also to the array of Type I sensor modules [128], fixture misalignment tolerance is less important, although similar methods [427, 105, 191, 234, 246] are employed nonetheless to maximize robust performance.

4.2 Primary (Type I) Sensors

Primary (Type I) Sensor Array, Electronics and Software. [Sheet F7]. The invention employs a primary (Type I) optical sensor array comprised of a plurality of (n) separate optical IR-shadow-detecting sensors [16, 73, 95, 99, 143, 233]. Such sensors are photoconductive-effect or photocell devices such as silicon phototransistors, and are electronically coupled [192, 236, 250, 532] to suitable analog-to-digital ("A/D"), or to multiplex ("MUX") electronics [416] (connected to suitable further A/D on [535] microcontroller). Digital values from sensor-state-changes are in turn made available to sensor processing [427] software logic by means of I/O mapped memory or I/O registers. Such software [427] may employ polling of such registers or memory, and in preferred embodiment the sensor I/O circuit [416] further employs a processor-interrupt scheme. Software [427] interprets the value(s) of sensor I/O data and determines whether or not a "valid" shadow-transition event [23, 24] has occurred or not. If deemed valid, this warrants reporting the valid trigger and it's Speed [581] value by means of an employed MIDI protocol [444] to the CZB (Creative Zone Behavior) Processing Module software [461] on host computer [487] for further contextual processing to affect media responses [547, 548].

Number of Primary Type I Sensors. [Series A]. The number (n) of Type I sensors [16, 73, 95, 99, 143] ranges between 8 and 32, with n=16 being considered optimal in terms of human factors and musical response while maintaining acceptable trade-offs in factors of implementation cost, content authoring complexity, portability and space requirements.

Platform's Sensor Embodiment. [Series A, B and D]. In transportable Platform embodiments Variation 1 through Variation 7 [871-876] [FIG. F1*c*], Type I sensors [16, 73, 95, 99] are mounted within a "thin" (30.0 mm)+/−(5.0 mm) Platform mounted at floor level [FIGS. A1-*a*, A1-*b*]. The Type I sensor is housed in a "well" assembly [189, 204] beneath an scratch-resistant transparent window [197] the top surface of which is flush with the surrounding opaque Platform [1] surface [Sheets D4 through D7]. In a permanent installation in the form of the Platform embodiment Variation 7 [877] Type I sensors are mounted in modules equivalent to [128] except inside a "thick" Platform. (See Section 4.4, Description of Sheet D9.)

Console's Sensor Embodiment. [Series C, D]. In the Console embodiments [FIG. F1-*c*] Variation 1 through Variation 8 [878-885] Type I sensors [143, 233] are mounted within modules [128] in a floor-stand [131] mounted Console-type enclosure [130]. The Type I sensor is housed in a "well" assembly [234, 246] either beneath a clear window [229] [Sheet D8] or beneath the microbeam correction optics [244] in the modified Schmidt-Cassegrain configuration [Sheet D9]. The on-axis module configuration accepts an arbitrarily bright source for the Beam-1, including even non-LED sources such as (RGB dichroic filtered) halogen or incandescents, because the Type I sensor is better shielded from internal reflections from the Beam-1 LEDs [259] as compared to the folded "thin" elliptical design [Sheets D6, D7].

Introduction to use of Type I (primary) Sensor Data. [Series G, H]. The Type I sensor array is considered "primary" in that it's use in practice defines both player ergonomics and media responses according to shadow (23) and un-shadow (24) actions, which actions are furthermore contextualized by programmable system transfer functions (550, 551, 552, 553) into three distinct Event (583) types. Attack (25) is the result of shadowing after auto-sustain (573) finish. Finish (27) is the entrained, generalized result of unshadowing action. Re-attack (26) is the result of re-shadowing before auto-sustain (573) finish. These three Events each have their corresponding media responses in sound (547) and light (548), according to contextual logic implemented by software module (461) and associated control logic data stores (430, 431, 432, 433) called (Creative Zone Behavior) CZB Setups Data. The translations performed by such logic (461), namely from player shadow (23) and unshadow (24) actions over a given Type I sensor into these three Events is highly precise and contextual (actually employing nine States and eighteen State Change Vectors) according to State Change Table logic [Sheets D1, D1*b*]. At the same time, the various media response parameters which may be assigned to these Events are extremely flexible [Sheet H1] in configuration [Series H, i, J, K].

Introduction to use of Type II (Secondary) Sensor Data. [Series G, H]. The Type II Height (286) sensor (113) array is "secondary." Height data does not itself generate Events (583), but instead may be used in software (429, 461) to define the system transfer functions (551) of Events for Notes Behaviors (430, 565) including Velocity (572), Sustain (573), Quantize (574), Range (575), Channels (576), and Aftertouch (577) Applying Height data in the form of live kinesthetic parameters (593) for Type I-generated Events (25, 26, 27) provides an expressive alternative to using pre-assigned parameters (594) such Set Value@ (290, 291, 292), Lock to GRID (284) or Lock to Groove (285) Height may also be applied to such as timbre, nuance and effects via transfer functions (551) for Controllers (431, 566), in which case height may generate MIDI Control Change messages independent of note Events.

Even though separate messages are sent in this Nuance (600) case, these Control Changes are only apparent in terms of their alteration of the results of Notes messages sent, to MIDI sound modules and effects units (480, 886) Height may also affect visual parameters (568, 569, 570) for transfer functions (552). (See Section 3.3 Secondary (Type II) Sensors.)

Type I Sensor Transition Events. [FIGS. A2-A7]. As player (17, 147) moving limbs (455, 456), torso or props at typical velocities (2.0 m/sec+/−1.5 m/sec) intercept the overhead IR source flood (831) and thus create IR shadow (18, 148) edges passing over Type I sensors, the resultant photonic intensity transition events generate easily detected changes in output current of the photoconductive sensors (16, 73, 95, 99, 143, 233). An IR source (108) is employed having an intensity level such that shadow-edge transitions are of sufficient magnitude to obtain a robust signal-to-noise ratio into the A/D electronics (416).

Type 1 Sensor Transition Speed. Type I sensors may be employed in a context of detecting "binary" shadow actions (23) and un-shadow actions (24) only, e.g. without speed detection. Type I sensors combined with appropriately high-resolution A/D electronics and signal processing (416, 427) may deconvolve the IR source clock (105) induced square wave aspect from the detecting sensor's current output waveform, thus revealing just the transition current's ramp or slope. The preferred embodiment may thus detect dynamic range as to Speed (581) (e.g. transition current slope values), and do so independently for both shadow actions and un-shadow actions over a single Type I sensor. Detecting varied speeds even with a dynamic range as limited as four, may yet be employed with great advantage as one (581) of 6-degrees-of-freedom of Kinesthetic control (563) in embodiments incorporating both Type I and Type II arrays, or as one of 5-degrees-of-freedom in embodiments having exclusively Type I arrays (e.g. without height sensing). Type I Sensor Narrow Trigger Regions. [FIGS. A2, A3, A6, A7, B2, B3, C3]. A Type I sensor's (16, 73, 95, 99, 143, 233) linear line-of-sight from an overhead fixture's (19, 125) IR source aperture (459), comprises its "sensor trigger region" (20, 21, 22, 120, 144, 145) and is equivalent in geometry to a narrow instrument "string" such as those of the acoustic harp. The trigger regions are ideally each ≦3.0 mm in diameter (181) and should not exceed a maximum of 8.0 mm in diameter in order to maintain the ergonomically desired ratios (182, 183, 184) for spatial feedback, to avoid becoming scaled up in size (in order to maintain the preferred ratios) so as to become overly large [FIGS. D2, D3].

Multiple "Groups" of Type I Sensors. [Series A, B, C]. Type I sensor positions are arranged into concentric groups situated from their mutual center at two or more distinct radial distances: in the case of two, (5,6) for Platform and (842, 843) for Console. The innermost group has the highest angular frequency or narrower inter-sensor spacing, and outer zone(s) employ a lower angular frequency, or wider inter-sensor spacing. At a given group radius and within that group, sensors are spaced equidistantly: inner sensors approximately 30° apart (7) for Platform and 18° apart (138) for Console, and outer sensors approximately 60° apart (8) for Platform and 36° apart (137) for Console. Outer groups are typically spaced at twice the angular frequency (e.g. half the number of sensors per interface circumference) in order to optimize polyphonic event structure variety and musical response interest (see Section 4.7, Musical Response). Concentric "groups" disclosed here should not be confused with the arrangements of "Zones" which may or may not be equivalent in geometry [FIG. H6].

Platform's Collective Geometry of Type I Sensor Trigger Regions. [Series A, B]. The array of Type I sensors (16, 73, 95, 99) as arranged within any of the Platform embodiment Variations 1 through 7 (871 *through* 877) form a multi-concentric distribution. This sensor distribution, together with the single IR source aperture (459), yields collective projected sensor trigger regions (20, 21, 22, 120) in a nested multi-conical shape [FIGS. A2, A3, A7]. These surrounding a centrally standing (17) player (as a reference position) in groups which are radially symmetrical and converge overhead. The array of Type I sensors taken together have an outermost diameter at Platform level of 1.7 to 2.7 meters, with a preferred embodiment (6) shown at 2.3 meters in diameter (115.0 cm radius). Such a Platform scale is preferred (for a setup suitable for either adult or child) since it yields reasonable heights (833) of ≦3.5 meters for the overhead fixture (19) without "crowding" the player (17, 457) from too "tight" a shadow projection angle (834, 844) which would produce (unintentional) over-triggering from player's shoulders, head, and torso [FIGS. A6-*a, b*]. A Platform designed for use exclusively by younger (smaller) children may be less than 2.0 meters in diameter without detriment.

Console Geometry of Type I Sensor Trigger Regions. [FIGS. C1-C4] The array of Type I sensor modules (128) is arranged within the Console embodiment in a multi-arc distribution, such that their collective projected sensor trigger regions comprise a nested half-conical shape. The modules (128) are each oriented [FIG. C2-*c*] or "aimed" at the IR source flood aperture (459) within the fixture (125) mounted in front of and at approximately the player's head level. The array of modules extends 180° to partially surround a centrally standing or seated player (147). The array of Type I sensors taken together should have an outermost radius at Console level of 0.6 to 1.0 meters, with a preferred value of 74 cm.

Type I Sensor Zone Configurations. Type I sensors in use, are functionally allocated into variously configured 1, 2, 3, 4, 5 or even 6 "Zones" of sensors, as shown [FIG. H6-*a*] in the GUI Command Interface "Zone Maps Menu" (656) In the "fixed-zone" embodiments [FIGS. A1-A8, A10] there are typically three zones, comprised of two inner zones (630, 631) of five sensors each plus one outer zone (629) of six sensors [FIG. H3-*a*]. Zone configurations are denoted numerically (662), by means of listing zones comprised of predominantly "outer" radius Type I sensors first and in clockwise order, the "bullet" character used as inner/outer zone separator symbol, then listing zones comprised of predominantly "inner" radius Type I sensors also in clockwise order. Thus the fixed 3-zone (663) case would be denoted as "6•5,5." Zone allocations are one of the primary 6-degrees-of-freedom (563) for Kinesthetic inputs, as far as organizing system transfer functions (430, 432) to media response outputs (547, 548). Given their predominantly inner/outer character this feature may be characterized in the kinesthetic feature space (546) approximately in terms of "reach" (578), although they also may be "split" in bilateral (left/right) fashion as well.

Suppression of Type I Crosstalk from Ambient Sources. [FIGS. F2, F3, F7]. The overhead fixture (19, 125) IR source (108) being square wave pulsed by means of circuit (105) which enables sensor (16) event processing (416, 427) to robustly ignore ambient sources which might otherwise generate false trigger events, especially given not-infrequent and unpredictable ambient IR in typical installation venues. This method, together with AGC (Automatic Gain Control) in software (427), suppresses such as false responses due to periodic issuance of fogging materials close to the interface.

Suppression of Type I Crosstalk from Active Sources. [FIGS. D4 through D9]. The clocked IR source (105, 108) also suppresses false triggering due to player body (or prop) reflections from Light Pipes 1 & 2 (13&14; 70&71; 93&94; 97&98; 140&141; 230&231) and/or Beam 1 light (56, 58, 59, 129) reflected back down into the Type I sensor wells (189, 204, 234, 246). Those LED-illuminated sources are essentially continuous, and have no embedded carrier frequency to speak of except to consider their maximum possible transition duty cycles between events Responses (74, 75, 76) during player performance; and that is typically two to three orders of magnitude less (even with time-quantization function disabled and a 1-tick auto-sustain duration) than IR source clock rate. For example, successive 32nd note attacks at a rapid tempo of 200 (at or above the humanly achievable performance limit) still results in only approximately 26 attacks/second. Plus, the IR frequency component from even the high-power LEDs (218, 253) is relatively negligible; LEDs run "cool" compared to other types of sources such as incandescent, halogen, etc.

Bandpass Filtering of Type I Sensors. Type I sensors in all module configurations [FIGS. D4-*b* through D9-*b*] are optically band-pass "notch"-filtered (191) to receive IR light only within a narrow band of frequencies centered around their peak IR sensitivity wavelength and as complementary to IR source (108, 110) frequency, so as to further suppress the potential for spurious crosstalk and maximize signal-to-noise ratio in the A/D circuits (416). While shown as separate filters (191), in practice these are often integral to the sensors (16, 73, 95, 99, 143, 233) themselves in the form of optical coatings.

Wells for Type I Sensors. Platform sensors (16, 73, 95, 99) are positioned at the bottom of mirrored "wells" (189, 204) such that even if IR flood light (831) from the source fixture (19) does not directly fall upon the sensor—as will be the case from some height adjustment settings (833) or from manufacturing module orientation errors or from Platform positioning (840)—then secondary internal reflections inside the mirrored tube will do so indirectly and sufficiently [FIGS. D4 through D7]. The wells furthermore greatly reduce if not eliminate the potential for, crosstalk from ambient IR sources, even those unlikely ones having clocked components at peak frequency sensitivities, due to the narrow directional selectivity for IR source positions forced by the deep wells. Wells (234, 246) are also utilized in the Console case [FIGS. D8, D9] primarily for crosstalk reduction and need not be mirrored for reason of height adjustment since they are aimed at a fixed-height IR flood fixture (125). In practice however, module-to-source misalignments can and do sometimes occur, so these are mirrored also as an added precaution.

Type I Sensor Automatic Gain Control. The sensor preprocessing Automatic Gain Control (AGC) logic (427) resets it's baseline reference (unshadowed) IR level automatically for each individual Type I sensor A/D channel of circuit (416) after any height adjustment (833) is made, (such adjustments always done without player present on Platform). AGC also performs a baseline floating differential, polling the unshadowed level periodically at relatively long intervals (≧500 msec) to detect any slow drift in intensity such as from intervening fogging materials. AGC utilizes whatever received IR levels (whether direct or indirect) are available from un-shadowed sensor state, even though these may vary greatly, both from sensor to sensor and over time for each sensor.

4.3 Secondary (Type II) Sensors

Type II Sensors. [Series B]. The invention in preferred embodiments (875-877, 880-885) employs a secondary Type II array of (n) separate proximity (height) detecting optical or ultrasonic sensor systems (113), each independently comprised of a transmitter/emitter (115) combined with a receiver/sensor (114) configured for reflective echo-ranging. Contrasted to the narrow trigger regions (120, 144, 145) of Type I sensors, Type II sensors typically may detect proximity or height (distance to torso or limb) within a broader spatial region of sensitivity including throughout various planar, spherical, or ellipsoidal shaped regions (121, 122, 146) and still serve the intended ergonomics of the invention. Type II regions of proximity detection typically have much greater aggregate volume than those of Type I sensors, and overlap them in space [Sheets B2, B3, C4].

Number of Type II Sensors. The number of Type II sensors employed may range from a maximum of one corresponding to each and every Type I sensor module in a given free-space interface, to a minimum of one per each entire interface. A reasonable compromise between adequate sensing resolutions vs. implementation cost and software complexity/overhead would be six as shown [Sheets B2, B3, F7] for the example "Remote Platform #1 (543) which illustrates an example of Platform embodiment Variation 6 (876).

Alternative Mounting Positions. Type II sensors (113) may be positioned: (i) all within the Console (130) [FIGS. C2-*a*, C2-*d*], or (ii) all within the Platform [FIG. B2-*a*], or (iii) all within an alternate overhead fixture assembly (not illustrated), or (iv) mounted in a combination of above and below locations (123) as in the arrangement shown for the alternate configuration of Platform Variation 6 (883) [FIGS. B3-*a, b, c*], or (v) in independent (external) accessory modules which may be repositioned (not illustrated).

Type II Sensor Array. In the Platform cases (875, 877), Type II sensor modules may be mounted in a circular distribution with approximately equal angular distribution (116) in the case of six at 60°, and at a radius in-between the radius of the inner (5) and outer (6) Type I sensor groups. For both Platform and Console cases, Type II sensor module detection regions (121, 146) are aimed so as to encompass as much as possible of nearby Type I sensor line-of-sight trigger (120) regions. In the Platform case Type II sensors are ideally mounted within Platform-flush plug-in modules (117) together with replacement bevels (118) and safety lamp (119), or in Console instances (880-885) integrated into the main Console enclosure (130). Type II sensors may alternatively be contained within external accessory modules either positioned adjacent to the main Platform on the floor, attached to the Console enclosure (130) or its floor stand (131) or separately mounted above and/or around the player, provided suitable software (428) adjustments are made for these alternative locations. (The cabling and ergonomic aspects of such an external Type II modules configuration however, are less desirable.)

Overlapping Type II Regions. Type II sensors may be arrayed to have partially mutually overlapping (121, 146) detection spatial regions [Sheets B2, B3, C4] in order to obtain a best spatial "fit" in also overlapping adjacent corresponding Type I trigger regions (120) This also serves to maximize Type II data's signal-to-noise ratios over all employed spatial regions of detection, by averaging or interpolation in software (428). The spatial Type II detection regions, individually or taken together, may comprise a cylindrical, hemispherical; ellipsoidal, or other shape.

Upper and Lower Groups of Type II Sensors. In Platform instances, if Type II sensors (113) are incorporated which have a limited range of distance sensing (≦60% of distance to IR aperture (459) of fixture (19), two Type II groups may be employed. One group has three spaced at 120° (124) in the Platform aimed upwards, and the other group has three spaced at 120° apart aimed downwards and housed in an alternate overhead fixture (123) [FIG. B3-*c*]. The relative angular position of the two groups may be 60° shifted, so the combined array of two groups has a combined angular spacing of 60° between Type II modules thus covering 360°, and alternating between upward and downward directions. In the Console cases, provided the range of proximity detection is sufficient (≧80% of Console to IR source distance), Type II modules (113) may all be mounted either within the Console (130) as shown [FIGS. C1, C2, C4] or the flood fixture's (125) enclosure.

Type II Sensor Dynamic Range. Type II sensors (113) together with their associated electronics (415) may employ various dynamic ranges for proximity (height) detection response within their sensitivity regions (121, 146). These dynamic ranges may also extend across complex 3D shapes such as nested ellipsoidal layers. Dynamic ranges of as little as 4 and as much as 128 may be effectively employed, with a higher dynamic range generally exhibiting an increased advantage in the scope of available ergonomic features of the invention. Notably, such dynamic ranges may include representation of relative "lateral" positions orthogonal to an on-axis projection from the Type II module (113), in addition to or combined with reporting "proximity" or linear distance (height) from the module. Type II sensor data processing (428) takes this into account, to weight or interpret Type II-data primarily in terms of on-axis distance or height, since Type I sensors detect lateral motions already (such motions being the most common form of shadow/unshadow actions.)

Data Rates for Type I vs. Type II Sensors. Type I sensors (16, 73, 95, 99, 143, 233) together with their associated MUX and A/D electronics (416) and processing software logic (427) may in practice exhibit duty cycles of detecting valid shadow/un-shadow events of as little as 3.0 msec. Type II sensors (113) with their associated electronics (415) and logic (428) are configured to report proximity range values at substantially slower duty cycles, on the order of 45.0 msec+/−15.0 msec. Such slower Type II data reporting rates are desirable and acceptable since their data is employed by system logic (461) to generate parameters (593) used with the much faster Type I trigger events (25, 26, 27) used in the creation of ultimate media results (MIDI note ON/OFF messages with their parameters). This is why Type II sensors may even employ such as the relatively "slow" ultrasonic technologies (vs. much faster optical techniques) with no significant disadvantage as to the ergonomics or musical response times of the invention.

Methods of Type II Post-Processing: Given the effective sampling rate differential between Type I and Type II sensors, event processing logic is utilized over time in order to interpret and apply Type II data to parameters of Type I Event responses. For example successive Type II values are via software (428, 429) averaged (706, 707) or the most recent detected height (705) over a given Type I zone (triggered) is applied [Sheets F1, F2, F3, i3].

Suppression of Type I and Type II Crosstalk. When both Type I and Type II sensor types are employed in a given interface, a substantial differential is employed between the Type I IR source (108) carrier frequency from clock circuit (105) vs. the modulation frequencies used in encoding of IR from Type II optical transmitters (115). Otherwise, there would be crosstalk both: (a) from Type II IR intended for its receiver (114) but which also falls (from unpredictable and chaotic reflections) into the Type I sensor wells, and also (b) from the Type I IR Flood (831) falling into Type II receivers (114) Non-optical Type II sensors may alternatively be used, such as ultrasonic in which case these crosstalk issues become moot.

4.4 Visual Feedback—Apparatus

Type I Sensor/LED Assemblies. [Series D]. Type I sensors are mounted within an opto-mechanical assembly (or "module") also housing active LED-illuminated light pipe indicators at near the free-space interface's surface (1, 130). In between the innermost sensor and Light Pipe 2, beam-forming optics (244) project (fogged) active visible microbeams (60,129). The array of (n) such microbeams form a conical array around the player.

Concentric Light Pipes. [Series D]. Each Type I sensor (16, 73, 93, 99, 143, 233) is surrounded by two concentric LED-illuminated display surfaces: the outer Light Pipe 1 (or LP-1) (13, 70, 93, 97, 140, 230) and the inner Light Pipe 2 (or LP-2) (14, 71, 94, 98, 141, 231). In the Platform embodiments, both Light Pipes are visible through a clear, scratch-resistant cover (197) which cover also protects Beam 1 optics and Type I sensors from damage by player impacts. In the Console embodiments, the Light Pipes have a 3-D shape (140, 141, 230, 231) extending above the interface enclosure (130) in a module enclosure (235, 249).

Beam-Forming Optics. [Sheets D6, D7, D9]. Centered within Light Pipe 2 is the projected microbeam's exit aperture, Beam-1 (15, 72, 142). The superposition of Type I sensor trigger region line-of-sight input at the center of Beam-1 output, is achieved either by perforated elliptical mirror (205) or a modified Schmidt-Cassegrain arrangement (244, 247, 248, 261).

Co-Registration of Sensing and Visual Feedback. [Sheets D2, D3]. Each Type I sensor's invisible 3D ("line-of-sight) trigger region (20, 21, 22, 120, 144, 145) is spatially co-registered on-axis with three of its corresponding visible outputs: Light Pipe 1 (13, 70, 93, 97), Light Pipe 2 (14, 71, 94, 98), and Beam 1 (15, 72).

Alternative Sensor/LED/Light Pipe Module Embodiments. [Series A, C, D]. Section 4.4 Descriptions of Drawings for Series D in particular [Sheets D4, D5, D6, D7, D8, D9] discloses in detail these variations. The use of Sensor/LED modules of Class A (90, 91, 92), Class B (96), Class C (10, 11, 12), or Class D (68) differentiate Platform embodiment Variations 1 through 4 (871-874). The distinctions between these four sensor/LED module Classes includes: (i) their use of fixed-color vs. dynamic RGB; and (ii) their use of surface light pipes (LP-1 and LP-2) only vs. use of both surface light pipes and active projecting microbeams (Beam-1). Where Type II sensors are employed in the Platform, Class B or Class D are always used, as these modules include full RGB color modulation functionality which is essential to providing sufficient degrees-of-freedom (584, 585, 586, 587) of feedback for the Type II Height (580) data. The Console embodiment Variations 1 through 8 (878-885) all use one of two-circularly symmetric, on-axis type of Sensor/LED modules [Sheets D8, D9]. These module types both have RGB processing as the Console is intended to employ floating zones [FIG. H6] since its light pipes 1 and 2 are uniformly circular. The difference between the two Console modules disclosed is whether or not projecting microbeam optics are included. The "thick" Platform Variation (877) also uses the on-axis, D-Class module type of [Sheet D9].

Opposed Beam-1 Outputs and Type I Inputs. The Type I sensor (16, 73, 95, 99, 143, 233) direction of invisible sensing input vs. the active visible output of Beam 1 (56, 58, 59, 129) are optically opposed, in that their respective light sources are opposed. The overhead IR (831) and visible (832) source floods are aimed "downwards," while the active microbeam-forming optical assemblies are aimed "upwards." This reduces potential for crosstalk. Aiming the active visible microbeams upwards furthermore eliminates the occurrence of false/multiple player shadows (confusing the kinesthetic ergonomics) which could be the case if Beams-1 were aimed downwards.

Sensor Zones Demarcation. Demarcation of zones is accomplished by operational logic (656) for LEDs (198, 199, 216, 217, 218, 237, 238, 251, 252) control (for 'floating zones'), and may also be designated by geometries of Light Pipe design (for 'fixed zones'). In the floating "n-Zone" Platform embodiment Variations 2, 4, 5, 6 & 7 (872, 874, 875, 876, 877) and for all Console embodiment Variations 1-8 (878-885), a Zone-by-Zone [FIG. K2-*a*] color assignment of Light Pipe 1&2 and Beam 1 Hues, together with uniform module (68, 96) Light Pipe geometry (such as hexagonal), may be employed. In fixed-Zone interfaces [Sheets A1-A8, A10] Light Pipes 1 and 2 employ geometric shapes distinct to each Zone, for example the circle (11, 91), hexagon (12, 92), and octagon (10, 90). Fixed-zone interfaces may further reinforce the ergonomic distinction between Zones by employing Hue assignments (e.g., different Hues for each respective Zone), these being constructed with various suitable fixed-color LEDs (193, 194, 207, 208).

Gap Between Light Pipes. [Sheets D2, D3]. A dark (absorptive) concentric gap (178) between Light Pipe 1 (93, 97, 13, 70, 140, 230) and Light Pipe 2 (94, 98, 14, 71, 141, 231) is employed, which gap is equal to or greater than the "thickness" (difference between inner and outer radius) of Light Pipe 2.

Sensor/Light Pipe Ratio. The minimal ratio of Type I sensor trigger region diameter (181) to outermost Light Pipe 1 diameter (179) equals at least 1:12, for example 72.0 mm diameter light-pipes to 6.0 mm diameter sensor. However, a minimal diameter for the Light Pipe 2 is also recommended, such that even if (for example) the sensor diameter is less than 1.0 mm, the Light Pipe 2 outermost diameter should still be at least 60.0 mm.

Sensor/Immersive Beam Ratio. The (fogged) Beam-1 (60) diameter (186) has a minimum ratio (considered in planar cross section) to Type I trigger region diameter (181) of at least 1:6, for example 36.0 mm at exit aperture (15, 72) to 6.0 mm diameter sensor. A slight Beam-1 divergence (e.g. lack of exact collimation) expands at maximum distance (overhead fixture height) (883) to as much as 1:24 ratio for a 150.0 mm diameter visual beam (887). The beam-forming optics (214, 215, 205, 206) and exit aperture (186) for the active Beam 1 are configured so as to result in this extent of beam divergence.

Blurred Edge of Active Visible Beams. [Sheets D6, D7, D8, D9]. The beam forming optics also are so configured so as to result in blurred beam edges (264, 888), preferably of Gaussian or similar beam intensity profile. Sharper apparent beam edges are disadvantageous, as they would diminish or even eliminate a desired "envelope of spatio-temporal ambiguity" by making the moment of traversal into the immersive beam edge more apparent. (See Section 4.4 Description of Series D Drawings, in particular for [Sheets D2, D3].

Conjunction of Active Beams at Fixture Apex. [Sheets A8, C1]. Contrasted with the most commonly occurring heights of intercepting sensor trigger regions (20, 21, 22, 144, 145) (between 1.0 m and 2.0 m for adult) where corresponding active beams are well separated and distinct, at near overhead-fixture (19, 125) height is the special case where multiple active beams are superposed since all are with diverged diameters (887) and are converging at the apex around the fixture into its baffles (102).

4.5 Visual Feedback—Functional

Frame of Reference. While the free-space instrument is a physical device located in space (on the floor or mounted on stand (131)), the point of human interaction is not at the interface surface, but in fact in empty space above it. Within that space the immersive Beams-1 (56, 58, 59, 129) are superposed with the sensor trigger regions (20, 21, 22, 120, 144, 145). In exact planar-projected relation (834, 844) to this geometry, the surface Light Pipes 1&2 (13, 14, 70, 71, 93, 94, 97, 98) and player visible shadow (892, 893) are both co-registered with the sensor trigger regions. The net perceived effect is not so much that the passive and active visual elements represent the instrument, but rather that they comprise a single, coherent frame of reference in space (full-cone shape for the Platform and partial cone shape for the Console) for the player's Body which is the instrument.

Collision-Detection Metaphor. The active visual media responses may be experienced as "collision detection indicators" of the body intersecting through the frame of reference conical shape [FIG. A8-*a*]. The active responses highlight the spatial frame of reference in changing Light Pipes 1&2 and Beam-1 Hue, Hue Variation, Saturation and/or Lightness (which of the latter parameters are changeable depends upon the embodiment Variation and the sensor/LED module Class). Active visuals thus are experienced as a result of play rather than as means of play.

Visible Shadows. In use players (and/or players' props) intervene between the array of sensors (95, 99, 16, 73, 143) and the IR flood (831) from the fixture above (19, 125), resulting in the generation of an invisible visible IR shadow (18, 148, 458), and simultaneously generate a visible shadow (892, 893) from the fixture's visible flood component (832) Player's perception of the visible shadow positions are co-aligned very closely (+/−5.0 mm at sensor level) to the invisible IR shadow position. The only exception is their differing respective edge focus.

Confinement of IR/Visible Floods. The overhead fixture (19, 125) includes a surrounding optical stop baffle (112) confining the radius of the visible flood at interface surface to a maximum of 0.5 m beyond its circumference, reducing the potential for multi-shadow confusion between two or more adjacent interfaces in a given venue.

Blurred Visible Shadow Edges. The visible overhead source component is optically configured via a slightly extended optical aperture (839) so that the edges (894) of player shadows generated from play at most-frequent heights (1.5 m)+/−(0.5 m) are slightly blurred, preferably exhibiting a Gaussian intensity gradient. Such blurred edges may range between 20.0 mm and 30.0 mm in width, and ideally not less than 10.0 mm, for a 0% to 100% intensity transition. The edges are blurred enough to maintain sufficient ambiguity for masking asynchronicity, yet are sufficiently clear to indicate body position with respect to sensor regions especially before and after active responses. Where Beams-1 are not fogged, then position of player's shadow may serve to indicate spatial proximity to sensor trigger regions, this being somewhat analogous to a piano player resting fingers on keys without yet pressing down to sound the notes. Without such a player visible shadow feedback, it would be difficult to determine (at most-frequent heights of play and typical body positions) the lateral proximity (e.g. the potential) to causing a trigger, without actually triggering the sensor.

Familiar Shadow Paradigm. A player's body shadow is a familiar perception in everyday experience. The simple 2-D planar shadow projection is further reinforced by corroboration of feedback from surface Light Pipes 1&2 and Beam-1 responses which are spatially co-registered with the shadow. These in combination support rapid learning of the 3D perceptual-motor skills of intercepting (shadowing/unshadowing) Type I sensor trigger zones at all heights and all relevant X-Y-Z positions in 3D-space. "Rapid learning" here means: proficiency achieved during the first 30-60 seconds of play, even for first-time casual players.

Intensity and Hue Balance of Multiple Visual Feedback. The overhead visible flood source is balanced in Intensity and Hue (with respect to Light Pipes 1&2 and Beam-1) in such a fashion so as to maintain a clearly-visible contrast of player shadow (892, 893) in the context of the Light Pipe 1&2 and Beam-1 active responses. The visible source is also balanced in Intensity so as to not diminish the contrast directly with those active responses, and no LED-illuminated surface Light Pipe 1&2 or immersive Beam-1 Hue exactly matches the reserved Hue of the visible flood.

Visual Feedbacks Accommodate All Ambient Lighting Conditions. The visual response paradigm employs multiple forms of visual feedback to provide maximum possible synesthesia [Series G] under varying ambient lighting conditions. The LED-illuminated Light Pipes 1&2 and Beams-1 provide feedback in passive form as a spatial frame of reference when in the Finish Response State, and an in active form when changing to Attack or Re-Attack Response States. These together with the passive player-projected visible shadow provides multiple correlated and synesthetic visual feedback sufficient for clear, easy and precision performance under varied ambient lighting conditions.

(a) Normal interior ambient levels, no fog. (2 correlated visual feedback)
  1—Surface Light Pipes 1 and 2.
  2—Projected Beam 1 light reflecting from player's body or prop (secondary).
(b) Darkened ambient levels, no fog. (3 correlated visual feedback)
  1—Surface Light Pipes 1 and 2.
  2—Player's 2D shadow projection on the interface surface.
  3—Projected Beam 1 light reflecting from player's body or prop (secondary).
(c) Darkened ambient levels and with fog. 4 correlated visual feedback)
  1—Surface Light Pipes 1 and 2.
  2—Player's 2D shadow projection on the interface surface.
  3—Projected Beam 1 light visible in space via the fog effect.
  4—Projected Beam 1 light reflecting from player's body or prop (secondary).

Proximity and Sync Entrainment by Feedback Design. Two types of opto-mechanical constraints are employed for one common ergonomic effect: contextualizing player perception of the most-of-the-time asynchronous Type I sensor trigger (shadow/unshadow) transitions as being in Proximity (305) to their subsequent time-quantized output responses (25, 26, 27, 74, 75, 76). While differing in approach, both techniques accomplish a similar and inter-reinforcing objective (see Section 4.4 Description of Drawings Series D, in particular [Sheets D2, D3]. The system entrains a perceived synchronous spatio-temporal kinesthetic input control space while the event-by-event actual kinesthetic input control space is typically asynchronous. The two forms of optomechanical design constraints employed to achieve this result (working together with software module (461) logic) are:

(1) Spatial Displacement (active). Use of minimal ratios between the radius of the Type I sensor trigger region and the radius its surrounding planar Light Pipes I and II (182, 183), and between the radius of the Type I sensor and the radius of the 3D immersive (fogged) Beam-1 (184).
(2) Envelopes of Ambiguity (passive). Use of Gaussian blurred edges for both the passive 2D player visible shadow (894) and the 3D (fogged) Beam-1 profiles (264, 888).

Multiple Entrainment. [FIGS. D1, D1-*b*]. The preferred embodiments (876, 877, 883, 885) simultaneously employ all these types of entrainment feedbacks together, each being ergonomically synchronized and spatially co-registered with each other. The entrainment effect is maximized by the typical lateral speeds and continuity of player motions, combined simultaneously with all of these:

Ratio between Type I sensor and Light Pipe 1 radius (182);
Ratio between Type I sensor and Light Pipe 2 radius (183);
Ratio between Type I sensor and Beam 1 radius (184);
Blurred (Gaussian) edges of visible player shadow projection (894);
Blurred (Gaussian) edge profiles of active beams (264, 888).

4.6 Methods of Play

Unconstrained Method. A player is unconstrained in that he or she may move about in a great variety of body positions and movements, to affect shadow/un-shadow actions, from both the inside and the outside of the conical shape of the IR Type I trigger regions, using any combination of torso, head, arms, hands, legs, feet and even hair.

Styles of Player Actions. Player body actions may range from gentle reaches or swings (455, 456), to any dance-like motions, to acrobatics, flips, head stands, tai chi, martial arts, and also from various seated (including wheelchair) or even lying down positions.

Effortless Precision. Transfer functions in the rhythmic (time) domain (573, 574) yield the freedom to play (perform) expressive, complex and inter-subjectively aesthetic music in an unencumbered free-space full-body context. The invention employs rhythmic transfer functions in a manner which:

Encourages continuous player motion.

Ensures precision of media response.

Promotes spontaneous complexity and variety of polyphonic structures.

Ensures rhythmic synchronization (474) between live note events (510, 511) and accompaniment pre-recordings (487, 513, 525).

Ensures overall aesthetic character of responses.

Height-Invariance to Type I Attack, Re-Attack, Finish Events. [Series A] Any shadow-creating body (47), or prop intercepting the overhead IR Flood (831), at any height along a given Type I sensor's line-of-sight ray (20, 21, 22, 120, 144, 145) (source-to-sensor) will result in the identical States Change Vector as per the State Changes Table [Sheets D1, D1-*b*] This promotes player's freedom of expression and variety of body motion simultaneously with repeatable, precise responses for each sensor. For example, a shadow formed at a 20.0 mm height above a Type I sensor will result in logically the same State Change as a shadow formed at a 2.0 meter height. The only exception to this convention, is where the Height (286) data is configured for use by (the Creative Zone Behavior setups) to influence such as the Attack Quantize (269) and Re-Attack Quantize (280) definition for Notes [Sheets H1, E10], which cases would be considered advanced or "virtuoso" CZB Setups.

Sensor Region Separation vs. Conjunction. A centrally standing player (17, 147), with horizontally (or slightly lower than horizontal) outstretched arms (or legs) can easily shadow sensors only within the inner concentric region (20, 22) at radius (5, 842), and do so either without significantly reaching (leaning) or moving (stepping) off-center. A centrally positioned, upright, standing player may easily intercept multiple sensors across both concentric radius (5, 6, 842, 843) by reaching outstretched arm(s) at heights above horizontal level, thus intercepting the overall cone (834, 844) where its diameter is less, and thus generating shadows (18, 458) of larger scale where such shadows fall at Platform level. This contrasts with the case of a limb (such as a leg) at near-Platform level traversing considerable distance (25.0 cm+/−5.0 cm) between two (7, 9) neighboring sensor trigger regions to affect triggers of both sensors.

Reaching Through Sensor Regions. The outer radius (6, 843) sensors are so offset in angular position (8) with respect to angular position of (7) of inner radius sensors, such that a centrally positioned standing player (17, 147) may generate an outer radius sensor region trigger (shadowing an outer zone module (21)) simply by slightly leaning and/or reaching (thrusting) between inner radius sensors (while not shadowing an inner zone module (20, 22) in order to reach the outer radius sensor. Similarly, limbs from a player positioned outside the cone may reach or thrust between outer radius sensors (without triggering outer radius sensors) to reach and trigger an inner radius sensor.

Multi-Zone Play. Radial sweeps of limbs can play various sensors within multiple radius zones simultaneously, provided appropriate lean and/or reach (torso angle and/or limb height) is applied.

Use of Props. Player(s) also may optionally employ any shadow-creating props such as paddles, wands, feathers, clothing, hats, capes and scarves.

Multiple Players. Two or more players may simultaneously position and move themselves above and around the Platform so as to generate shadow/unshadow actions as input into the system.

4.7 Musical Response

Event-by-Event Rhythmic Processing. The invention favors player event-by-event (23, 24) musical transfer functions (551, 552, 553) [FIGS. D1, D1-*b*, Series E], as contrasted with the alternative approach of single-trigger activation of multi-event responses such as subsequences or recording playbacks. The preferred approach maximizes clear feedback and player ownership of creative acts, contributes to optimal ergonomics, and also enables the maximum degree of variation in forms of polyphonic musical structures.

Affect of Height on Polyphony. The disclosed systems (in both Platform and Console embodiments) incorporate a slight variation in degree of achievable polyphony relative to varied heights of play. Positioned at a low height near the surface of the interface, with minimal motions a given IR-intercepting limb passing over a sensor can trigger individual responses from that sensor only. Positioned at the opposite extreme of height, (i.e. player raising one or both hands up) close to the IR/visible flood fixture (19, 125), a single limb can with little motion trigger responses from all (n) Type I sensors in all sensor zones at once, since all sensors' line-of-sight trigger regions (20, 21, 22, 120, 144, 145) all converge upon the IR source exit aperture (459) through optics (103). A given limb or object used to gesture at various heights of trigger zone interception between these two extremes (near-interface vs. near-IR source) produces a range of simultaneous polyphonic responses between (1) and (n) notes, where (n)=number of sensors in the interface. For the free-space performer this introduces an interesting range of contrasting musical results from movements and postures near the interface surface vs. those reaching overhead (in Platform case) or those reaching upward and forward (in Console case).

Sensor Zones and Instrument Voicing. [Series F, H]. Typically the primary parameter in terms of musical response differentiating sensor zones, is musical instrument "voicing" assignment(s) of the connected sound generating equipment, by means of the Notes Behaviors for Channels (576). Most MIDI sound modules, samplers, etc., distinguish instrument settings by MIDI Channel, such that Note On/Off messages sent to different channels result in notes with different instrument sounds or timbres. The invention provides for multiple instrument voicing and/or effects 'stacked' per each zone. Channels may be setup with pre-assignments (594) as illustrated in CZB Setup examples #2 (296), #3 (297), #5 (299) and #6 (300). A similar result can alternatively be achieved by means external to the Free-Space logic (461) such as by employing MIDI Program Change and bank select Control Change messages in sequencer (499, 440) tracks (497), or by various Channel mapping functions available in Other MIDI Software (439) and controlled by its track (498). In using these external methods alone however, Channel assignments will always be the same for Attack Event (25) and Re-Attack Event (26) generated Note messages. Only the internal free-space Channels (576) function via software (461) allows differentiation of Channel assignments between the Attack (25) and Re-Attack (26) Events. This can be a very useful and musically rich application of the free-space Re-Attack. Furthermore the internal Channel configuration provides for the uniquely free-space behaviors dynamically controlled by players according to the additional live kinesthetic parameters (593) including Height (286), Speed (287), and Precision (288)—illustrated for the case of Precision, in example #1 (295) illustrated on [Sheets i5, J5].

Multiple Type I Sensor Zones with Independent Output Response Behaviors. Zones in practice [Sheets H3, H6] are typically operated independently with respect to each other as regards their response modes and parameters (565, 566) including Channel (576) as discussed above, Quantize (574) including for Grid (284) or Groove (285), auto Sustain (573), polyphonic Aftertouch (577), Velocity (572) and Range (575). Creative Zone Behaviors (CZB) may be quickly adjusted in any and all of their response parameters "on the fly" during play either by the GUI CZB Command Interface [Series H, i, J] or by sequencer-stored CZB Command Protocol messages [Series F]. These features greatly increase the scope of musical expressivity, multi-instrumentation, multi-player orchestration, and seamless aesthetic integration with pre-recordings.

Coordinated Use of Channel and other Behaviors. Creative Zone Behaviors may be made to aesthetically correspond with instruments and the compositional aesthetics of the song. For example, a Zone set to a pizzicato string voice (by Channel assignment) could employ a shorter Quantize (574) and/or a shorter Sustain (573), while in contrast a legato flute could employ longer values for Quantize and/or Sustain. When instrument voicing is re-assigned dynamically for a Zone, so also may other CZB Behaviors be adjusted for that Zone to aesthetically match the instrument change.

Use of Stereo Pan. To reinforce the correlation of physical sensor Zones with the audio output, the system may employ the "Pan" parameter (stereo balance of relative audio channel levels) as part of Controller (566) Creative Zone Behaviors (431) or the Voices panels (611, 633, 634), or this may be done by means of Audio Mixer (481) or Sound Module(s) (480, 866). This can be used to match the general physical positions of the Type I sensor Zones on the Free-Space Interface to audio spatialization. For example in the (6•5,5) zone configuration (663), the inner left zone (630) of (5) sensors may have its audio output set at a more "left Pan" position, the inner right zone (631) of (5) sensors may use a "right Pan" position, and the outer zone (629) of (6) centers may use a "center" Pan position, for example. This further reinforces the (sound-light-body) Synesthesia (560) effect, and amplifies the sense of Kinesthetic Spatial Sync (306) engendered.

Use of Reverb. Similarly, responses from trigger of outer radius sensors (5, 842) vs. inner radius of sensors (6, 843) may also employ differing levels of Reverb and other effects (566) to generate spatial a feel of "nearer" vs. "further". This further reinforces the (sound-light-body) Synesthesia (560) effect, and amplifies the overall subjective sense of Kinesthetic Spatial Sync (306) engendered.

Use of 3D Sound. In addition to or instead of the use of such as audio Pan and Reverb in the fashion disclosed above, various 3D or spatially processed sound methodologies may also be employed to match perceived audio positions even more closely to physical sensor positions. This further reinforces the (light-sound-body) Synesthesia (560) effect, and amplifies the sense of Kinesthetic Spatial Sync (306) engendered.

Re-attack During Auto-Sustain. The invention employs a distinct method of Re-attack (26) response resulting from player shadow action during auto-Sustain duration (see State Changes Table [Sheet D1*b*]). Where auto-Sustain is employed in free-space, it is an evident performance option to move back over (re-shadow) a sensor whose previous response (both audio and visual) is still ON. Most MIDI sound modules, however will have no audible result from receiving additional note-ON messages (having non-zero Velocity) for a sounding note; ("for non-zero velocity" since some modules will interpret velocity zero Note-ON as a Note-OFF). In other words, modules ignore a note-ON message received after a previous note-ON message with no intervening note-OFF message received for the same note number. Where auto-sustain is not employed this state of affairs is seldom an issue, although at times polyphonic aftertouch is employed however that only affects velocity level.

The invention implements the Re-Attack as a full-fledged ergonomic feature of music media expression which may be uniquely and variously applied to all transfer functions of Creative Zone Behaviors (430, 431, 432, 433), not only relative Velocity. Re-Attack processing is disclosed in the State Changes Table [FIG. D1-*b*] and examples detailed in [Sheets E6, E7]. Re-Attack generates a truncation of the current Note ON: first a Note-OFF message is generated $V_4$ (164) or $V_{15}$ (175) and sent out immediately. Then a Note-ON message is generated $V_5$ (165) and sent once the next time-quantization ("TQ") delay has passed (according to the Quantize setup active for that Zone at that time). Sending the unquantized note OFF event first, and then the quantized note ON event gives the MIDI Sound Module(s) a brief "gap" to separate the notes, and to allow a more natural finish to the previously auto-sustained note. While sometimes there may be an instance when an "exact" Re-Attack occurs in the cases of State Change $V_{16}$ (176) or $V_{18}$ (870) and thus the Re-Attack Note OFF is immediately followed by the Note ON, this still typically demarcates the adjacent note attacks sufficiently for discrimination on most sound modules, since the intervening Note Off message was in fact sent.

Gestures for Complex Arpeggiation and Polyphony. Numerous (effectively unlimited in practice) limb gestures result in complex and interesting arpeggiation and substantial polyphony, taking advantage of the sensor geometries and multiple concentric sensor Zones together with the CZB algorithms for rhythmic processing. The employment of multiple differing Zone-specific parameters, including such as Quantize and auto-Sustain, provides complex polymodal rhythms with simple gestures for example spanning multiple Zones of sensors. Even when such gestures [Sheet E7] are triggering only one or two sensors, the musical results can be highly variegated and interesting.

4.8 Command Interface and MIDI

Correlated (Display and MIDI) Command Interface. [Series F, G, H, i, J, K]. As is often the case for other MIDI devices, commands are implemented both in MIDI and the display interface (GUI) in a simultaneous and tightly coordinated (550) fashion. For example, when a display interface control is changed by a user, such as selecting from a displayed menu or from an array of graphic icons, corresponding MIDI messages (491) are sent at the same time that relevant system response behaviors are adjusted. Similarly, when a valid MIDI message in the Command protocol (502) is received, the corresponding GUI display element(s) are updated, and the relevant system response behaviors are adjusted.

Display Command Interface (GUI) and MIDI Command Interface. [Series F, G, H, i, J, K]. Reductions to practice include the use of specific MIDI protocols (444, 445, 502, 510, 512) and a user interface or GUI via such as an LCD or CRT display (442) and input devices such as mouse, touch-surface or trackball (443). The display may be either embedded into the Interface surface, as in Console embodiments (880-885), or remote from the Interface surface as in Platform embodiments (871-877).

MIDI Protocol Uses. [Series F]. MIDI message types including System Exclusive, System Realtime including Beat Clock, Note On/Off and Control Changes are used in three protocols specifically designed for free-space. These are the CZB Command Protocol (502), the Free-Space Event Protocol (445) and the Visuals and Sensor Mode Protocol (444). These free-space MIDI protocols and their uses, along with novel uses of conventional, third-party manufacturer compatible protocols, are disclosed in depth, in the Section 4.6 Description of the Drawings for Series F.

Changes in Behaviors. Creative Zone Behavior changes become available to players in most cases during the interactive performance session, as the result of playback of CZB Command from CZB Command Tracks stored in a MIDI sequence.

Start-up Auto-Load of Presets or User-Defined Defaults. Upon, free-space software startup (boot) all Creative Zone Behaviors are automatically initialized and all interface screen controls may display those settings accordingly. Boot-up CZB Setups (data) for behaviors are loaded either from banks of "Factory Presets" (stored in write-protected memory), or are loaded from other and previous "User-Defined Defaults"). These boot CZB Setups remain active until any further CZB Commands are received via GUI or MIDI.

Context of Display Interface Use. [Sheets F4, F5, F6]. A CRT or LCD graphic display and relevant input device(s) are employed primarily for the definition, selection and control of Creative Zone Behaviors and their defining CZB Setups data during studio authoring of interactive content titles. The process of authoring content (in terms of the resulting content data) consists primarily of using the display to control the capturing of desired CZB Command sequences which are later used to recall or reconstruct the corresponding CZB Setups. The graphic display also may be used for the selection of content titles by any free-space players just before initiating a session of play. The display and associated input device are rarely to be used by players during free-space music performance itself, although this is appropriate for practiced and virtuoso players and for authoring venues, in particular using the Integrated Console embodiments (882-885).

Use of Speech Recognition. Use of the CZB Command Interface during performance, especially for all Platform embodiments (but also for Console embodiments (878-881)), may optionally be made more practical (and to minimize distraction from the free-space paradigm) by means of providing the player with a wireless microphone as input into a suitable voice recognition system on the host PC computer (487) which translates a pre-defined set of speaker-independent speech commands into equivalent input device commands.

4.9 Setup, Portability and Safety

Adjustable to Player Height (Platform). [FIG. A6-*b*]. For the Platform embodiments the overhead IR/Visible flood fixture (19) position is adjustable in height (833) ranging between a minimum of 2.5 meters for a small child player (457), to a maximum of 4.0 meters for a tall adult player (17), with a median of 3.25 meters. Height re-calibration has the result that when a player of any particular height stands upright (not leaning) upon the center of the Platform (1) (considered as a reference position) their outstretched arms, in a slightly upward angle (≦15° above horizontal), intercept the illumination floods to form superposed IR and visible shadows (18, 458) over one or more of the Type I sensors in at least the inner radius (5). Small players (457) with fixture set too high will need to step away from center and/or lean far to reach sensor trigger regions. Conversely, adult players with fixture too low will feel overly confined to an exact central position, and will "over-trigger" (e.g. trigger when not intended) because of their over-scaled and over-reaching shadows—even from head and shoulders. For this latter reason, should height adjustment (833) not be employed, then the height of the IR/Visible flood source is fixed at 3.5 to 3.75 meters.

Beam 1 Positioning for Platform. [Sheets A6, D9]. Without means of servo- or manual-activated in-Platform beam positioning, overhead source height adjustments (833) will leave intact the conical distribution geometry (56, 58, 59) of the visual beams but their mutual apex may "miss" the flood source fixture (19) in space (e.g., converging either above or below it). At the same time, of course the geometry of the apex of Type I sensor trigger regions always tracks from the fixture's exact exit aperture position. For any particular height setting, this will result in a slight misalignment of the Type I sensor trigger regions with respect to the fogged beams. During performance the disparity becomes progressively greater at heights of play approaching the fixture, however this is nonetheless insufficient to noticeably degrade the ergonomics of Kinesthetic Spatial Sync, since the entrainment effects are so powerfully reinforced at the more often used (middle and lower) heights of play and where such misalignment (if any) is negligible.

An alternative idealized "thick" Platform embodiment Variation 7 (877) however, may include embedded servo-mechanisms or similar means to swivel into the correct angular position a modified Class D type of on-axis LED/beam/sensor modules [FIG. D9]. Alternatively, manual "click-stop" mechanisms (at each module) may be employed to adjust the modules angle. With either method, visible Beam-1 orientations may be made to match various overhead source fixture heights. Such coordinated fixture and beam-forming module height adjustments may either be continuous, or in the form of a step function over a limited number of discreet cases such as "Extra Short, Short, Medium, Tall, and Extra Tall". (See the Section 4.4 Description of Drawings for Series D, in particular for [Sheet D9]).

Height Adjustment Methods for Console Players. Adjustment for varied height of Console players (147) is achieved by utilizing such as a variable-height stool or bench, or ideally for the standing player a mechanically adjustable floor section, to change player height position. Alternatively this may be accomplished by adjusting the Console's floor stand or base (131) to change the Console's height. In either case, the relative positioning (889, 890, 891) of the Console to its IR/Visible flood fixture (125) remains constant, since the fixture is mounted upon extension arms (126) affixed to the Consoles base (131).

Platform Portability. The "thin" Platform embodiments (871-876) feature a plurality of Platform subsections (for example seven hexagons) (1,2) which may at times be disassembled and stacked for transport or storage, and at other times easily reassembled by placing the appropriate sections adjacent to each other and sliding together, thus interlocking and forming a single flat, firmly integrated, and flush obstruction-free Platform surface. Type II sensor modules (113) may be housed in add-on modules (117) which flush-connect and interlock with the primary Type I Platform sections.

Console Portability. The Console embodiments, in particular Variations 1-4 (878-881) may incorporate the ability to fold, collapse and/or telescope into a much more compact form, and the ability to easily reverse this process (manually or with servo-mechanism assistance) so as to be made ready for performance use. The Integrated Console embodiments (882-885) incorporating integral LCD touch-display, PC computer, removable media drives, and MIDI and audio modules, would be relatively less collapsible, although still tending to become progressively more so over time as relevant technologies continue to miniaturize.

Safety Features for Platform Embodiment. For player's safety as they variously move onto and off of the Platform interface, (should it not be flush-recessed into the surrounding floor level), the assembled Platform incorporates outer edges with sloping bevels (3, 118) and also includes a continuously illuminated fiber-optic safety light (4, 119) for unmistakable edge visibility. The Platform is typically textured on top and provides a secure, non-slip surface.

5.0 DESCRIPTIONS OF THE DRAWINGS

5.1 Series A: Platform Optomechanics, Biometrics, and Visual Feedback

Overview. The Series A drawings disclose: (a) the overall optomechanics for Platform embodiments of the invention, (b) example free-space biometrics and corresponding visual feedback for player interception of Type I sensor trigger regions, and (c) details of the overhead infrared (IR) and visible flood fixture.

[Sheets A10, A11, A1 and A9] illustrate Platform embodiments each incorporating one of the four alternate types of Type I Sensor/LED Modules: respectively Class A, Class B, Class C, and Class D (for modules detail refer to [Sheets D4, D5, D6 and D7] respectively). [FIGS. A2-*a* and A3-*a*] illustrate example player body positions for Type I sensor line-of-sight trigger zone interceptions (Shadow and Un-shadow actions). Each interception example shown represents one case of the seven possible resulting sensor/LED module visual Response States. Response State changes are contextual, thus a particular state change depends upon a sensor/LED module's pre-existing state plus timing of player Shadow or Un-shadow action in relation to active time quantization and auto-sustain setups; refer to [Sheets D1 and D1*b*] for state changes.

An identical player position and posture within a counter-clockwise arm-swing motion are shown in all of [FIGS. A2-*a*, A3-*a*, A4-*a*, A5-*a*, A6-*a*, A7-*a* and A8-*a*], however it is intended that two different instances of timing of this player Motion are portrayed, thus resulting in differing Response States for the multiple affected sensor/LED modules. Motion Case One is shown in [FIGS. A2-*a*, A4-*a*, A6-*a*, A7-*a* and A8-*a*], and the Motion Case Two is shown in [FIGS. A3-*a* and A5-*a*]. Motion Case Two oblique view equivalents to Motion Case One [FIGS. A6-*a*, A7-*a* and A8-*a*] respectively may be inferred from the representations disclosed, thus those renderings are omitted.

The seven possible Response States to shadow/unshadow player actions over one Type I sensor are: [FIGS. A2-*d* and A4-*d*] Near Attack, [FIGS. A2-*b* and A4-*b*] Attack-Hold, [FIGS. A2-*c* and A4-*c*] Attack Auto-Sustain, [FIGS. A2-*e*, A3-*e*, A4-*e* and A5-*e*] Finish, [FIGS. A3-*d* and A5-*d*] Near Re-Attack, [FIGS. A3-*b* and A5-*b*] Re-Attack-Hold, and [FIGS. A3-*c* and A5-*c*] Re-Attack Auto-Sustain. Each of these seven states is in turn comprised of a certain combination of three possible ("trinary") visual feedback conditions (Attack, Re-Attack or Finish) for each of a module's three LED-illuminated individual visual elements. These elements are the surface Light-Pipe 1 (LP-1), surface Light-Pipe 2 (LP-2) and free-space microbeam (Beam-1); see [FIGS. A1-*c* and D6] and [Sheet A1 legend]. The three feedback conditions for the elements of a given LED module (throughout Series A drawings) are symbolic, intending only to show their typical differentiation, as the particulars depend entirely upon a great variety of possible visual response behaviors further disclosed [Sheets G2, G3, K2, K3 and K4]. An example of an interesting and useful response for all Classes of sensor/LED modules is as follows. The Finish is a relatively low-valued intensity (brightness), Attack is a high-valued intensity, and Re-Attack is a medium-valued intensity, all for an equal hue/saturation.

[FIGS. A4-*a* and A5-*a*] repeat the player Motions of [FIGS. A2-*a* and A3-*a*] respectively, however instead showing the Microbeams in their spatial configuration as visible in a fogged environment, and symbolically indicating their Response States for the two differently timed Motion examples.

Output of MIDI Note ON and Note OFF messages (and resulting audio via MIDI sound module(s) [Sheets F4, F5, and F6]) corresponding to the Series A disclosed player biometrics and visual Response States are contextual, and depend upon state change vectors. The map of state change vectors is summarized graphically on [Sheet D1], shown in table form with details of MIDI messages and timing conditions on [Sheet D1*b*], and a Collection of examples in practice are illustrated in the Series E drawings.

Sheet A1 3-Zone Platform w/ Type I Sensors

Class C Sensor/LED Modules Shown

[FIG. A1-*a*] shows an overhead view of the Platform embodiment, with typical use of distinct geometric shapes (octagon, hexagon, circle) for each Zone (5-inner left, 5-inner right, 6-outer) of Class C Type I Sensor/LED modules. The preferred thin Platform form-factor for transportable systems is shown in [FIG. A1-*a*]. Data I/O edge panel connectors are detailed in [FIG. A1-*d*].

Sheet A2 3-Zone Platform w/ Type I Sensors

Showing Trigger Zones, Player, IR Shadow, Attack Events, Feedback States

[FIG. A2-*a*] shows Motion Case One of player arm-swing timing, in relation to line-of-sight Type I trigger regions. Player's left arm has shadowed a Type I sensor module previously in Finish, thus generating that module's Near Attack [FIG. A2-*d*] shown (comprising only LP-1 in Attack feedback), after previously passing over an adjacent Type I sensor whose LED module Response State has returned from an Attack Auto-Sustain to the Finish [FIG. F2-*e*] shown (comprising LP-1, LP-2 and Beam-1 all in Finish feedback). Player's right arm is continuing to shadow a Type I sensor changing that LED module's Near Attack into [FIG. A2-*b*] Attack-Hold (comprising LP-1, LP-2 and Beam-1 all in Attack feedback), after previously passing over (shadowing/un-shadowing) an adjacent Type I sensor whose LED module Response State changed from Attack-Hold to the [FIG. A2-*c*] Attack-Auto-Sustain shown (comprising only LP-2 and Beam-1 in Attack feedback).

Sheet A3 3-Zone Platform w/ Type I Sensors

Showing Trigger Zones, Player, IR Shadow, Re-Attack Events, Feedback States

[FIG. A3-*a*] shows Motion Case Two of player arm-swing timing, in relation to line-of-sight Type I trigger regions. Player's left arm has re-shadowed a Type I sensor module previously in Attack-Auto Sustain thus generating the [FIG. A3-*d*] Near Re-Attack shown (comprising only LP-1 in Re-Attack feedback), after previously passing over (shadowing/un-shadowing) an adjacent Type I sensor whose LED module Response State has returned from an Attack Auto-Sustain (or a Re-Attack Auto-Sustain) to the Finish [FIG. A3-*e*] shown (comprising LP-1, LP-2 and Beam-1 all in Finish feedback). Player's right arm is continuing to shadow a Type I sensor changing the module's Near Re-Attack into [FIG. A3-*b*] Re-Attack-Hold (comprising LP-1, LP-2 and Beam-1 in Re-Attack feedback), after previously passing over (shadowing/un-shadowing) an adjacent Type I sensor whose LED module Response State changed from Re-Attack-Hold to the [FIG. A3-*c*] Re-Attack-Auto Sustain shown (comprising only LP-2 and Beam-1 in Re-Attack feedback).

Sheet A4 3-Zone Platform w/ Type I Sensors

Showing Player, Microbeams, Attack Events, Feedback States

Motion Case One is shown exactly as in [Sheet A2], except illustrated in relation to visible fogged microbeams on-axis superposing/surrounding the invisible Type-I line-of-sight trigger regions.

Sheet A5 3-Zone Platform w/ Type I Sensors

Showing Player, Microbeam, Re-Attack Events, Feedback States

Motion Case Two is shown exactly as in [Sheet A3], except illustrated in relation to visible fogged microbeams on-axis superposing/surrounding the invisible Type-1 light-of-sight trigger regions.

Sheet A6 3-Zone Platform w/ Type I Sensors

Showing IR & Visible Floods, Adjustable Fixture Height, 2 Trigger Regions, Player, IR Shadow, Attack Events FIG. [A6-*a*] illustrates (for Motion Case One) the formation of invisible infrared (IR) shadow over one or more Type I sensor/LED modules by means of player's intercepting (blocking) the fixture-mounted overhead invisible IR source flood, and formation of the superposed visible shadow formed by means of player's intercepting (blocking) the fixture-mounted overhead visible source flood.

[FIG. A6-*b*] illustrates how sufficiently scaled IR- and visible-shadow projections are formed for various player heights by means of corresponding adjustment to the overhead fixture height relative to the Platform position. "Sufficient" here means in biometric terms the capability of a centrally positioned (standing) player to effect 16-sensor polyphonic operation by means of fully horizontally outstretched arms with little or moderate bending of the torso (reaching), noting that such sufficiency is a relative biometric frame of reference only and not intended to constrain players to any particular positions or motions.

Sheet A7 3-Zone Platform w/ Type I Sensors

Showing Trigger Zones, Player, IR Shadow, Attack Events

[Sheet A7] illustrates an oblique perspective of the Motion Case One.

Sheet A8 3-Zone Platform w/ Type I Sensors

Showing Microbeams, Player, Visible Shadow, Attack Events, Response States

[Sheet A8] illustrates an oblique perspective of the Motion Case One.

Sheet A9 n-Zone Platform w/ Type I Sensors

Class D Sensor/LED Modules Shown

[FIG. A9-*b*] illustrates a Platform with the preferred Class D sensor/LED modules, all having one geometry of LEDs Light-Pipes. This embodiment is contrasted to the three fixed sensor-zones (5 inner-left, 5 inner-right, and 6 outer) shown in [FIGS. A1-A8] that being typical for Class C [Sheet D6] sensor/LED modules where hue is fixed per all the sensors in each zone. Type D modules [Sheet D7] under "on-the-fly" software control of their RGB hardware response, allow the flexible definition of which sensors are functionally operating similarly in groups or zones at any particular time, thus to "float" zone definitions in a given media context. (For examples of varied zone configurations or Zone Maps refer to [Sheet H6].)

Sheet A10 3-Zone Platform w/ Type I Sensors

Class A Sensor/LED Modules Shown

[Sheet A10] illustrates a Platform with the simplest visual feedback configuration, having Class A [Sheet D4] fixed hue LEDs illuminating surface Light-Pipes 1 and 2 only, and with no microbeams. This is suitable for use where fogging materials are not used, and/or for achieving greatest hardware economy. Even when applying groups of like-hued LEDs into functional zones, the additional use of geometric shape differentials is recommended to further aid in player's zone recognition (and for benefit of those players who are color perception challenged.)

Sheet A11 n-Zone Platform w/ Type I Sensors

Class B Sensor/LED Modules Shown

[Sheet A11] illustrates a Platform with Class B [Sheet D5] sensor/LED modules, having no microbeams, however with full RGB LEDs allowing "floating" Zone Maps as described in the summary for [Sheet A9].

Sheet A12 IR/Visible Overhead Flood Fixture

Platform Configuration Shown

[FIG. A12-*a*] illustrates an overhead fixture showing the internal optomechanics and (summary of) electronics for beam-combined continuous visible flood and superposed clock-pulsed IR flood. External housing form-factor, microbeam stop baffle configuration, and floods exit beam angle shown are suitable for over-Platform use, whereas all other fixture components are equivalent for both over-Platform and over-Console use.

5.2 Series B: Preferred Platform Embodiment

Overview. The Series B drawings disclose the preferred Platform embodiment of the invention incorporating both Type I sensors (passive line-of-sight, discrete shadow-transition event-triggered) and Type II sensors (active, high-duty-cycle height-detecting). [FIGS. B1-*a* and B2-*a*] illustrate the most preferred embodiment of the invention, referred to in Series F, H, i, and J as "Platform #1."

[FIGS. B2-*b* and B3-*c*] illustrate the difference in overhead fixture for 0-of-6 vs. 3-of-6 Type II sensors fixture-mounted respectively. [FIGS. B2-*a* and B3-*a*] show an example spatial distribution of Type II sensors and their respective trigger (height detection) regions and how these typically superpose or overlap the Type I trigger regions. Typically the Type I sensor/LED modules of Class D are employed in a system configuration where Type II sensors are also employed, as shown in [Sheets B1, B2 and B3]. This is because variable RGB color output for surface Light Pipes as well as microbeams provides the dynamic range for subtle and varied visual feedback options reflecting Type II sensor data attributes.

Sheet B1 n-Zone Platform w/ Type I & II Sensors

Showing Type I Class D Sensor/LED Modules

The seven interlocking hexagonal Platform segments for the Type-I-only Platform embodiments (shown in Series A drawings) are supplemented as illustrated in [FIG. B1-*a*] by six additional, triangular Platform segments each containing one Type II sensor module. An outer bevel surrounds all 13 segments forming a circular outer edge, and also includes an embedded fiber-light within the bevel slope for safety purposes.

Sheet B2 n-Zone Platform w/ Type I & II Sensors

Showing Trigger Zones, 6-below Type II

[FIG. B2-*a*] illustrates Type II sensors all mounted in-Platform, angularity spaced at even 60° intervals.

Sheet B3 n-Zone Platform w/ Type I and Type II Sensors

Showing Trigger Zones, 3-above & 3-below Type II

[FIG. B3-*a*] shows an alternate instance having 3 of 6 Type II sensors in-Platform and the remaining 3 of 6 in fixture mounted. Thus only three of the additional triangular Platform segments have Type II sensor modules, and three do not. [FIG. B3-*b*] shows the 120° angular spacing preferred for the 3 of 6 in-Platform Type II sensors, as a group 60° angularly rotated with respect to the 3 of 6 in-fixture Type II sensors also 120° angularly spaced as shown in [B3-*c*], thus taken together alternating each 60° around the combined Platform-fixture system between upper- and lower-mounted sensors.

5.3 Series C: Console Embodiment

Overview. The Series C drawings disclose the Free-space Console or floor-stand-mounted embodiment of the invention, exhibiting the partially constrained biometrics of upper torso motions vs. full body completely unconstrained biometrics in the Platform case. The Console embodiment favors 1 player per each unit, vs. the Platform's 1, 2 or n players. The Console system contains an accessible space near the IR/visible flood fixture, where all of the Type I trigger regions are scaled together near the apex of the cone [FIGS. C3, C4]. This facilitates, more conveniently for the Console vs. the Platform embodiment, rapid finger and hand gesture detection and a more harp-like feel to the spatial interface.

The Console requires one-eighth the installation volume (2 meters$^3$) and one-fourth the floor space (2 meters$^2$) of the Platform's (4 meters$^3$) volume and (4 meters$^2$) floor space. While a Platform may reside on as little as a (2.7 meters$^2$) footprint, (4 meters$^2$) is recommended for perimeter safety considerations and to allow unconstrained play from either inside or from around the outside of the Platform, and to allow multiple players (if playing) sufficient space. Thus a cluster of four Consoles (if packed together) can require as little as the floor space recommended for one Platform.

The Series C drawings show a Console incorporating both Type I and Type II sensors, and exclusively utilizing Class D sensor/LED modules, in a form factor suitable for Console embodiment (detailed in [FIG. D9]. The Console LED modules detailed in [FIGS. C2-*c*, D8 and D9] include more 3D complex LP-1 and LP-2 Light Pipe shapes compared to the flush-constrained Platform's LP-1 and LP-2 planar equivalents. These provide enhanced ergonomics for wide-angle viewing perspectives, and a more dramatic appearance (increased cm$^2$ of light pipe optical surface area per each module). A Console without microbeams is not illustrated in the drawing Series C but may be easily inferred and implemented, having such as the Class B sensor/LED modules [FIG. D8] for use in un-fogged environments.

While not required for free-space play itself, the Console as illustrated in [FIGS. C1, C2 and C4] also includes an integrated touch-screen interface for content title selection and/or advanced adjustment of response by virtuoso players and free-space content authors (refer to Series H, i, J, and K drawings.) Where the touch-screen interface is included, the Console includes integrated PC computer system(s) and may include removable magnetic and optical storage media [FIG. C1].

A Console system without integral LCD interface may be organized, in its internal electronic hardware and software, identically to the firmware-based Remote Platform [Sheet F3] and connect via its MIDI I/O panel [FIG. C1-*b*] to a Remote Platform Server computer system [Sheet F2]. Or, as shown in [Sheet F1] an Integrated Console enclosure may also include internally the functions of the Remote Platform Server [Sheet F2], and in this case via its MIDI I/O panel connect to associated Other MIDI Software and Sequencer modules running on an external host computer. Or, the equivalent to the Remote Platform plus the Remote Platform Server modules together, plus also the Other MIDI Software and Sequencer modules [Sheets F4, F5 and F6] may all be included within the Console enclosure. This yields a totally self-contained Console system, requiring only external AC power to operate. In this latter case the external MIDI I/O panel [FIG. C1-*b*] may be optionally used for connecting to such as supplemental immersive Robotic Lighting systems, MIDI-controlled Computer Graphics systems (typically large-format projected), and/or link to Other Free-space systems.

Sheet C1 n-Zone Integrated Console w/ Type I & II Sensors

Showing On-Axis Class D Sensor/LED Modules and Beams

[FIG. C1-*s*] illustrates the system orientated as facing a player, and showing microbeams as spatially arrayed in a fogged environment.

Sheet C2 n-Zone Integrated Console w/ Type I & II Sensors

Showing On-Axis Class D Sensor/LED Modules

[Sheet C2]illustrates how in the Console case, the angular separation between adjacent Type I sensor trigger regions (at sensor/LED module height) compacts to only 18° for inner sensors and 36° for outer sensors, compared to the Platforms 30° and 60° respectively. The array of sensors as a whole is compressed into a 180° hemisphere. The off-center translation of the IR/visible source fixture position makes this necessary, since were the array to extend further than 180° around, the players body would unavoidably and inadvertently trigger sensors behind them. Similarly, the Type II modules are compacted to a 144° range of mounting positions as compared to the full 360° of the preferred Platform embodiment [Sheets B1 and B2]. In the Console only five instead of the Platform's six Type II modules are used, without reduction in performance since their closer spacing yields sufficient and overlapping data. The tighter spacing of the Consoles Type II sensors having greater overlap also provides the opportunity for Type II sensor software logic to triangulate providing relative lateral position in addition to the height data.

[FIG. C2-*d*] illustrates an example Type II sensor module with separate optical or ultrasonic active transmitter and receiver.

Sheet C3 n-Zone Integrated Console w/ Type I & II Sensors

Showing On-Axis Class D Sensor/LED Modules

[Sheet C3] illustrates a side view of the Console, showing how the Type I sensor/LED modules each tilt variously to retain an on-axis line-of sight to the IR/visible flood fixture, not only for the sensor well but for the LED Light Pipes also. In sessions without fog (hence no visible microbeams even if employed), the tilt of the line-of-sight-orthogonal modules aids the player in perceiving the in-space orientations of the Type I sensor trigger regions.

The overall slanted angle of the top surface of the enclosure parallels the baseline biometric reference swing for the Console: moving between arm(s) out and forward horizontally and arms hanging vertically down at the sides. This is contrasted to the equivalent biometric reference swing for the Platform: moving with arm(s) outstretched horizontally and either spinning the entire body in place or just twisting the torso or hips back and forth. The advantage of these baseline swings in each case is in maximizing ergonomic/biometric simplicity and ease of playing the most common musical situations such as arpeggios and melodic scale phrases. The Console Type I array's trigger region geometry makes a slight sacrifice in terms of lesser simplicity, being non-symmetric (slanted) and a 180° half-cone vs. the Platform's symmetric vertical and nearly-complete 300° cone. The Console does however yield in positive trade-off the benefits of (a) its reduced installation space, (b) an increased accessibility of the compact "tight play" trigger region near the fixture, and (c) the option for an additional type of conventional 2D (touch-screen) interface situated within, and not interfering with, the 3D free-space media environment.

Sheet C4 n-Zone Integrated Console w/ Type I & II Sensors

Showing Trigger Regions, Player, IR and Visible Shadows

[FIG. C4-*a*] Console top view illustrates (a) its overlapping Type II and Type I sensor trigger regions, (b) example player position and (c) generated visible shadow. The player's shadow is a less prominent visual feedback than for the Platform case, given (a) the small upper surface area of the Console, (b) the off-center, forward-translated fixture position relative to typical player position, and (c) the asymmetric position of shadow falling mostly behind the player. This is why the preferred Console embodiment includes the use of Class D modules with fogged microbeams [Sheet D9] and for the un-fogged case also incorporates the more dramatic LED [Sheets D8 and D9] Light Pipe modules.

5.4 Series D: Response State Changes and Sensor/LED Modules

Overview. The Series D drawings disclose: (a) The Type I sensor/LED module's visual and MIDI Notes Response State Changes map, as it applies universally to both Platform and Console embodiments and to all classes of modules; (b) the ergonomic regions of Spatial Displacement of Feedback between a Type I sensor trigger region and its local LED-illuminated visual feedback elements; and (c) the internal optomechanical apparatus of each of the Class A, Class B, Class C, and Class D sensor/LED modules for the Platform, as well as alternative Class B and Class D modules designed for the Console and for a "thick" form-factor Platform.

All four module Classes A, B, C, D [Sheets D4 through D9] are designed with certain critical ergonomic form-factor constraints in common, so that players changing between (or upgrading to) different free-space systems employing the various Class modules will experience the same essential aspects of ergonomic look-and-feel, and without confusion. These common constraints include the ratios of diameter between LP-1 and LP-2, and the Spatial Displacements of Feedback between active visible responses with their greater diameters surrounding on-axis the substantially lesser diameter invisible Type I sensor trigger region [FIGS. D2-*a*, D3-*a*].

Similarly, although the LEDs of modules Class B [Sheets D5, D8] and Class D [Sheets D7, D9] have RGB variable color while LEDs of modules Class A [Sheet D4] and Class C [Sheet D6] are monochromatic with variable intensity, the Response State Changes [Sheets D1, D1*b*] including all timing and contextual conditions behave identically for all four module classes. The universal or common behaviors include how player Shadow and Un-shadow actions affect Response State changes for the module and thus feedback of the individual module elements (LP1, LP2 and Beam-1) in their resulting combinations of Finish, and Attack, and Re-Attack states [Sheets D1, D1*b*]. The difference is how the visual parameters for those three states respectively are defined as stored in Local Visuals CZB Setups Data [Sheets F1, F2] for the given zone and module, and as may be adjusted by: (a) virtuoso player or content composer via the touch interface with Creative Zone Behavior (CZB) Local Visuals Command Panel [Sheets K2, K3, K4], or (b) by content CZB Local Visuals control tracks [Sheets F4, F5, F6 and G1].

Sheet D1 Visual Response State Change Map

Nine States and Eighteen Possible State Change Vectors

[Sheet D1] shows the complete visual response state changes map in graphical and conic format. The seven primary Response States are supplemented by two transitional special cases (transient Finish states) for a total of nine unique states. Considering only the primary states for simplicity, of the matrix of $(7\times7)-7=42$ possible state change vectors (seven being discounted as identity vectors), only 18 valid state change vectors are employed. The whole-module Response States for the three Attack cases (Near Attack, Attack-Hold and Attack Auto-Sustain) are exactly equivalent to the three for Re-Attack (Near Re-Attack, Re-Attack Hold, and Re-Attack Auto-Sustain) except having visual feedback elements LP1, LP2 and Beam-1 in [Finish or Attack] vs. [Finish or Re-Attack] states respectively. Similarly, the Response State change vectors and their conditions amongst the three Attack cases vs. amongst the three Re-Attack cases are very similar, the differences arising in interplay (change vectors) between Attacks and Re-Attacks. Out of the eighteen possible State Change vectors, seven occur most commonly, while the remaining eleven State Change vectors occur only sometimes or rarely because their conditions to initiate are more restricted.

Sheet D1*b* Visual & MIDI Note Response State Change Table

States and State Change Vectors, Showing MIDI and Timing

[Sheet D1*b*] refers to the same information illustrated graphically in the State Change Map [Sheet D1], except presented in a table format, and including MIDI Note message output and details on the exact timing conditions which together with player actions (shadow vs. un-shadow) define each change vector.

Sheet D2 Spatial Displacement of Feedback: Light Pipes

Class A or Class B Sensor/LED Module

[FIG. D2-*a*] illustrates the critical ergonomic form-factor considerations for the Class A and Class B Type I sensor/LED modules (having no microbeam) in achieving a specific transparent entrainment effect. Type I sensor trigger regions are typically shadowed and un-shadowed by lateral body motion across a module. At typical lateral motion velocities, the differentials in radius (measured from sensor axis) of the visual elements in the module are designed to entrain the players perception of events as follows. The initial Shadow action is interpreted as only moving into a "proximity" or Near-Attack before a subsequent (delay time-quantized) and precise "real" Attack action is made (whether in the form of Attack-Hold or Attack Auto-Sustain). The latter events are kinesthetically "owned" as the "real" Attack action due to (a) the impact of exact synesthetic correlation of the larger-surface-area central LP-2 feedback with audio response, combined with (b) typical player limb positions at Shadow action vs. time-quantized response times.

This effect is by design. When an initial shadow action occurs (as with a baseline swing) by the leading edge of the body that first intercepts the trigger region, the centroid of the limb (especially arm or hand) is typically displaced to approximately the radius of the outer LP-1. At typical or median lateral velocities the delayed Attack-Hold response occurs when the centroid of the limb has passed over to the center of the module, thus when the Attack-Hold feedback comes the perception is that the centroid of the limb is creating the "real" response over the center of the module at that time. This entrainment is compelling enough to persist in the ergonomic and psychology of play, including for with all of the body, even though various lateral velocities are both slower and faster than this "ideal" most common case. LP-1 is an outer concentric ring (circular, hexagonal or octagonal) so that the effect is identical for lateral motions coming from any direction over the module. This effect is a transparent biofeedback entrainment; refer to the Series E drawings [FIGS. E1-*d* through E10-*d*] for 28 specific examples of this entrainment effect in the context of 14 of the 18 total State Change vectors employed [Sheets D1, D1-*b*].

Sheet D3 Spatial Displacement of Feedback: Light Pipes and Microbeam

Class C or Class D Sensor/LED Module

[FIG. D3-*a*] illustrates how the Class C and Class D modules also achieve the effect disclosed in the Summary for [FIG. D2] above, with the addition of the microbeams. In this case the microbeams, when fogged, reinforce the effect further as follows. When initial Shadow action occurs, the centroid of an intercepting limb is approximately at the edge of the beam, which edge is Gaussian-beam-profile blurred and thus ambiguous [FIG. D9-*c*]. This provides a passive spatial feedback (since the microbeam response state changes only in unison with LP-2) which correlates to the initial outer LP-1 active state change feedback, being together spontaneously perceived synesthetically as being in "proximity" to an immanent "real" attack. When the limb's lateral motion continues over the module, the time-quantized subsequent Attack-Hold most frequently occurs when the limb is approximately over the center of the module and in the center of the fogged beam, thus reinforcing the perception that it is the limb's presence in the center of the beam which produces the "real" attack.

Thus whether a player's attention is on fogged beams or on surface Light Pipes, or on both together, the transparent entrainment effect (making the delay of Time Quantization effectively invisible) is strongly reinforced. The inter-module distance between adjacent sensors in both the Platform and Console embodiments of the invention are designed to promote a reference baseline swing velocity for the most commonly used Time Quantization factor (musical sixteenth notes), which factor maximizes this effect.

Sheet D4 Platform Type I Sensor/LED Module: "Class A"

Light Pipes 1 and 2 Only; Fixed-Color Variable-Intensity LEDs; Inner Right Zone Module Shown

[FIG. D4-*a*] illustrates the external top view, and [FIG. D4-*b*] illustrates the corresponding cross section of internal optomechanics for Class A, the simplest Type I sensor/LED module. This Class has the advantages of lowest implementation cost, as well as potentially extremely thin Platform thickness (25.0 mm+/−5.0 mm), due to the simplicity and compactness of the optics.

Sheet D5 Platform Type I Sensor/LED Module: "Class B"

Light Pipes 1 and 2 Only; RGB LEDs; for any n-Zone Module

[FIG. D5-*a*]] illustrates the external top view, and [FIG. D5-*b*] illustrates the corresponding cross section of internal optomechanics for Class B sensor/LED module. This Class also may be implemented in very thin Platforms similarly to the Class A case, and has the additional feature of RGB LED responses for illuminating each of LP-1 and LP-2 independently, thus allowing fully "floating" sensor zones [Sheet H6]. This is the preferred embodiment for Platforms where fogging is not used. This module is essentially identical to Class A [FIG. D4-*a*], except for the addition of RGB LEDs vs. the single-LEDs of Class A.

Sheet D6 Platform Type I Sensor/LED Module: "Class C"

Light Pipes 1 and 2 and Beam 1; Fixed-Color Variable-Intensity LEDs; Inner Right Zone Module Shown

[FIG. D6-*a*] illustrates the external top view, and [FIG. D6-*b*] illustrates the corresponding cross section of internal optomechanics for the Class C sensor/LED module. This Class implements an microbeam output on-axis both within the surrounding outer LP-1 and also itself surrounding the Type I sensor (and its trigger region). The considerably more complex optics (compared to Class A or B) includes a perforated elliptical mirror and a microbeam-forming optics housing. These microbeam-related optics require a slightly thicker Platform enclosure than the Class A or B cases, on the order of (50.0 mm+/−10.0 mm).

Sheet D7 Platform Type I Sensor/LED Module: "Class D"

Light Pipes 1 and 2 and Beam 1; RGB LEDs; for any n-Zone Module—"Preferred (Thin) Embodiment"

[FIG. D7-*a*] illustrates the external top view, and [FIG. D7-*b*] illustrates the corresponding cross section of internal optomechanics for the Class D sensor/LED module. This is the preferred module embodiment for (transportable) Platforms, providing fully independent RGB response for both surface LP-1 and LP-2 as well as microbeam. This module is essentially identical to Class C [FIG. D6-*a*] with the addition of the RGB LEDs vs. the single-LEDs of Class C. This embodiment is also considerably more complex in its driving electronics [Sheets F3, F7]; a 16-module Platform contains (16)×(3)×(3)=144 total LEDs, as compared to the simplest case of Class A having only (16)×(2)=32 total LEDs.

Sheet D8 Console Type I Sensor/LED Module: "Class B"

Light Pipes 1 and 2 Only; RGB LEDs; for any n-Zone Module

[FIG. D8-*a*] illustrates the external top view, [FIG. D8-*c*] illustrates the external side view, and [FIG. D8-*b*] illustrates the corresponding cross section of internal optomechanics for the Class B sensor/LED module as configured for the Console embodiment. This is the preferred embodiment for a Console module not used with fog and thus without microbeams. As the Console is typically implemented with Type I and also Type II sensors, only the RGB implementations are shown as these provide the additional degrees of freedom desirable to adequately reflect the Type II data in visual feedback. [FIGS. D8-*b* and D8-*c*] show how the LP-1 and LP-2 extend away from the Console surface to maximize lateral viewing and increase light pipe surface area for a more dramatic appearance.

Sheet D9 On-Axis, Type I Sensor I LED Module: "Class D"

Light Pipes 1 and 2 and Beam 1; RGB LEDs; for any n-Zone Module

[FIG. D9-*a*] illustrates the external top view, [FIG. D9-*c*] illustrates the external side view, and [FIG. D9-*b*] illustrates the corresponding cross section of internal optomechanics for a Class D sensor/LED module configured for the Console. This is the preferred embodiment for a Console used with fog and thus having microbeams. The internal (modified Schmidt-Cassegrain) Class D module optomechanics differ substantially from the perforated elliptical mirror type of Class D module. This is advantageous for several reasons: (a) the available internal space (depth) of the Console enclosure is expanded compared to the Platform thus allowing for a deeper optical design, and one which uses additional reflective optics along with transparent optics, yielding considerable cost and efficiency (brightness) advantages; (b) since the modules within the Console enclosure are variously tilted to all aim at the fixture, and their Light Pipes are circularly symmetric, this allows the identical module subsystem design to be used for all module positions thus lowering cost; (c) the combined transparent and reflective elements of the modified Schmidt-Cassegrain design produces a superior exit beam profile with less distortion and improved focus compared to a perforated elliptical mirror design; and finally (d) the Type I sensor well is better optically isolated from the adjacent output of microbeam than is the case for the perforated elliptical mirror design, thus allowing use of brighter source LEDs for the microbeam without risk of optical crosstalk into the Type I sensor well, sensor IR bandpass filter notwithstanding.

An alternative utilization for a Class D module closely similar to that illustrated on [Sheet D9] is as follows. In case of availability of a much thicker Platform enclosure (200 mm+/−50 mm), such as for permanent custom installations, this on-axis module design may be used for the Platform. This would represent the ultimate or most preferred Platform embodiment for the reasons (c) and (d) disclosed above, as well as the following. All of the on-axis modules may each be gimbal mounted, gimbal axis orthogonal to their radius from Platform center, and with one axis of rotation. The entire module is mounted beneath a top protective clear cover, flush with the Platforms surface, with sufficient internal clearance for angular rotation beneath the cover plate. The gimbals may be rotated under electronic and software control by unremarkable means such as servo mechanisms, pneumatics, hydraulics, and similar methods. Such rotation may be used to maintain perfect on-axis co-registration and alignment of the exiting microbeams and the input Type I sensor trigger regions even when the overhead fixture is adjusted up or down to accommodate varied player sizes as in [FIG. A6-*b*]. This also ensures the microbeams in all cases perfectly enter the fixture's stop baffles [FIGS. A12-*b*, A12-*c*] thus forming a perfect bound cone, for any height cone.

By contrast, with the use of fixed-angle sensor wells and fixed-angle exiting microbeams for the Platform modules, as in the perforated elliptical mirror type of Class C and D design [FIGS. D6 and D7], when the option to adjust the overhead fixture height is used, the Type I sensor trigger regions (always line-of-sight from the exit aperture of the fixture) become more approximate in their alignment with respect to the visible microbeams. Furthermore in this case the microbeams may converge either below or above the fixture's stop baffles (and thus miss the fixture). The use of the module type as shown on [Sheet D9] in a thick Platform enclosure thus overcomes these challenges entirely.

5.5 Series E: Gestures, Ergonomic Timing, Visual Feedback, MIDI Notes Response and Sync Entrainment Overview. The Series E drawings illustrate ten specific examples in practice of player actions and system responses for a single Type I sensor/LED module (identical for either Platform or Console). Cases of one pair, two pairs, and three pairs of player's [Shadow plus Un-Shadow] actions (being equivalent to one, two or three musical Notes respectively) are shown in the various examples. The examples taken together represent a collection of player "gestures" over a single sensor with corresponding system responses. Any and all forms of polyphonic (multiple sensor) responses for any zone may be directly inferred from these monophonic examples, as being comprised of combinations of the monophonic behaviors shown.

Each of the "a" drawings for the ten Sheets [FIGS. E1-*a* through E10-*a*] illustrates one of six different Creative Zone Behavior (CZB) Setups, in terms of the CZB Command Panel for Notes [Sheet H2] and its graphical user interface (GUI) icons [defined on Sheet H1]. [Sheets H4 and H5] detail these six CZB Setup examples in the context of a three zones Command Panel for a Platform. The "a" and "b" drawings on each sheet are directly linked. The "a" drawing CZB Setup for the zone's Time Quantization (TQ) is also shown in the form of an adjacent "b" drawing "TQ slot" pulse waveform (each TQ point or "slot" being exactly one tick wide but shown exaggerated for clarity). The "a" drawing CZB Setup for the zone's Sustain is also shown in terms of an adjacent "b" drawing showing the equivalent musical notes defining the Setup's default sustain durations at each TQ slot.

The time axis for the "b" sheets is shown in terms of the MIDI standard of 480 ticks per quarter note. Ticks are the tempo-invariant time metric, thus all examples hold true for any tempo, including for a tempo varying during the gestures.

Each of the "b" drawings for the ten Sheets [FIGS. E1-*b* through E10*b*] illustrates a specific case of player actions over a Type I sensor trigger region in terms of a "binary" input timing waveform (Shadow vs. Un-Shadow) since those are the only two player actions available as regards the Type I aspect of the system. However, those two actions are within a time context [as detailed on [Sheets D1 and D1*b*]. From the players perspective the distinction between generating an Attack vs. a Re-Attack is simple: (1) shadowing a sensor while it is in Finish state yields an Attack, and (2) shadowing a sensor while it is already in Attack Auto-Sustain (or Re-Attack Auto-Sustain) state yields a Re-Attack. Thus, the module's system response is shown in ergonomic terms as the "ternary" output timing waveform, comprised of three Primary Response Events which players are entrained to identify with, namely: Attack, Re-Attack, and Finish. To understand the simplified ternary waveforms of the Series E "b" drawings it is critical to note that the three "Primary Response Events" as such are the ergonomic reality in "look and feel" perception or Player Interpretation, while their underlying system logic is contextual and subtle however exact "to the tick" (comprised of the nine Module Response States and eighteen different State Change Vectors between them).

As shown on [Sheets D1, D1*b*] and in [FIGS. E1-*c* through E10*c*] State Change Vectors [$V_2$, $V_4$, $V_5$, $V_7$, $V_8$, $V_9$, $V_{10}$, $V_{12}$, $V_{14}$, $V_{15}$, $V_{16}$, $V_{17}$, and $V_{18}$] generate perception of transition to Primary Response Events, and are distinguished from the Secondary State Change Vectors [$V_1$, $V_3$, $V_6$, $V_{11}$, and $V_{13}$] by being those state changes where both: (a) the MIDI Note ON or OFF messages are sent, typically generating an audio result, and (b) the module's inner concentric visual elements LP-2 (and Beam-1 when employed) transition from Finish to either Attack or Re-Attack conditions or back to Finish.

Each such pair of Primary Response Event transitions are what players perceive to be the playing of One Note first ON then OFF. (The exception to this being when exclusively MIDI Control Change messages instead of Note messages for a given Zone are generated, a special and advanced CZB Setup configuration for virtuoso players.) [Sheets E1, E2, E3, E4, E5, E8, E9 and E10] show example Attack scenarios while [Sheets E6 and E7] show example Re-Attack scenarios.

Both the "e" and the "c" drawings for the ten Sheets [FIGS. E1*e* through E10*e*] and [FIGS. E1*c* through E10-*c*] show MIDI Note ON and Note OFF messages generated for each example. The "e" drawings show this in terms of exact MIDI clock ticks and the "c" drawings show this in terms of the MIDI Note messages as they are aligned with corresponding visual feedback.

The "d" drawings for the ten Sheets [FIGS. E1*d* through E10*d*] identify, for each example gesture, the spontaneous perceptual-motor kinesthetic Sync Entrainment which the invention's free-space biofeedback behaviors induce in player subjective experience. This Entrainment is comprised of the transparent contextualization of initial Shadow action over a sensor (the actual trigger in fact) as only being in "Near" or temporal Proximity (indicated only by LP-1's visual response) to the subsequent "real" in-Sync Time-Quantized Attack response (indicated by LP-2, Beam-1 and MIDI responses together), the mechanics of which are disclosed in the summary for [Sheets D2 and D3]. The Finish system response to player release or Un-shadow action is similarly adjusted transparently, excepting for very long auto-sustain values. In player perceptual-motor terms, however, the end of a note's duration being perceivably subsequent to player release action is still deemed transparent, since subjective "ownership" of the creative act (e.g. generating the note) is weighted far more critically by the perception of input-output time identity at the start of the note. This corresponds to the familiar and natural resonance in acoustic instruments where there is some unpredictable persistence after the pluck of a string for example, such variations not calling into doubt ownership of the "act of plucking" itself.

Special cases [Sheets E3, E6, E7] where the Shadow or Un-Shadow actions are directly aligned with the response events (e.g. occurring at the same tick) are not included in the "d" drawings as these are not instances of the Entrainment effect. These include the exact and truncation types of state change vectors [FIGS. D1, D1*b*] although only truncation instances are illustrated on the Series E Sheets (exact being a rare occurrence). Another special case where Entrainment is not strictly indicated is for the combined fast [Shadow and Un-shadow] actions where both occur before the next Time Quantization slot, as for certain parts of the gestures shown on [Sheets E1, E4, E5, E6, E7, and E8]. With very fast player body lateral translation speeds, some perception of system delay is possible with the appearance of the briefly transitional Finish 2 or Finish 3 Response States [D1, D1*b*] together with player body displacement beyond the module at time of subsequent Primary Response. Thus the fast state change vectors are conservatively excluded from being identified as perceptual-motor Entrainment instances, although subjective reports from further experiments with players may reveal otherwise, such as identification of an "entrainment threshold" where the fast action occurs close enough in time to the TQ response to still entrain the Kinesthetic Spatial Sync effect.

Sheet E1 Attacks

Ergonomic Timing, State Changes, MIDI Out, and Kinesthetic Sync Entrainment

[Sheet E1] illustrates the simplest and most common case of system behavior, the Attack. When players Un-Shadow action comes either before the first applicable TQ slot or during the first Auto-Sustain duration, then Finish comes at end of Auto-Sustain duration value.

Sheet E2 Sustain Extend

Ergonomic Timing, State Changes, MIDI Out, and Kinesthetic Sync Entrainment

[Sheet E2] illustrates a common variation of the case shown in [Sheet E1], that is when the player holds the Shadow state beyond the end of the next Time Quantize point in the active Grid or Groove and Un-Shadows before the end of the current Auto-Sustain duration value [FIGS. E2-*a* and E2-*b*]. In this case, the note Extends by Auto-Sustain and Finish comes at end of the Auto-Sustain duration value. This is essentially the same Finish behavior as in case of [Sheet E1] except that the total duration has been held by an additional time period equal to the gap between the first and second (or first and nth) Time Quantization slots. Note that the subtleties of this behavior vs. the following behaviors shown in [Sheet E3] are highly dependent upon the relationship of the particular Quantize and Sustain CZB settings [FIGS. E2-*a* and E3-*a*] together with the timing of player actions.

Sheet E3 Sustain Truncate

Ergonomic Timing, State Changes, MIDI Out, and Kinesthetic Sync Entrainment

[Sheet E3] illustrates another common variation of the case shown in [Sheet E1], that is when the player holds the Shadow state beyond the end of the current Auto-Sustain duration, and the Un-Shadow comes before the next Time Quantization point for the applicable Grid or Groove [FIGS. E3-*a* and E3-*b*]. In this case, the Un-Shadow action Truncates the note, that is, the Finish response is simultaneous with Un-Shadow action, since there is no currently active Auto-Sustain value by which to extend the note.

Sheet E4 Sustain Anchor

Ergonomic Timing, State Changes, MIDI Out, and Kinesthetic Sync Entrainment

[Sheet E4] illustrates the identical player gesture as [Sheet E1] "Performance Example #1," however with a different value for the Sustain Anchor CZB Setup parameter, e.g. 85% vs. 100% [FIG. E4-*a* and FIG. E4-*b* side bar]. Sustain Anchor generates a unique degree of random variation to each Auto-Sustain value thus providing a "humanized" quality to the Sustain aspect of the performance.

Sheet E5 Quantize Anchor

Ergonomic Timing, State Changes, MIDI Out, and Kinesthetic Sync Entrainment

[Sheet E5] illustrates again the identical player gesture as [Sheets E1 and E4] "Performance Example #1," however with a different value for the Quantize Anchor CZB Setup parameter, e.g. 75% vs. 100% [FIG. E5-*a*]. Quantize Anchor introduces a unique degree of random variation to each Time Quantization slot thus providing a "humanized" quality to that aspect of the performance. This is an important feature as strict (Anchor=100%) time quantization schemes can be criticized as being aesthetically "too artificial," since natural acoustic or even live synthesizer performances rarely exhibit such a degree of time precision. The generation of the "random" aspect of Quantize Anchor is accomplished, however somewhat differently than for the Sustain Anchor case which uses an artificially generated random number. For Quantize Anchor, the player's natural variation in gap duration between Shadow action and next Time Quantize slot (according to the applicable CZB Quantize Setup [FIG. E5-*a*]) is exploited as being set as the 100% frame of reference, to which lesser percentage Quantize Anchor values are applied [FIG. E5-*b* side bar]. This also allows the musical feel of "playing ahead" since values less than 100% translate into a relative shift forward in time of the TQ Attack, a feature useful for some instrument patches having slow (audio) onset in their synthesized or sampled response. Values of less than 100% may be used for both Quantize Anchor and Sustain Anchor simultaneously for maximized "humanization".

Sheet E6 Re-Attacks

Ergonomic Timing, State Changes, MIDI Out, and Kinesthetic Sync Entrainment

[Sheet E6] illustrates a player gesture generating an initial Attack followed by two Re-Attack responses. The example shows how a Re-Attack may be generated by Shadow action during either an Attack Auto-Sustain or a Re-Attack Auto-Sustain [FIG. E6-*b*], and how it truncates the intercepted Auto-Sustain in both cases. The Attack Quantize and sustain CZB Setups [FIGS. E6-*a* and E6-*b*] are from a Groove (variegated) pattern while the Re-Attack Quantize and sustain setups are from Grid (uniform) patterns. An interesting contrast is generated in this particular case in that several Re-Attack TQ points are syncopated in relation to Attack TQ points [FIG. E6-*b*]. The Re-Attack response may have any or all aspects of its MIDI Notes response distinct from those of the Attack, including Velocity, Sustain, Quantize, Range, Channels, and Aftertouch [Sheets H1 and H2]. The contrast between the two may be as subtle, or as dramatic as desired including for example switching to entirely different sound module instrumentation (via Channel switching). The introduction of the Re-Attack entity to music thus amounts to expansion beyond only (binary) one Note ON and Note OFF per each pitch position to the "trinitization" of musical performance at its fundamental or note-event level, expanding the available variety of musical expression available to the player at a very intimate level of the performance experience, and uniquely so in free-space. The only potentially comparable feature of (non-free-space or conventional) MIDI music is the MIDI Aftertouch message which however is limited in that it only relates to the relative MIDI Velocity of a note, typically affecting loudness and in some cases timbre.

Sheet E7 Hybrid Quantizations

Ergonomic Timing, State Changes, MIDI Out, and Kinesthetic Sync Entrainment

[Sheet E7] further illustrates the potential for interplay between Attack and Re-Attack, where the two different TQ values alternate. [FIG. E7-*b*] shows a gesture identical to that shown in [FIG. E6-*b*] up to the designated time $t_6$. Thereafter, the two examples diverge, as in the [FIG. E7-*b*] case the third of the player's shadow actions occurs not during the Re-Attack Auto-Sustain (as in [FIG. E6-*b*]) but instead slightly after it, thus generating an Attack rather than a second Re-Attack. The realm of potential interplay between Attack and Re-Attack combinations is very large, and in all cases the player retains considerable and subtle control by means of their chosen timings of Shadow and Un-Shadow actions.

Sheet E8 Sustain by Attack Speed

Ergonomic Timing, State Changes, MIDI Out, and Kinesthetic Sync Entrainment

[Sheets E1 through E7] illustrate examples where player's evoking of Sustain and Quantize are in reference to pre-assigned Parameter Values governed by Grids or Grooves [see FIG. H1-*c*]. In systems with or without Type II sensors, many CZB Notes Behaviors may alternatively allow "on the fly" adjustment by referring to player's Precision (proximity of shadow to TQ slot), Position (within zone) and/or Speed of Shadow or Un-shadow action. In preferred systems incorporating Type II sensors, the Height degree-of-freedom may furthermore be employed to adjust any of the 14 Notes Behaviors.

[Sheet E8] illustrates an example of employing Speed (detection of lateral motion rate over a Type I sensor) as a parameter which affects the definition of a Sustain duration uniquely for each Attack Response. An "Inverse Map" is shown whereby a faster Shadow action Speed results in a shorter Attack Sustain duration [FIGS. E8-*b* and E8-*b* side bar]. While many other maps [Sheet i4] may be employed applying Speed to Sustain, this example is particularly "natural" in feel. [Fig E8-*f*] shows detail of the Speed Control Panel settings [Sheet i4] for this example, indicating the frame of reference Grid to which (or "OVER") the Speed is applied as a percentage to calculate the resulting sustain value, as well as the minimum ("LO") and maximum ("HI") values, and the resolution or number of mapped to values ("#VAL"). It is also possible to map Speed to a range of MIDI values, or even to ticks directly [Sheet i4], depending on which CZB Notes behavior it is applied to [FIG. H1-*c*] and the effect desired.

Sheet E9 Sustain by Release Speed

Ergonomic Timing, State Changes, MIDI Out, and Kinesthetic Sync Entrainment

[Sheet E9] illustrates an alternative example of employing Speed as a Live Kinesthetic Parameter, in this case Speed of Un-Shadow action, which affects Sustain duration uniquely for each Release of an Attack or Re-Attack. An "Inverse Map" is again shown here whereby a faster Un-Shadow or release Speed results in a shorter Sustain duration [FIGS. E9-*b* and E9-*b* side bar]. [FIG. E9-*f*] shows details of the Speed Control Panel settings [Sheets i4 and J4]. This example [FIG. E9-*b* and E9-*b* sidebar] illustrates how this type of control may range not only to less than 100% of the reference map but also to greater than 100%, as for the 200% HI value shown. For applications such as virtuoso play, it is furthermore quite permissible to employ Speed of Shadow action to one CZB Notes Behavior (such as Note Velocity or Note Range) while employing Speed of Un-Shadow action to another [see FIG. H1-*c*].

In this case the Speed of Release (Un-Shadowing) is applied as a percentage against the frame of reference of the Attack Sustain map. In all three valid cases of applying Live Kinesthetic Parameters to CZB for Notes Release definitions [see FIG. H1-*c*], namely Release Velocity, Release Sustain and Release Aftertouch, Speed (or Height) is always applied in reference to the relevant Attack map and thus functions as an "over-ride" to what the release values would have been had Speed (or Height) not been employed. There are no valid CZB for Notes independent options [FIG. H1-*a*] for the Release Range and Release Channels. These behaviors must always (and automatically) utilize range and channel parameters matching those of the Attack or Re-Attack ("AUTO"), or else mismatched MIDI Note OFF messages would be generated leaving "stuck notes" (Notes ON). Similarly there are no valid configurable options [FIG. H1-*a*] for CZB for Notes Release Quantize, since in practice the TQ definition is already employed prior to any Release occurring (e.g. it is, of course, not possible to go back in time and change it).

Valid Release over-ride behaviors (whether from Height or Speed) apply similarly to whichever type of Response they conclude, e.g. either Attacks or Re-Attacks. That is why there is only one (common or shared) set of Release CZB Setup definitions for each Zone in the CZB Command Panel GUI controls [Sheets H2 and H3, Series J]. While it is certainly possible via software logic to implement a free-space system having dual or separate sets of Release behaviors for each of Attack and Re-Attack, this is deemed too potentially confusing to the player to be useful, as well as requiring excessive overhead to manage and author content.

Sheet E10 Quantize by Attack Height

Ergonomic Timing, State Changes, MIDI Out, and Kinesthetic Sync Entrainment

[Sheet E10] illustrates and example of employing Height (distance of the Type I trigger zone intercepting body part above nearest single- or interpolated-multiple Type II modules) of Shadow action as a parameter which affects the definition of the next Time Quantization slots. Not only the "next" or "first" TQ slot after Shadow action is so defined but also further TQ slots as well, (until a subsequent Shadow action redefines them again), since these TQ values may be referred to by such as the Sustain Truncate [Sheet E2] and Sustain Extend [Sheet E3] at later points in the notes development and Release. A "Split Map" is employed, whereby the shortest Quantize value is found at the middle Shadow (Attack) height, and longest Quantize at both the least and the greatest Shadow action heights. (The mirror-reverse of this Split Map is also interesting and useful, e.g. having the longest Quantize at mid-height and shortest Quantize at greatest and least heights, in particular because of the spatial compaction at the top of the cone makes shorter Quantize values sensible for such "tight" play.) [FIG. E10-*f*] shows detail of the Height Control Panel settings, a variation of those shown on [Sheet i3], indicating the frame of reference is direct mapping to MIDI ticks. The LO and HI values are even integers reflecting the TQ divisors involved (quarter note at=60 ticks, eighth note at=120 ticks, and sixteenth note at=240 ticks) with #VAL set at=3 to indicate these are the only "mapped to" values across the height range. Sustain must be either by a Grid or a "bridged to" [FIG. H2-*d*] Height control for Sustain.

5.6 Series F: Software Modules, Electronics and Data Flow Architectures 5.6.1 Overview. The Series F drawings illustrate the software modules, the relevant electronics where such software resides, and the data flow architecture employed which together embody the ergonomic functionality of the free-space interactive interface and communicate with other relevant media equipment and software.

5.6.2 Groups. The Series F drawings are organized into four groups, representing different and complementary viewpoints of the same software, hardware, and data flows:

Group 1: [Sheets F1 and F1*b*] illustrate in summary overview fashion how the two primary functional control modules of the invention—the Free-Space Interface (Firmware and Hardware) Module (470, 530) and Creative Zone Behaviors (CZB) Processing (Software) Module (461)—may either co-reside within a single Integrated Console enclosure (130, 131) or, reside in a Free-Space Interface (543) enclosure distinct from a system enclosure such as a 19" rack mount for a Host Computer (487) with Audio systems (480, 481, 482). These two modules intercommunicate via MIDI messages structured in two unidirectional protocols designed specifically for this purpose, the Free-Space Event Protocol (444) and the Visuals and Sensor Mode Protocol (445); the use of these appears on [Sheets F1, F1*b*, F2, F3, F4, F5 and F6]. (See Section 5.6.4, MIDI Protocols).

Group 2: [Sheets F2 and F3] illustrate the internal details within the CZB Processing Module and Free-Space Interface Module, respectively.

Group 3: [Sheets F4, F5 and F6] illustrate three variations on Clock Master (472) and Global Sync Architecture, and details the data flows between the CZB Processing Module software and other ancillary software and equipment. This group also illustrates the distinctions in data flow pathways used only for interactive content authoring (491, 496, 500) versus those used for both live interactive play and authoring (504, 510, 511, 512), as well as the use of sequence tracks (492, 493, 494, 495) to store (encode) and retrieve (make active) Creative Zone Behavior (CZB) Setups (430, 431, 432, 433, 553) information by means of representative CZB Command Protocol (502) MIDI messages.

Group 4: [Sheet F7] illustrates the modular internal electronics for a Platform embodiment, although the Embedded Free-Space Microcontroller (530) circuit board detailed in [FIG. F7-*b*], however may be used for all Platform [Series A and B] and all Console [Series C] free-space interface configurations.

5.6.3 Design Constraints and Solutions. The design of the software and communications methods disclosed for the invention meets a number of demanding requirements.

(a) Ruggedness [Sheets F3 and F7]. The thin form factor of the transportable floor Platform [FIG. A1-*a*] combined with its unusually rugged duty requirement (e.g. one or more users encouraged to perform unconstrained and repeated full-body motions and high-force impacts directly upon it including jumping, dancing, etc.) demands firmware, that is, the use of exclusively solid state memory (468, 469), and no use of electromechanical data storage devices (disk drives etc.) residing within the Platform enclosure. Since interactive content titles commonly involve removable media of various types, that requirement naturally partitions these aspects of a total Platform system into a separate Host Computer (487). Similarly, such as a touch-display interface (127) is not suitable to be directly inside a Platform for the obvious human factors of in-accessibility (e.g., being at floor level vs. a typically standing player).

(b) Daisy-Chaining [Sheets F2, F3, F4, F5 and F6]. Multiple Free-Space Interfaces in "shared" venues operating within media content in (440 *or* 499) on a single host computer (487) with the CZB Processing Module (461) are "daisy-chainable" to minimize both interconnect cabling complexity and MIDI patchbay equipment overhead. RS-485 is shown as an example, although other higher-performance IEEE and ISO standards may alternatively be implemented including such as for example USB (universal serial bus), FireWire, and fiber optic links.

(c) High-Speed, Bi-directional I/O with MIDI [Sheets F2 and F3]. The Free-Space Interface (507) architecture maintains MIDI message software compatibility while it supports higher speed and bi-directional communications standards such as the RS485 (450, 451) shown at 112 kbs (in addition to the original MIDI specification's unidirectional 41 kbs serial speed), in order to efficiently implement daisy-chaining and connect to the CZB Processing Module (461) while minimizing degradation of system performance due to MIDI message buffering and repeating.

(d) Multiple MIDI Communications [Sheets F4, F5 and F6]. The CZB Processing Module (461) communicates with suitable companion software including MIDI sequencer (440) and Other MIDI Processing (439) software co-residing on a multi-tasking PC-type computer (487), as well as with other MIDI-compatible media equipment including computer graphic systems (438) with large-format displays, and intelligent robotic lighting systems (437). Of particular note is that although pre-existing or "conventional" use of MIDI messages are employed in most of these cases (e.g. messages compliant in functional application with each software or hardware manufacturer's MIDI implementation), unique Sync advantages are gained in terms of message timing, as discussed in the Global Sync Architecture section (g) below. Also, a novel CZB Command Protocol (502) specifically designed for free-space systems is employed, in conjunction with the sequencer function (440 *or* 499) and transparently within the MIDI data constraints of sequencer track formats.

(e) Content Authoring [Sheets F4, F5 and F6]. The architecture takes into account the differing requirements of free-space Performance or Play of interactive content in typical end-user (player) venues, vs. the studio Authoring environments for free-space content development. This may include the use of other "conventional" MIDI controllers (500) typically for accompaniment tracks composition. The "A" symbol denotes Authoring-only data flow paths (491, 496, 500, 520, 521, 523). During authoring sessions a MIDI sequencer (440 *or* 499) capability is used to "capture" (encode for later recall) authored Creative Zone Behavior (CZB) Setups Data (430, 431, 432, 433) by means of the CZB Command Protocol (502) into convenient CZB Command Tracks (492, 493, 494, 495) which co-reside in the sequencer (440 *or* 499) with other accompaniment tracks (497), digital audio tracks (525) and/or other data tracks (498) for subsequent playback during live free-space performance sessions. (See Section 5.6.4 below, MIDI Protocols).

5.6.4. MIDI Protocols. The Series F drawings illustrate the contexts of three distinct and novel uses (444, 445, 502) of the MIDI protocol, designed specifically for the free-space interactive system, as well as additional uses (496, 503, 510, 512) of "pre-existing" MIDI message usage (e.g. being compliant with manufacturers' MIDI implementation) however in the free-space context. All of these MIDI protocol uses in their functional assignments and specific MIDI messages employed, are identical whether used over original MIDI serial, RS-485, RS-232C, internal shared memory, or via other high speed communications standards such as FireWire or USB. Two of the protocols, the (A) Visuals and Sensor Modes Protocol. (444) and the (B) Free-Space Event Protocol (445) are used strictly over "internal" (exclusive) communications links and only between one or more Free-Space Interface (470, 530) Module(s) and one "host-resident" CZB Processing Module (461). Uses of these two protocols (444,445) appear on all of the [Series F] drawings except [Sheet F7]. Typically these "internal" links and thus the protocols' (444,445) data is isolated from other MIDI data streams, although provision is made for intermixing with other MIDI data if necessary for customized applications, by means of flexible assignment of alternative messages to avoid assignment "collisions". The third protocol type, the (C) CZB Command Protocol (502) is designed for published "open standards" use, being employed to configure the ergonomic behaviors (551, 552, 553) of the media system variously by free-space-interactive compatible content titles.

(A) Free-Space Event Protocol [Sheets F1, F1*b*, F2, F3, F4, F5 and F6]. Messages within this protocol (445) are sent always from the Free-Space Interface Modules(s) (507, 530) to the CZB Processing Module (461), when player actions are determined by the Free-Space Interface Firmware (470) to qualify as "valid" Type I and Type II sensor events to report. "Valid" events are those qualifying from AGC (automatic gain control) and other logic in the firmware (427, 428) as not being "false triggers" (e.g. false detection of shadow or unshadow events where no corresponding player actions occurred, or invalid height data). Depending upon the firmware (470) parameters configuration stored in memory (469) established by the Visuals and Sensor Mode Protocol (444) (see below), or by read-only "factory defaults", valid Type I events (23,24) (shadow and unshadow actions) are reported via MIDI out (435, 83, 466) using either the protocol's (445) Note ON/Note OFF or Control Change messages. The MIDI Channel value in these messages indicates CZB Zone assignment, Note Number or Controller Number indicates sensor physical position in the interface, and Note Velocity or Control Change Data value indicate the player's Speed (581) parameter (speed of lateral motion across Type I trigger region). Type II events (669) (height detection data) are reported using Control Change messages.

(B) Visuals and Sensor Mode Protocol [Sheets F1, F1*b*, F2, F3, F4, F5 and F6]. Messages within this protocol (444) are sent always from the CZB Processing Module (461) to the Free-Space Interface Modules(s) (507, 530). (i) The Visuals Protocol is comprised of two functional groups of messages. LED Configuration Commands setup firmware-accessed RGB color lookup tables in memory (469), and also set MIDI message assignments. LED Control Commands change the active LED states pursuant to the logic in software (429) as per [Sheets D1, D1*b*]. LED Configuration Commands include both System Exclusive and Control Change messages. LED Control Commands employ either Control Change or Note ON/Note OFF messages, determined by previous LED Configuration Commands or factory defaults. (ii) The Sensor Mode Protocol uses System Exclusive messages to configure the characteristics of Type I and Type II messages subsequently sent via the Free-Space Event Protocol (445). Type I configuration options include MIDI message assignment, AGC (Automatic Gain Control) modes and parameters, sensor-to-Zone assignments, and dynamic range of Speed (581) reporting. Type II configuration options include MIDI message assignment, multiple sensor interpolation and spatial averaging modes, sensor-to-Zone assignments, time averaging and reporting modes, and dynamic range of Height (580) reporting. Typically the LED Configuration Commands and Sensor Mode Protocol messages are automatically generated from the host-resident CZB Processing Module (461) as a result of Creative Zone Behavior (CZB) Setups (via either GUI commands or via playback of content CZB Command tracks—see below), but alternatively may be manually set by CZB Processing Module system utilities, for such as system troubleshooting or experimental applications.

(C)Creative Zone Behavior (CZB) Command Protocol. [Sheets F4, F5 and F6] illustrate the contexts of use (491, 501) for the CZB Command Protocol (502). This protocol both indexes to, and encodes within MIDI messages (491, 501) external to the CZB Processing Module (461), the four types of CZB Setups Data residing within the CZB Processing Module [Sheet F2], namely for Notes (430), MIDI Controllers (431), Local Visuals (432) and External Visuals (433). The CZB Setups Data stores the control and parameter values for ergonomic response behaviors of the free-space system (e.g. translation of player actions to visual and audio results). [Sheets G1, G2, and G3] illustrate in conceptual overview format how these CZB Setups connect or map between player's Kinesthetic feature space input parameters (546) and the media output parameters for music (547) and Visuals (548). The CZB Setups Data serve this role in software (429) identically whether the source of their configuration data originated from either: (a) an author/composer's (or expert player's) use of the GUI (Graphic User Interface) Command Panels [Series H, i, J and K drawings], or (b) via an input MIDI stream of CZB Command Protocol messages including from CZB Command Tracks (492, 493, 494, 495) stored within a sequencer (440 or 499) MIDI song file (filename.mid) as shown in [Sheets F4, F5 and F6].

The CZB Processing Module (461) software includes in its pre-stored CZB Setups Data (write-protected) library of "factory defaults" various pre-configured Zone Map (656) assignments [Sheet H6] and Creative Zone Behaviors for Notes (430) such as shown in the detailed examples [Sheets H4 and H5]. The most "compact" use of the CZB Command Protocol (e.g. efficient in terms of minimizing MIDI communications overhead) is to simply select from the "factory default" CZB Setups Data configurations, or from previously "user defined" and previously stored CZB Setups. This is analogous to the selection of stored/configured instrument "voices" for a MIDI synthesizer or sampler sound module (usually via MIDI Program Change messages), except in the free-space case [Sheets G1, G2 and G3] the CZB Command Protocol (502) and corresponding CZB Setups Data control the complete scope (430, 431, 432, 433, 553) of possible ergonomic behaviors of the interface. (Noting however in this comparative analogy, that the CZB Notes Behaviors (430) for Channels (576), Range (575) and Velocity (572) may also affect timbre, depending upon sound module(s) (480) "instruments" and/or "effects" settings).

The simplest CZB Command Protocol (502) context consists of two aspects. First, a MIDI System Exclusive Master Zone Allocation message (i) assigns a Zone Map [Sheet H6] or sensor allocation map to physical Free-Space Interface Module(s) (507), and (ii) assigns one CZB Command Receive Channel (626, 627, 628) to each Zone for all free-space interfaces connected to the CZB Processing Module's (461) host computer (487). These CZB Command Receive Channel assignments also determine the assignment of which incoming Free-Space Event Protocol (444) Type I and Type II sensor messages are processing according to which Zone's (629, 630, 631) CZB Setups (295, 296, 297). System Exclusive is used for the Master Zone Allocation message since it is channel independent, and all subsequent channel messages (Note ON/OFF and Control Change) reflect that Master Zone Allocation configuration. Second, for each (629, 630, 631) Zone (now a distinct MIDI channel), MIDI Control Change messages defined in the (502) protocol assign 1 of (n) CZB Banks and 1 of (n) CZB Setups within that Bank. Multiple (n) physical free-space interfaces (507, 452, 454) whether connected to a common host (487), or by multi-host extensions of the protocol (502) to Other Free-Space (441) hosts, may be configured by these CZB Commands for shared media content by (n) players. It is also possible via the corresponding [Sheet H3] GUI Commands to separately select CZB Command Receive Channels (626, 627, 628), to assign CZB Banks and Setup (295, 296, 297), and to reassign the Zone Map (613) per each Zone (629, 630, 631) and for each Player (612). It is not necessary for all the zone-to-channel assignments to be unique, although this is most common to avoid confusion between multiple players by providing mutually distinctive zone responses.

The number of CZB Banks is memory (of 487) dependent. Available memory is allocated to (n) read-only Banks for "factory default" pre-stored (write-protected) CZB Setups, plus another (n) Banks for "user" CZB Setups which may be freely designed and configured, typically by initially copying the "factory" setups into "user memory" and then modifying them. In content authoring applications, where "user" or custom CZB Setups are exploited, this is typically accomplished as follows.

The CZB Command Panels (599, 600, 601) GUI are used to configure the CZB Setups for "Notes" shown in [Series H, i and J], "Nuance" (free-space continuous Controller modes) not disclosed but suggested in [Sheet G2 (566)], "Local Visuals" (LEDs response) shown in [Series K], and "External Visuals" not disclosed but suggested in [Sheet G2 (570)]. The use of the GUI Command Panels generate [Sheets F4, F5, F6] corresponding MIDI "authoring" ("A") output (491) of the CZB Command Protocol messages which are recorded into tracks (492, 493, 494, 495) on the host-resident sequencer (440 or 499). These tracks are then stored along with any Accompaniment Tracks (497) and/or Other Control Tracks (498) into a MIDI (filename.mid) "song file." To configure the system for free-space interactive play or performance, the playback of CZB Command Tracks, initiated by a System Realtime Start message (hex byte $FA) from Transport (471), results in making "active" the CZB Setups Data which was previously indexed to and/or "encoded" by the CZB Command Protocol during the authoring phase. This determines the Free-Space system's ergonomic response behaviors to player actions at the beginning of and continuously variable during the Play session as the sequence tracks roll forward (playback), until a System Realtime Stop message (hex byte $FC) from transport (471) halts the sequence.

There are several procedures or methods to "capture" (491) and "playback" (501) CZB Command Protocol (502) messages using CZB Command Tracks (492, 493, 494, 495) and the sequencer (440 or 499). These methods may be intermixed in practice, and used for all Global Sync architectures [Sheets F4, F5 and F6].]. When the "factory default" CZB Setups are suitable "as is", then the sequencer may be employed with Control Change messages which directly set the index to the "factory" CZB Bank number and CZB Setups number (these messages are assigned within the "undefined" control number range of 102 to 119 decimal). When there are desired variances from a "factory default" CZB Setup but which are relatively minor, then first this method to index to the "factory" CZB Bank number and CZB Setups number is employed followed by (n) individual Control Change messages for individual CZB Setup parameters needed to adjust or 'overlay' the variances from the particular "factory default" CZB Setup (see below). This is the most convenient method.

Another method is to create and store complete "user-defined" CZB Setups which may include any valid combinations of CZB Setup parameters and which may be entirely unlike any of the "factory" CZB Setups. These may be authored via GUI, then captured (491) and subsequently replayed (501) in their entirety by the sequencer in the form of a comprehensively defining or "bulk" System Exclusive message: the CZB Zone Data Dump. This "Sysex" message also includes assignment of its CZB Setup data to a "user" Setup or memory index number, so that subsequent to the first instance of use, the more compact Control Change messages for CZB Bank and CZB Setup may be employed which simply index into the user CZB Setups data memory previously loaded by the CZB Zone Data Dump message, to make it active.

In addition to (and in combination with) these two methods, CZB Command Protocol (502) Control Change messages are used to affect any and all of the large number of individual CZB Setup Control Types [FIG. H1-*b*] with their parameters detailed in [Series i]. These Control Change messages utilize the extended scope of device-specific data via the MIDI protocol's Non Registered Parameter Numbers (NRPN) with LSB (least significant byte) and MSB (most significant byte), and may be used at any time to adjust any characteristics of response during play. In the case of Creative Zone Behaviors for Notes (430) these CZB Command Protocol Control Change messages include the equivalents to all GUI actions, including for example: changing the application of player's Type II Height data (580) from Attack Velocity (267) to Attack Range (270), changing the Lock to Groove (284) for Attack Quantize (269) from one Groove to a different Groove (697), changing the Attack Channels (271) from pre-assigned values to being determined by the player's Precision (288) parameter, and the vast number of other permutations of ergonomic control illustrated in [Series H, i and J]. [FIG. H1-*c*] details the 71 possible (valid) CZB Behaviors for Notes, [Series i] details the Control Types and their parameters available for assignment to Notes behaviors, and [Series J] illustrates specific examples of useful applications in practice; all of these are individually configurable by use of the CZB Command Protocol (502).

(D) Other "Third Party" MIDI Protocol uses and conventions [Sheets F4, F5 and F6]. Additional uses (496, 500, 503, 510, 512) of "pre-existing" MIDI messages are employed, i.e. messages which are compliant with manufacturers' MIDI implementations and/or which follow industry conventions. These are used however in the free-space system context.

For authoring of audio accompaniment to be used as part of free-space interactive content titles, conventional MIDI controllers (486) may be used (500) to capture accompaniment tracks (497) including common uses of Notes ON/OFF messages with velocity, Continuous Controllers for such as portamento, breath control, and modulation Control Change messages and/or a pitch bend device for generating Pitch Bend Change messages.

For authoring of External Visuals accompaniment (e.g. non-interactive aspects of a total immersive media environment), this may similarly use the conventional MIDI controller (486) or other devices such as memory lighting controllers, and store such "lighting queues" also into tracks (497) for playback during interactive play sessions.

During interactive play, the CZB Processing Module (461) outputs "conventional" Note ON/Note OFF messages (510) to Other MIDI Processing Software (439). These messages reflect Player's Type I sensor shadow/unshadow actions (sometimes combined together with influence of Type II sensor data if employed), however these messages are temporally adjusted or scheduled (434) by logic (429) to be in Kinesthetic Spatial Sync alignment [FIGS. E1-*c, d&e* through E10 *c, d&e*]. These "conventional" Note ON/OFF messages' parameters furthermore are defined by the Creative Zone Behaviors for Notes (430) for the Zone, in that their note number (message byte two) reflects the Range Behavior (575), their velocity (message byte three) reflects the Velocity Behavior (572) and their channel (message byte one LS nibble) reflects Channels Behavior (576), The function of the Other MIDI Software (439) is typically and primarily (but not exclusively) to adjust or translate the note number (byte two) according to various schemes of chord/scale adjustment under control of its own Other MIDI Processing Command Tracks (498), and to then send (511) these adjusted Note ON/OFF messages (still within the Kinesthetic Spatial Sync timing, e.g. passed through without other time processing) on to sound modules and effects units (480). Within some CZB Setups, Type II sensor data may alternatively be passed (510) to Other MDI Software (439) directly in the form of Control Change messages which may affect a variety of parameters including both conventional (modulation, pitch bend) and unconventional (such as the Other Software's chord and/or scale controls).

Conventional MIDI Note ON/OFF and Control Changes messages are also used for Intelligent Robotic Lighting (437) in compliance with the lighting equipment's protocol, and Computer Graphics (438) in compliance with the MIDI visuals software employed in such a external computer system. Similarly as to the case for Other MIDI Software, the messages sent (510) to these visuals systems align in Kinesthetic Spatial Sync via scheduling, and their parameters reflect player's actions according to CZB Setups (433).

(E) Global Sync Architecture [Sheets F4, F5, and F6]. The free-space architecture for content exploits alternative sources of MIDI Clock Masters (472), in order to accommodate various modalities of synchronized accompaniment media and also (in one case [Sheet F4]) to support player's control of tempo. CD-audio (513) via Other MIDI Processing software (439) acting as Clock Master (514, 516) is shown in [Sheet F5]. Digital Audio tracks (525) via Sequencer (440) acting as Clock Master (528) is shown in [Sheet F6]. Free-space Internal (CZB Processing Module) software (461) acting as Clock Master (506) is shown in [Sheet F4]. Enhanced CD (CD+), CD-ROM, and DVD content may similarly serve as Master Clock sources; although these are not separately shown in the drawings, they may be derived from the other examples illustrated.

Regardless of which source media or software is acting in capacity of MIDI Clock Master (472), the free-space software (461, 470) and communications methods (444, 445, 502) employed strictly maintain the ergonomic look-and-feel of the Kinesthetic Spatial Sync effect [FIGS. E1-*d&e* through E10-*d&e*]. This Sync effect includes player perception of exact alignment between body kinesthetic and live play responses (510, 511) and external visuals (437, 438, 512), while also in clock/tempo sync with previously authored (496) accompaniment (504). The maintenance of this Global Sync between body kinesthetic (546), visual response (548), and audio response (547) ensures each event is perceived in 3-way Synesthesia (560) (multi-sensory fusion) as illustrated in [FIG. G1-*a*]. The continuity of this effect by means of Creative Zone Behaviors (551, 552, 553) for all feedback constitutes an Omni-Synesthetic Manifold (571) as illustrated in [FIG. G2-*a*]. The [FIG. F4-*a*] Internal clock source (506) case can include a free-space player's control (505) of tempo during live play while still maintaining the Kinesthetic Spatial Sync effect across all of the media.

Furthermore, the free-space architecture brings into the precise Kinesthetic Spatial Sync ergonomic alignment of all these diverse media elements, in-sync with whichever MIDI Master Clock, while many media components in the environment do not need to actually receive in their MIDI streams (510, 511, 512) the clock data (MIDI System Realtime byte $F8 hex). This avoids a communications overhead which is very significant since many types of MIDI devices and software commonly exhibit substantial delays, dropped messages, or can even fail (lock-up) altogether when the very dense System Realtime MIDI beat clock is inter-mixed with much other (non-System-Realtime) MIDI data. This problem is overcome in the free-space software (461) time quantization (574) and auto-sustain (573) logic for Notes and corresponding visuals for state change vectors $V_2$, $V_5$, $V_7$, $V_8$, $V_{12}$ and $V_{14}$ [Sheet D1*b*] generating (434) Scheduling [Sheets F1 and F2] for in-SYNC-alignment [FIGS. E1*c, d&e* through E10*c, d&e*] of the non-System-Realtime messages such as Notes ON/OFF sent to these various subsystems [Sheets F4, F5 and F6]. This is in practice equivalent to a kind of "pseudo-clock-master" (474) e.g. without needing the $F8 System Realtime clock data stream. This includes the free-space software (461) in some cases simultaneously functioning in the capacity of a bona-fide MIDI Clock Slave (518) and a (pseudo-) MIDI Clock Master (474) simultaneously.

Sheet F1 Integrated Console Architecture

Simplified Overview of Hardware and Software Partitions, and Figure Cross-Reference

[FIG. F1-*a*] illustrates the Integrated Console hardware/software architecture which includes together the functions illustrated in [Sheets F2, F3, and F6] within a single physical enclosure (130, 131). Pro performance, arcade-type public venues, and content authoring applications benefit from this "all-in-one" integration. The Integrated Console enclosure includes the Embedded Free-Space Microcontroller (530) with its Free-Space Interface Firmware (470) for Type I Sensor/LED (128) and Type II Sensor (113) processing, and Multi-tasking PC computer (487) with integral touch-display (127) In addition to the CZB Processing Module (461) software, the enclosure-internal PC computer also runs the co-resident MIDI Sequencer (440) and Other MIDI software (439). The integral touch-display and data storage subsystems are shared (488) via operating system BIOS and OS (Windows) software calls (478) by the CZB Processing, Sequencer, and Other MIDI software modules.

[FIG. F1-*a*] shows partitioning for MIDI synthesizer(s) and digital audio (D.A.) hardware in its most compact form, within one or more circuit cards (480*) residing within the PC's expansion bus slot(s). This overcomes limitations of such as 41k external MIDI speeds and allows for optimal timing performance and integration with the software modules (439, 440, 461) running on the PC.

Internal audio amplifier (482) and speakers (484, 485) are included, although external MIDI sound and effects modules (480), mixers (481) and external audio systems may also be used as shown in [FIG. F6-*a*]. While not shown in [F1-*a*], when external audio systems are used (such as in Pro performance venues) the internal amp and speakers may serve as local "monitors" for the performer, and internal MIDI synth may be disabled. In professional stage or themed venues, or for visuals content authoring, the MIDI I/O panel (135) connects to external MIDI-controlled graphics (438), robotic lighting (437), and/or other Free-Space Hosts (441) via inter-host extensions to the CZB Command Protocol (502).

Sheet F1*b* Interface-and-Host Architecture

Simplified Overview of Hardware and Software Partitions, and Figure Cross-Reference

[Sheet F1*b*] illustrates the Interface-and-Host Architecture which partitions the free-space interactive media system into multiple enclosures, primarily an Interface enclosure (543) and a Host PC (487) plus audio enclosure. This "split" architecture is preferred for three configurations: professional stage Platform, consumer Platform, and consumer Console.

For all transportable (thin) Platform embodiments this is the architecture used, for the reasons of ruggedness and display-interface ergonomics discussed in the Series F Design Constraints and Solutions section (a) above. In the professional stage performance and other public Platform venues (such as Location Based Entertainment), the Host PC (487) with its software (439, 440, 461, 488), display (442) and input device (443) are typically 19" rack-mounted in either shock-resistant road cases or inside a podium-style enclosure, together with MIDI Sound Module(s) (480), Audio Mixer (481) and Amplifier (482). External computer graphics (438) and intelligent robotic lighting (437) are separate.

For consumer-type "Home" Platform use, a rack mount would be the exception and the Host PC would be in its own enclosure; audio would be handled either with external MIDI sound module(s), mixer and amplifier in the "pro-sumer" case, or more compactly by means of PC-integrated sound card (480*) similarly as shown in [FIG. F1]. In both consumer and pro stage configurations, speakers (484, 485) are typically separate.

The "split enclosures" architecture is suitable for a basic (economical) consumer-type or "home" Console embodiment lacking an integral PC and touch-display. This type of Console, a free-space interactive PC peripheral MIDI interface, is connected by conventional MIDI, RS-232C or RS-485 serial cable to a separate home PC computer running the co-resident software modules (461, 439, 440, 488). The "internal" MIDI protocols (444, 445) used over this cable link are identical in nature to those used within an Integrated Console [Sheet F1]. The audio is typically handled by means of PC-integrated sound card (480*), however may alternatively in pro-sumer case be in the form of separates (480, 481, 482). The enclosure-internal electronics for such a home Console, with embedded firmware (530, 470) and Type II sensor modules (113) are identical to the Platform case. The internal cabling and interconnects however are Console-specific, and the Console style of Type I sensor/LED modules [Sheets D8, D9] are used.

For simplicity in this [Sheet F1*b*], the data flows (476, 478, 479) between the co-resident software modules (439, 440, 461, 488) are represented with single bi-directional lines, however these are further detailed in [Sheets F4, F5, and F6].

Sheet F1*c* Matrix of Embodiment Variations

Combinations of Sensor Types, LED/Light Pipe Types, PC Host/LCD, and MIDI Audio

Alternative configurations for the Platform and Console embodiments of the invention are differentiated into Variations. These classifications depend upon the inclusions of: Type I only or Type I and Type II sensors both; LED and light pipe Classes A, B, C or D; internal or external computer and display configuration; and internal or external MIDI audio. Seven principle Variations (871-877) of the Platform embodiment are disclosed, and eight principle Variations (878-885) of the Console embodiment are disclosed.

Sheet F2 Creative Zone Behavior (CZB) Processing Module

Internal Software Architecture/MIDI and Data Flow

[Sheet F2] illustrates the CZB Processing Module software internal architecture and data flow. This software is "host-resident", residing within a PC-type computer (487). In a free-space interactive media system, the CZB Processing Module (461) software always complements one or more Embedded Free-Space Microcontroller module(s) (530) illustrated in [Sheets F3 and F7-*b*]. The CZB Processing Module functions as logic processor, scheduler and mediator between the Free-Space Interface (507) data streams (444, 445) and the other host-resident MIDI software modules (439, 440), MIDI audio (480) and (when employed) computer graphics (438) and robotic lighting equipment (437). The CZB Processing Module further manages with Display Device (442) and its control software (422) together with Input Device (443) and its software (421) a GUI interface logic implementing the functions shown in the [Series H, i, J and K] drawings, using low-level of I/O via OS/BIOS display and input device resources (488) shared with other (439, 440) host co-resident software [Sheets F1, F1*b*, F4, F5 and F6]. For simplicity in [FIG. F2-*a*] the MIDI IN and OUT (446, 448) are shown as one item each, although in practice they represent a more complex mix of both internal software data flows and external communications ports as further detailed in [Sheets F4, F5 and F6].

The function of the MIDI IN Parser (a) (420) is to filter out any data errors, and then to split the incoming valid MIDI (446) and RS-485 (450) Data In, into three data streams and route them to the appropriate internal software modules. Incoming MIDI clock data ($F8 messages) from external source (509 *or* 516) is converted into a beat-clock-synced metronome format (424) and distributed to both the Free-Space Event Processor (429) and the Scheduler (434). Incoming Free-Space Event Protocol (444) messages are routed to the Remote Performance Pre-Processor (426), where they along with any equivalent GUI commands detected by (421) for simulated performance [FIGS. K4-*a*, K4-*d*] are converted into an internal uniform format of event messages for the Free-Space Event Processor (429) Incoming Creative Zone Behavior (CZB) Command Protocol (502) messages (501) originating in external sequencer (440 *or* 499) are routed to the CZB Command Processor (423).

The CZB Command Processor (423) receives and parses CZB Command Protocol (502) messages and when these are deemed valid, makes the relevant modifications to the stored CZB Setups Data (430, 431, 432, 433) and/or marks as "active" indexes thereto for subsequent use by the Free-Space Event Processor (429). The use of the CZB Setups Data (430, 431, 432, 433) is discussed in depth in Section 5.6.4 (C) Creative Zone Behaviors Command Protocol. The CZB Command Processor (423) also interprets user GUI actions via the Input Device (443) and software (421), and if MIDI output is enabled for content authoring (491), or inter-host protocol extension is enabled for link to Other Free-Space Hosts (441), it then structures CZB Command Protocol (502) messages and sends them to the MIDI OUT Message Assembler (435) for MIDI output (448).

The Free-Space Event Processor (429) implements the core realtime functional logic of the Creative Zone Behaviors paradigm. This software takes input valid Type I sensor events encoded via Free-Space Event Protocol (444) from the Remote Performance Pre-Processor (428) together with Timing Metronome (424), and applies three types of logic tests in mutual context: test #1 is for previous Module Response State at time of event=which of 9 cases; test #2 is for Event Type=which of 3 cases; and test #3 is for Timing Condition=which of 13 cases) as is illustrated in the table [FIG. D1*b*]. The combined output of these tests is the determination of which one of the 18 possible State Change Vectors ($V_1$ through $V_{18}$) should follow from the Shadow ("S") or Un-Shadow ("US") or ΔT-only input event instance.

At start time of every one of the 18 different State Change Vectors and for all interface (507) Type I sensor or ΔT-only events, Free-Space Event Processor logic (429) outputs to the Scheduler (434) (always with a time stamp delay value of zero) the appropriate LED Control Command in protocol (444), namely one of the 7 cases of Module Elements Feedback States for LP1 (93, 97, 13, 70), LP2 (94, 98, 14, 71) and B1 (15, 72) shown in [Sheets D1 and D1*b*]. The resulting RGB output values of the Module Elements for these 7 cases is dependent upon software (470) previous receipt of LED Configuration Commands in protocol (444) for each Zone (see Section 5.6.4, MIDI Protocols) and their consequential RGB lookup table settings in the memory (468) of Free-Space Microcontroller (530).

For 13 of the 18 State Change Vectors ($V_2$, $V_4$, $V_5$, $V_7$, $V_8$, $V_9$, $V_{10}$, $V_{12}$, $V_{14}$, $V_{15}$, $V_{16}$, $V_{17}$, $V_{18}$) and as these occur for any and all interface (507) Type I sensor positions, Free-Space Event Processor logic (429) structures the parameters (channel, note number, velocity) of a MIDI Note ON or Note OFF message and sends these to Scheduler (434). A clock metronome (424) time stamp delay value (including case of zero value) is affixed to these messages (510, 496, 512) indicating when the Scheduler should send them to the MIDI OUT message assembler (435) for output (448) to co-resident software (439, 440) and/or external visuals systems (437, 438). The value of the time delay affixed to a particular message, as well as the MIDI parameters of channel, note number and velocity values, are determined uniquely for that message in reference to the CZB Setups Data (430, 431, 432, 433) which are applicable (the "active" indexes) for the triggering event (shadow or unshadow or ΔT-only) for the particular sensor position in the particular Zone. The timing and MIDI parameters may also include the influence of Type II sensor data for Height (286) as in the case example illustrated in [Sheet E10], or modified by Speed (287) as in the case examples illustrated in [Sheets E8 and E9]. Examination of the entire [Series E] drawings will illustrate the results in practice for many examples of the temporal logic implemented in software (429) including how Type. I and Type II data are combined into the MIDI streams which produce the ultimate perceived media output results.

The Scheduler (434) manages a queue of waiting messages which are sent to MIDI OUT Message Assembler (435) when their time stamp delays count down to zero, thus resulting in the pseudo-clock effect (474) discussed in the Global Sync Architecture [Sheets F4, F5, F6] section (f) above. Alternatively, if the media environment including software modules (439, 440, 441) exploits features of MIDI which support messages with time stamps (Song Position Pointer messages, MIDI Time Code Messages, or extended protocols such as ZIPI) the messages may be sent out immediately through the MIDI Message Assembler (435) which adds the appropriate time stamp format for the protocol to each message. In this latter case, unique ergonomic/perceptual advantages may be gained over random latency including over the Internet for remote networked or multi-host free-space content. This is because (i) the chaotic "undesirable" network packet delays will average to some significant degree into the "desirable" precision or timed delays of the CZB time quantization logic, and also (ii) the time-stamped messages sent "ahead" of their "play" times have an increased chance to "get ahead of" the network delays, ("play" here meaning submission of the message to media software or hardware resulting in audio/visual feedback). Thus for both these reasons, the mutual/remote linked media events will be in increased Sync as compared to an equivalent mutual media link which did not employ the CZB time quantization logic.

Sheet F3 Free-Space Interface Module

Embedded Firmware Architecture/MIDI and Data Flow

[Sheet F7] is also closely referenced in this [Sheet F3] description since the software and hardware are intimately related, and some variations in functional allocation between software vs. hardware are described which would not depart from the spirit of the invention. [FIG. F3-*a*] illustrates the Free-Space Interface Module (507) which is suitable for either Platform or Console embodiments as illustrated in [FIGS. F1 and F1-*a*]. The function of the Embedded Free-Space Interface Firmware (470) within Module (507) is three-fold. First, to detect player free-space actions (23, 24, 669) and report valid Type I (95, 99, 16, 73) and Type II (113) sensor events via the Free-Space Events Protocol (444) to an external CZB Processing Module (461) Second, to receive from Module (461) LED Configuration Commands within the Visual and Sensor Mode Protocol (445) to setup LED RGB lookup tables for subsequent use by LED Processing software (895), and MIDI assignments for subsequent use by MIDI IN Parser (b) (462), pursuant to receiving protocol (445) LED Control Commands. Third, to process incoming Sensor Mode Protocol messages also within data stream (445) in order to configure MIDI assignments for subsequent use by Parser (462), and to define logic modes and settings for Type I and Type II Sensor Processing software modules (427, 428).

[FIG. F7-*b*] shows how the Embedded Free-Space Microcontroller (530) (EFM) module is interfaced (415, 416, 417, 418, 438) to the time-critical I/O hardware. The Embedded Free-Space Interface Firmware (470) employs a real-time operating kernel supporting preemptive multitasking and prioritized interrupts to optimize its interface with all this I/O hardware. The firmware (470) in memory (468) is object-oriented and supports inter-object messaging.

The RS-485 Network Node Manager (464) is implemented via software and/or ASIC (Application Specific Integrated Circuit) or other electronic logic such as an integrated "smart" USRT (467) (Universal Synchronous Receiver/Transmitter) which is designed for RS-485 LAN network processing. Its function is to determine if incoming protocol (445) messages are addressed to its local Module node ID# or to another network node ID# (507, 452, 453 *or* 454). Hardware implementation of this function is preferred to offload processor (535). Messages addressed with the local node ID# are routed to the local node's MIDI IN Parser (b) (462). Messages for other node addresses are forwarded "thru" to the RS-485 Data OUT (81, 467). Network Node Managers (464) in Modules (454, 453 *and* 453) "ahead" in the daisy chain of module (507) as shown in [FIG. F3-*a*] would parse out or "capture" messages addressed to their node ID#'s and not repeat them out further. Similarly, depending upon position in the daisy-chain, an Interface such as (452, 453, 454) will "thru" forward to remote host software CZB Processing Module (461) protocol (444) messages received from other Interface Modules "down" the daisy-chain. The primary function performed on incoming MIDI data by MIDI IN Parser (b) (462) is that of detection and routing, of either Visuals Protocol (436) messages to LED Processing software (895) or Sensor Mode Protocol messages to software modules (427) or (428).

The external data (444, 445) and internal data flows to and from the RS-485 "virtual ports" (81, 467) and (80, 467) are shown for illustration purposes in terms of the protocol data flows for this software architecture [FIG. F3], and these are different from the physical configuration of RS-485 ports. Physical ports on panel (78) as shown in [FIGS. A1-*d*, F7-*a*] do have an "IN" and "OUT" RJ-11 connector (80, 81). However these are both bi-directional links, each simultaneously supporting protocols (444 *and* 445), one physical port connecting to other devices "up the daisy chain" via IN (80) and the other physical port connecting to other devices "down the daisy chain" via OUT (81). It is important to keep this in mind when considering [Sheets F2, F3, F4, F5 and F6]. Also, while use of both conventional unidirectional MIDI serial and also RS-485 are shown in [FIG. F3-*a*], typically, only one is used at one time. Where only one Module (507) is used, either serial MIDI or RS-485 may be used (assuming the host PC (487) has suitable RS-485 I/O). Where multiple Free-Space Interface Modules are used as illustrated, then RS-485 alone is preferred, although provided suitable MIDI patchbay for merging and routing is used, serial MIDI cables may be used (two per each Free-Space Interface for IN and OUT). All Modules (507, 454, 453, 452) come equipped with both serial MIDI and RS-485 communications types for flexibility in varied usage. All MIDI data flows (444,445) in [Sheets F4, F5 and F6] may be thus assumed to be either serial MIDI or RS-485 while transmitting the identical MIDI messages for both cases, and framed with node ID#'s in the RS-485 case.

Type I sensors (16, 73, 95, 99) interface to Type I Sensor Electronics (416) Analog pre-processing electronics in the circuitry (416) detects the Speed (581) of player shadow and unshadow actions by means of the angle of slope (transition time) of the analog signal detected. This section of circuit (416) further subtracts the 2 khz clock pulse waveform of the IR flood generated by Overhead Fixture (19) clock pulse circuit (105), and suppresses output of false transitions to the next stage. Depending upon the sampling resolution and dynamic range of the A-to-D employed these functions in whole or in part may alternatively be accomplished by software (427) Depending upon type of microprocessor (535) that is employed, either a discrete A-to-D circuit converts analog signals to digital data, or a "MUX" circuit multiplexes the typically 16 sensor analog channels into the 8 channels of direct A-D input lines integral on any of the Motorola family of 68HCxx Microcontroller. Type I Sensor Processing software (427) employs a floating differential type of AGC or Automatic Gain Control on the digitized Type I data, in order to: (a) allow for variance in IR source flood (831) intensity due to varied relative positioning (5, 6, 7, 8) of each sensor on the free-space interface surface; (b) allow for variations in source flood intensity due to such as intermittent fogging materials introduced in the intervening air; and (c) allows for variations in the flood fixture's height (833) [FIG. A6-*a*]. When software (427) qualifies as valid a Type I sensor event (23, 24) it creates an internal sensor event message including sensor position ID and speed parameter. The MIDI OUT Message Assembler (435) interprets this internal sensor event message and creates the assigned type of MIDI message (either Note ON/Note OFF or Control Change) and sends it out MIDI (83, 466) and/or RS-485 (81, 467). This output Free-Space Event Protocol (444) message has values of appropriate Note Number or Control Number (for sensor ID), Channel (for Zone ID), and Velocity or Control Data (for speed parameter) according to previous MIDI message format configurations set by protocol (445).

Type II Sensors (113) are pre-processed by local electronics and software on their PCB modules (415) and sent via cable (417) to Type II Sensor Serial I/O (538) Type II sensor modules (415) are self-contained microprocessor subsystems which create a serial output stream of Type II data which is sent and forwarded down cable (417) in a cascading scheme resulting in one Type II status packet, delivered to serial port (538). Thus Type II sensor Processing software (428) polls port (538) at fixed intervals for this periodic packet of combined Type II data representing state of all Type II modules in the interface, regardless of timing and nature of player actions. Since Type II data is generated at much higher rates at each Type II module (415), the collection into one periodic "global" (all Type II sensors) Type II packet constitutes an efficient data reduction scheme in the time domain. The polling rate for such a serial scheme need not be too high (for example 30 msec or even longer), as time-averaging or "last value" of data is typically used by remote host (487) software (429) in the CZB logic for Height (286) and then applied to associated Type I events which are by contrast extremely time-critical to accurately effect the Kinesthetic Spatial Sync. A further advantage of this scheme is that such "global" height message reporting may be compactly binary encoded within protocol (444) using MIDI Control Change messages of type NRPN with proprietary LSB and MSB encoding. For very high performance Pro systems an additional circuit (not shown) may intervene between (415, 417) and (538, 428) which differentiates changes only and filters out unchanged data thus allowing faster polling rates and reducing processor (535) overhead. Alternatively, a different internal serial protocol may be used between modules (415) and the EFM PCB (530) which rather than cascading into a single "global" packet reporting for all modules, instead reports individual Type II module data packets to port (538) and thus to software (428).

Sheet F4 Global Sync Architecture: "Internal" Clock Master

Co-Resident Software Block Diagram—MIDI and Data Flow—Use of Sequences

The system functions and data flow architecture illustrated in [Sheet F4], including most all aspects of use of MIDI protocols, are discussed in detail in Section 5.6.4 parts (C) CZB Command Protocol and (D) Other Third Party MIDI Protocol Uses and Conventions, as well as in Section 5.6.4 part (E) Global Sync Architecture.

The host co-resident software architecture [FIG. F4-*a*] shows the CZB Processing Module (461) acting as MIDI Clock Master (506) to the third-party Other MIDI Processing (439) Co-resident application with its embedded Sequencer Module (499). MIDI System Realtime (Start, Stop, Continue) messages from transport (505) and tempo control by software (461) synchronize playback of all tracks (492, 493, 494, 495, 497, 498) with scheduled (434) events (510, 511, 512) originating from "live" free-space actions (23, 24, 669).

Sheet F5 Global Sync Architecture: "CD-Audio/Other MIDI" Clock Master

Co-Resident Software Block Diagram—MIDI and Data Flow—Use of Sequences

The system functions and data flow architecture illustrated in [Sheet F5], including most all aspects of use of MIDI protocols, are discussed in detail in Section 5.6.4 parts (C) CZB Command Protocol and (D) Other Third Party MIDI Protocol Uses and Conventions, as well as in Section 5.6.4 part E) Global Sync Architecture.

The host co-resident software architecture [FIG. F5-*a*] shows the embedded Sequencer Module (499) of Other MIDI Processing (439) co-resident application acting as MIDI Clock Master (506) to CZB Processing Module (461) thus acting as Clock Slave (518). In this case however, origination of the conventional MIDI Clock stream ($F8 bytes) from sequencer (499) is itself internally synced to another clock source process. The third-party Other MIDI Software (439) includes capability of playback of Redbook audio CD tracks (513) on PC (487) CD-ROM drive with low-level timing synchronization provided to the embedded sequencer (499). During the authoring processes (denoted by symbol "A") for creating an interactive content title, playback of the CD-audio track is used by an author to manually create using devices (443 or 486) a tempo Beat-Alignment Track (515) within the sequencer song file.

At sequence playback (and which is also the live interactive performance session) this low-level timing logic in Other MIDI Software then automatically synchronizes the Beat Alignment Track (515) to the CD-audio track (513), thus effectively making the CD-audio a "meta-clock" master $M_i$ (514) in turn controlling the tempo of conventional clock master $M_{ii}$ (516) output. The result of this configuration is that MIDI System Realtime (Start, Stop, Continue) messages from transport (517) (and tempo now in sync with the CD-audio) synchronize playback of all other sequencer MIDI tracks (492, 493, 494, 495, 497, 498) and CD-audio track (513) including its audio output (519), and furthermore these are also in sync with all scheduled (434) event messages (510, 511, 512) originating from "live" free-space actions (23, 24, 669), since software module (461) internal beat clock metronome (424) is synced to the clock (516). While the sync process between the CD-audio track (513) and sequencer (499) is within the proprietary domain of the third-party Other MIDI software (439), the extension of that sync using clock source (516) to include the free-space interactive Kinesthetic Spatial Sync Entrainment (306) effect [FIGS. E1-*d* through E10-*d*] in alignment also with CD-audio is an improvement in use of software (439), and thus is claimed to be within the domain of this invention.

Sheet F6 Global Sync Architecture: "Sequencer" Clock Master

Co-Resident Software Block Diagram—MIDI and Data Flow—Use of Sequences

The system functions and data flow architecture illustrated in [Sheet F6], including most all aspects of use of MIDI protocols, are discussed in Section 5.6.4 parts (C) CZB Command Protocol and (D) Other Third Party MIDI Protocol Uses and Conventions, as well as in Section 5.6.4 part E) Global Sync Architecture.

[FIG. F6-*a*] illustrates a more complex host (487) co-resident software architecture, where the functions of Other MIDI Software (439) are reduced to primarily its note-number translation functions (as described in Section 5.6.4 part (D) Other Third Party MIDI Protocol Uses and Conventions), and its embedded Sequencer Module (499) functions are replaced by those of another third-party Sequencer Application (440). In this case, the Other MIDI software (439) Command Tracks (498) are stored in the song file on sequencer (440), but otherwise function the same as in cases shown on [FIGS. F4-*a* and F5-*a*] as to its control of the software (439) translation process of modifying MIDI messages (510) into messages (511). The function of sequencer (440) in regards to tracks (492, 493, 494, 495, 497) are identical to that illustrated in [FIGS. F4-*a* and F5-*a*]. [FIG. F6-*a*] furthermore reveals the data flows (512, 521, 522) which are otherwise implicit in [FIGS. F4-*a* and F5-*a*] being there occurring between software (439) and its own sequencer (499). Sequencer (440) also shares (544) Display (442) and Input (443) Devices via OS/BIOS Shared Resources (488).

The advantage of this configuration includes the use of much more fully-featured (and varied cases on sequencers (440) than embedded sequencer (499), while still retaining the unique features of software (439) in the total host MIDI software architecture. Additional features of such sequencers (440) include sophisticated internal management of Digital Audio tracks (525) for seamlessly integrated MIDI and digital audio processing, composing and editing. During authoring sessions (denoted by symbol "A"), audio (524) is captured using such as microphones or pickups (523) and recorded into tracks (525). For both recording and playback, audio (529) feeds to mixer (481) and may route also into samplers and/or effects units (480). While the synchronization between the digital audio tracks (525) ("as if" being a clock slave (526)) and MIDI sequences (492, 493, 494, 495, 497, 498) in sequencer (440) is not typically implemented using an actual $F8 byte Realtime clock stream, this is shown for illustration purposes. In some cases where the digital audio is via a further subsystem such as a linear DAT or analog tape device (not shown) actual MIDI Clock may be used, in a context such as MIDI clock-to-SMPTE code conversion for a SMPTE-slaved tape device.

The result of this configuration is that MIDI System Realtime (Start, Stop, Continue) and tempo from transport (527) synchronize playback of all MIDI tracks (492, 493, 494, 495, 497, 498) and Digital Audio tracks (525) including audio output (529), and furthermore these are also in sync with all scheduled (434) event messages (510, 511, 512) originating from "live" free-space actions (23, 24, 669), since software module (461) internal beat clock metronome (424) is synced (518) to the clock (528). While the sync process between the digital audio tracks (525) and sequencer (440) is within the proprietary (or public) domain of the third-party sequencer (440), the extension of that sync using clock source (528) to include the free-space interactive Kinesthetic Spatial Sync Entrainment (306) effect [FIGS. E1-*d* through E10-*d*] in alignment also with digital audio, is an improvement in use of software (440), and thus is claimed to be within the domain of this invention.

Sheet F7 n-Zone Platform w/ Type I & II Sensors: Internal Electronics

Remote Platform Modular Hardware Overview

[Sheet F7] illustrates the modular hardware for the preferred embodiment or Free-Space Interactive "Platform #1" (543), although much of the drawing elements may be applied as well to internal electronics for Console embodiments. Many of the elements of the hardware shown in [FIG. F7-*a*] are discussed above, in Description of Drawings for Sheet F3: Free-Space Interface Module, since the hardware operates intimately with the software (470) discussed therein. All elements are also noted in the Legend to [Sheet F7]. Type I Sensor/LED and light pipe modules, detailed in [Sheets D4, D5, D6 and D7], all interface to a printed circuit board (531) shown in this [FIG. F7-*a*] which includes a connector to cable of type (532) to centrally located Embedded Free-Space Microcontroller board (530) via connector of type (541). The center hex enclosure (2) of the Platform has a removable cover allowing access to the central electronics within, and the PCB (530) includes a hole (542) allowing use of a steel support post to the cover to protect the electronics from the repeated and continuous player impacts in typical use.

The same Embedded Free-Space Microcontroller (530) circuit board detailed in [FIG. F7-*b*], however may be used for all Platform [Series A and B] and all Console [Series C] free-space interface configurations, since all these embodiments include (at the interface level) identical sensor/LED electronics and software functions related thereto. The differences between Platform and Console embodiments are thus reduced to enclosures, cable harnesses and interconnection schemes, and different styles of LED Light Pipes [Series D]. Thus for the Console case, Type I sensor/LED light pipe modules [Sheets D8, D9] printed circuit boards (243, 262) interface to an identical EFM card (530) centrally located within Console enclosure (130) also using cables of type (532) differing only in length and orientation suitable for the Console case.

MIDI IN/OUT/THRU and RS-485 IN/OUT and power sockets, all on front panel (78), are connected via cable assembly (534) and connector (540) to MIDI UART (466), RS-485 USRT (467) and PS (power supply) (536) respectively, on PCB (530). As discussed above in the Description of Drawings for Sheet F3: Free-Space Interface Module, Type II PCBs (415) are connected via cable (417) and connector (539) to RS-232C UART (538) on PCB (530).

5.7 Series G Drawings: Creative Zone Behaviors (CZB) Conceptual Overview

Overview. (See text on pages 88, 100, 113, 120, 172).

Sheet G1 Creative Zone Behaviors: 3-Way 'Synesthesia'

Relationship of Accompaniment and Creative Zone Commands to Perceived "Synesthesia"

(See text on pages 135, 153, 154, 158, 172, 176, 178).

Sheet G2 Creative Zone Behaviors: "Omni-Synesthetic Manifold"

Transparent & Symmetric Transfer Functions Between Kinesthetic, Music, and Visuals Features (See text on pages 126, 153, 154, 155, 159, 172, 176, 178).

Sheet G3 Creative Zone Behaviors: Matrix of Valid Transfer Functions

Mapping from Kinesthetic to Notes & Visuals Responses/

(See text on pages 126, 153, 154, 172).

5.8 Series H Drawings: Creative Zone Behaviors for Notes

Overview. (See text on pages 100, 117, 118, 120, 131, 153, 155, 156, 162, 172).

Sheet H1 Creative Zone Behaviors for Notes Valid Control Types (H1-*a*: see text on pages 96, 115, 140, 145; H1-*b*: 147; H1-*c*: 96, 146, 147, 156).

Sheet H2 Creative Zone Behaviors (CZB) Command Panel for Notes

Touch-Display Interface for One Zone (See text on pages 140, 145, 147, 148, 172).

Sheet H3 Creative Zone Behaviors (CZB) Command Panel for Notes

Touch-Display Interface for Three Zones (See text on pages 103, 118, 147, 154, 173).

Sheet H4 Creative Zone Behaviors (CZB) Command Panel for Notes

Touch-Display Interface for Three Zones—FIGURE CROSS REFERENCE (See text on pages 140, 153, 173).

Sheet H5 Creative Zone Behaviors (CZB) Command Panel for Notes

Touch-Display Interface for Three Zones—FIGURE CROSS REFERENCE (See text on pages 140, 153, 173).

Sheet H6 Zone Maps Menu

Touch-Display Interface for Three Zones (See text on pages 102, 103, 109, 118, 129, 137, 153, 154, 173).

5.9 Series i Drawings: Display Interface for Notes Behaviors: Control Panels

Overview. (See text on pages 100, 118, 120, 131, 153, 155, 156, 162).

Sheet i1 Lock to Grid Control Panel for Notes Behaviors

Touch-Display Interface (Referenced only by other drawings, or indirectly, or as part of a whole Series reference.)

Sheet i2 Lock To Groove Control Panel for Notes Behaviors

Touch-Display Interface (Referenced only by other drawings, or indirectly, or as part of a whole Series reference.)

Sheet i3 Height Control Panel for Notes Behaviors

Touch-Display Interface (See text on pages 108, 148).

Sheet i4 Speed Control Panel for Notes Behaviors

Touch-Display Interface (See text on pages 146, 147).

Sheet i5 Precision Control Panel for Notes Behaviors

Touch-Display Interface (See text on page 118).

Sheet i6 Position Control Panel for Notes Behaviors

Touch-Display Interface (Referenced only by other drawings, or indirectly, or as part of a whole Series reference.)

Sheet i7 Set Value ON Control Panel for Notes Behaviors

Touch-Display Interface (Referenced only by other drawings, or indirectly, or as part of a whole Series reference.)

Sheet i8 Set Value OFF Control Panel for Notes Behaviors

Touch-Display Interface (Referenced only by other drawings, or indirectly, or as part of a whole Series reference.)

Sheet i9 Set Value Aftertouch Control Panel for Notes Behaviors

Touch-Display Interface (Referenced only by other drawings, or indirectly, or as part of a whole Series reference.)

Sheet i10 None Control Panel for Notes Behaviors

Touch-Display Interface (Referenced only by other drawings, or indirectly, or as part of a whole Series reference.)

5.10 Series J Drawings: Display Interface for Notes Behaviors: Applied Controls

Overview. (See text on pages 100, 118, 120, 131, 147, 153, 155, 156, 162, 174).

Sheet J1 Lock to Grid Applied to Notes Re-Attack Quantize Behavior

Touch-Display Interface for Three Zones (Referenced only by other drawings, or indirectly, or as part of a whole Series reference.)

Sheet J2 Lock to Groove Applied to Notes Attack Quantize Behavior

Touch-Display Interface for Three Zones (Referenced only by other drawings, or indirectly, or as part of a whole Series reference.)

Sheet J3 Height Applied to Notes Attack Velocity Behavior

Touch-Display Interface for One Zone (Referenced only by other drawings, or indirectly, or as part of a whole Series reference.)

Sheet J4 Speed Applied to Notes Release Sustain Behavior

Touch-Display Interface for Three Zones (See text on page 147).

Sheet J5 Precision Applied to Notes Attack Channels Behavior

Touch-Display Interface for One Zone (See text on page 118.)

Sheet J6 Position Applied to Notes Re-Attack Range Behavior

Touch-Display Interface for One Zone (Referenced only by other drawings, or indirectly, or as part of a whole Series reference.)

Sheet J7 Set Value ON Applied to Notes Re-Attack Velocity Behavior

Touch-Display Interface for Three Zones (Referenced only by other drawings, or indirectly, or as part of a whole Series reference.)

Sheet J8 Set Value OFF Applied to Notes Release Velocity Behavior

Touch-Display Interface for Three Zones (Referenced only by other drawings, or indirectly, or as part of a whole Series reference.)

Sheet J9 Set Value Aftertouch Applied to Notes Re-Attack Aftertouch Behavior Touch-Display Interface for Three Zones (Referenced only by other drawings, or indirectly, or as part of a whole Series reference.)

Sheet J10 None Applied to Notes Release Sustain Behavior

Touch-Display Interface for Three Zones (Referenced only by other drawings, or indirectly, or as part of a whole Series reference.)

5.11 Series K Drawings: Display Interface for Local Visuals Behaviors

Overview. (See text on pages 100, 120, 131, 153, 155, 162). Note there is no Sheet K1.

Sheet K2 CZB Command Panel for Local Visuals: Preview & Assign Values Tab

Touch-Display Interface (See text on pages).

Sheet K3 CZB Command Panel for Local Visuals: Define Values Tab

Touch-Display Interface (See text on pages 126, 135).

Sheet K4 CZB Command Panel for Local Visuals: Play Values Tab

Touch-Display Interface (See text on pages 126, 135, 162).

6.0 HUMAN FACTORS IMPACT ON PSYCHOLOGY

Simultaneity and Synesthesia. [Sheets G1, G2]. Simultaneity is critical to perception of "Synesthesia" (560) which is that type of perception where multiple sensory stimuli (546, 547, 548) are perceived coherently as aspects or features of a single event or stimulus. A key enabler to reaching the threshold of a synesthetic event is in fact simply that perceptions are being experienced at the same time. Non-simultaneity reinforces perception of multiple (distinct) events across the sensory modalities, thus directly negating Synesthesia which by definition must be a unified perception amongst those sensory modalities. Non-simultaneity precludes, or at least greatly suppresses the chance for Synesthesia. Perceived simultaneity of multi-sensory events (546, 547, 548) is thus critical to enabling Synesthesia, which in turn is critical to achievement of the invention's Kinesthetic Spatial Sync biofeedback entrainment effect (306).

Reported "Gestalt" Effect and Supporting Hypothesis The free-space interface's transparency of Kinesthetic Spatial Sync and with its "collision metaphor" of visual feedback, evokes a psychological Gestalt effect, wherein the unaided body in continuous motion becomes subjectively perceived as the sole and precision instrument. The traditional concept of "instrument" (defined as something beyond and separate to the human body) appears to disappear, or at least, becomes greatly reduced in emphasis.

Effortless Entrainment. By directing feedback (547, 548) to sustain the players' focus of attention to the immersive media responses, which are perceived as precisely and kinesthetically coupled (306, 307) to the body in empty space, the system evokes a spontaneous and effortless entrainment into a continuous Gestalt of:

"My body IS the instrument."

Hypothesis of Cascading Entrainment. Given the nearly universal degree of intimate control by player choice over body motion (a practical unity of choice and kinesthetic), the first Gestalt cascades into a deeper Gestalt, wherein the immersive media responses become effectively near-telepathic in "human interface" character or subjective feeling. At this level, we find an intention-response coupling, where the Gestalt becomes "my choice creates aesthetic media response." For reference, first consider (by way of contrast) the use of traditional musical instruments in terms of:

[intention]×[body-kinesthetic]×[instrument behavior]
=[media response]

Entrainment Phase 1. The invention stimulates players into an evoked Gestalt of "My body is the instrument," which may also be expressed in terms of:

[intention]×[body kinesthetic]=[media response]

Entrainment Phase 2. The entrainment then naturally cascades into a deeper Gestalt, given the effortless and intimate relationship of intention and body kinesthetic (for the average unimpaired player):

[intention]=[media response].

Creative Unity. This psychological process evoked by the invention is hypothesized to include a reduction from the more common duality of everyday Causes and Effects into what might be termed "Creative Unity" wherein intention and result become simultaneous and integral while yet in a context of continuously harmonious, aesthetic, engaging and complex results.

Identification with Transparently Modified Response. The Kinesthetic Spatial Sync experience continuously provides a visceral (physical) body kinesthetic perception of the otherwise rarely juxtaposed properties of:

[precision] and [effortlessness].

Akin to Inner Psychology of Experts. This experience of effortless precision may be both compared and contrasted to the following. Virtuoso or skilled musical instrument performers report that they sometimes lose physical awareness of their hands or feet entirely while in precision performance, and subjectively connect only their inner thought or feeling with the ultimate physical sound results. Their matrix of internal (mental) and physical (bodily) transfer functions has become invisible or subconscious; gone from conscious attention or focus are details of eyesight processing music notation, and the actions of hands, arms, diaphragm and/or lip muscles. This is part of the reported inner psychology of expert conventional music instrument performance, typically subsequent to years of learning and sustained practice. A free-space musical instrument employing the invention appears to make immediately accessible to the unskilled, novice or casual player (as well as to musicians and practiced free-space players alike), experiences which are at least akin to those arising in the inner psychology of expert musical expression, yet in a context of compelling, visceral bodily awareness as well.

Critical Enabling Effect of Omni-Transparent Multiple Transfer Functions. [Sheets G1, G2]. Free-space media systems employing the invention's Creative Zone Behaviors biofeedback paradigm for interactive music are uniquely able to provide transparent transfer functions (551, 552, 553) for all feature spaces (546, 547, 548) thus comprising an Omni-Synesthetic Manifold (571) of experience. The invention co-registers all of these synesthetic transparencies within a unified clear kinesthetic and visceral perceptual-motor ergonomic paradigm. In so doing, in free-space, rhythm is the "last" (most recent in the evolution of musical instruments) musical transfer function to be made simultaneously transparent and symmetric. This form of rhythmic processing is a critical enabler when employed simultaneously with the other transparent transfer functions previously available (for timbre and pitch). What is enabled by the Kinesthetic Spatial Sync effect is the evoking of a perceptual-motor Gestalt of Creative Unity, and the unconditional subjective "ownership" of effortless virtuoso precision in aesthetic creative expression.

Disclosed Human Factors Reflect a "Process". In constructing a device or system exhibiting the disclosed human factors, the implementation and fabrication methods (including sensor electronic hardware, sensor control software, system enclosures, mechanical packaging, sensor array spatial configuration, LED indicators, external visual response systems, and musical response systems) are all to be constrained within the invention's disclosed Kinesthetic Spatial Sync feedback paradigm, namely the operational process of the Creative Zone Behaviors. One skilled in the relevant arts could execute a variety of implementations employing varied control means, alternative optical and electronic materials and technologies, all the while exhibiting the disclosed ergonomic, optical, cybernetic, algorithmic, and human factors design constraints.

7.0 UTILITY AND BENEFITS OF THE INVENTION

Test Player Reports. Utilizing developmental prototype reductions to practice, hundreds of trial players encompassing a broad player demographic (including those with no prior musical skill or training) have reported various experiences which we loosely categorize into the following common results:

(a) Experienced intersubjectively aesthetic musical and visual media responses;

(b) Maintained a perception of direct ownership of creative acts;

(c) Discovered the natural ability to apply unrelated and previously acquired perceptual-motor skills into successful intersubjectively aesthetic musical expression, including such as martial arts, dance, sports, aerobics, gymnastics, sign language and Tai Chi, and the ability to do so with maintained precision, aesthetic and variety in media responses; and (d) Evoked a "Creative Wellness Response" or subjective therapeutic effect. Casual (first-time) players as well as expert (practiced) players described their free-space-interactive experience in subjective terms including: "satisfying, all-positive feedback, emotionally healing, uplifting of self esteem (including performance to others), energizing, compelling, visceral, inspiring, comforting, promoting a sense of balance, well-being, alertness and euphoria." This subjective effect may have physical counterparts.

Creative Empowerment. The invention provides the experience that body motion (input) is spatially superposed and simultaneous to aesthetic media creation (output). A more psychological perspective might describe this in terms such as "creative physical expression becomes inescapably synonymous with sharable beauty and harmony in perception". This powerful positive feedback encourages continued creative expression and exploration through continued body motion. The combination of unrestricted free-space interface and aesthetic musical and visual responses thus collectively entrain continuous player body motion. Continuous body motion in turn further amplifies and sustains the desired ergonomic effect of "effortlessly creating aesthetic experience." The continuously positive and synesthetic feedback to full-body creativity appears to spontaneously evoke the "Creative Wellness Response" which further empowers creativity, thus forming a self-reinforcing biofeedback process.

Therapeutic Benefits. How therapeutic effects from free-space media are achieved may be suggested by the empirically applied techniques and well-documented benefits found in the healing arts of music therapy, creative therapy, art therapy, dance therapy and physical therapy. The invention makes available a repeatable, participatory creative experience to players which appears to spontaneously elicit many of the benefits previously derived separately by techniques of these various therapeutic disciplines. The invention claims to be a significant improvement of the arts of these therapies, considered separately and collectively. Although typically to be provided in entertainment venues, the utility of the invention includes in particular importance its therapeutic and healthful application.

Prediction of Measurable Health Benefits. It is anticipated that repeat players may develop significant objectively measurable benefits in the areas of pain relief (endorphins), hormonal balance, immune system strengthening (S-IgA or salivary immunoglobulin A). Players may also experience improved rates of basal metabolism, blood pressure, respiration and cardiac (including heart rate variability or HRV). Regular use may also stimulate results such as improved perceptual-motor performance, increased intelligence (IQ), enhanced problem solving skills, improved spatial-synthetic reasoning and various other psychological and sociological skills including many for which accepted metrics have been developed.

Relevant Applied Arts. The practiced arts and scientific research in the fields of music therapy as well as dance therapy, art therapy, creative therapy and physical therapy together with such as biometrics, ergonomics, neuropsychology and neurophysiology comprise a relevant multi-disciplinary frame of reference for exploring the therapeutic potential of the invention and evaluating empirical results.

Evoked Euphoria. A subjective "euphoric" nature of the disclosed free-space-interactive experience was reported by many trial players, a condition however being simultaneous with increased alertness, self-awareness and enhancement of perceptual-motor performance.

Group Body Effect. Furthermore in group multi-player context this free-space media biofeedback system provides an experience wherein all participants are continuously dynamic and individually creatively expressive while always in harmonious, successful and seamless aesthetic integration with all creative expressions of each other, even given arbitrarily mixed player demographics. Group free-space-interactive media deployment may thus engender emergent coexisting behavioral spontaneity and synchronicity perceivable as an integral whole "synesthetic body of shared experience" visible (and audible) as the collective immersive media state space.

Group Mind Effect. The psycho-motor "group-body" metaphor may both express and further evoke unforeseen and spontaneously emergent group mental and psychological skills including for example some form of functional "group mind" phenomena. This may be akin to flock behaviors of birds, or to schools of fish, or be entirely different and distinctly human in characteristic. Such skills if engendered may furthermore have broad practical applications in telepresence, telerobotics, and control and cybernetic systems for distributed propulsive, biomechanical, and/or navigational applications.

Profound Internet Venues. Shared Internet venues may utilize existing arts including real-time MIDI networking, GPS, and telepresence. The transparency of time-quantization and rhythmic sync will improve perceived real-time performance even over variably latent networks, providing a "more sharable now" in the "look and feel" experience of free-space media players. This may represent as an improved tele-biomechanical paradigm, the application of free-space-interactive interfaces with Kinesthetic Spatial Sync effects [305, 306] across mutual telepresence.

Inter-Cultural Shared Creative Expression. The universality of human body movement capacity, together with the universality of musical expression and appreciation in human cultures, places the group use of the invention also into a context of accessible omni-cultural and trans-lingual co-creative expression and communication.

Use by Vision- and Hearing-Disabled. The invention allows the creation of intersubjectively aesthetic music performances even by the deaf (utilizing the multiple visual feedback), as well as the creation of intersubjectively aesthetic visual responses even by the blind (utilizing the musical feedback). Sufficient practice may yield even virtuoso levels of performance in both of these extreme cases.

What is claimed is:

1. An interactive system designed to allow a user to control the interactive system with body parts moving through free space, comprising:

a photo emission source;

a detector designed to:

receive photons from the photo emission source; and create a detector signal proportional to an amount of received photo emissions;

a processor system designed to process the detector signal and output a conditioned control signal; and a feedback system designed to provide feedback information to the user in conditioned response to the amount of photons blocked by the user, wherein the feedback system comprises:

a first light that is located proximate to the detector and which is controlled by the detector signal; and a second light that is located proximate to the detector and which is controlled by the conditioned control signal.

2. The system of claim 1, wherein the feedback system further comprises visual and auditory feedback information to a user in response to the control signal.

3. The system of claim 2, wherein the visual and auditory feedback responses include real-time quantization and conditioned sustain durations in a free space interface, designed to entrain the user into a desired perceptual-motor, cognitive state.

4. The system of claim 1, wherein the photo emission source further comprises an infrared light source that floods a controller surface, which has at least one detector mounted thereon.

5. The system of claim 1, wherein the processor system further comprising a MIDI tempo clock input that is used to calculate the control signal.

6. The system of claim 5, wherein the processor system further includes a response state definition data store used to calculate the control signal.

7. The system of claim 1, wherein brightness, hue, and saturation state definitions of the first light is supplied by the data store and which state change events are controlled by the detector signal.

8. The system of claim 7, wherein brightness, hue, and saturation state definitions of the second light is supplied by the data store and which state change events are controlled by a detector signal.

9. The system of claim 1, wherein the effect of the control of the first light and second light is designed to give an effect to the user of instant control of the conditioned output even though the conditioned output is delayed from when the first light changes state.

10. The system of claim 9, wherein the feedback information comprises a sound output which is quantized and temporally synchronized in audible event onset, sustain and release with the behavior of the second light.

11. The system of claim 1, wherein the feedback information is selected from the group consisting of: computer graphics, immersive robotic lighting, lasers, pyrotechnic systems, water projection systems, robotic control systems, aroma therapy projection, sound systems, lighting systems, servo control systems, visual display systems, and projected air flow systems.

12. The system of claim 1, wherein the processor system is a computer designed to receive the detector signal and determine the control signal which is appropriate and conditioned, to control the feedback information.

13. The system of claim 12, wherein determining the appropriate control signal is created by a data store system and a MIDI tempo clock.

14. The system of claim 1, wherein the photo emission source includes a visible light source.

15. The system of claim 1, further comprising multiple spaced detectors positioned in at least one platform to allow a person to stand on the platform and activate the detectors using various body part motions.

16. The system of claim 15, wherein the multiple spaced detector arrangement is determined by biometric constraints of the user's shadow projection onto the platform to enhance biofeedback entrainment effects.

17. The system of claim 16, wherein the multiple detectors, the processor system, and feedback information are operating substantially in parallel behavior.

18. The system of claim 1, further comprising multiple detectors positioned in at least one elevated console and which are spaced to allow a person to activate the detectors, wherein activating the detectors involves using the upper torso parts of the user, including head and arms of the body, to affect changes, as contrasted with the platform which accepts full-body inputs.

19. The system of claim 1, wherein the number of detectors is at least eight and at most-thirty two.

20. An interactive system designed to allow a user to control the interactive system with body parts moving through free space, comprising:

a photo emission source;

a detector designed to:

receive photons from the photo emission source; and create a detector signal proportional to an amount of received photo emissions;

a processor system designed to process the detector signal and output a conditioned control signal, wherein the processor system includes a response state definition data store used to calculate the control signal; and a feedback system designed to provide feedback information to the user in conditioned response to the amount of photons blocked by the user, wherein the feedback system comprises:

a first light that is located proximate to the detector and which is controlled by the detector signal, wherein brightness, hue, and saturation state definitions of the first light is supplied by the data store and which state change events are controlled by the detector signal; and a second light that is located proximate to the detector and which is controlled by the conditioned control signal.

21. The system of claim 20, wherein the feedback system further comprises visual and auditory feedback information to a user in response to the control signal.

22. The system of claim 21, wherein the visual and auditory feedback responses include real-time quantization and conditioned sustain durations in a free space interface, designed to entrain the user into a desired perceptual-motor, cognitive state.

23. The system of claim 22, wherein the photo emission source further comprises an infrared light source that floods a controller surface, which has at least one detector mounted thereon.

24. The system of claim 23, wherein the processor system further comprising a MIDI tempo clock input that is used to calculate the control signal.

* * * * *